US011813508B2

(12) United States Patent
Higdon et al.

(10) Patent No.: US 11,813,508 B2
(45) Date of Patent: Nov. 14, 2023

(54) MULTI-COMPONENT PUTTER

(71) Applicant: KARSTEN MANUFACTURING CORPORATION, Phoenix, AZ (US)

(72) Inventors: David A. Higdon, Cave Creek, AZ (US); Jacob T. Clarke, Apex, NC (US); Anthony D. Serrano, Phoenix, AZ (US); Murphy R. Alexander, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/645,668

(22) Filed: Dec. 22, 2021

(65) Prior Publication Data

US 2022/0161108 A1 May 26, 2022

Related U.S. Application Data

(63) Continuation-in-part of application No. 17/444,468, filed on Aug. 4, 2021, which is a continuation of application No. 17/243,338, filed on Apr. 28, 2021, now Pat. No. 11,458,375, which is a continuation-in-part of application No. 29/720,679, filed on Jan. 15, 2020, now Pat. No. Des. 930,097, which is a continuation of application No. 16/590,270, filed on Oct. 1, 2019, now Pat. No. 11,020,640.

(Continued)

(51) Int. Cl.
*A63B 53/04* (2015.01)

(52) U.S. Cl.
CPC ..... *A63B 53/0487* (2013.01); *A63B 53/0412* (2020.08); *A63B 53/0416* (2020.08); *A63B 53/0441* (2020.08); *A63B 2209/00* (2013.01)

(58) Field of Classification Search
CPC ..... A63B 53/0487; A63B 53/0441
USPC ..... 473/340
See application file for complete search history.

(56) References Cited

U.S. PATENT DOCUMENTS 2,014,829 A 9/1935 Young
3,143,349 A 8/1964 Macintyre
(Continued)

FOREIGN PATENT DOCUMENTS

CN 2461602 Y 11/2001
CN 205055352 U 3/2016
(Continued)

OTHER PUBLICATIONS

International Search Report/Written Opinion for Int'l Patent Application No. PCT/US2019/054139, filed on Oct. 1, 2019.
(Continued)

*Primary Examiner* — Raeann Gorden

(57) ABSTRACT

Embodiments of multi-component putters comprising an upper portion and a lower portion are described herein. The upper portion is formed from a first material having a first density and the lower portion is formed from a second material having a second density. The first density is less than the second density. The upper portion is affixed to the lower portion via an adhesive or a combination of adhesives and interlocking geometry. The multi-component putter design provides increased forgiveness and moment of inertia compared to a putter formed from a single material.

20 Claims, 44 Drawing Sheets

Related U.S. Application Data

(60) Provisional application No. 63/260,612, filed on Aug. 26, 2021, provisional application No. 63/203,257, filed on Jul. 14, 2021, provisional application No. 63/190,691, filed on May 19, 2021, provisional application No. 63/130,312, filed on Dec. 23, 2020, provisional application No. 62/739,747, filed on Oct. 1, 2018.

(56) References Cited

U.S. PATENT DOCUMENTS

| | | | | |
|---|---|---|---|---|
| 3,300,241 | A | 1/1967 | Eberwein | |
| 3,374,027 | A | 3/1968 | Jacobs | |
| 3,841,639 | A | 10/1974 | Werner | |
| D257,872 | S | 1/1981 | MacDougall | |
| 4,834,387 | A | 5/1989 | Waites | |
| 5,037,102 | A | 8/1991 | Fukayama et al. | |
| 5,078,398 | A | 1/1992 | Reed et al. | |
| 5,368,302 | A | 11/1994 | Thomas | |
| 5,417,426 | A | 5/1995 | Bayer | |
| 5,482,281 | A | 1/1996 | Anderson | |
| 5,485,999 | A | 1/1996 | Hull et al. | |
| D368,752 | S | 4/1996 | Patten | |
| 5,509,658 | A | 4/1996 | Youngblood | |
| 5,524,889 | A | 6/1996 | Rush | |
| 5,628,696 | A | 5/1997 | Frye | |
| 5,655,976 | A | 8/1997 | Rife | |
| 5,676,606 | A | 10/1997 | Schaeffer et al. | |
| 5,797,176 | A | 8/1998 | Rose et al. | |
| 5,842,935 | A | 12/1998 | Nelson | |
| 5,951,412 | A | 9/1999 | Rose et al. | |
| 6,083,118 | A | 7/2000 | Martins et al. | |
| 6,149,534 | A | 11/2000 | Peters et al. | |
| 6,261,190 | B1 | 7/2001 | Ashcraft | |
| 6,270,422 | B1 | 8/2001 | Fisher | |
| 6,416,421 | B1 | 7/2002 | Sery | |
| 6,471,600 | B2 | 10/2002 | Tang et al. | |
| 6,692,378 | B2 * | 2/2004 | Shmoldas | A63B 53/0466 473/340 |
| 6,716,110 | B1 | 4/2004 | Ballow | |
| 6,878,072 | B1 | 4/2005 | Henry | |
| 6,949,028 | B1 | 9/2005 | Hueber | |
| 6,958,019 | B2 | 10/2005 | Rohrer | |
| 6,960,140 | B2 * | 11/2005 | Solheim | A63B 53/0487 473/340 |
| 6,984,181 | B2 | 1/2006 | Hettinger et al. | |
| 6,988,955 | B2 | 1/2006 | Stoakes | |
| 7,022,030 | B2 | 4/2006 | Best et al. | |
| D521,089 | S | 5/2006 | Dingman | |
| 7,077,758 | B2 | 7/2006 | Rohrer | |
| 7,083,525 | B2 | 8/2006 | Pond et al. | |
| 7,083,526 | B2 | 8/2006 | Durnin | |
| 7,160,203 | B2 | 1/2007 | Bonneau | |
| 7,163,469 | B2 | 1/2007 | Bonneau | |
| 7,198,574 | B2 | 4/2007 | Barbosa | |
| 7,226,362 | B1 | 6/2007 | Schell et al. | |
| 7,235,021 | B2 * | 6/2007 | Solheim | A63B 53/0487 473/340 |
| 7,351,162 | B2 | 4/2008 | Soracco et al. | |
| 7,377,858 | B2 | 5/2008 | Kubota | |
| 7,384,345 | B2 | 6/2008 | Sherman | |
| 7,393,285 | B2 | 7/2008 | Stellander | |
| 7,455,599 | B2 * | 11/2008 | Jones | A63B 53/0487 473/340 |
| 7,485,051 | B2 | 2/2009 | Richard, Jr. | |
| 7,491,131 | B2 | 2/2009 | Vinton | |
| 7,491,135 | B1 | 2/2009 | Rollinson | |
| 7,559,848 | B2 | 7/2009 | Nickel | |
| 7,594,865 | B2 | 9/2009 | Ines | |
| 7,601,076 | B2 | 10/2009 | Rollinson | |
| 7,717,806 | B2 | 5/2010 | Kubota | |
| 7,798,919 | B2 | 9/2010 | Kubota | |
| 7,803,066 | B2 | 9/2010 | Solheim et al. | |
| 7,815,515 | B1 | 10/2010 | Hunt | |
| 7,815,519 | B2 | 10/2010 | Bryant et al. | |
| 7,828,675 | B2 * | 11/2010 | Hilton | A63B 53/0487 473/340 |
| 7,846,036 | B2 | 12/2010 | Tanaka | |
| 7,854,665 | B2 | 12/2010 | Dewhurst et al. | |
| 7,918,745 | B2 | 4/2011 | Morris et al. | |
| 7,993,215 | B1 | 8/2011 | Rentz | |
| 8,016,693 | B2 | 9/2011 | Pedraza | |
| 8,100,779 | B2 | 1/2012 | Solheim et al. | |
| 8,109,838 | B2 | 2/2012 | Solheim et al. | |
| 8,308,583 | B2 | 11/2012 | Morris et al. | |
| 8,328,654 | B2 | 12/2012 | Demkowski et al. | |
| 8,597,139 | B2 | 12/2013 | Jorgensen | |
| 8,632,415 | B1 | 1/2014 | Smith | |
| 8,758,154 | B2 | 6/2014 | Demkowski et al. | |
| 8,870,682 | B2 | 10/2014 | Roach | |
| 8,961,334 | B2 | 2/2015 | Franklin et al. | |
| 9,022,876 | B2 | 5/2015 | Snyder et al. | |
| 9,044,062 | B2 | 6/2015 | Delaney | |
| 9,072,948 | B2 | 7/2015 | Franklin et al. | |
| 9,132,325 | B2 | 9/2015 | Whitlam | |
| 9,220,960 | B2 | 12/2015 | Schartiger et al. | |
| 9,238,166 | B1 | 1/2016 | Vesligaj | |
| 9,415,279 | B2 | 8/2016 | Foster | |
| 9,504,886 | B2 | 11/2016 | Albertsen et al. | |
| 9,827,479 | B2 | 11/2017 | Demkowski et al. | |
| 9,901,792 | B2 | 2/2018 | Franklin et al. | |
| 9,956,463 | B2 | 5/2018 | Franklin et al. | |
| 10,046,211 | B2 | 8/2018 | Franklin et al. | |
| 10,252,138 | B2 | 4/2019 | Demkowski et al. | |
| 10,300,348 | B2 | 5/2019 | Morris | |
| 10,716,990 | B2 | 7/2020 | Hilton et al. | |
| 11,020,640 | B2 | 6/2021 | Higdon et al. | |
| 11,135,486 | B2 | 10/2021 | Higdon | |
| 2003/0114243 | A1 | 6/2003 | Yeh | |
| 2005/0043114 | A1 | 2/2005 | Cheng | |
| 2005/0181889 | A1 | 8/2005 | Green | |
| 2005/0187028 | A1 | 8/2005 | Chang et al. | |
| 2005/0192114 | A1 | 9/2005 | Zider et al. | |
| 2006/0199662 | A1 | 9/2006 | Cole | |
| 2006/0234810 | A1 | 10/2006 | Chiodo et al. | |
| 2007/0142122 | A1 | 6/2007 | Bonneau | |
| 2007/0167253 | A1 | 7/2007 | Sizemore | |
| 2008/0176672 | A1 | 7/2008 | Roach et al. | |
| 2008/0207352 | A1 | 8/2008 | Engel | |
| 2010/0227704 | A1 | 9/2010 | Souza et al. | |
| 2011/0151996 | A1 | 6/2011 | Dewhurst et al. | |
| 2012/0064988 | A1 | 3/2012 | Raab | |
| 2012/0129620 | A1 | 5/2012 | Davis et al. | |
| 2012/0244959 | A1 | 9/2012 | Dewhurst et al. | |
| 2015/0335966 | A1 | 11/2015 | Cameron | |
| 2020/0147460 | A1 | 5/2020 | Serrano et al. | |
| 2020/0282274 | A1 | 9/2020 | Spackman et al. | |

FOREIGN PATENT DOCUMENTS

| | | | |
|---|---|---|---|
| DE | 20316385 | U1 | 3/2004 |
| DE | 10346699 | A1 | 5/2005 |
| DE | 202008012386 | U1 | 12/2008 |
| DE | 102008047738 | A1 | 4/2010 |
| DE | 202009016925 | U1 | 5/2011 |
| GB | 2357251 | A | 6/2001 |
| GB | 2391484 | A | 2/2004 |
| GB | 2441974 | A | 3/2008 |
| JP | 2001062013 | A | 3/2001 |
| JP | 3146587 | U | 11/2008 |
| JP | 2011255135 | A | 12/2011 |
| JP | 2012029858 | A | 2/2012 |
| KR | 20070113833 | A | 11/2007 |
| KR | 101305796 | B1 | 9/2013 |
| KR | 101882750 | B1 | 7/2018 |
| KR | 101980597 | B1 | 5/2019 |

OTHER PUBLICATIONS

International Search Report/Written Opinion for Int'l Patent Application No. PCT/US2021/064938, filed on Dec. 22, 2021.

(56) References Cited

OTHER PUBLICATIONS

"Bullet Golf—BL3 Putter" (Amazon) Feb. 7, 2020 (Feb. 7, 2020) [online] (retreived from the internet on Feb. 15, 2022) <URL http://www.amazon.com/BULLET-Bullet-Golf-BL3-Putter/dp/B084KZSFJF?th=1&psc=1>, entire document, especially Fig. 3.
"Pinemeadow Golf Men's PGX Putter" (Amazon) [online] (retreived from the internet on Nov. 9, 2020) <URL https://www.amazon.com/gp/product/B008JO4SHK>, entire document, especially Fig. 1.

* cited by examiner

MULTI-COMPONENT PUTTER

CROSS-REFERENCE TO RELATED APPLICATIONS

This claims the benefit of U.S. Provisional Patent Appl. No. 63/260,612, filed on Aug. 26, 2021, U.S. Provisional Patent Appl. No. 63/203,257, filed on Jul. 14, 2021, U.S. Provisional Patent Appl. No. 63/190,691, filed on May 19, 2021, and U.S. Provisional Patent Appl. No. 63/130,312, filed on Dec. 23, 2020. This is also a continuation-in-part of U.S. patent application Ser. No. 17/444,468, filed on Aug. 4, 2021, which is a continuation-in-part of U.S. Design Appl. No. 29/720,679, filed on Jan. 15, 2020, and is issued as U.S. Pat. No. D930,097 on Sep. 7, 2021, and is a continuation of U.S. patent application Ser. No. 17/243,338, filed on Apr. 28, 2021, which is a continuation of U.S. patent application Ser. No. 16/590,270, filed on Oct. 1, 2019, and is issued as U.S. Pat. No. 11,020,640 on Jun. 1, 2021, which claims the benefit of U.S. Provisional Patent Appl. No. 62/739,747, filed on Oct. 1, 2018, the contents all of which are incorporated fully herein by reference.

TECHNICAL FIELD

This disclosure relates generally to golf clubs and relates more particularly to a multi-component putter type golf club head.

BACKGROUND

In many putter-type golf club heads, weight distribution is used to vary the center of gravity or increase the moment of inertia (MOI) of the golf club head. Common weight distribution devices include removable weight ports in the heel and toe regions of the sole, weighted faceplate inserts, inserts for the back of portion of the face, and attachments for the outer perimeter of the toe and heel regions. In particular putter-type golf club heads, often use weight ports in the heel and toe regions that can be removably attached by a fastener, or permanently attached through a variety of epoxies, glues, or machining methods. The use of weight ports in the heel and toe regions, the increases the MOI in the putter head, thereby producing a straighter ball path after impact.

Although these weight ports in the heel and toe regions increase MOI, they increase the weight of the golf club head and can make the golf club head heavier than an ideal weight for a putter. In addition, installing weight ports into a golf club putter head requires a cavity or recess to place these weight ports into the putter head during manufacturing, thereby increasing the cost of that putter head. Additionally, the weight ports can cause vibrations within the cavity or recess during impact, when the golf club head contacts a golf ball. These cavities and recesses can cause the sound of the club head to change as well, creating a hollow sound within the club head. There is a need in the art to develop a putter having a desirable sound, perimeter weighting, and an ideal weight for balanced putting while being pleasing to the eye of the user to create repeatability for a putt.

Figure 1B:
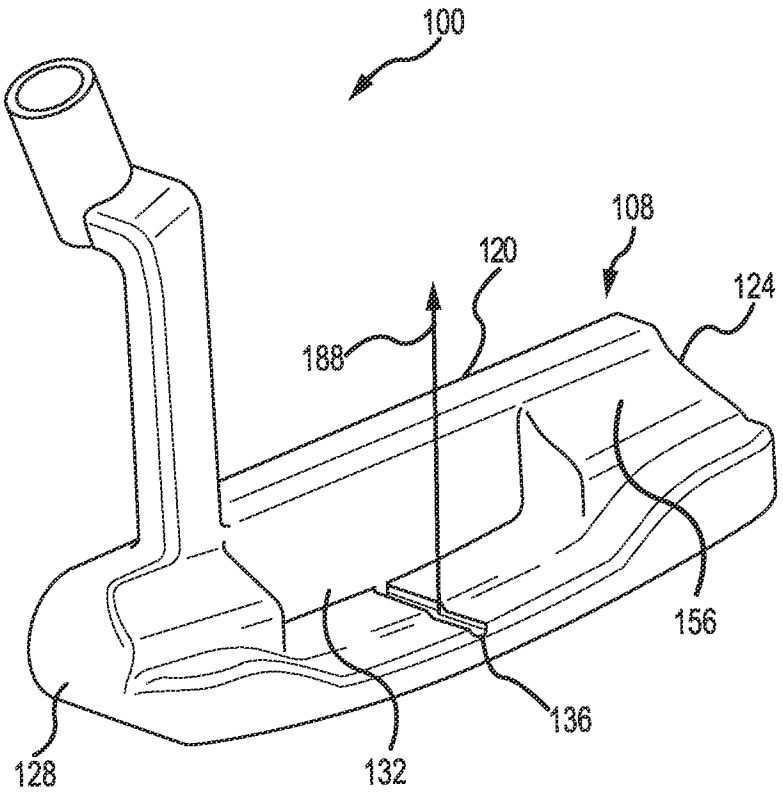
FIG. 1B illustrates an isometric view of the blade putter type golf club head of FIG. 1A.

Other aspects of the disclosure will become apparent by consideration of the detailed description and accompanying drawings.

DESCRIPTION

I. Putter Golf Club Head

Described herein is a two-part putter head having an upper portion made of a first material such as low density metal (i.e., aluminum, but not limited to) and a lower portion made of a second material, such as a high density metal (i.e., steel, but not limited to). The upper portion has a crown that spans from a strike face to a back edge. This upper portion is affixed to the lower portion and is farther from a ground plane than the lower portion. The lower portion, in most embodiments, has less than 35% of the total solid volume of the putter head, but greater than 45% of the mass. The lower portion provides a peripheral construction and a sole. This combination of peripheral construction and high density lower portion, results in an increase in MOI of at least 30%, over a putter with the same volume, mass, and single material construction (i.e., a putter milled of a single material such as a steel putter or a putter investment cast of a single material).

The lower portion of the two-part putter head further comprises a sole plate. The sole plate is formed from a high-density material. As described in more detail below, the two-part putter head includes the upper portion and the lower portion comprising the sole plate. The lower portion comprising the sole plate comprises mass structures, ball retrieval features, and/or ball outlining alignment aids to improve the putter experience. The putter heads including the upper portion and the lower portion comprising the sole plate provides increased perimeter weighting, MOI, and forgiveness while being pleasing to the eye. The putter heads including the upper portion and the lower portion comprising the sole plate further provides consistent ball speed and ball travel distance for repeated putts.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "upper," "lower," "over," "under," "top," "bottom," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

In many embodiments, the golf club head can comprise a putter-type golf club head (the putter type golf club head 100, 200, 300 400 . . . etc.). FIGS. 1-12B illustrate multiple embodiments of a putter-type golf club head having an upper portion and lower portion that are separately made of different materials and coupled together. The putter-type golf club head can be a mallet-type putter head, mid-mallet type putter head, a blade type putter head, a high MOI putter head, or any other type of putter-type golf club head.

In many embodiments, the putter-type golf club head can have a loft angle less than 10 degrees. In many embodiments, the loft angle of the club head can be between 0 and 5 degrees, between 0 and 6 degrees, between 0 and 7 degrees, or between 0 and 8 degrees. For example, the loft angle of the club head can be less than 10 degrees, less than 9 degrees, less than 8 degrees, less than 7 degrees, less than 6 degrees, or less than 5 degrees. For further example, the loft angle of the club head can be 0 degrees, 1 degree, 2 degrees, 3 degrees, 4 degrees, 5 degrees, 6 degrees, 7 degrees, 8 degrees, 9 degrees, or 10 degrees.

The putter-type golf club head comprises an upper portion and a lower portion. The golf club head can comprise a toe end and a heel end opposite the toe end. The putter-type golf club head can comprise a strike face. The putter-type golf club head can comprise a rear wall opposite the strike face. Further, the putter-type golf club head can comprise an alignment feature. Furthermore, the putter-type golf club head can comprise a hosel attached to the heel end of the golf club head. The hosel may be attached to the center of the putter-type golf club head. The hosel may be attached to the heel end of the putter-type golf club head. The hosel may be integrally formed with the upper portion of the putter-type golf club head. The hosel may be integrally formed with the lower portion of the putter-type golf club head.

The upper portion is made of a first material. The lower portion is made of a second material. The first material is different than the second material. The first material has a first density. The second material has a second density. The first density is not the same as the second density.

In many embodiments, the putter-type golf club head can have a mass that ranges between 340 and 385 grams. In other embodiments, the mass of the putter-type golf club head can range between 340 grams-345 grams, 345 grams-350 grams, 350 grams-355 grams, 355 grams-360 grams, 360 grams-365 grams, 365 grams-370 grams, 370 grams-375 grams, 375 grams-380 grams, or 380 grams-385 grams. In some embodiments, the mass of the putter-type golf club head can be 340 grams, 341 grams, 342 grams, 343 grams, 344 grams, 345 grams, 346 grams, 347 grams, 348 grams, 349 grams, 350 grams, 351 grams, 352 grams, 353 grams, 354 grams, 355 grams, 356 grams, 357 grams, 358 grams, 359 grams, 360 grams, 361 grams, 362 grams, 363 grams, 364 grams, 365 grams, 366 grams, 367 grams, 368 grams, 369 grams, 370 grams, 371 grams, 372 grams, 373 grams, 374 grams, 375 grams, 376 grams, 377 grams, 378 grams, 379 grams, 380 grams, 381 grams, 382 grams, 383 grams, 384 grams, or 385 grams.

In many embodiments, the putter type golf club head can comprise a club head volume ranging between 25 cc and 125 cc. In some embodiments, the club head volume can range between 25 cc-30 cc, 30 cc-35 cc, 35 cc-40 cc, 40 cc-45 cc, 45 cc-50 cc, 50 cc-55 cc, 55 cc-60 cc, 60 cc-65 cc, 65 cc-70 cc, 70 cc-75 cc, 75 cc-80 cc, 80 cc-85 cc, 85 cc-90 cc, 90 cc-95 cc, 95 cc-100 cc, 100 cc-105 cc, 105 cc-110 cc, 110 cc-115 cc, 115 cc-120 cc, or 120 cc-125 cc. In one embodiment, the club head volume can range between 40 cc-110 cc. In some embodiments, the club head volume can be greater than 25 cc, greater than 50 cc, greater than 75 cc, or greater than 100 cc.

In some embodiments, the putter type golf club head can comprise a strike face made of the first material. In other embodiments, the strike face can be made of the second material. In these embodiments, the material of the strike face can be any one or combination of the following: 8620 alloy steel (7.83 g/cc), S25C steel (7.85 g/cc), carbon steel (7.85 g/cc), maraging steel (8.00 g/cc), 17-4 stainless steel (7.81 g/cc), 303 stainless steel (8.03 g/cc), 304 stainless steel (8.00 g/cc), stainless steel alloy (7.75 g/cc-8.05 g/cc), tungsten (19.25 g/cc), aluminum (2.70 g/cc), aluminum alloy (2.64 g/cc-2.81 g/cc), ADC-12 (2.75 g/cc), or any metal suitable for creating a golf club head. In some embodiments, the strike face can be integrally formed to the upper portion. In other embodiments the strike face can be integrally formed to the lower portion. The strike face can be integrally formed to the club head by co-molding, injection molding, casting, additive manufacturing or other forming process.

Figure 11A:
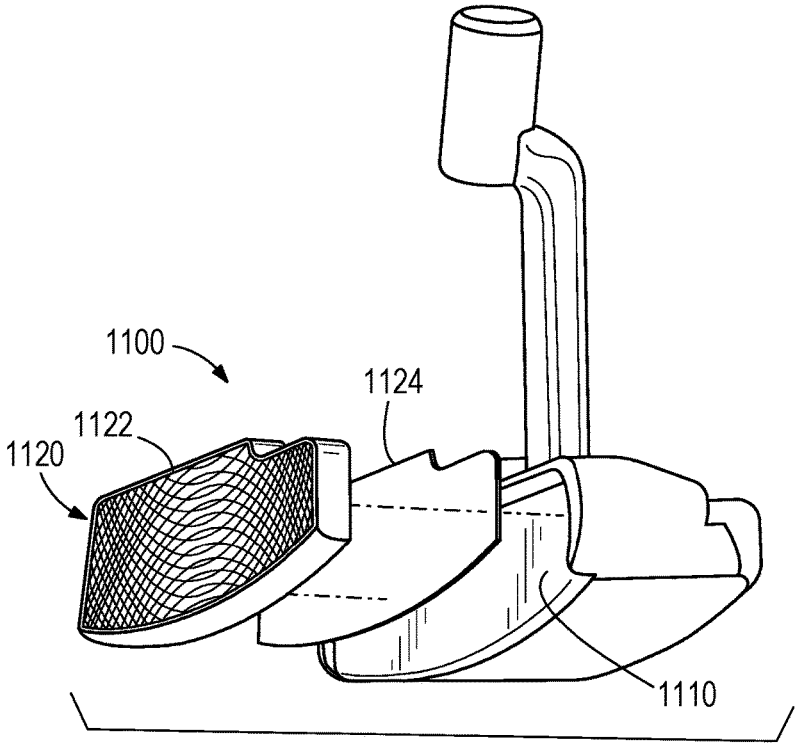
FIG. 11A illustrates an exploded view of a putter type golf club head comprising a strike face insert having a single component system.
Figure 11B:
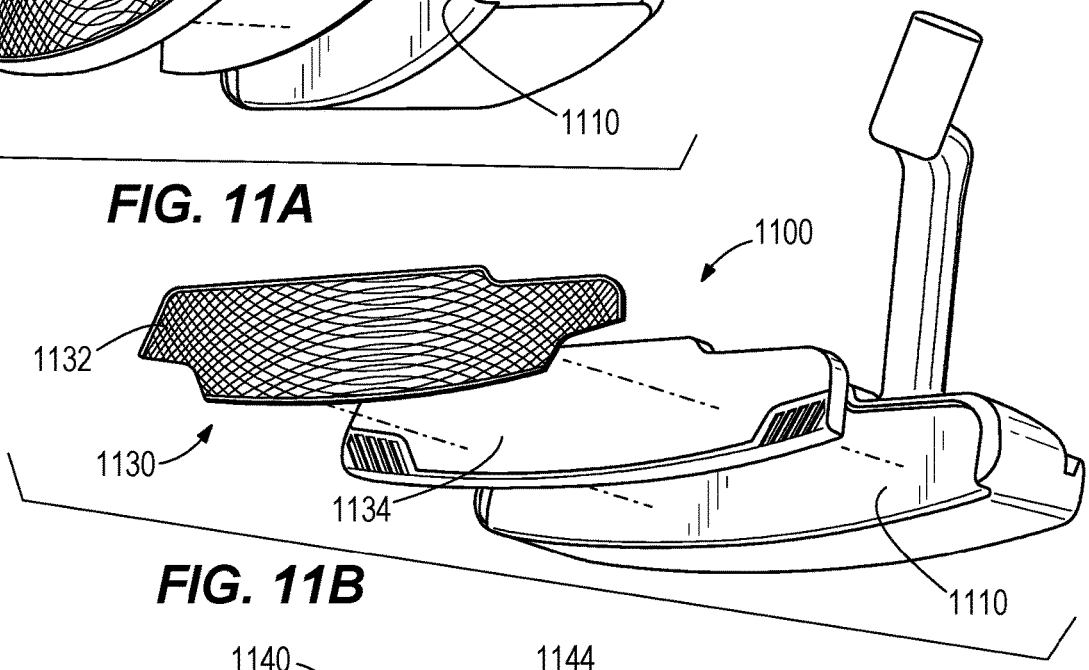
FIG. 11B illustrates an exploded view of a putter type golf club head comprising a strike face having a two-component system.
Figure 11C:
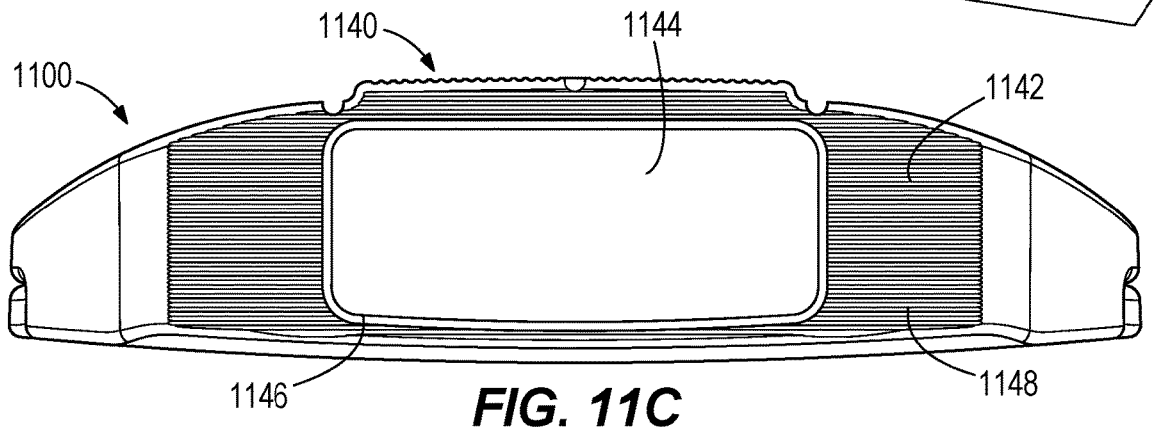
FIG. 11C illustrates a front view of a putter type golf club head comprising a strike face insert according to a third embodiment.

FIGS. 11A-11C illustrate various strike face features 1100 used on the multi-component putters described in this disclosure. As described in more detail below, the strike face features 1100 can comprise a single component system, a two-component system, or a single component system in combination with a metal portion. The single component system comprises a single strike face insert or component. The two-component system comprises multiple strike face inserts or components. In many embodiments, the strike face features 1100 can comprise a strike face insert. In these embodiments, the strike face is independently formed prior to being coupled to the club head. The side of the strike face insert that will contact the club head can comprise geometry complementary to the geometry of the corresponding portion of the club head that will contact the strike face. In some embodiments, the strike face insert can be made of the first material or the second material. In other embodiments, the strike face insert can be made of a third material. In some embodiments, the strike face insert can be integrally formed with the upper portion or the lower portion. In other embodiments, the strike face insert can be separately formed from both the upper portion and the lower portion.

The strike face can be secured to the club head by being integrally formed to a portion of the club head or by a fastening means. In some embodiments, the strike face is secured to the upper portion. In these embodiments, the upper portion defines an insert cavity 1110 in a forward portion of the upper portion. The upper portion insert cavity 1110 is configured to receive the strike face insert. Further, in these embodiments, when the strike face insert is affixed to the upper portion, the upper portion encompasses and mates with the insert cavity 1110. In other embodiments, the strike face can be secured to the lower portion. In these embodiments, the lower portion can comprise an insert cavity (not shown). The lower portion insert cavity functions to receive the strike face insert. Further, in these embodiments, when the insert is affixed to the lower portion, the lower portion encompasses and mates with the insert cavity. The strike face can be secured by an adhesive such as glue, very high bond (VHB™) tape, epoxy or another adhesive. Alternately or additionally, the strike face can be secured by welding, soldering, screws, rivets, pins, mechanical interlock structure, or another fastening method.

The strike face insert can comprise any one or layered combination of the following: aluminum, stainless steel, copper, thermoplastic co-polyester elastomer (TPC), thermoplastic elastomer (TPE), thermoplastic urethane (TPU), steel, nickel, TPU/aluminum, TPE/aluminum, plastic/metal screen insert, polyethylene, polypropylene, polytetrafluoroethylene, polyisobutylene, polyvinyl chloride, PEBAX®, or any other desired material. PEBAX® is a polyether block amide that is a thermoplastic elastomer made of a flexible polyether and rigid polyamide. The rigid polyamide can comprise Nylon. The PEBAX® can comprise different compounds that correspond to different Shore D hardness values, polyether percentages, and/or polyamide percentages. In many embodiments, the PEBAX® can comprise a PEBAX® 4033 (Arkema, Paris France) or a PEBAX® 6333 (Arkema, Paris France). The PEBAX® 4033 (Arkema, Paris France) comprises a tetramethylene oxide (53% wt) and a Nylon 12. The PEBAX® 6333 (Arkema, Paris France) comprises a Nylon 11. In some embodiments, the face insert can comprise a material such as steel, steel alloys, tungsten, tungsten alloys, aluminum, aluminum alloys, titanium, titanium alloys, vanadium, vanadium alloys, chromium, chromium alloys, cobalt, cobalt alloys, nickel, nickel alloys, other metals, other metal alloys, composite polymer materials or any combination thereof.

The PEBAX® can comprise a percentage of polyether by volume. In some embodiments, the PEBAX® can comprise 0% to 10%, 10% to 20%, 15% to 30%, 20% to 30%, 30% to 40%, 30% to 50%, 30% to 60%, 40% to 50%, 40% to 60%, 50% to 60%, or 60% to 70% polyether by volume. For example, the PEBAX® can comprise 0%, 5%, 10%, 15%, 20%, 25%, 30%, 35%, 40%, 45%, 50%, 55%, 60%, 65%, or 70% of polyether by volume. In some embodiments, the PEBAX® can comprise 0% to 10%, 10% to 20%, 15% to 30%, 20% to 30%, 30% to 40%, 40% to 50%, 40% to 60%, 50% to 60%, or 60% to 70% of polyamide by volume. For example, the PEBAX® can comprise 0%, 5%, 10%, 15%, 20%, 25%, 30%, 35%, 40%, 45%, 50%, 55%, 60%, 65%, or 70% of polyamide by volume. As the percentage of polyether percentage increases, the hardness of the PEBAX® decreases. As the percentage of polyamide percentage increases, the hardness of the PEBAX® increases. For example, the PEBAX® 4033 (Arkema, Paris France) can comprise 40% to 60% polyether by volume and 15% to 30% polyamide by volume. For example, the PEBAX® 6333 (Arkema, Paris France) can comprise 15% to 30% polyether by volume and 40% to 60% polyamide by volume.

In many embodiments, the PEBAX® can comprise a hardness ranging from Shore 25D to Shore 75D. In some embodiments, the hardness of the PEBAX can range from Shore 25D to Shore 35D, Shore 35D to Shore 45D, Shore 36D to Shore 44D, Shore 38D to Shore 42D, Shore 45D to Shore 55D, Shore 55D to Shore 65D, Shore 56D to Shore 64D, Shore 60D to Shore 65D, or Shore 65D to Shore 75D. For example, the hardness of the PEBAX can be Shore D 25, 30, 35, 40, 45, 50, 55, 60, 65, or 70.

In many embodiments, the PEBAX® 4033 (Arkema, Paris France) can comprise a lower hardness than the PEBAX® 6333 (Arkema, Paris France). In many embodiments, the PEBAX® 4033 (Arkema, Paris France) can comprise a hardness range of Shore 35D to Shore 55D. In some embodiments, the PEBAX® 4033 (Arkema, Paris France) can comprise a hardness range of Shore 38D to Shore 42D, or Shore 39D to Shore 41D. For example, the PEBAX® 4033 (Arkema, Paris France) can be comprise a Shore D hardness of 40. In many embodiments, the PEBAX® 6333 (Arkema, Paris France) can comprise a hardness range of Shore 50D to Shore 75D. In some embodiments, the PEBAX® 6333 (Arkema, Paris France) can comprise a hardness range of Shore 55D to Shore 70D, or Shore 60D to Shore 65D. For example, the PEBAX® 6333 (Arkema, Paris France) can comprise a Shore D hardness of 63.

As illustrated in FIG. 11A, the strike face features 1100 can comprise a strike face insert system 1120. The strike face insert system 1120 can be a single component system comprising a ball striking layer 1122 and an adhesive layer 1124. The strike face insert 1120 is configured to be adhered into the insert cavity 1110 via the adhesive layer 1124. The strike face insert 1120 can comprise a polymer type material as described in this disclosure. The strike face insert 1120 can comprise a PEBAX® as described in this disclosure.

As illustrated in FIG. 11B, the strike face features 1100 can comprise a strike face insert system 1130. The strike face insert system 1130 can be a two-component system comprising a ball striking face plate 1132 and a face insert base 1134. The strike face insert 1130 having the two-component system is configured to be received in the insert cavity 1110 via one or more adhesive layers. The ball striking face plate 1132 of the strike face insert 1130 can comprise a first insert material. The face insert base 1134 of the strike face insert 1130 can comprise a second insert material. In many embodiments, the first insert material of the ball striking face plate 1132 and the second material of the face insert base 1134 can be different. In some embodiments, the first insert material of the ball striking face plate 1132 and the second insert material of the face insert base 1134 can be similar. In many embodiments, the first insert material of the ball striking face plate 1122 can comprise a polymer type material. In some embodiments, the first insert material of the ball striking face plate 1122 can comprise a metallic material. In many embodiments, the second insert material of the face insert base 1134 can comprise a polymer type material.

The first insert material can comprise a metal such as steel, steel alloys, tungsten, tungsten alloys, aluminum, aluminum alloys, titanium, titanium alloys, vanadium, vanadium alloys, chromium, chromium alloys, cobalt, cobalt alloys, nickel, nickel alloys, other metals, other metal alloys, composite polymer materials or any combination thereof.

The first insert material or the second insert material can comprise a polymer type material. The polymer type material can comprise polyethylene, polypropylene, polytetrafluoroethylene, polyisobutylene, polyvinyl chloride, or any other polymer type material. In many embodiments, the face insert can comprise a PEBAX®. More specifically, the PEBAX® is a polyether block amide that is a thermoplastic elastomer made of a flexible polyether and rigid polyamide. The rigid polyamide can comprise Nylon. The PEBAX® can comprise different compounds that correspond to different Shore D hardness values, polyether percentages, and/or polyamide percentages. In many embodiments, the PEBAX® can comprise a PEBAX® 4033 (Arkema, Paris France) or a PEBAX® 6333 (Arkema, Paris France). The PEBAX® 4033 (Arkema, Paris France) comprises a tetramethylene oxide (53% wt) and a Nylon 12. The PEBAX® 6333 (Arkema, Paris France) comprises a Nylon 11. The first insert material and the second insert material can comprise similar polyether percentages, polyamide percentages, or Shore D hardness values as described above.

The ball striking face plate 1132 of the strike face insert 1130 can comprise a thickness. In many embodiments, the thickness of the ball striking face plate 1132 can range from 0.015 to 0.115 inch. In some embodiments, the thickness of the ball striking face plate 1132 can range from 0.015 to 0.045 inch, 0.020 to 0.050 inch, 0.025 to 0.055 inch, 0.050 to 0.100 inch, 0.055 to 0.105 inch, 0.060 to 0.110, or 0.065 to 0.115 inch. In some embodiments, the thickness of the ball striking face plate 1132 can be at least 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch. In some embodiments, the thickness of the ball striking face plate 1132 can be greater than or equal to 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch. In some embodiments, the thickness of the ball striking face plate 1132 can be less than or equal to 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch. For example, the thickness of the ball striking face plate 1132 can be 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch.

In other embodiments, the thickness of the ball striking face plate 1132 can range from 0.115 to 0.40 inch. In some embodiments, the thickness of the ball striking face plate 1132 can range from 0.115 to 0.20 inch, 0.15 to 0.30 inch, 0.20 to 0.30 inch, 0.25 to 0.35 inch, or 0.30 to 0.40 inch. In some embodiments, the thickness of the ball striking face plate 1132 can be at least 0.15, 0.20, 0.25, 0.30, 0.35, or 0.40 inch. In some embodiments, the thickness of the ball striking face plate 1132 can be greater than or equal to 0.15, 0.20, 0.25, 0.30, 0.35, or 0.40. In some embodiments, the thickness of the ball striking face plate 1132 can be less than or equal to 0.15, 0.20, 0.25, 0.30, 0.35, or 0.40 inch. For example, the thickness of the ball striking face plate 1132 can be 0.15, 0.20, 0.25, 0.30, 0.35, or 0.40 inch.

The face insert base 1134 of the strike face insert 1130 can comprise a thickness. In many embodiments, the thickness of the face insert base 1134 can range from 0.05 to 0.20 inch. In some embodiment, the thickness of the face insert base 1134 can range from 0.05 to 0.10 inch, or 0.10 to 0.20 inch. In some embodiments, the thickness of the face insert base 1134 can be at least 0.05, 0.10, 0.15, or 0.20 inch. In some embodiments, the thickness of the face insert base 1134 can be greater than or equal to 0.05, 0.10, 0.15, or 0.20 inch. In some embodiments, the thickness of the face insert base 1134 can be less than or equal to 0.05, 0.10, 0.15, or 0.20 inch. For example, the thickness of the face insert base 1134 can be 0.05, 0.10, 0.15, or 0.20 inch.

In other embodiments, the thickness of the face insert base 1134 can range from 0.20 to 0.80 inch. In some embodiments, the thickness of the face insert base 1134 can range from 0.20 to 0.50 inch, 0.30 to 0.60 inch, 0.40 to 0.70 inch, or 0.50 to 0.80 inch. In some embodiment, the thickness of the face insert base 1134 can range from 0.20 to 0.40 inch, 0.30 to 0.50 inch, 0.40 to 0.60 inch, 0.50 to 0.70 inch, or 0.60 to 0.80 inch. In some embodiments, the face insert base 1134 of the strike face insert 1130 can be at least 0.20, 0.25, 0.30, 0.35, 0.40, 0.45, 0.50, 0.55, 0.60, 0.65, 0.70, 0.75, or 0.80 inch. In some embodiments, the face insert base 1134 of the strike face insert 1130 can be greater than or equal to 0.20, 0.25, 0.30, 0.35, 0.40, 0.45, 0.50, 0.55, 0.60, 0.65, 0.70, 0.75, or 0.80 inch. In some embodiments, the face insert base 1134 of the strike face insert 1130 can be less than or equal to 0.20, 0.25, 0.30, 0.35, 0.40, 0.45, 0.50, 0.55, 0.60, 0.65, 0.70, 0.75, or 0.80 inch. For example, the thickness of the face insert base 1134 can be 0.20, 0.25, 0.30, 0.35, 0.40, 0.45, 0.50, 0.55, 0.60, 0.65, 0.70, 0.75, or 0.80 inch.

As illustrated FIG. 11C, the strike face features 1100 can comprise a strike face insert system 1140. The strike face insert system 1140 comprise a strike face insert 1144 and a metal portion 1142. The strike face insert 1144 comprises a single component system described above. The metal portion 1142 surrounds the strike face insert 1144. The strike face insert 1144 can be formed from a polymer material described in this disclosure. The strike face insert 1144 is further surrounded by an epoxy border 1146. The epoxy border 1146 extends around a perimeter of the strike face insert 1144. The combination of the strike face insert 1144 formed from a polymer type material and the epoxy border 1146 can provide enhanced feel and sound during impacts with a golf ball. Further, removing material from the strike face or the upper portion to accommodate the strike face insert 1144 reduces the putter head weight at or near a center area of the putter head. Removing material from the center area and/or forward area of the putter head allows for more weight to be positioned in the perimeter of the putter head thereby increasing moment of inertia and forgiveness.

The epoxy border 1146 surrounding the strike face insert 1144 can comprise a width. The width of the epoxy border 1146 can be measured as a transverse width. In many embodiments, the width of the epoxy border can range from 0.01 inch to 0.08 inch. In some embodiments, the width of the epoxy border 1146 can range from 0.01 inch to 0.04 inch, or 0.04 inch to 0.08 inch. In some embodiments, the width of the epoxy border 1146 can range from 0.02 inch to 0.05 inch, 0.03 inch to 0.06 inch, 0.04 inch to 0.07 inch, or 0.05 inch to 0.07 inch. For example, the width of the epoxy border can be 0.01, 0.02, 0.03, 0.035, 0.04, 0.045, 0.05, 0.06, 0.07, or 0.08 inch. In one example, the width of the epoxy border 1146 can be 0.03 inch.

The metal portion 1142 can further comprise a milling pattern 1148. The milling pattern 1148 can comprise a plurality of milling lines that extend in a vertical, horizontal, curvilinear, arcuate, or circular direction across the strike face. The milling pattern 1148 can extend in a crown to sole direction, and/or in a heel to toe direction across the strike face. The milling pattern 1148 enhances the surface finish of the putter head or strike face to improve the appearance of the putter head.

The strike face insert systems (1120, 1130, 1140) described in this disclosure can be formed by a number of different processes. The different forming processes include the following: injection molding, casting, blow molding, compression molding, co-molding, laser forming, film insert molding, gas assist molding, rotational molding, thermoforming, laser cutting, 3-D printing, forging, stamping, electroforming, machining, molding, or any combination thereof. Further, the strike face insert can have any combination of hardness, volume, thickness, and forming processes described above.

In many embodiments, the upper portion of the putter-type golf club head having the first material comprises a first density ranging between 1.0 g/cc and 6.0 g/cc. The first density can range between 2.0 g/cc to 5.0 g/cc. In some embodiments, the first density can range between 1.0-1.25 g/cc, 1.25-1.5 g/cc, 1.5-1.75 g/cc, 1.75-2.0 g/cc, 2.0-2.25 g/cc, 2.25-2.5 g/cc, 2.5-2.75 g/cc, 2.75-3.0 g/cc, 3.25-3.5 g/cc, 3.5-3.75 g/cc, 3.75-4.0 g/cc, 4.0-4.25 g/cc, 4.25-4.5 g/cc, 4.5-4.75 g/cc, 4.75-5.0 g/cc, 5.0-5.25 g/cc, 5.0-5.25 g/cc, 5.25-5.5 g/cc, 5.5-5.75 g/cc, or 5.75-6.0 g/cc. In one embodiment, the first density of the lower portion can range between 2.0-3.0 g/cc. In some embodiments, the first density can be less 6.0 g/cc, less than 5.0 g/cc, less than 4.0 g/cc, less than 3.0 g/cc, or less than 2.0 g/cc. In some embodiments, the first density can be 1.25 g/cc, 1.50 g/cc, 1.75 g/cc, 2.0 g/cc, 2.25 g/cc, 2.50 g/cc, 2.75 g/cc, 3.0 g/cc, 3.25 g/cc, 3.50 g/cc, 3.75 g/cc, 4.0 g/cc, 4.25 g/cc, 4.50 g/cc, 4.75 g/cc, 5.0 g/cc, 5.25 g/cc, 5.50 g/cc, 5.75 g/cc, or 6.0 g/cc.

In many embodiments, the lower portion of the putter-type golf club head having the second material. The second material can comprise a density. The density is a second density to the first density of the first material in the upper portion. The second density of the second material of the lower portion can range between 7.0 g/cc and 20.0 g/cc. In some embodiments, the second density can range between 7.0-7.5 g/cc, 7.5-8.0 g/cc, 8.0-8.5 g/cc, 8.5-9.0 g/cc, 9.0-9.5 g/cc, 9.5-10.0 g/cc, 10.0-10.5 g/cc, 10.5-11.0 g/cc, 11.0-11.5 g/cc, 11.5-12.0 g/cc, 12.0-12.5 g/cc, 12.5-13.0 g/cc, 13.0-13.5 g/cc, 13.5-14.0 g/cc, 14.0-14.5 g/cc, 14.5-15.0 g/cc, 15.0-15.5 g/cc, 15.5-16.0 g/cc, 16.0-16.5 g/cc, 16.5-17.0 g/cc, 17.0-17.5 g/cc, 17.5-18.0 g/cc, 18.0-18.5 g/cc, 18.5-19.0 g/cc, or 19.0-19.5 g/cc, or 19.5-20.0 g/cc. In one embodiment, the second density of the second material in the lower portion can range between 8.0-9.0 g/cc. In some embodiments, the second density can be 7.0 g/cc, 7.5 g/cc, 8.0 g/cc, 8.5 g/cc, 9.0 g/cc, 9.5 g/cc, 10.0 g/cc, 10.5 g/cc, 11.0 g/cc, 11.5 g/cc, 12.0 g/cc, 12.5 g/cc, 13.0 g/cc, 13.5 g/cc, 14.0 g/cc, 14.5 g/cc, 15.0 g/cc, 15.5 g/cc, 16.0 g/cc, 16.5 g/cc, 17.0 g/cc, 17.5 g/cc, 18.0 g/cc, 18.5 g/cc, 19.0 g/cc, 19.5 g/cc, or 20.0 g/cc. In some embodiments, the second density of the lower portion can be at least 2 times greater than the first density, at least 3 times greater than the first density, at least 4 times greater than the first density, or at least 5 times greater than the first density. In some embodiments, the second density can be greater than 7.0 g/cc, greater than 9.0 g/cc, greater than 10.0 g/cc, greater than 11.0 g/cc, or greater than 12.0 g/cc.

The upper portion of the putter-type golf club having the first material can be made from any one or combination of the following: 8620 alloy steel (7.83 g/cc), S25C steel (7.85 g/cc), carbon steel (7.85 g/cc), maraging steel (8.00 g/cc), 17-4 stainless steel (7.81 g/cc), 303 stainless steel (8.03 g/cc), 304 stainless steel (8.00 g/cc), stainless steel alloy (7.75 g/cc-8.05 g/cc), tungsten (19.25 g/cc), aluminum (2.70 g/cc), aluminum alloy (2.64 g/cc-2.81 g/cc), ADC-12 (2.75 g/cc), or any metal suitable for creating a golf club head. In many embodiments, the upper portion is made of aluminum alloy or ADC-12.

The lower portion of the putter-type golf club having the second material can be made from any one or combination of the following: 8620 alloy steel (7.83 g/cc), S25C steel (7.85 g/cc), carbon steel (7.85 g/cc), maraging steel (8.00 g/cc), 17-4 stainless steel (7.81 g/cc), 303 stainless steel (8.03 g/cc), 304 stainless steel (8.00 g/cc), stainless steel alloy (7.75 g/cc-8.05 g/cc), tungsten (19.25 g/cc), aluminum (2.70 g/cc), aluminum alloy (2.64 g/cc-2.81 g/cc), ADC-12 (2.75 g/cc), or any metal suitable for creating a golf club head. In many embodiments, the lower portion is made of 304 stainless steel, 8620 alloy steel, 17-4 stainless steel, or 1380 stainless steel. However, the lower and upper portion are not made from the same one material or the same combination of materials.

Furthermore, the upper and lower portion of the putter-type golf club head can be joined in any one or combination of the following methods: welding, soldering, brazing, swedging, adhesion, epoxy, or mechanical fastening. In some embodiments, the upper and lower portion can be joined by adhesion with epoxy, polyurethanes, resins, hot melts, or any other adhesive.

II. Embodiments a. Blade Embodiment

Figure 1A:
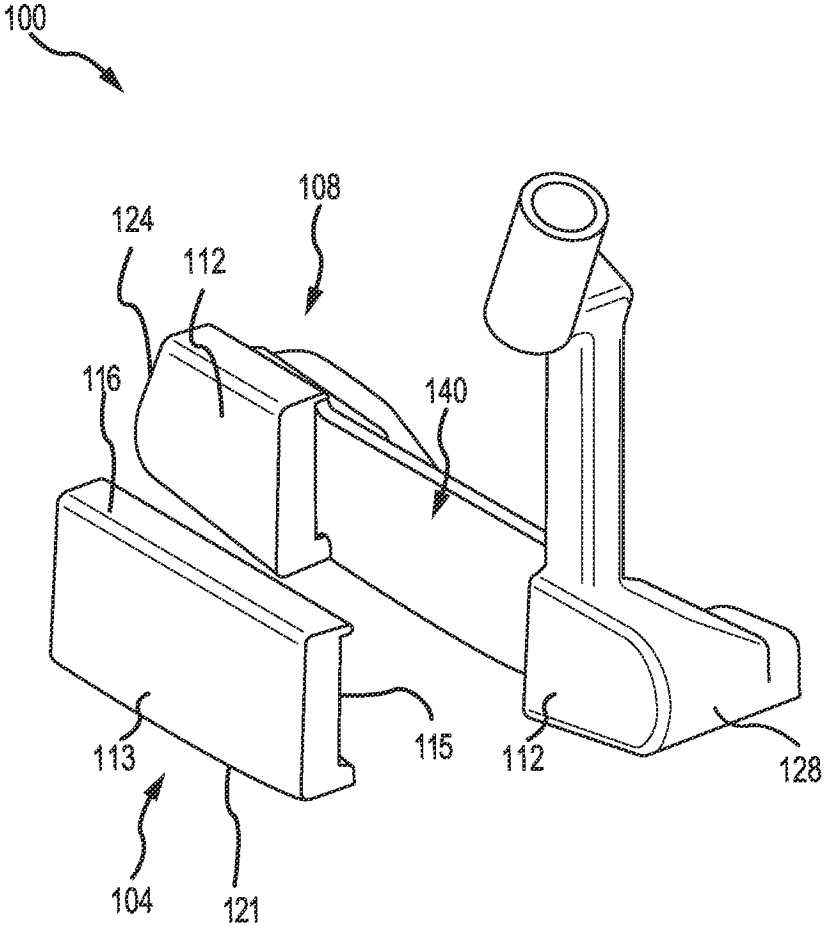
FIG. 1A illustrates an exploded view of a blade putter type golf club head.

In one embodiment, the putter-type golf club head can be a blade type putter head 100. Referring to FIGS. 1A and 1B, the blade type putter head 100 has an upper portion 104 and a lower portion 108. The upper portion 104 is made from a first material having a first density and the lower portion 108 is made from a second material having a second density. The first density is less than the second density. The upper portion 104 and lower portion 108 combine to create a balanced putter head 100, while maintaining a desirable volume and mass.

The lower portion 108 comprises a toe end 124, a heel end 128 opposite the toe end 124, a rear wall 132 opposite a front surface 112, a rear portion 156, and an under surface (not shown). The under surface and the upper portion 104 form a sole 168. The rear wall 132 is opposite and approximately parallel to the front surface 112. The toe end 124 is opposite the heel end 128, while adjacent to the strike face 112 and the rear portion 156. The rear portion 156 spans from the heel end 128 to the toe end 124, while also extending away from the rear wall 132 and the front surface face 112. The rear portion 156 is adjacent the sole. The under surface spans from the heel end 128 to the toe end 124 and is adjacent the rear portion 156 and the front surface 112.

Further, the toe end 124, heel end 128, and front surface 112 of the lower portion 108 forms a recess 140, wherein the recess extends inwards from the front surface 112, towards the rear wall 132. The recess functions to receive the upper portion 104. In most embodiments, the recess 140 comprises a corresponding geometry similar or identical to that of the upper portion 104. When the upper portion 104 is affixed to the lower portion 108, the upper portion 104 encompasses and mates with the lower portion 108 to fit within the recess 140.

Figure 2B:
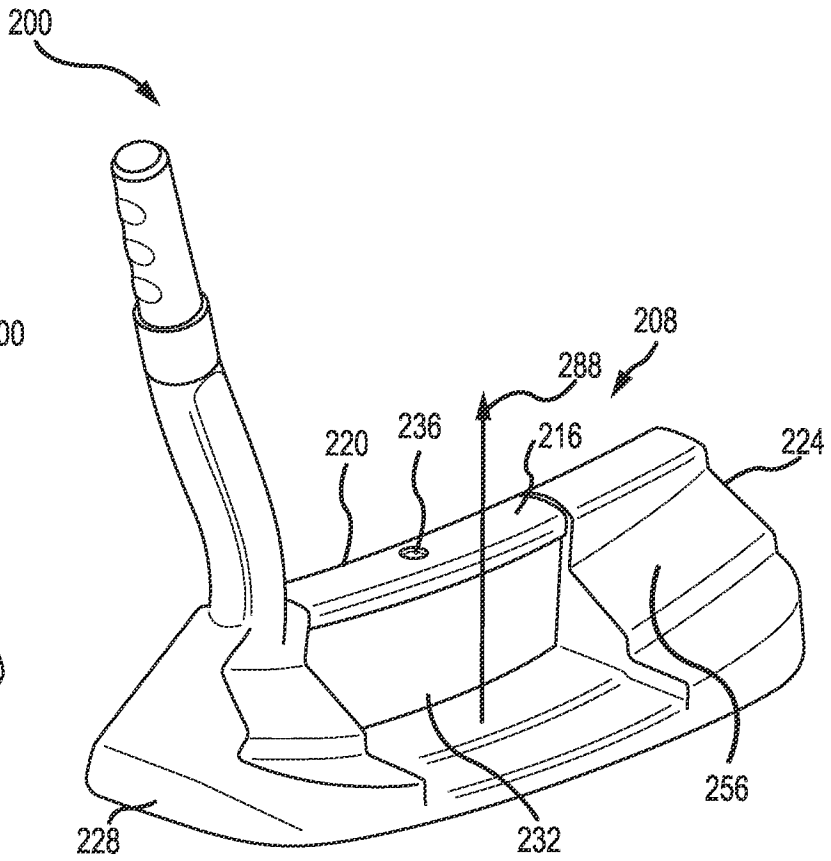
FIG. 2B illustrates an isometric view of the blade putter type golf club head of FIG. 2A.
Figure 2A:
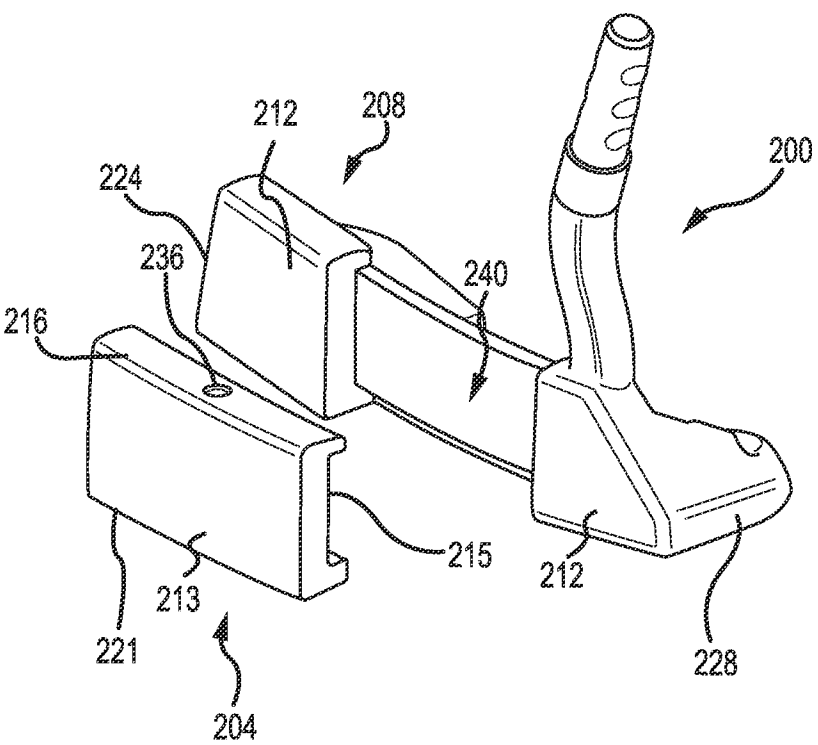
FIG. 2A illustrates an exploded view of a blade putter type golf club head.
Figure 2C:
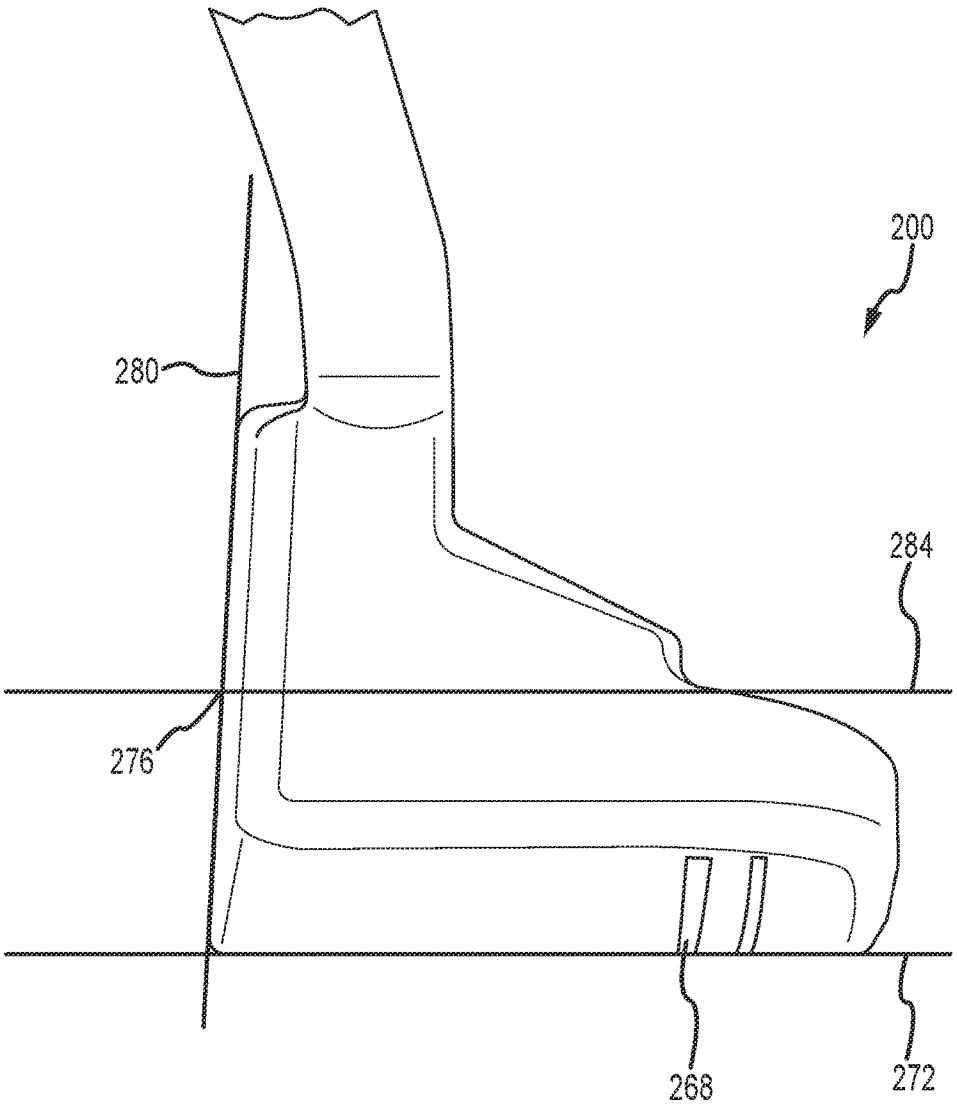
FIG. 2C illustrates a side view of the blade putter type golf club head of FIG. 2A.

The lower portion 108 of the blade type putter head 100 can further comprise an alignment feature 136. The alignment feature 136 can be any one or combination of the following: a line, a circle, a dashed line, a triangle, a channel, or any other desired alignment feature 136. Referring to FIGS. 2A-2C, in some embodiments, the blade type putter head 200 can comprise an alignment feature 236 on the upper portion 204, rather than the lower portion 208.

The upper portion 104 of the blade type putter 100 head comprises a hitting surface 113 and an adhesion surface 115. The hitting surface 113 comprises an upper edge 116 and a lower edge 121, wherein the upper edge 116 is further from a ground plane 172 than the lower edge 116. The ground plane 172 is tangent to the lower portion 108, when the putter head is at an address position to strike a golf ball. The upper edge 116 is adjacent the hitting surface 113 and the adhesion surface 115, while opposite the lower edge 121. In most embodiments, the hitting surface 113 and adhesion surface 115 are parallel, however in other embodiments, the hitting surface 113 and adhesion surface 115 are not parallel.

When the upper portion 104 and lower portion 108 are joined, the adhesion surface 115 is affixed to the recess 140 of the lower portion 108. The hitting surface 113 of the upper portion 104, and the front surface 112 of the lower surface, align to form a strike face 120, that will function to hit strike golf ball.

The lower edge 121 of the upper portion 104, and under surface of the lower portion 108 combine to create the sole 168. The sole 168 is perpendicular to the ground plane 172, wherein the ground plane 172 is tangent to the sole 168, when the putter 100 is at an address position to strike a golf ball. The sole 168 of the putter 100 extends from the toe end 124 of the putter head 100 to the heel end 128 of the putter head 100.

Figure 1C:
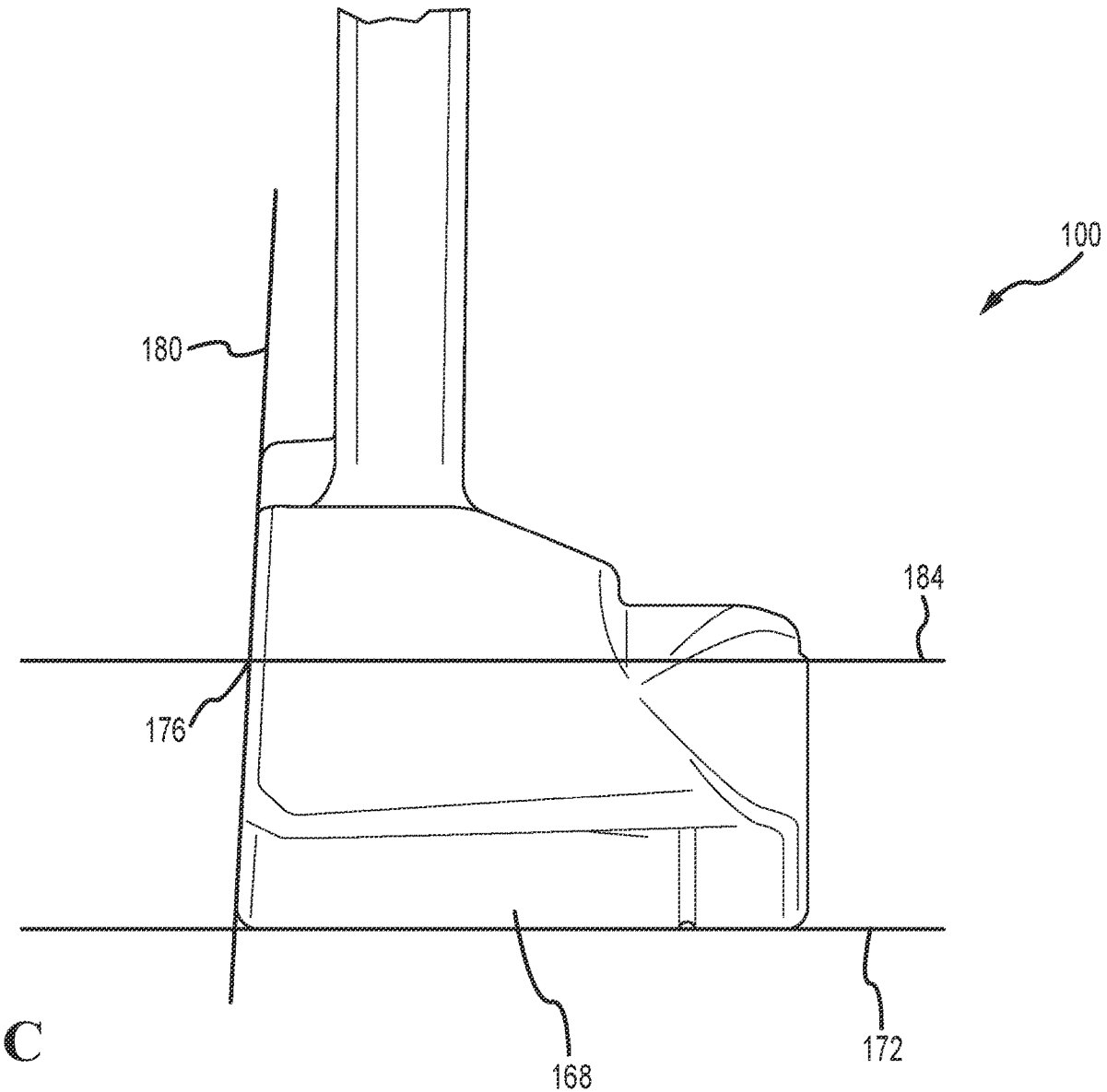
FIG. 1C illustrates a side view of the blade putter type golf club head of FIG. 1A.

Referring to FIG. 1C, in most embodiments, the sole 168 of the putter head 100 can be perfectly flat. In some embodiments, the sole 168 of the putter head 100 can have a slight arch in a heel 128 to toe 124 direction, wherein the slight arch can be linear, or a function of a polynomial. In some embodiments, the sole 168 of the putter head 100 can have a strong arch in the heel 128 to toe 124 direction, wherein the strong arch can be linear, or a function of a polynomial. The sole 168 functions to provide a surface to rest the putter head 100 on the ground plane 172.

The strike face 120 of the blade type putter head 100 comprises a strike face center point 176 and a loft plane 180. The strike face center point 176 is equidistant from the lower edge 120 and upper edge 116 of the strike face 120, as well as equidistant from the heel end 128 and toe end 124 of the blade type putter head 100. The loft plane 180 is tangent to the strike face 112 of the blade type putter head 100. Further, a midplane 184 intersects the strike face center point 176 and is perpendicular to the loft plane 180. Furthermore, a y-axis 188 intersects the strike face center point 176 and is perpendicular to the ground plane 172.

In some embodiments, when the lower portion 108 and the upper portion 104 are joined, the upper edge 116 of the upper portion 104 can protrude in a direction away from the strike face 120, overlaying at least a portion of the rear wall 132 of the lower portion 108. Further, the lower edge 121 of the upper portion 104 can protrude in a direction away from the strike face 120, towards at least a portion of the under surface of the lower portion 108, thereby making up a portion of the sole 168. In these embodiments, the rear wall 132 of the lower portion 108 does not make up a portion of the sole 168.

The combination of the low density first material upper portion 104 with the high density second material lower portion 108, increases the MOI of the putter 100, over a putter of unitary, solid block construction. The two part construction (upper portion 104 and lower portion 108) of the putter 100, moves denser material towards the heel 128 and toe 124, while placing lighter material (the upper portion 104) near the center, thereby increasing the MOI of the putter 100, since more mass is further from the center of gravity. The denser material of the lower portion helps increase the MOI of the putter-type golf club head by shifting the weight of the putter head 100 towards the outer portions of the putter-type golf club head. A single material putter fails to allocate high density material to the periphery. In some embodiments, the putter-type golf club head 100 with upper 104 and lower portions 108 of two different materials, increases the MOI about the y-axis center of gravity by at least 15% over a putter with the same volume, mass, and single material construction.

b. Blade Embodiment with Heel and Toe Mass

In some embodiments of the invention, the putter-type golf club head can be a blade type putter head 1700. Referring to FIGS. 17A-17E, the blade type putter head 1700 has an upper portion 1704 and a lower portion 1708. The upper portion 1704 is made from a first material having a first density and the lower portion 1708 is made from a second material having a second density. The first density is less than the second density. The two-part blade type putter head 1700 is formed by an upper portion 1704 that overlays the back end of the lower portion 1708 without disturbing the strike face 1720. The upper portion 1704 and lower portion 1708 combine to create a balanced putter head 1700 with a high moment of inertia (3500 $g \cdot cm^2$-5000 $g \cdot cm^2$), while maintaining a desirable volume and mass.

Figure 17A:
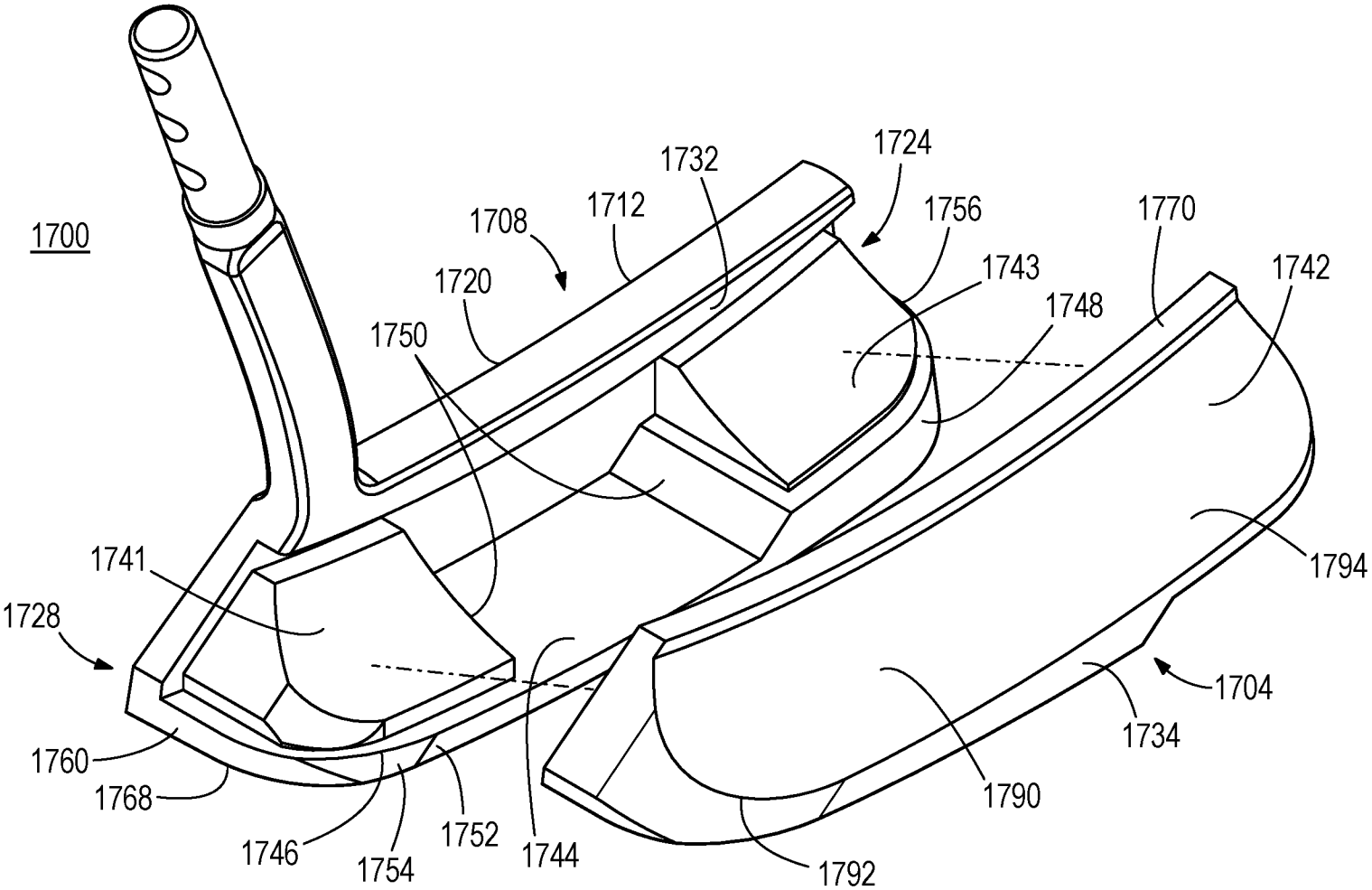
FIG. 17A illustrates a rear perspective exploded view of a two-part blade-type putter head according to a first embodiment.

As discussed above, the lower portion 1708 is comprised of a high-density material (i.e., the second material). Referring to FIG. 17A, the lower portion 1708 comprises a toe end 1724, a heel end 1728 opposite the toe end 1724, a front surface 1712 defining a strike face 1720, a rear wall 1732 opposite the front surface 1712, a rear portion 1756, and a sole 1768. The rear wall 1732 is opposite and approximately parallel to the front surface 1712. The toe end 1724 is opposite the heel end 1728, while adjacent to the strike face 1720 and the rear portion 1756. The rear portion 1756 spans from the heel end 1728 to the toe end 1724, while also extending away from the rear wall 1732 and the front surface 1712. The rear portion 1756 is adjacent the sole 1768. The sole 1768 spans from the heel end 1728 to the toe end 1724 and is adjacent the rear portion 1756 and the front surface 1712.

In many embodiments, the sole 1768 comprises a variable thickness. The sole 1768 comprises a central portion 1744, a heel portion 1746, and a toe portion 1748, wherein the heel portion 1746 and the toe portion 1748 each comprise a greater thickness than the central portion 1744. In many embodiments, transition regions 1750 can be provided between the heel portion 1746 and the central portion 1744 and between the central portion 1744 and the toe portion 1748. The transition regions 1750 provide a gradual and smooth transition between different thicknesses of the sole 1768. Providing the sole 1768 with a reduced thickness in the central portion 1744 and an increased thickness in the heel portion 1746 and toe portion 1748 allocates a greater amount of mass toward the periphery of the putter head 1700, thus increasing MOI. As discussed further below, the lower portion 1708 can further comprise a heel mass 1741 and a toe mass 1743 to further increase the perimeter weighting of the putter head 1700 and increase MOI.

In many embodiments, the sole 1768 of the putter head 1700 can be flat or planar. In some embodiments, the sole 1768 of the putter head 1700 can have a slight arch in a heel 1728 to toe 1724 direction, wherein the slight arch can be linear, or a function of a polynomial. In some embodiments, the sole 1768 of the putter head 1700 can have a strong arch in the heel 1728 to toe 1724 direction, wherein the strong arch can be linear, or a function of a polynomial. The sole 1768 functions to provide a surface to rest the putter head 1700 on the ground.

Figure 17B:
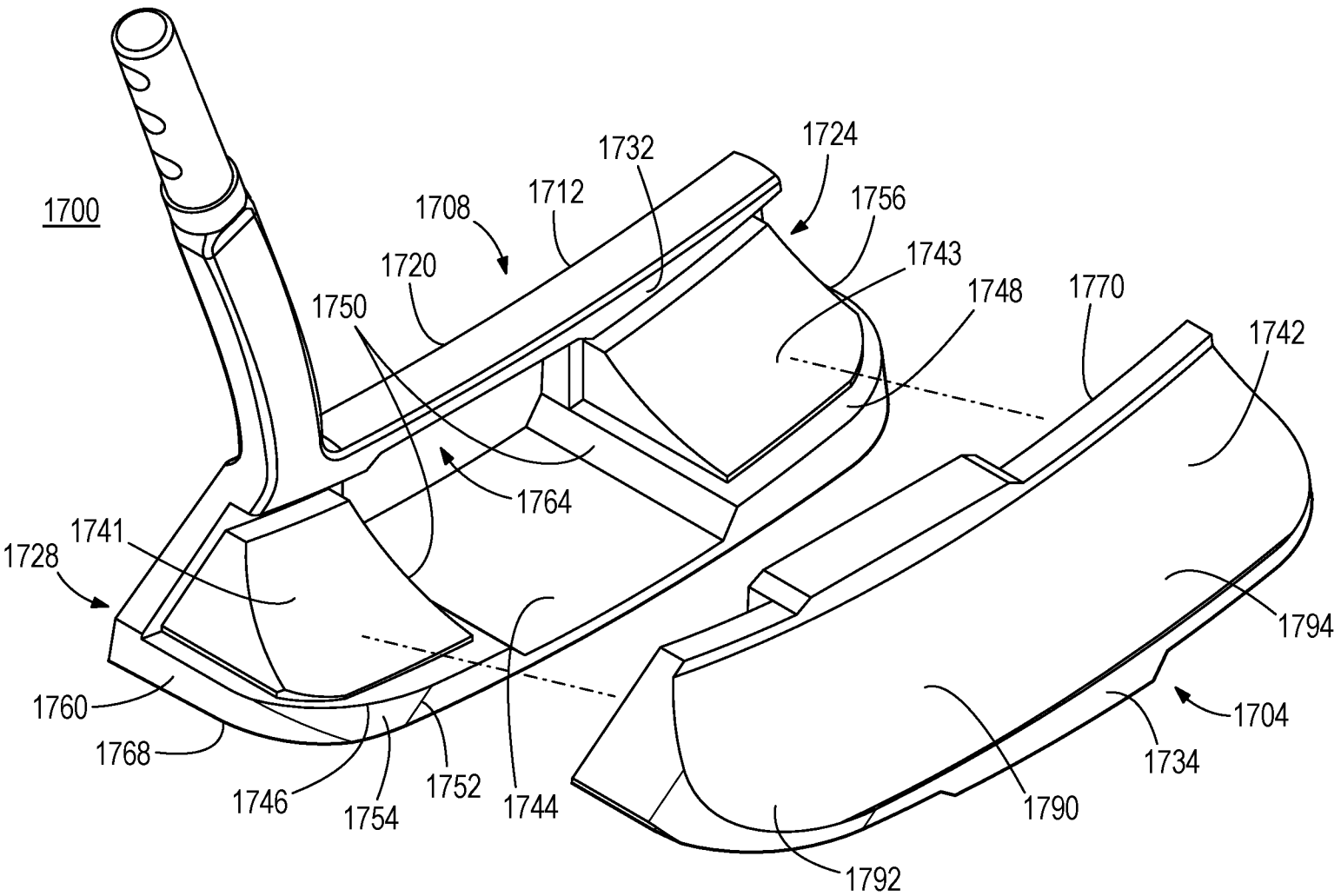
FIG. 17B illustrates a rear perspective exploded view of a two-part blade-type putter head according to a second embodiment with an aperture through the strike face.
Figure 17C:
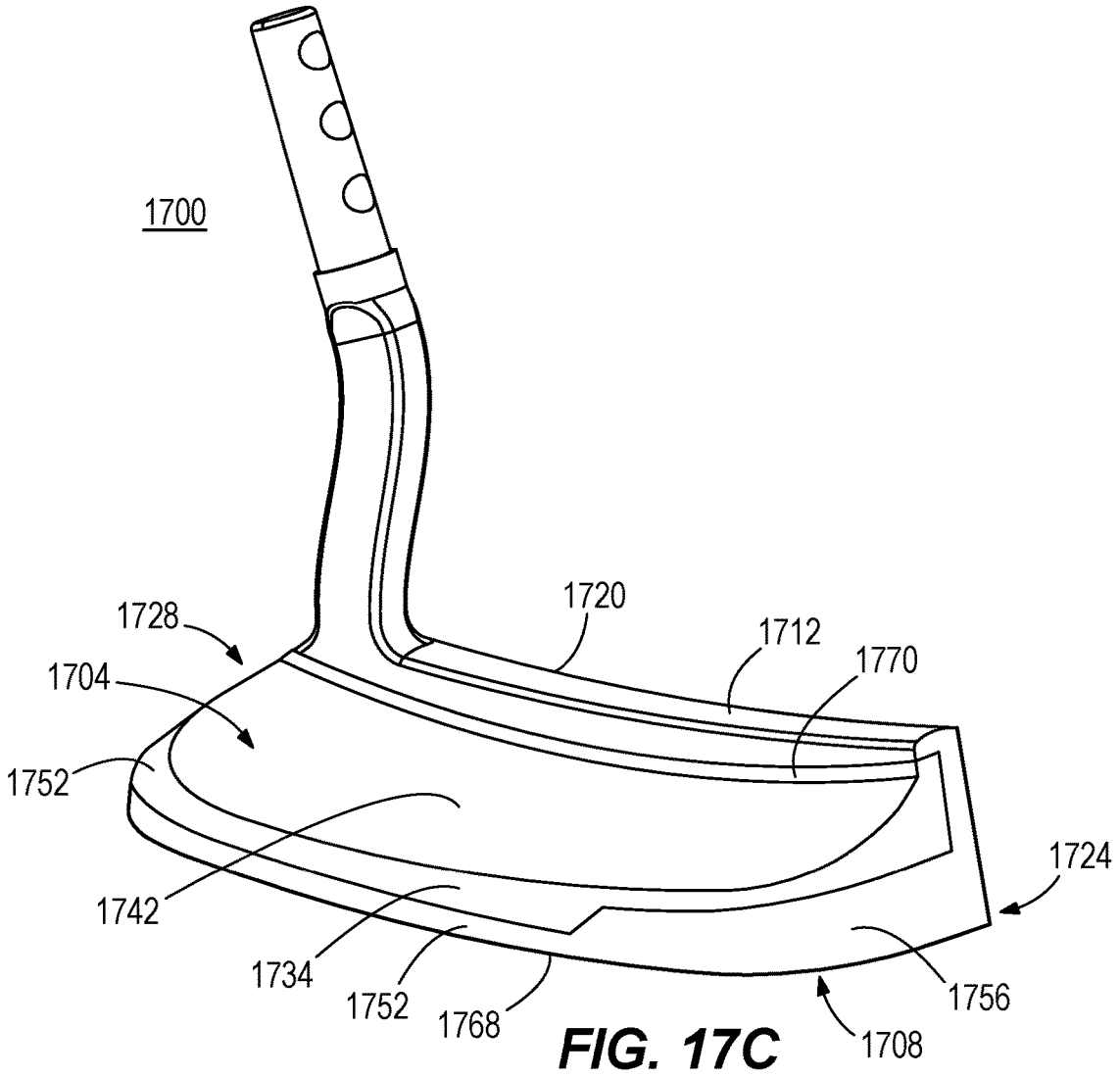
FIG. 17C illustrates a rear perspective view of the two-part blade-type putter head of FIG. 17A.

In some embodiments, referring to FIG. 17B, the lower portion 1708 comprises an aperture 1764 extending through the front surface 1712 and the rear wall 1732. The aperture 1764 is centrally located on the front surface 1712 and is configured to receive at least a portion of the low-density upper portion 1704. As illustrated in FIG. 17B, the aperture 1764 is substantially rectangular. In other embodiments, the aperture 1764 can be circular, curvilinear, triangular, trapezoidal, parabolic, golf ball shaped, square, or any other desired shape. The aperture 1764 allows mass to be removed from the center of the lower portion front surface 1712 and re-allocated in other areas of the putter head 1700 to increase perimeter weighting and provide a higher MOI.

Figure 17D:
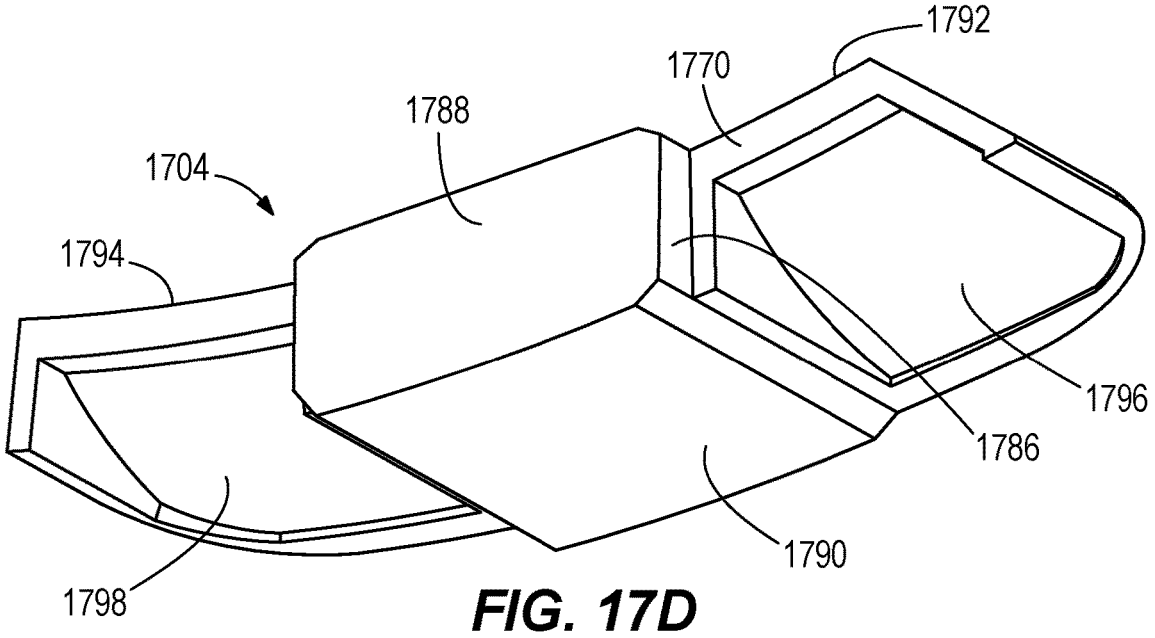
FIG. 17D illustrates a front perspective view of the upper portion of the two-part blade-type putter head of FIG. 17A.

As discussed above, the upper portion 1704 is comprised of a low-density material (i.e., the first material). The upper portion 1704 is configured to overlay the lower portion 1708 and create a putter head 1700 with a solid construction. The upper portion 1704 covers the back end of the lower portion 1708. In some embodiments, as described in further detail below, the upper portion 1704 can form part of the strike face 1720. Referring to FIG. 17D, the upper portion 1704 comprises a main body 1790, a heel extension 1792 formed between the main body 1790 and the heel side periphery 1760, and a toe extension 1794 formed between the main body 1790 and the toe side periphery 1756. The upper portion 1704 further comprises a front edge 1770, a back edge 1734 opposite the front edge 1770, and a crown 1742, wherein the crown 1742 extends over the entire span of the upper portion 1704, from the front edge 1770 to the back edge 1734 and from the heel side periphery 1760 to the toe side periphery 1756.

The main body 1790 is a substantially solid structure. The main body 1790 comprises a geometry configured to correspond to the shape of the lower portion 1708. The main body 1790 abuts the central portion 1744 of the sole 1768 and is located between the heel portion 1746 and the toe portion 1748 In many embodiments, referring to FIG. 17A, the main body 1790 abuts the rear wall 1732 of the lower portion 1708.

Figure 17E:
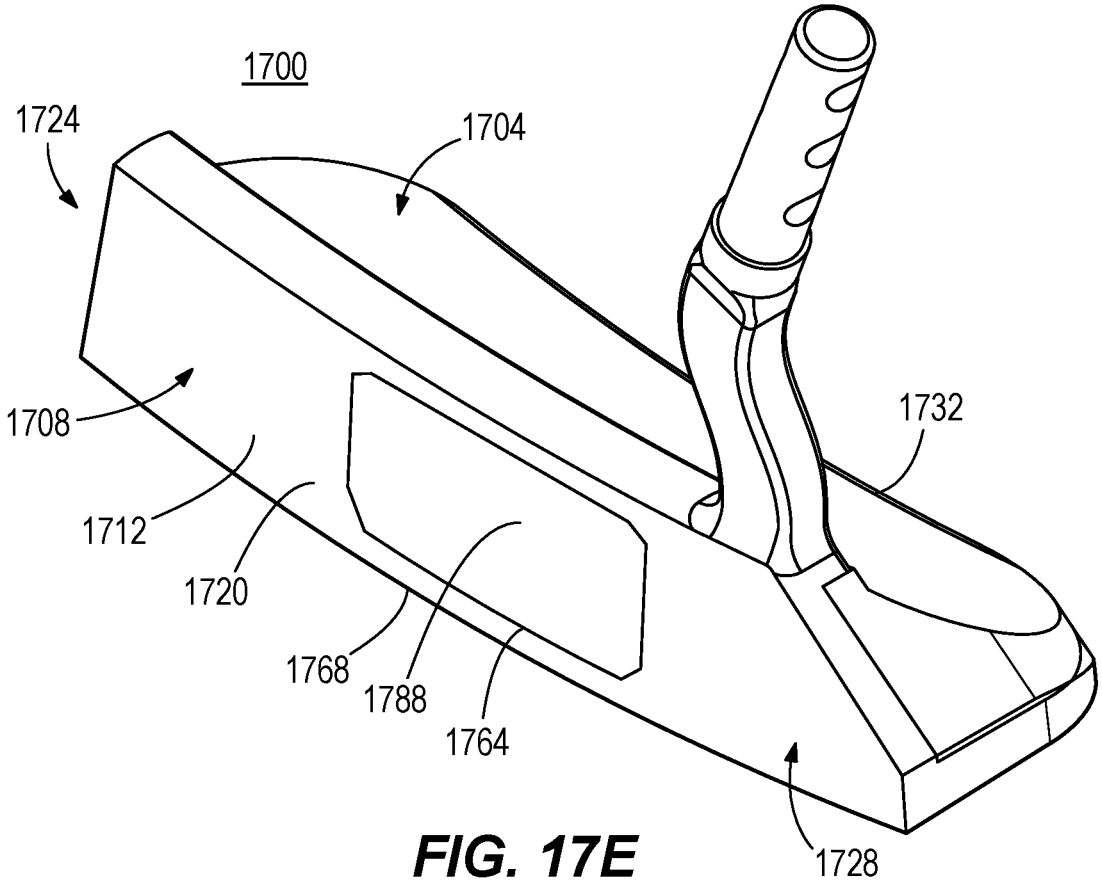
FIG. 17E illustrates a front perspective view of the two-part blade-type putter head of FIG. 17B.

Referring now to the embodiment of FIG. 17B, in some embodiments, the main body 1790 comprises a protrusion 1786 forming a forwardmost portion of the main body 1790. As illustrated in FIG. 17D, the protrusion 1786 extends from the main body 1790 toward the lower portion front surface 1712. The protrusion 1786 extends through and fills the aperture 1764 formed in the front surface 1712 of the lower portion 1708. The protrusion 1786 comprises a geometry matching the geometry of the aperture 1764 provided in the lower portion front surface 1712, such that when the upper 1704 and lower portions 1708 are joined, the main body 1790 completely fills the aperture 1764. As illustrated by FIG. 17E, when joined to the lower portion 1708, a front surface 1788 of the main body 1790 is flush with the front surface 1712 of the lower portion 1708. In this way, the lower portion front surface 1712 and the upper portion main body 1790 combine to create a continuous, solidly constructed strike face 1720. As a result, the strike face 1720 is formed as a high-density material (i.e. the second material) with an aperture 1764 located substantially in the center and filled by a low-density material (i.e. the first material). The strike face 1720 comprises lower density first material near the center surrounded by higher density second material toward the perimeter of the strike face 1720.

The crown 1742 of the upper portion 1704 forms an entirety of an upper surface of the upper portion 1704. The crown 1742 extends from the front edge 1770 to the back edge 1734 and from the toe side periphery 1756 to the heel side periphery 1760, covering the entire span of the upper portion 1704. When joined to the lower portion 1708, the crown 1742 forms a majority of the top of the putter head 1700, although small portions of the top of the putter head 1700 may be formed by the lower portion 1708. In many embodiments, the crown 1742 comprises a smooth, continuous surface. In the embodiment illustrated by FIG. 17C, the crown 1742 comprises a concave curvature. In some embodiments, the concave curvature of the crown 1742 can substantially match the curvature of the sole 1768. In other embodiments, the crown 1742 can be substantially flat. In yet other embodiments, the crown 1742 may not be substantially smooth, instead comprising one or more surface features (not shown) that provide roughness or discontinuity to the crown 1742.

In some embodiments, the under surface 1774 of the upper portion 1704 can form a first cavity 1796. The first cavity 1796 is recessed within the under surface of the toe extension 1794. The first cavity 1796 is recessed towards the crown 1742 but does not extend entirely through the crown 1742. The first cavity 1796 is bounded by the back edge 1734, the crown 1742, the front edge 1770 and the toe side periphery 1756. The toe extension 1794 overlays the toe mass 1741 of the lower portion 1708, completely concealing the toe mass 1741 within the first cavity 1796.

In some embodiments, the under surface of the upper portion 1704 can form a second cavity 1798. The second cavity 1798 is recessed within the under surface of the heel extension 1792. The second cavity 1798 is recessed towards the crown 1742 but does not extend entirely through the crown 1742. The second cavity 1798 is bounded by the back edge 1734, the crown 1742, the front edge 1770 and the heel side periphery 1760. The heel extension 1792 overlays the heel mass 1743 of the lower portion 1708, completely concealing the heel mass 1741 within the second cavity 1798.

The first and second cavities 1796, 1798 can comprise any desired geometry. However, in most embodiments, the first and second cavity comprise a geometry similar or identical to that of the corresponding toe mass 1741 and heel mass 1743. Further, when the upper portion 1704 is affixed to the lower portion 1708, the upper portion 1704 overlays the lower portion 1708 in such a way that the toe mass 1741 is housed within the first cavity 1796 and the heel mass 1743 is housed within the second cavity 1798.

The upper portion 1704 and the lower portion 1708 are joined to create a solidly constructed putter head 1700 with high MOI. The upper portion 1704 and lower portion 1708 are complementarily shaped to fit together without any interior voids or hollow spaces. As discussed above, the upper portion 1704 overlays the lower portion 1708 and fills the aperture 1764 formed within the lower portion front surface 1712. The main body 1790 of the lower portion 1708 correspondingly fits within the sole 1768 and protrudes through the aperture 1764 to form a continuous strike face 1720. The toe extension 1794 and heel extension 1792 overlay the toe mass 1741 and heel mass 1743, respectively.

As alluded to above, in some embodiments, the putter head 1700 can further comprise a toe mass 1741 and a heel mass 1743. The weights of the heel mass 1741 and toe mass 1743 can be tailored to achieve a desired swing weight or overall putter head mass. Referring to FIGS. 17A and 17B, the toe mass 1741 and heel mass 1743 are located on the toe portion 1748 and the heel portion 1746 of the sole 1768, respectively. The heel mass 1741 and the toe mass 1743 can be integral with the lower portion 1708 and can be formed of the lower portion 1708 second material. In other embodiments, the toe mass 1741 and the heel mass 1743 can be formed of a third material with a third density greater than the second density of the lower portion 1708. The toe mass 1741 and heel mass 1743 extend vertically from the lower portion 1708. The toe mass 1741 and heel mass 1743 provide a means to position and align the upper portion 1704 with the lower portion 1708 of the putter head 1700.

Furthermore, the toe mass 1741 and heel mass 1743 provide an additional means of adding mass to the perimeter for increasing the MOI of the blade-shaped putter head 1700 when compared with putters without such mass features. The heel mass 1741 and toe mass 1743 can comprise a density greater than or equal to the second density of the remainder of the lower portion 1708. The toe mass 1741 and heel mass 1743 can have masses that range from 10-40 grams. In some embodiments, the toe mass 1741 and heel mass 1743 can comprise a mass of approximately 25 grams each. In some embodiments, the toe mass 1741 and heel mass 1743 can have masses that range from 10-25 grams, 15-30 grams, 20-35 grams, or 25-40 grams. In some embodiments, the toe mass 1741 and heel mass 1743 can have masses that range from 10-20 grams, from 15-25 grams, from 20-30 grams, from 25-35 grams, or from 30-40 grams. In some embodiments the toe mass 1741 and heel mass 1743 can comprise a mass of approximately 15 grams, 16 grams, 17 grams, 18 grams, 19 grams, 20 grams, 21 grams, 22 grams, 23 grams, 24 grams, 25 grams, 26 grams, 27 grams, 28 grams, 29 grams, 30 grams, 31 grams, 32 grams, 33 grams, 34 grams, or 35 grams.

The toe mass 1741 and heel mass 1743 can each have the same mass or can comprise different masses within the ranges provided above. The toe mass 1741 and heel mass 1743 can respectively be any one or combination of the following shapes: rectangular, triangular, pyramidal, spherical, crescent-shaped, square, cylindrical, ovular, elliptical, trapezoidal, pentagonal, hexagonal, octagonal, or any other desired geometric or non-geometric shape.

Referring to FIGS. 17A and 17B, the toe mass 1741 and heel mass 1743 can be positioned away from one or more of the rear periphery 1752, the toe side periphery 1756, and the heel side periphery 1760, wherein the toe mass 1741 and heel mass 1743 do not touch or intersect with the rear periphery 1752, the toe side periphery 1756, and/or the heel side periphery 1760. However, in other embodiments, the toe mass 1741 and heel mass 1743, can be positioned on one or more of the rear periphery 1752, the toe side periphery 1756, and the heel side periphery 1760, wherein the toe mass 1741 and heel mass 1743 are integral to and intersect the rear periphery 1752, the toe side periphery 1756, and/or the heel side periphery 1760.

Referring to FIGS. 17A and 17B, the toe mass 1741 and heel mass 1743 can be spaced rearwardly from the rear wall 1732, wherein the toe mass 1741 and heel mass 1743 do not touch or intersect with the rear wall 1732. However, in other embodiments, the toe mass 1741 and heel mass 1743 are integrally formed with the rear wall 1732, wherein the front of the heel mass 1743 and toe mass 1741 intersect the rear wall 1732.

The toe mass 1741 and heel mass 1743 provide areas of concentrated mass, such that the toe mass 1741 and heel mass 1743 function to increase the moment of inertia of the putter head 1700. The placement of the toe mass 1741 and the heel mass 1743 on or near the front surface 1712 and on or near the toe side periphery 1756 and heel side periphery 1760, respectively, increases the MOI by shifting mass away from a center of gravity of the putter head 1700. The toe mass 1741 and the heel mass 1743 can be integrally formed from the second material, wherein the second material is denser than the first material.

The toe mass 1741 and heel mass 1743 offer dual functionalities, such that the toe mass 1741 and heel mass 1743 function not only to increase the MOI of the putter head 1700 but provide additional surfaces for the upper portion 1704 to join to the lower portion 1708. Therefore, the toe mass 1741 can also be referred to as a front toe adhesion portion 1741 and the heel mass 1743 can also be referred to as a front heel adhesion portion 1743.

The lower portion 1708 of the blade type putter head 1700 can further comprise an alignment feature (not shown). The alignment feature can be any one or combination of the following: a line, a circle, a dashed line, a triangle, a channel, or any other desired alignment feature. In some embodiments, the blade type putter head 1700 can comprise an alignment feature on the upper portion 1704, rather than the lower portion 1708.

The combination of the low density first material upper portion 1704 with the high density second material lower portion 1708, increases the MOI of the putter head 1700, over a putter of unitary, solid block construction. The two-part construction (upper portion 1704 and lower portion 1708) of the putter head 1700, moves denser material towards the heel 1728 and toe 1724, while placing lower density material (the upper portion 1704) near the center, thereby increasing the MOI of the putter head 1700, since more mass is further from the center of gravity. The denser material of the lower portion 1708 helps increase the MOI of the putter head 1700 by shifting the mass of the putter head 1700 towards the outer portions of the putter head 1700. A single material putter fails to allocate high density material to the periphery while maintaining a desirable volume (50 cc-75 cc) and mass (340 grams-385 grams). In one example, the putter head 1700 comprises a high MOI (4187 $g \cdot cm^2$), a desirable volume (55 cc), and a desirable mass (361 grams). In some embodiments, the putter head 1700 with upper 1704 and lower portions 1708 of two different materials, increases the MOI about the y-axis center of gravity by at least 15% over a putter with the same volume, mass, and single material construction.

In the present embodiment, the lower portion 1708 comprises a larger proportion of the volume of the putter head 1700, in comparison to other putter head embodiments described herein. The lower portion 1708, in most embodiments, comprises less than 80% of a volume of the putter head 1700. In some embodiments, the lower portion 1708 comprises less than 79% of the total volume of the putter head 1700, less than 78% of the total volume of the putter head 1700, less than 77% of the total volume of the putter head 1700, less than 76% of the total volume of the putter head 1700, less than 75% of the total volume of the putter head 1700, less than 74% of the total volume of the putter head 1700, less than 73% of the total volume of the putter head 1700, less than 72% of the total volume of the putter head 1700, less than 71% of the total volume of the putter head 1700, or less than 70% of the total volume of the putter head 1700.

Due to the high percentage of volume comprised by the lower portion 1700, the lower portion also comprises a significantly high percentage of the mass of the putter head 1700. The lower portion 1708 comprises at least 85% of an overall mass of the putter head 1700. In some embodiments, the lower portion 1708 comprises at least 86% of the mass of the putter head 1700, at least 87% of the mass of the putter head 1700, at least 88% of the mass of the putter head 1700, at least 89% of the mass of the putter head 1700, at least 90% of the mass of the putter head 1700, at least 91% of the mass of the putter head 1700, at least 92% of the mass of the putter head 1700, at least 93% of the mass of the putter head 1700, at least 94% of the mass of the putter head 1700, or at least 95% of the overall mass of the putter head 1700.

The beneficial shift of mass to the periphery of the putter head 1700, through the use of a high density, lower portion 1708 and the inclusion the heel mass 1743 and toe mass 1741 increases the MOI of the putter head 1700. The putter head 1700 comprises an increased MOI over a putter with the same volume, mass, and single material construction (i.e., a putter milled of a single stainless-steel block, or a putter investment cast of a single material).

c. Crescent Embodiment

Figure 3B:
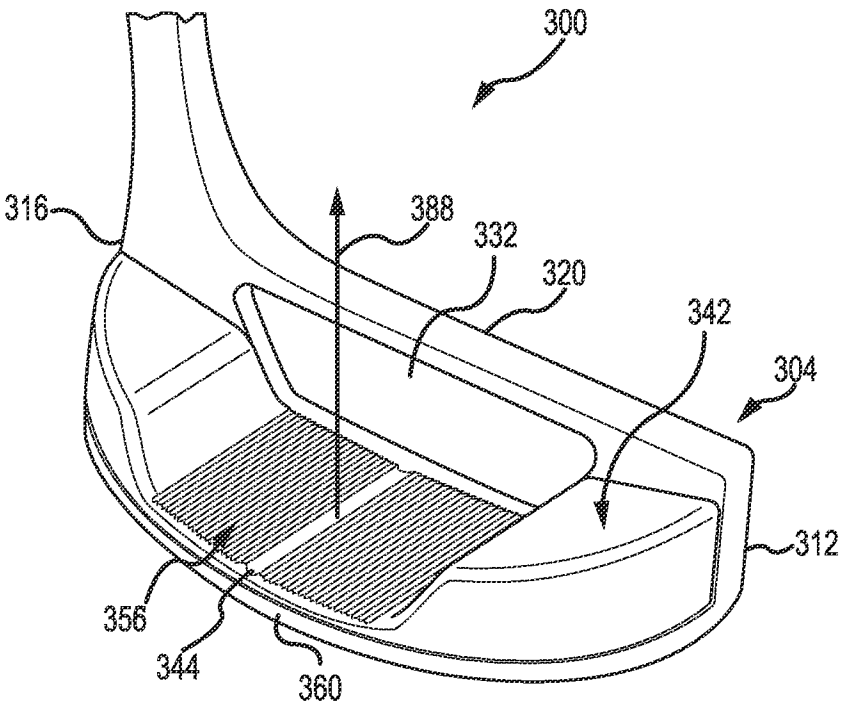
FIG. 3B illustrates an isometric view of the crescent putter type golf club head of FIG. 3A.
Figure 3A:
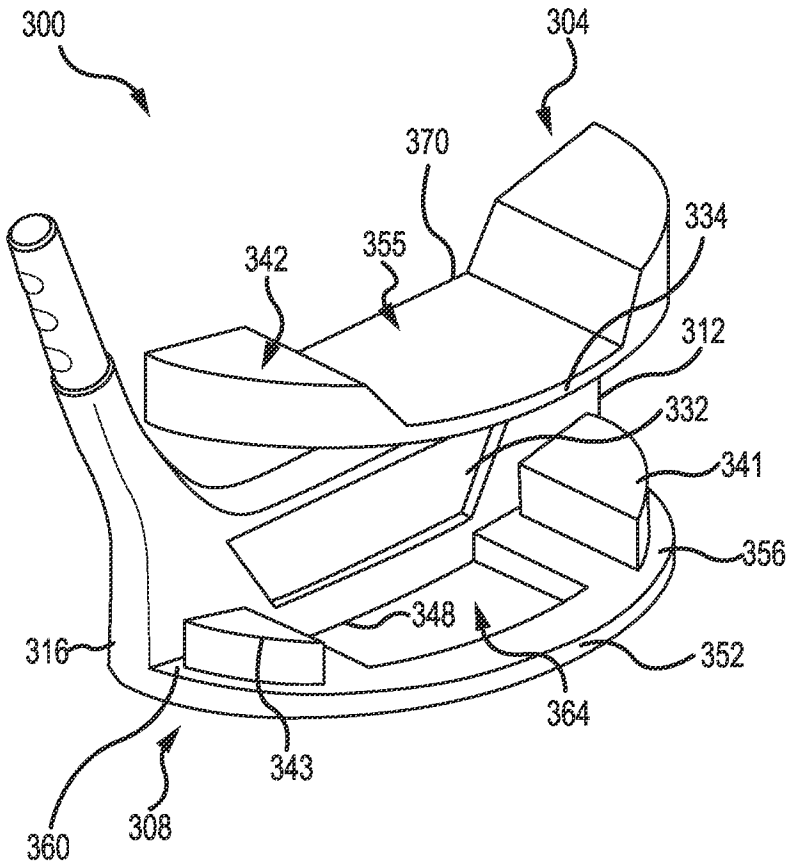
FIG. 3A illustrates an exploded view of a crescent putter type golf club head.
Figure 3C:
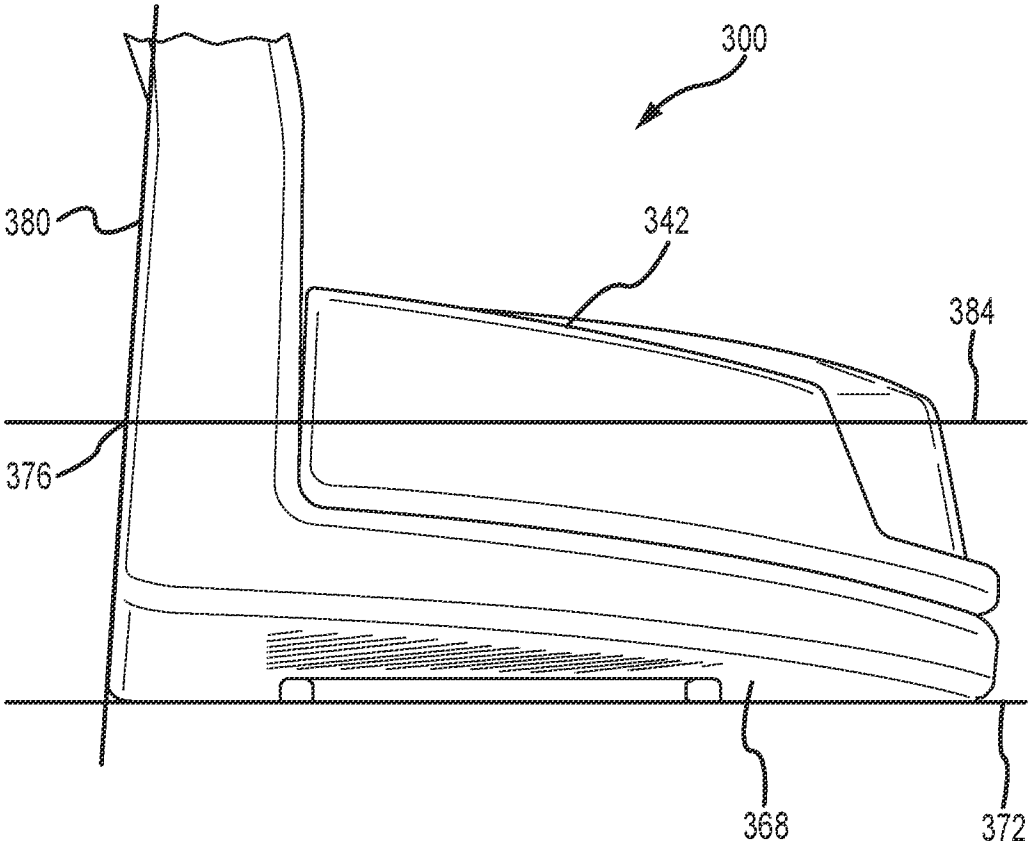
FIG. 3C illustrates a side view of the crescent putter type golf club head of FIG. 3A.

In one embodiment, the putter-type golf club head can be a crescent-shaped putter head 300. Referring to FIG. 3A-3C, the crescent-shaped putter head 300 has a upper portion 304 and a lower portion 308. The upper portion 304 is made from a first material have a first density and the lower portion 308 is made from a second material having a second density. The first density is less than the second density. The upper portion 304 and lower portion 308 combine to create a balanced putter head 300, while maintaining a desirable volume and mass. The high density lower portion 308 and low density upper portion 308, place more mass near the peripheries of the putter head 300, thus increasing the MOI and stability over a putter with the same volume, mass, and single material construction.

As discussed above, the lower portion 308 is comprised of a high-density material (i.e., the second material). The lower portion 308 comprises a rear periphery 352, a toe end 312, a heel end 316, a strike face 320, a rear wall 332, a back edge 334, a crown 342, and an under surface (not shown). The under surface and the upper portion 304 form a sole 368. The toe end 312 is opposite the heel end 316. The toe end 312 and the heel end 316 of the lower portion 308 respectively comprise a toe side periphery 356 and a heel side periphery 356. The strike face 320 spans from the toe end 312 to the heel end 316 and is opposite the rear wall 332. The rear wall 332 is opposite, and approximately parallel to, the strike face 320. The lower portion further comprises a heel side periphery 360, a toe side periphery 356, a front edge 316, and a upper edge 312.

The front edge 348 is adjacent to the toe side periphery 356 and the heel side periphery 360, and opposite to the rear periphery 352. The toe side periphery 356 is adjacent to the front edge 348 and the rear periphery 352, and opposite to the heel side periphery 360. The heel side periphery 360 is also adjacent to the front edge 348 and the rear periphery 352, but opposite to the toe side periphery 356.

In most embodiments, the toe side periphery 356 extends perpendicularly from the front edge 348, towards the rear periphery 352, such that a right angle (90° angle) is formed at the junction of the toe side periphery 356 and the front edge 348. However, in other embodiments, the toe side periphery 356 can extend from the front edge 348 in any direction, such that any angle (0°-180°) can be formed at the junction of the toe side periphery 356 and the front edge 348. Further, in most embodiments, the heel side periphery 360 extends perpendicularly from the front edge 348, such that a right angle (90° angle) is formed at the junction of the heel side periphery 360 and the front edge 348. However, in other embodiments, the heel side periphery 360 can extend from the front edge 348 in any direction, such that any angle (0°-180°) can be formed at the junction of the heel side periphery 360 and the front edge 348.

The front edge 348, toe side periphery 356, and heel side periphery 360 form an aperture 364. The aperture 364 is bounded by the front edge 348 the toe side periphery 356, and the heel side periphery 360. The aperture 364 shifts a majority of the volume and mass of the putter to the extremities of the lower portion 308. The aperture 364 can comprise any shape, however in one embodiment the aperture 364 is approximately rectangular. In other embodiments, the aperture 364 can be circular, curvilinear, triangular, trapezoidal, parabolic, golf ball shaped, square, or any other desired geometric shape.

The upper portion 304 of the putter head 300 comprises a crown 342, a front edge 370, and a back edge 334. The crown 342 extends away from the front edge 370 to the back edge 364 of the upper portion 304. The under surface is opposite the crown 342, spanning from the front edge 348 to the back edge 334.

In some embodiments, the heel side periphery 360 and toe side periphery 356 can be parallel, while in some embodiments, the heel side periphery 360 and toe side periphery 356 are not parallel. In some embodiments, the rear periphery 352 and front edge 348 can be parallel, while in some embodiments, the rear periphery 352 and front edge 348 are not parallel. The rear periphery 352 of the crescent-shaped putter head 300 is approximately crescent-shaped, and therefore, the rear periphery 352 and front edge 348 are not parallel. The rear periphery 352 can be curvilinear spanning from the heel side periphery 360 to the toe side periphery 356. The rear periphery 352 comprises a curve length measured along the rear periphery 352 from the junction between the heel side periphery 360 and the rear periphery 352 to the junction between the toe side periphery 356 and the rear periphery 352. In some embodiments, the rear periphery 352 curve length can be between 4.5 inches and 6.5 inches. In some embodiments, the rear periphery curve length can be 4.5 inches-4.75 inches, 4.75 inches-5.0 inches, 5.0 inches-5.25 inches, 5.25 inches-5.5 inches, 5.5 inches-5.75 inches, 5.75 inches-6.0 inches, 6.0 inches-6.25 inches, or 6.25 inches-6.5 inches.

When the upper portion 304 and the lower portion 308 are joined, the crown 342 extends between the strike face 320 to the rear periphery 352. The crown 342, in most embodiments, spans approximately inward 25% of the total club head 300 width from the toe side periphery 356 and spans approximately inward 25% of the total club head 300 width from the heel side periphery 360. In other embodiments, the crown 342 can, continuously or discontinuously, span the entire width of the total club head 300, in a heel 316 to toe 312 direction. In some embodiments, the crown 342, can span less than 90% of the total width of the club head 300, less than 80% of the total width of the club head 300, less than 70% of the total width of the club head 300, less than 60% of the total width of the club head 300, less than 50% of the total width of the club head 300, less than 40% of the total width of the club head 300, or less than 30% of the total width of the club head 300. Further, in some embodiments, the crown 342 can be substantially flat from the strike face 320 to the back edge 334 or ascend from the strike face 320 to the back edge 334. In most embodiments, the ascent or descent of the crown 342 can be linear, curvilinear, parabolic, sinusoidal, or a function of polynomial.

The crown 342 further comprises an alignment trough 355, wherein the alignment trough 355 is equidistant from the heel end 316 and the toe end 312. The alignment trough 355 is adjacent the rear wall 328 and approximately perpendicular to the strike face. The alignment trough 356 is bounded by the back edge 334, the rear wall 332, and the crown 342 on the heel end 316 and the toe end 312. In most embodiments, the alignment trough is approximately the width of a golf ball (approximately 4.27 cm) to provide the viewer a visual alignment field that extends the width of the golf ball.

Furthermore, the upper portion 304 of the putter head 300 can comprise one or more alignment features 344 on the crown 342. The alignment feature 344 can be any one or combination of the following: a line, a series of lines, milling troughs, a circle, a dashed line, a triangle, a channel, or any other desired alignment feature 344. The alignment features 344 can be equally spaced on the entire crown 342, a portion of the crown 342, or the alignment trough 355. The alignment features 344, extending along the alignment trough 355, function to provide the viewer a visual alignment field that extends the width of the golf ball, from the rear wall 332 to the back edge 334 of the putter 300. The goal is to align the entire putter 300 with the golf ball using these alignment features 344 along the crown 342 and/or the alignment trough 355.

Referring to FIG. 3C, the upper portion 304 can be affixed to the lower portion 308 such that the upper portion 304 is further from a ground plane than the lower portion 308, wherein the ground plane 372 is tangent to the lower portion 304, when the putter head 300 is at an address position to strike a golf ball.

Referring to FIG. 3C, the strike face 320 of the putter head 300 comprises a strike face center point 376 and a loft plane 380. The strike face center point 376 is equidistant from the crown 342 and the under surface of the upper portion 304, as well as equidistant from the heel end 316 and toe end 312 of the putter head 300. The loft plane 380 is tangent to the strike face 320 of the putter head 300. Further, a midplane 316 intersects the strike face center point 376 and is perpendicular to the loft plane 380. Furthermore, referring to FIG. 3B, a y-axis 388 intersects the midplane 384, and is perpendicular to the ground plane 372.

When the upper portion 304 and lower portion 308 are joined such that the heel end 316 overlays at least a portion of the toe side periphery 356. Further, when the upper portion 304 and lower portion 308 are joined such that the toe end 312 overlays at least a portion of the heel side periphery 360. Further still, when the upper portion 304 and lower portion 308 are joined such that the strike face 320 overlays at least a portion of the front edge 316. Finally, the upper portion 304 and lower portion 308 are joined such that the back edge 364 overlays at least a portion of the rear periphery 332.

The front edge 316, rear periphery 332, toe side periphery 356, and heel side periphery 360 of the lower portion 308, combined with the upper portion 304, create the sole 368. The sole 368 is perpendicular to the ground plane 372, wherein the ground plane 372 is tangent to the sole 368, when the putter head 300 is at an address position to strike a golf ball. The sole 368 of the putter head 300 extends from the toe end 312 of the putter head 300 to the heel end 316 of the putter head 300.

In most embodiments, the sole 368 of the putter head 300 can be perfectly flat. In some embodiments, the sole 368 of the putter head 300 can have a slight arch in a heel 324 to toe 320 direction, wherein the slight arch can be linear, or a function of a polynomial. In some embodiments, the sole 368 of the putter head 300 can have a strong arch in the heel 324 to toe 320 direction, wherein the strong arch can be linear, or a function of a polynomial. The sole 368 functions to provide a surface to rest the putter head 300 on the ground plane 372.

Referring to FIG. 3A, in one embodiment, the lower portion 308 can further comprise a toe mass 341 and a heel mass 343. The toe mass 341 and heel mass 343 are integral to the lower portion 308 and are in contact with the toe side periphery 356 and heel side periphery 360, respectively. The toe mass 341 and heel mass 343 extend from the lower portion 308, in a direction away from the ground plane 372, and toward the upper portion 304. The toe mass 341 and heel mass 343 provide a means to position and align the upper portion 304 with the lower portion 308 of the putter head 300.

Furthermore, the toe mass 341 and heel mass 343 provide an additional means of adding weight to the perimeters for increasing the MOI of the crescent-shaped putter head 300 when compared with putters without these mass features. These mass features can have weights that range from 2-5 grams, 3-7 grams or 1-6 grams. The mass features can have all the same weight or be different weight within the ranges provided above. The weight of the mass features can be 1 gram, 2 grams, 3 grams, 4 grams, 5 grams, 6 grams, or 7 grams. The toe mass 341 and a heel mass 343 can respectively be any one or combination of the following shapes: rectangular, triangular, pyramidal, spherical, crescent-shaped, square, cylindrical, ovular, elliptical, trapezoidal, pentagonal, hexagonal, octagonal, or any other desired geometric or non-geometric shape.

Referring to FIG. 3A, the toe mass 341 and heel mass 343 can be positioned away from the rear periphery 352, wherein the toe mass 341 and heel mass 343 do not touch or intersect with the rear periphery 352. However, in other embodiments, the toe mass 341 and heel mass 343, can be positioned on the rear periphery 352, wherein the toe mass 341 and heel mass 343 are integral to and intersect the rear periphery 352.

In one embodiment, the toe mass 341 is positioned on the front edge 348, at the junction of the toe side periphery 356 and the front edge 348, however in other embodiments the toe mass 341 can be positioned anywhere along the toe side periphery 356. In one embodiment, the heel mass 343, is positioned on the front edge 348, at the junction of the heel side periphery 360 and the front edge 348, however in other embodiments the heel mass 343 can be positioned anywhere along the heel side periphery 360.

The toe mass 341 and heel mass 343 provide areas of concentrated mass, such that the toe mass 341 and heel mass 343 function to increase the moment of inertia of the putter head 300. The placement of the toe mass 341 and the heel mass 343 on or near the front edge 316 and on or near the toe side periphery 356 and heel side periphery 360, respectively, increases the MOI since the toe mass 341 and the heel mass 343 are farther from a center of gravity of the putter 300. The toe mass 341 and the heel mass 343 can be integrally formed from the second material, wherein the second material is denser than the first material.

The toe mass 341 and heel mass 343 offer dual functionalities, such that the toe mass 341 and heel mass 343 function not only to increase the MOI of the putter 300 but provide additional surfaces for the upper portion 304 to join to the lower portion 308. Therefore, the toe mass 341 can also be referred to as a front toe adhesion portion 341 and the heel mass 343 can also be referred to as a front heel adhesion portion 343.

In some embodiments, the under surface, crown 342, front edge 370, and back edge 334 of the upper portion 304, can form a first cavity (not shown). The first cavity extends inwards from the under surface, on the toe end 312, towards the crown 342 but does not reach the crown 342. The first cavity is bounded by the back edge 334, the crown 342, and the front edge 370. The first cavity functions to receive the toe mass 341 of the lower portion 308.

In some embodiments, the under surface, crown 342, front edge 370, and back edge 334 of the upper portion 304, can form a second cavity (not shown). The second cavity extends inwards from the under surface, on the heel end 316, towards the crown 342 but does not reach the crown 342. The second cavity is bounded by the back edge 334, the crown 342, and the front edge 370. The second cavity functions to receive the heel mass 343 of the lower portion 308.

The first and second cavities can comprise any desired geometry. However, in most embodiments, the first and second cavity comprise a geometry similar or identical to that of the corresponding toe mass 341 or the heel mass 343. Further, when the upper portion 304 is affixed to the lower portion 308, the first cavity is positioned such that the first cavity encompasses the toe mass 341, and the second cavity is positioned such that the second cavity encompasses the heel mass 343.

The combination of the low density first material upper portion 304 with the high density second material lower portion 308, creates a high MOI putter 300, without creating an extremely heavy putter. The large aperture 364 formed by the rear wall 332, the rear periphery 352, the toe side periphery 356, and the heel side periphery 360 of the lower portion 308 forms a dense, yet low volume portion that increases the MOI of the putter, in comparison to a putter milled from a single material. A single material putter fails to allocate high density material to the periphery, while maintaining a desirable volume (50 cc-75 cc) and mass (340 grams-385 grams).

The lower portion 308, in most embodiments, comprises less than 38% of a volume of the putter 300. In some embodiments, the lower portion 308 comprises less than 37% of the total volume of the putter 300, less than 36% of the total volume of the putter 300, less than 35% of the total volume of the putter 300, less than 34% of the total volume of the putter 300, less than 33% of the total volume of the putter 300, less than 32% of the total volume of the putter 300, less than 31% of the total volume of the putter 300, less than 30% of the total volume of the putter 300, less than 29% of the total volume of the putter 300, less than 28% of the total volume of the putter 300, or less than 27% of the total volume of the putter 300.

Although the lower portion 308 comprises less than half of the volume of the putter 300, the lower portion 308 comprises at least 45% of an overall mass of the putter 300. In some embodiments, the lower portion 308 comprises at least 46% of the mass of the putter 300, at least 46% of the mass of the putter 300, at least 47% of the mass of the putter 300, at least 48% of the mass of the putter 300, at least 49% of the mass of the putter 300, at least 50% of the mass of the putter 300, at least 51% of the mass of the putter 300, at least 52% of the mass of the putter 300, at least 53% of the mass of the putter 300, at least 54% of the mass of the putter 300, or at least 55% of the overall mass of the putter 300.

The beneficial shift of mass to the periphery of the putter head 300 increases the MOI of the putter 300, over a putter with the same volume, mass, and single material construction (i.e., a putter milled of a single stainless steel block, or a putter investment cast of a single material).

d. Semi-Circular Embodiment

Figure 4B:
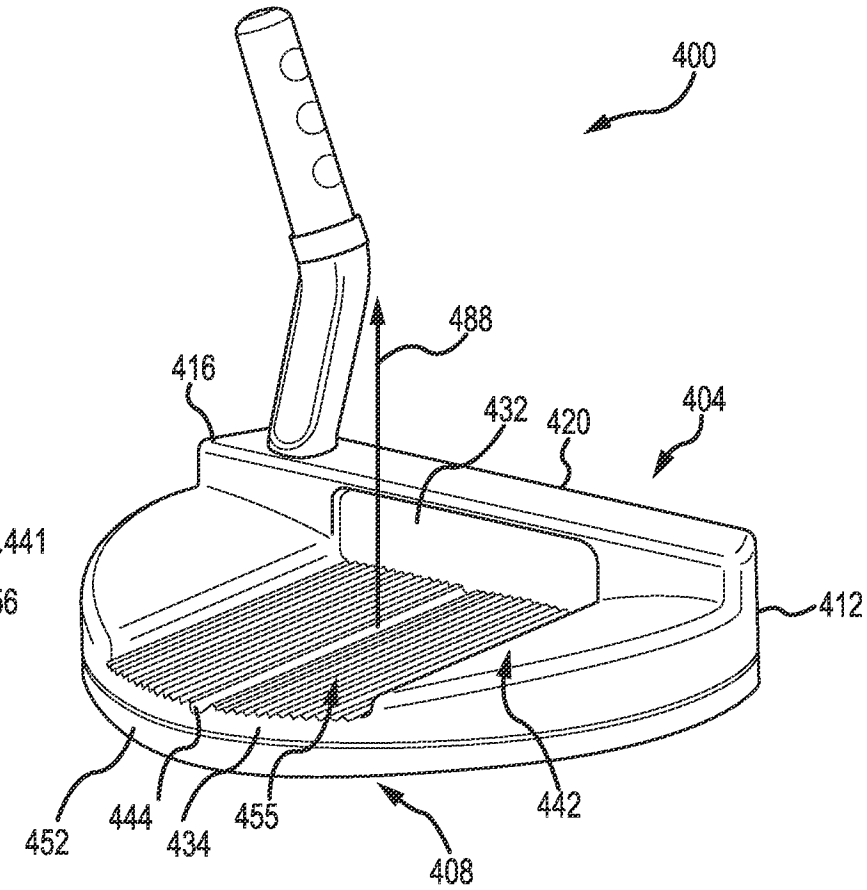
FIG. 4B illustrates an isometric view of the semi-circular putter type golf club head of FIG. 4A.
Figure 4A:
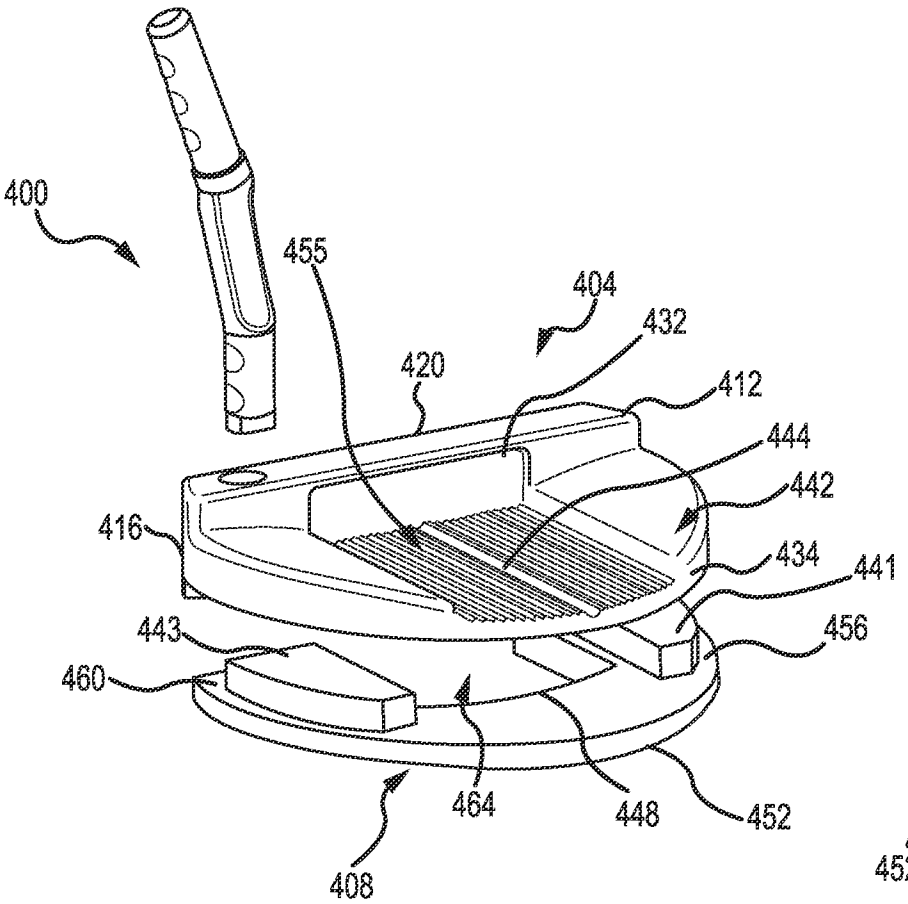
FIG. 4A illustrates an exploded view of a semi-circular putter type golf club head.
Figure 4C:
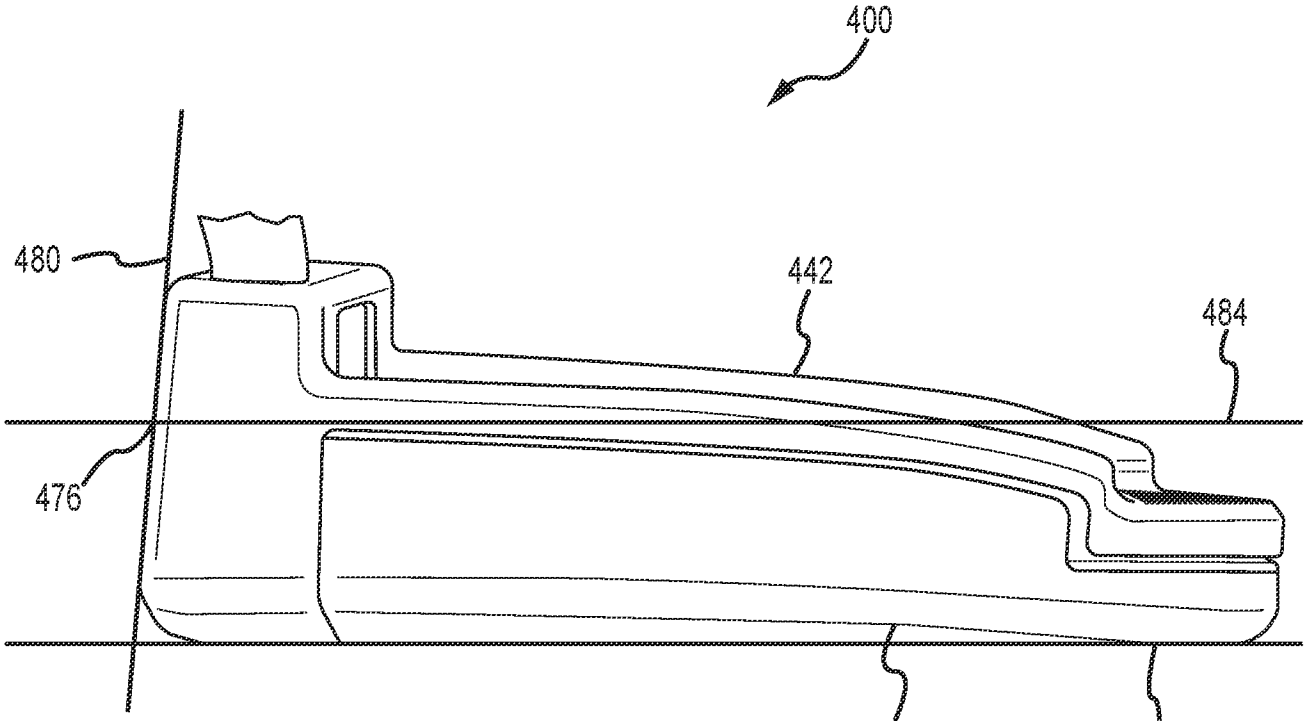
FIG. 4C illustrates a side view of the semi-circular putter type golf club head of FIG. 4A.
Figure 5B:
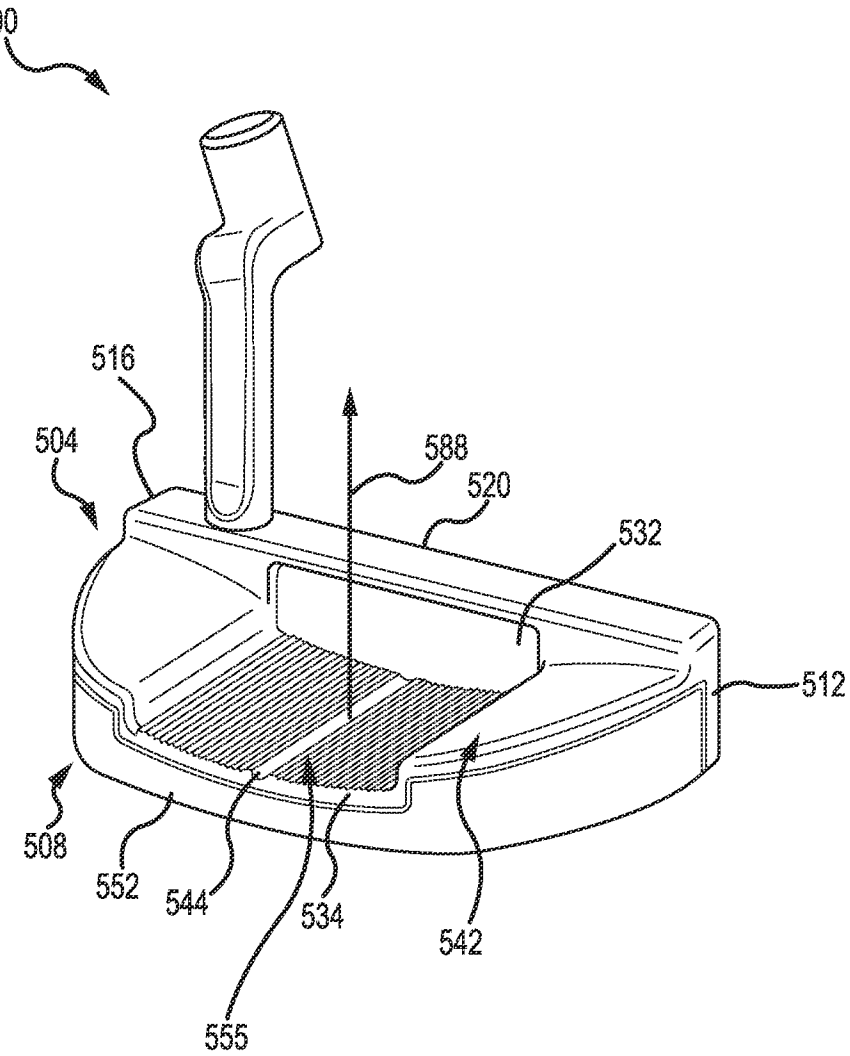
FIG. 5B illustrates an isometric view of the semi-circular putter type golf club head of FIG. 5A.
Figure 5A:
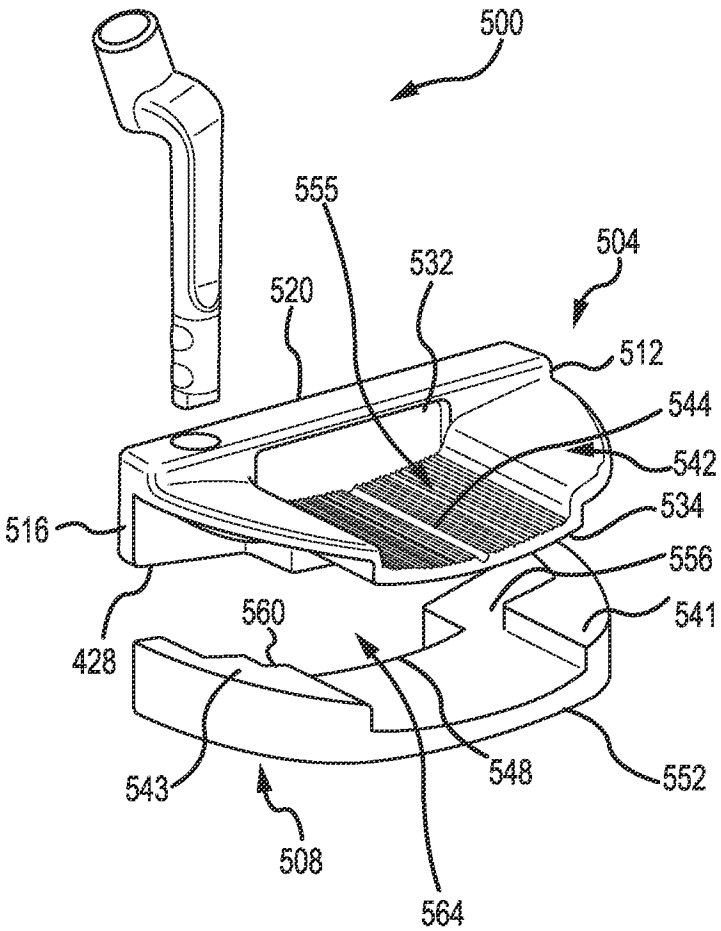
FIG. 5A illustrates an exploded view of another semi-circular putter type golf club head.
Figure 5C:
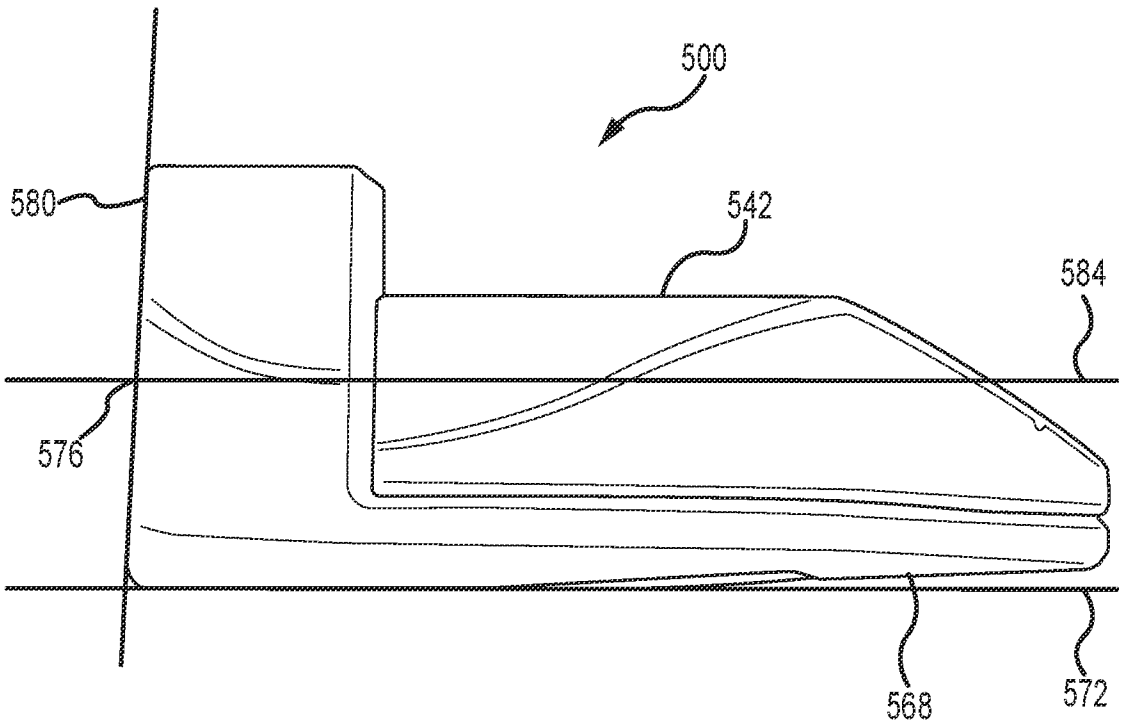
FIG. 5C illustrates a side view of the semi-circular putter type golf club head of FIG. 5A.

In one embodiment, the putter-type golf club head can be a semi-circular shaped putter head 400. Referring to FIG. 4A-4C, the semi-circular putter head 400 has an upper portion 404 and a lower portion 408. The upper portion 404 is made from a first material have a first density and the lower portion 408 is made from a second material having a second density. The first density is less than the second density. The upper portion 404 and lower portion 408 combine to create a high-MOI putter head 400 (5000 $g \cdot cm^2$-6500 $g \cdot cm^2$), while maintaining a desirable volume and mass.

As discussed above, the lower portion 408 is comprised of a high-density material (i.e., the second material). The lower portion 408 comprises a front edge 448, a rear periphery 452, a toe side span 456, and a heel side span 460. The lower portion 408 and an under surface of the top portion 404 combine to create a sole 468. The front edge 448 is adjacent to the toe side span 456 and the heel side span 460, and opposite to the rear periphery 452. The toe side span 456 is adjacent to the front edge 448 and the rear periphery 452, and opposite and to the heel side span 460. The heel side span 460 is also adjacent to the front edge 448 and the rear periphery 452, but opposite to the toe side span 456. The toe side span 456 and heel side span 460, extend beyond the rear periphery 448 of the upper portion 404. In some embodiments, the heel side span 460 and toe side span 456 can be parallel, while in some embodiments, the heel side span 460 and toe side span 456 are not parallel. In some embodiments, the rear periphery 452 and front edge 448 can be parallel, while in some embodiments, the rear periphery 452 and front edge 448 are not parallel. In this embodiment, the rear periphery 452 is approximately semi-circular, thus the rear periphery 452 and front edge 448 are not parallel.

In most embodiments, the toe side span 456 extends perpendicularly from the front edge 448, such that a right angle (90° angle) is formed at the junction of the toe side span 456 and the front edge 448. However, in other embodiments, the toe side span 456 can extend from the front edge 448 in any direction, such that any angle (0°-180°) can be formed at the junction of the toe side span 456 and the front edge 448. Further, in most embodiments, the heel side span 460 extends perpendicularly from the front edge 448, such that a right angle (90° angle) is formed at the junction of the heel side span 460 and the front edge 448. However, in other embodiments, the heel side span 460 can extend from the front edge 448 in any direction, such that any angle (0°-180°) can be formed at the junction of the heel side span 460 and the front edge 448.

The front edge 448, toe side span 456, and heel side span 460 form a gap 464. The gap 464 is bounded by the front edge 448, the toe side span 456, and the heel side span 460. The gap 464 formed by the front edge 448, the toe side span 456, and the heel side span 460 shifts a majority of the volume and mass of the putter to the extremities of the lower portion 408. The gap 464 can comprise any shape, however in one embodiment the gap is approximately rectangular. In other embodiments, the gap 464 can be circular, curvilinear, triangular, trapezoidal, parabolic, golf ball shaped, square, or any other desired geometric shape.

The upper portion 404 of the putter head 400 comprises a toe end 412, a heel end 416, a strike face 420, a rear wall 432, a back edge 434, a crown 442, and an under surface (not pictured). The toe end 412 is opposite the heel end 416. The strike face 420 spans from the toe end 412 to the heel end 416 and is opposite the rear wall 432. The rear wall 432 is opposite, and approximately parallel to the strike face 420. The crown 442 extends away from the strike face 420 to the back edge 434 of the upper portion 404. Furthermore, the under surface is opposite the crown 442, spanning from the strike face 420 to the back edge 434.

The crown 442 further descends from the strike face 420 to the back edge 434. Additionally, the crown 442 extends away from the strike face 420, over the front edge 448 of lower portion 408, and to the back edge 434 of the upper portion 404. The crown 442, in most embodiments, spans approximately inward 25% of the total club head 400 width from the toe side span 456 and spans approximately inward 25% of the total club head 400 width from the heel side span 460. In other embodiments, the crown 442 can, continuously or discontinuously, span the entire width of the total club head 400, in a heel to toe direction. In some embodiments, the crown 442, can span less than 90% of the total width of the club head 400, less than 90% of the total width of the club head 400, less than 80% of the total width of the club head 400, less than 70% of the total width of the club head 400, less than 60% of the total width of the club head 400, less than 50% of the total width of the club head 400, less than 40% of the total width of the club head 400, or less than 30% of the total width of the club head 400. Further, in some embodiments, the crown 442 can be substantially flat from the strike face 420 to the back edge 434 or ascend from the strike face 420 to the back edge 434. In most embodiments, the ascent or descent of the crown 442 can be linear, curvilinear, parabolic, sinusoidal, or a function of polynomial.

The crown 442 further comprises an alignment trough 455, wherein the alignment trough 455 is equidistant from the heel end 416 and the toe end 412. The alignment trough 455 is adjacent the rear wall 432 and approximately perpendicular to the strike face 420. The alignment trough 455 is bounded by the back edge 434, the rear wall 432, and the crown 442 on the heel end 416 and the toe end 412. In most embodiments, the alignment trough 455 is approximately the width of a golf ball (approximately 4.27 cm or 1.68 inches) to provide the viewer a visual alignment field that extends the width of the golf ball.

Furthermore, the upper portion 404 of the putter head 400 can comprise one or more alignment features 444 on the crown 442. The alignment feature 444 can be any one or combination of the following: a line, a series of lines, milling troughs, a circle, a dashed line, a triangle, a channel, or any other desired alignment feature 444. The alignment features 444 can be equally spaced on the entire crown 442, a portion of the crown 442, or the alignment trough 455. The alignment features 444, extending along the alignment trough 455, function to provide the viewer a visual alignment field that extends the width of the golf ball, from the rear wall 432 to the back edge 434 of the putter 400. The goal is to align the entire putter 400 with the golf ball using these alignment features 444 along the crown 442 and/or the alignment trough 455.

Referring to FIG. 4C, the upper portion 404 is affixed to the lower portion 408 such that the upper portion 404 is further from a ground plane 472 than the lower portion 408, wherein the ground plane 472 is tangent to the lower portion 404, when the putter head 400 is at an address position to strike a golf ball.

Further, the strike face 420 of the putter head 400 comprises a strike face center point 476 and a loft plane 480. The strike face center point 476 is equidistant from the crown 442 and the undersurface of the upper portion 404, as well as equidistant from the heel end 416 and toe end 412 of the putter head 400. The loft plane 480 is tangent to the strike face 420 of the putter head 400. Further, a midplane 484 intersects the strike face center point 476 and is perpendicular to the loft plane 480. Furthermore, a y-axis 488 intersects the midplane 484, and is perpendicular to the ground plane 472.

When the upper portion 404 and lower portion 408 are joined such that the heel end 416 overlays at least a portion of the toe side span 456. Further, when the upper portion 404 and lower portion 408 are joined such that the toe end 412 overlays at least a portion of the heel side span 460. Further still, when the upper portion 404 and lower portion 408 are joined such that the strike face 420 overlays at least a portion of the front edge 448. Finally, the upper portion 404 and lower portion 408 are joined such that the back edge 434 overlays at least a portion of the rear periphery 452.

The rear periphery 452 can be curvilinear spanning from the heel side 416 to the toe side 416. The rear periphery 452 comprises a curve length measured along the rear periphery 452 from the junction between the heel side 416 and the rear periphery 452 to the junction between the toe side 416 and the rear periphery 452. In some embodiments, the rear periphery 452 curve length can be between 4.5 inches and 8.0 inches. In some embodiments, the rear periphery 452 curve length can be 4.5 inches-4.75 inches, 4.75 inches-5.0 inches, 5.0 inches-5.25 inches, 5.25 inches-5.5 inches, 5.5 inches-5.75 inches, 5.75 inches-6.0 inches, 6.0 inches-6.25 inches, 6.25 inches-6.5 inches, 6.5 inches-6.75 inches, 6.75 inches-7.0 inches, 7.25 inches-7.50 inches, 7.50 inches-7.75 inches, or 7.75 inches-8.0 inches.

The front edge 448, rear periphery 452, toe side span 456, and heel side span 460 of the lower portion 408, combined with the upper portion 404, create the sole 468. The sole 468 is perpendicular to the ground plane 472, wherein the ground plane 472 is tangent to the sole 468, when the putter head 400 is at an address position to strike a golf ball. The sole 468 of the putter head 400 extends from the toe end 412 of the putter head 400 to the heel end 416 of the putter head 400.

In most embodiments, the sole 468 of the putter head 400 can be perfectly flat. In some embodiments, the sole 468 of the putter head 400 can have a slight arch in a heel 416 to toe 412 direction, wherein the slight arch can be linear, or a function of a polynomial. In some embodiments, the sole 468 of the putter head 400 can have a strong arch in the heel 416 to toe 412 direction, wherein the strong arch can be linear, or a function of a polynomial. The sole 468 functions to provide a surface to rest the putter head 400 on the ground plane 472.

Referring to FIG. 4A, in one embodiment, the lower portion 408 can further comprise a front toe mass 441 and a front heel mass 443. The front toe mass 441, front heel mass 443 are integral to the lower portion 408. The front toe mass 441 and front heel mass 443 extend from the lower portion 408, in a direction away from the ground plane 472, and toward the upper portion 404. These mass portions provide a means to position and align the upper portion 404 with the lower portion 408 of the putter head 400. Furthermore, these mass portions (i.e., the front toe mass 441 and front heel mass 443) provide an additional means of adding weight to the perimeters for increasing the MOI of the putter 400 over putters without these mass features. These mass features can have weight that range from 2-5 grams, 3-7 grams or 1-6 grams. The mass features can have all the same weight or be different weight within the ranges provided above. The mass features can be 1 gram, 2 grams, 3 grams, 4 grams, 5 grams, 6 grams, or 7 grams. The front toe mass 441 and a front heel mass 443 can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape.

In FIG. 4A, the front toe mass 441 and front heel mass 443 are positioned away from the rear periphery 452, wherein the front toe mass 441 and front heel mass 443 do not touch or intersect with the rear periphery 452. However, referring to FIG. 5A-5C, an alternate semi-circular shaped putter 500 is illustrated below. Putter 500 comprises the same features as putter 400, however the front toe mass 541 and front heel mass 543 of putter 500, are positioned on the rear periphery 552, wherein the front toe mass 541 and front heel mass 53 are integral to and intersect the rear periphery 452.

In one embodiment, the front toe mass 441 is positioned on the front edge 448, at the junction of the toe side span 456 and the front edge 448, however in other embodiments the front toe mass 441 can be positioned anywhere along the toe side span 456. In one embodiment, the front heel mass 443, is positioned on the front edge 448, at the junction of the heel side span 460 and the front edge 448, however in other embodiments the front heel mass 443 can be positioned anywhere along the heel side span 460.

The front toe mass 441 and front heel mass 443 provide areas of concentrated mass, such that each mass 441, 443 function to increase the moment of inertia of the putter head 400. The placement of each mass 441, 443 on the front edge 448 and spans 456, 460 increases the MOI since each mass 441, 443 since each mass is farther from a center of gravity of the putter 400. Each mass 441, 443 on the periphery 448 and spans 456, 460 is integrally formed from the second material, wherein the second material is denser than the first material.

The front toe mass 441 and front heel mass 443 offer dual functionalities, such that the front toe mass 441 and front heel mass 443 function not only to increase the MOI of the putter 400 but provide additional surfaces for the upper portion 404 to join to the lower portion 408. Therefore, the front toe mass 441 can also be referred to as a front toe adhesion portion 441 and the front heel mass 443 can also be referred to as a front heel adhesion portion 443.

In some embodiments, the under surface, strike face 420, and rear wall 432 of the upper portion 408, can form a first cavity (not shown). The first cavity extends inwards from the under surface, on the toe end 412, towards the crown 442 but does not reach the crown 442. The first cavity is bounded by the rear wall 432, the strike face 420, and the toe 412. The first cavity functions to receive the front toe mass 441 of the lower portion 408.

In some embodiments, the under surface, strike face 420, and rear wall 432 of the upper portion 408, can form a second cavity (not shown). The second cavity extends inwards from the under surface, on the heel end 416, towards the crown 442 but does not reach the crown 442. The second cavity is bounded by the rear wall 432, the strike face 420, and the heel 416. The second cavity functions to receive the front heel mass 443 of the lower portion 408.

The first and second cavity can comprise any desired geometry, however in most embodiments, the first and second cavity comprise a geometry similar or identical to that of the front toe mass 441 and the front heel mass 443. Further, when the upper portion 704 is affixed to the lower portion 408, the first cavity is positioned such that the first cavity encompasses the front toe mass 441, and the second cavity is positioned such that the second cavity encompasses the front heel mass 443.

The combination of the low density first material upper portion 404 with the high density second material lower portion 408, creates a high MOI putter 400, without creating an extremely heavy putter. The large gap 464 formed by the rear periphery 452 and the spans 456, 460 of the lower portion 408 forms a dense, yet low volume portion that increases the MOI of the putter, in comparison to a putter milled from a single material. A single material putter fails to allocate high density material to the periphery, while maintaining a desirable volume (75 cc-100 cc) and mass (340 grams-385 grams).

The lower portion 408, in most embodiments, comprises less than 38% of a volume of the putter 400. In some embodiments, the lower portion 408 comprises less than 37% of the total volume of the putter 400, less than 36% of the total volume of the putter 400, less than 35% of the total volume of the putter 400, less than 34% of the total volume of the putter 400, less than 33% of the total volume of the putter 400, less than 32% of the total volume of the putter 400, less than 31% of the total volume of the putter 400, less than 30% of the total volume of the putter 400, less than 29% of the total volume of the putter 400, less than 28% of the total volume of the putter 400, or less than 27% of the total volume of the putter 400.

Although the lower portion 408 comprises less than half of the volume of the putter 400, the lower portion 408 comprises at least 45% of an overall mass of the putter 400. In some embodiments, the lower portion 408 comprises at least 46% of the mass of the putter 400, at least 46% of the mass of the putter 400, at least 47% of the mass of the putter 400, at least 48% of the mass of the putter 400, at least 49% of the mass of the putter 400, at least 50% of the mass of the putter 400, at least 51% of the mass of the putter 400, at least 52% of the mass of the putter 400, at least 53% of the mass of the putter 400, at least 54% of the mass of the putter 400, or at least 55% of the mass of the putter 400.

The beneficial shift of mass to the periphery of the putter head 400, through the use of a high density, low volume lower portion 408, increases the MOI of the putter 400, over a putter with the same volume, mass, and single material construction (i.e., a putter milled of a single stainless steel block, or a putter investment cast of a single material).

e. Winged Embodiment

Figure 6B:
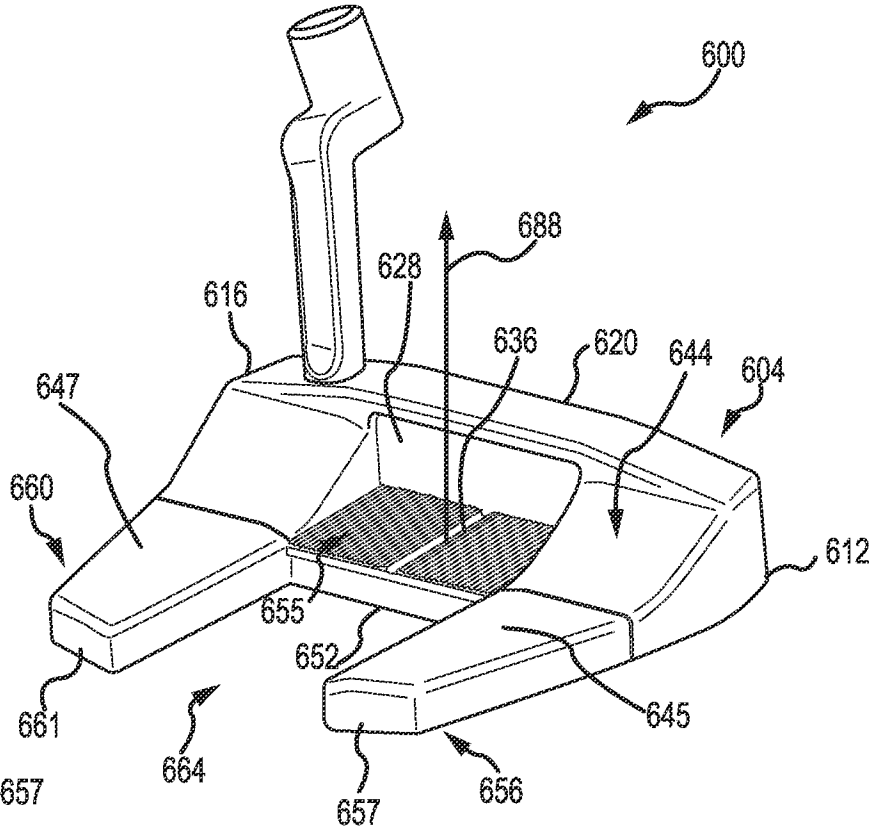
FIG. 6B illustrates an isometric view of the winged putter type golf club head of FIG. 6A.
Figure 6A:
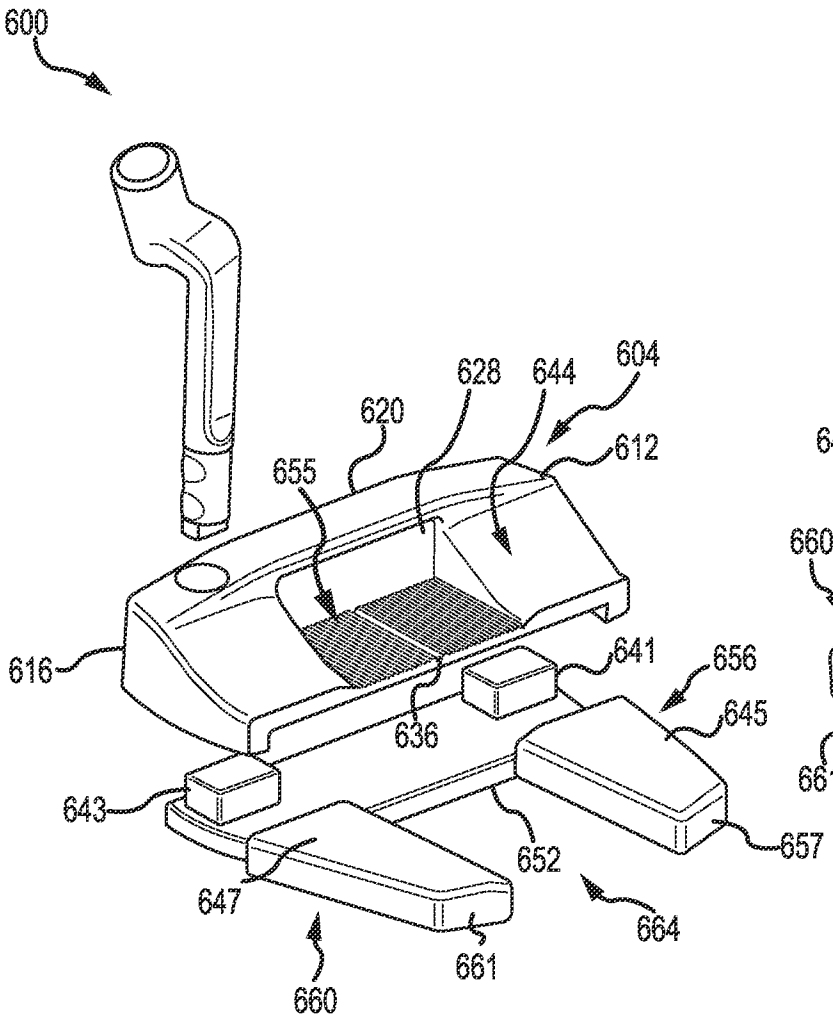
FIG. 6A illustrates an exploded view of a winged putter type golf club head.

In one embodiment, the putter-type golf club head can be a winged shaped putter head with periphery spans 600. Referring to FIGS. 6A and 6B, the winged shaped putter head 600 has a upper portion 604 and a lower portion 608. The upper portion 604 is made from a first material have a first density and the lower portion 608 is made from a second material having a second density. The first density is less than the second density. The upper portion 604 and lower portion 608 combine to create a high-MOI putter head 600 (5000 g·cm$^2$-6500 g·cm$^2$), while maintaining a desirable volume and mass.

As discussed above, the lower portion 608 is comprised of a high-density material (i.e., the second material). The lower portion 608 comprises a front periphery 648, a sole 668, a rear periphery 652, a toe side wing 656, and a heel side wing 660. As discussed below, FIG. 6C, the front periphery 648, rear periphery 652, toe side wing 656, and heel side wing 660 of the lower portion 608, combined with the upper portion 604, create a sole 668. The front periphery 648 is adjacent to the toe side periphery 656 and the heel side periphery 660, and opposite to the rear periphery 652. The toe side wing 656 is adjacent to the front periphery 648 and the rear periphery 652, and opposite to the heel side wing 660. The heel side wing 660 is also adjacent to the front periphery 648 and the rear periphery 652, but opposite to the toe side wing 656. The toe side wing 656 and heel side wing 660, extend beyond the rear periphery 648 of the upper portion 604. In some embodiments, the heel side wing 660 and toe side wing 656 can be parallel, while in some embodiments, the heel side wing 660 and toe side wing 656 are not parallel. In some embodiments, the rear periphery 652 and front periphery 648 can be parallel, while in some embodiments, the rear periphery 652 and front periphery 648 are not parallel.

In most embodiments, the toe side wing 656 extends perpendicularly from the rear periphery 652, such that a right angle (90° angle) is formed at the junction of the toe side wing 656 and the rear periphery 652. However, in other embodiments, the toe side wing 656 can extend from the rear periphery 652 in any direction, such that any angle (0°-180°) can be formed at the junction of the toe side wing 656 and the rear periphery 652. Further, in most embodiments, the heel side wing 660 extends perpendicularly from the rear periphery 652, such that a right angle (90° angle) is formed at the junction of the heel side wing 660 and the rear periphery 652. However, in other embodiments, the heel side wing 660 can extend from the rear periphery 652 in any direction, such that any angle (0°-180°) can be formed at the junction of the heel side wing 660 and the rear periphery 652.

The front periphery 648, of the lower portion 608, comprises a front width. The front width is measured from the junction of the toe side wing 656 and the front periphery 648, to the junction of the heel side wing 660 and the front periphery 648. Further, the lower portion 608, comprises a rear width. The rear width is measured from a tip 657 of the toe side wing 656 and a tip 661 of a toe side wing 660, wherein the tip 657 is the point of the toe side wing 656 furthest from the front periphery 648 and the tip 661 is the point of the heel side wing 660 furthest from the front periphery 648. In most embodiments, the front width is greater than the rear width, however in some embodiments, the front width can be equal to or less than the rear width.

The rear periphery 652, toe side wing 656, and heel side wing 660 form a gap 664. The gap 664 is bounded by the rear periphery 652, the toe side wing 656, and the heel side wing 660. The gap 664 formed by the rear periphery 652, the toe side wing 656, and the heel side wing 660 shifts a majority of the volume and mass of the putter to the extremities of the lower portion 608. The gap 664 can comprise any shape, however in one embodiment the gap is approximately rectangular. In other embodiments, the gap 664 can be circular, curvilinear, triangular, trapezoidal, parabolic, golf ball shaped, square, or any other desired geometric shape.

The upper portion 604 of the putter head 600 comprises a toe end 612, a heel end 616, a strike face 620, a rear wall 632, a back edge 634, a crown 642, and an under surface (not pictured). The toe end 612 is opposite the heel end 616. The strike face 620 spans from the toe end 612 to the heel end 616 and is opposite the rear wall 632. The rear wall 632 is opposite, and approximately parallel to the strike face 620. The crown 642 extends away from the strike face 620 and to the back edge 634 of the upper portion 604. Furthermore, the under surface is opposite the crown 642, spanning from the strike face 620 to the back edge 634.

The crown 642 further descends from the strike face 620 to the back edge 634. Additionally, the crown 642 extends away from the strike face 620, over the front periphery 648 of lower portion 608, and to the back edge 634 of the upper portion 604. The crown 642, in most embodiments, spans approximately inward 25% of the total club head 600 width from the toe side wing 656 and spans approximately inward 25% of the total club head 600 width from the heel side wing 660. In other embodiments, the crown 642 can, continuously or discontinuously, span the entire width of the total club head 600, in a heel to toe direction. In some embodiments, the crown 642, can span less than 90% of the total width of the club head 600, less than 90% of the total width of the club head 600, less than 80% of the total width of the club head 600, less than 70% of the total width of the club head 600, less than 60% of the total width of the club head 600, less than 50% of the total width of the club head 600, less than 40% of the total width of the club head 600, or less than 30% of the total width of the club head 600. Further, in some embodiments, the crown 642 can be substantially flat from the strike face 620 to the back edge 634 or ascend from the strike face 620 to the back edge 634. In most embodiments, the ascent or descent of the crown 642 can be linear, curvilinear, parabolic, sinusoidal, or a function of polynomial.

The crown 642 further comprises an alignment trough 655, wherein the alignment trough 655 is equidistant from the heel end 616 and the toe end 612. The alignment trough 655 is adjacent the rear wall 632 and approximately perpendicular to the strike face 620. The alignment trough 655 is bounded by the back edge 634, the rear wall 632, and the crown 642 on the heel end 616 and the toe end 612. In most embodiments, the alignment trough is approximately the width of a golf ball (approximately 4.27 cm) to provide the viewer a visual alignment field that extends the width of the golf ball.

Furthermore, the upper portion 604 of the putter head 600 can comprise one or more alignment features 644 on the crown 642. The alignment feature 644 can be any one or combination of the following: a line, a series of lines, milling troughs, a circle, a dashed line, a triangle, a channel, or any other desired alignment feature 644. The alignment features 644 can be equally spaced on the entire crown 642, a portion of the crown 642, or the alignment trough 655. The alignment features 644, extending along the alignment trough 655, function to provide the viewer a visual alignment field that extends the width of the golf ball, from the rear wall 632 to the back edge 634 of the putter 600. The goal is to align the entire putter 600 with the golf ball using these alignment features 644 along the crown 642 and/or the alignment trough 655.

The upper portion 604 is affixed to the lower portion 608 such that the upper portion 604 is further from a ground plane 672 than the lower portion 608, wherein the ground plane 672 is tangent to the lower portion 604, when the putter head 600 is at an address position to strike a golf ball.

Further, the strike face 620 of the putter head 600 comprises a strike face center point 676 and a loft plane 680. The strike face center point 676 is equidistant from the crown 642 and the undersurface of the upper portion 604, as well as equidistant from the heel end 616 and toe end 612 of the putter head 600. The loft plane 680 is tangent to the strike face 620 of the putter head 600. Further, a midplane 684 intersects the strike face center point 676 and is perpendicular to the loft plane 680. Furthermore, a y-axis 688 intersects the midplane 648, and is perpendicular to the ground plane 672.

When the upper portion 604 and lower portion 608 are joined such that the heel end 616 overlays at least a portion of the toe side wing 656. Further, when the upper portion 604 and lower portion 608 are joined such that the toe end 612 overlays at least a portion of the heel side wing 660. Further still, when the upper portion 604 and lower portion 608 are joined such that the strike face 620 overlays at least a portion of the front periphery 648. Finally, the upper portion 604 and lower portion 608 are joined such that the back edge 634 overlays at least a portion of the rear periphery 652.

Figure 6C:
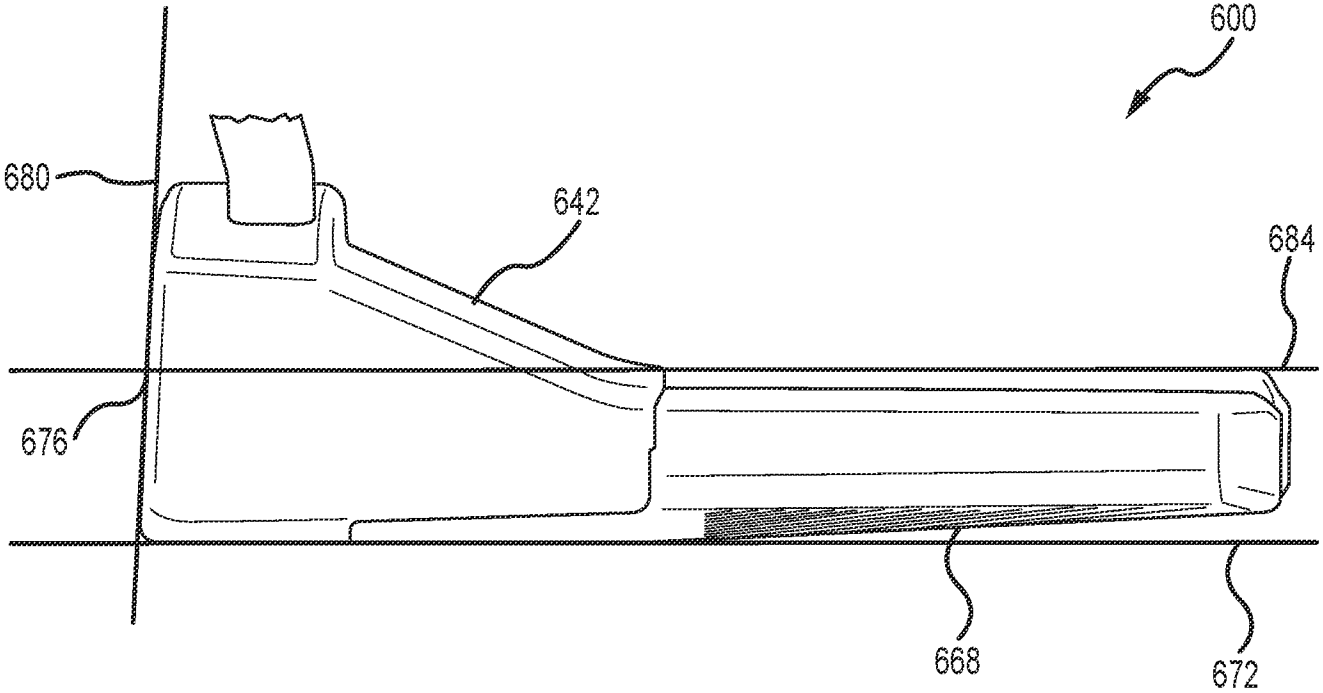
FIG. 6C illustrates a side view of the winged putter type golf club head of FIG. 6A.

Referring the FIG. 6C, the front periphery 648, rear periphery 652, toe side wing 656, and heel side wing 660 of the lower portion 608, combined with the upper portion 604, create a sole 668. The sole 668 is perpendicular to the ground plane 672, wherein the ground plane 672 is tangent to the sole 668, when the putter head 600 is at an address position to strike a golf ball. The sole 668 of the putter head 600 extends from the toe end 612 of the putter head 600 to the heel end 616 of the putter head 600.

In most embodiments, the sole 668 of the putter head 600 can be perfectly flat. In some embodiments, the sole 668 of the putter head 600 can have a slight arch in a heel 616 to toe 612 direction, wherein the slight arch can be linear, or a function of a polynomial. In some embodiments, the sole 668 of the putter head 600 can have a strong arch in the heel 616 to toe 612 direction, wherein the strong arch can be linear, or a function of a polynomial. The sole 668 functions to provide a surface to rest the putter head 600 on the ground plane 672.

Referring to FIG. 6A, in one embodiment, the lower portion 608 can further comprise a front toe mass 641, a front heel mass 643, a toe wing mass 645, and a heel wing mass 647. The front toe mass 641, front heel mass 743, toe wing mass 645, and heel wing mass 647 are integral to the lower portion 608. The front toe mass 641, front heel mass 643, toe wing mass 645, and heel wing mass 647 extend from the lower portion 608, in a direction away from the ground plane 672, and toward the upper portion 604. These mass portions provide a means to position to upper portion 604 and align with the lower portion 608 of the putter head 600. Furthermore, these mass portions (i.e., the front toe mass 641, front heel mass 643, toe wing mass 645, and heel wing mass 647) provide an additional means of adding weight to the perimeters for increasing the MOI of the putter 600 over putters without these mass features. These mass features can have weight that range from 2-5 grams, 3-7 grams or 1-6 grams. The mass features can have all the same weight or be different weight within the ranges provided above. The mass features can be 1 gram, 2 grams, 3 grams, 4 grams, 5 grams, 6 grams, or 7 grams. The front toe mass 641, a front heel mass 643, a toe wing mass 645, and a heel wing mass 647 can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape.

In one embodiment, the front toe mass 641 is positioned on the front periphery 648, at the junction of the toe wing 656 and the front periphery 648, however in other embodiments the front toe mass 641 can be positioned anywhere along the front periphery 648. In one embodiment, the front heel mass 643, is positioned on the front periphery 648, at the junction of the heel wing 660 and the front periphery 648, however in other embodiments the front heel mass 643 can be positioned anywhere along the front periphery 648. In one embodiment, the toe wing mass 645 can be positioned over a portion of toe side wing 656, however in other embodiments the toe wing mass 645 can be positioned anywhere along a portion of, or the entire, toe side wing 656. In one embodiment, the heel wing mass 647 can be positioned over a portion of the heel side wing 660, however in other embodiments the heel wing mass 647 can be positioned along a portion of, or the entire, heel side wing 660.

The front toe mass 641, front heel mass 643, toe wing mass 645, and heel wing mass 647, provide areas of concentrated mass, such that each mass 641, 643, 645, and 647 function to increase the moment of inertia of the putter head 600. The placement of each mass 641, 643, 645, and 647 on the periphery 648 and wings 656, 660, increases the MOI since each mass 641, 643, 645, and 647 since each mass is farther from a center of gravity of the putter 600. Each mass 641, 643, 645, 647 on the periphery 648 and wings 656, 660 is integrally formed from the second material, wherein the second material is denser than the first material.

The front toe mass 641 and front heel mass 643 offer dual functionalities, such that the front toe mass 641 and front heel mass 643 function not only to increase the MOI of the putter 600 but provide additional surfaces for the upper portion 604 to join to the lower portion 608. Therefore, the front toe mass 641 can also be referred to as a front toe adhesion portion 641 and the front heel mass 643 can also be referred to as a front heel adhesion portion 643.

In some embodiments, the under surface, strike face 620, and rear wall 632 of the upper portion 608, can form a first cavity (not shown). The first cavity extends inwards from the under surface, on the toe end 612, towards the crown 642 but does not reach the crown 642. The first cavity is bounded by the rear wall 632, the strike face 620, and the toe 612. The first cavity functions to receive the front toe mass 641 of the lower portion 608.

In some embodiments, the under surface, strike face 620, and rear wall 632 of the upper portion 608, can form a second cavity (not shown). The second cavity extends inwards from the under surface, on the heel end 616, towards the crown 642 but does not reach the crown 642. The second cavity is bounded by the rear wall 632, the strike face 620, and the heel 616. The second cavity functions to receive the front heel mass 643 of the lower portion 608.

The first and second cavity can comprise any desired geometry, however in most embodiments, the first and second cavity comprise a geometry similar or identical to that of the front toe mass 641 and the front heel mass 643. Further, when the upper portion 604 is affixed to the lower portion 608, the first cavity is positioned such that the first cavity encompasses the front toe mass 641, and the second cavity is positioned such that the second cavity encompasses the front heel mass 643.

The combination of the low density first material upper portion 604 with the high density second material lower portion 608, creates a high MOI putter 600, without creating an extremely heavy putter. The large gap 664 formed by the rear periphery 652 and the wings 656, 660 of the lower portion 608 forms a dense, yet low volume portion that increases the MOI of the putter, in comparison to a putter milled from a single material. A single material putter fails to allocate high density material to the periphery, while maintaining a desirable volume (75 cc-100 cc) and mass (340 grams-385 grams).

The lower portion 608, in most embodiments, comprises less than 38% of a total volume of the putter 600. In some embodiments, the lower portion 608 comprises less than 37% of the total volume of the putter 600, less than 36% of the total volume of the putter 600, less than 35% of the total volume of the putter 600, less than 34% of the total volume of the putter 600, less than 33% of the total volume of the putter 600, less than 32% of the total volume of the putter 600, less than 31% of the total volume of the putter 600, less than 30% of the total volume of the putter 600, less than 29% of the total volume of the putter 600, less than 28% of the total volume of the putter 600, or less than 27% of the total volume of the putter 600.

Although the lower portion 608 comprises less than half of the volume of the putter 600, the lower portion 608 comprises at least 45% of an overall mass of the putter 600. In some embodiments, the lower portion 608 comprises at least 46% of the overall mass of the putter 600, at least 46% of the overall mass of the putter 600, at least 47% of the overall mass of the putter 600, at least 48% of the overall mass of the putter 600, at least 49% of the overall mass of the putter 600, at least 50% of the overall mass of the putter 600, at least 51% of the overall mass of the putter 600, at least 52% of the overall mass of the putter 600, at least 53% of the overall mass of the putter 600, at least 54% of the overall mass of the putter 600, or at least 55% of the overall mass of the putter 600.

The beneficial shift of mass to the periphery of the putter head 600, through the use of a high density, low volume lower portion 608, increases the MOI of the putter 600, over a putter with the same volume, mass, and single material construction (i.e., a putter milled of a single stainless steel block, or a putter investment cast of a single material).

f. Spade Embodiment

Figure 7A:
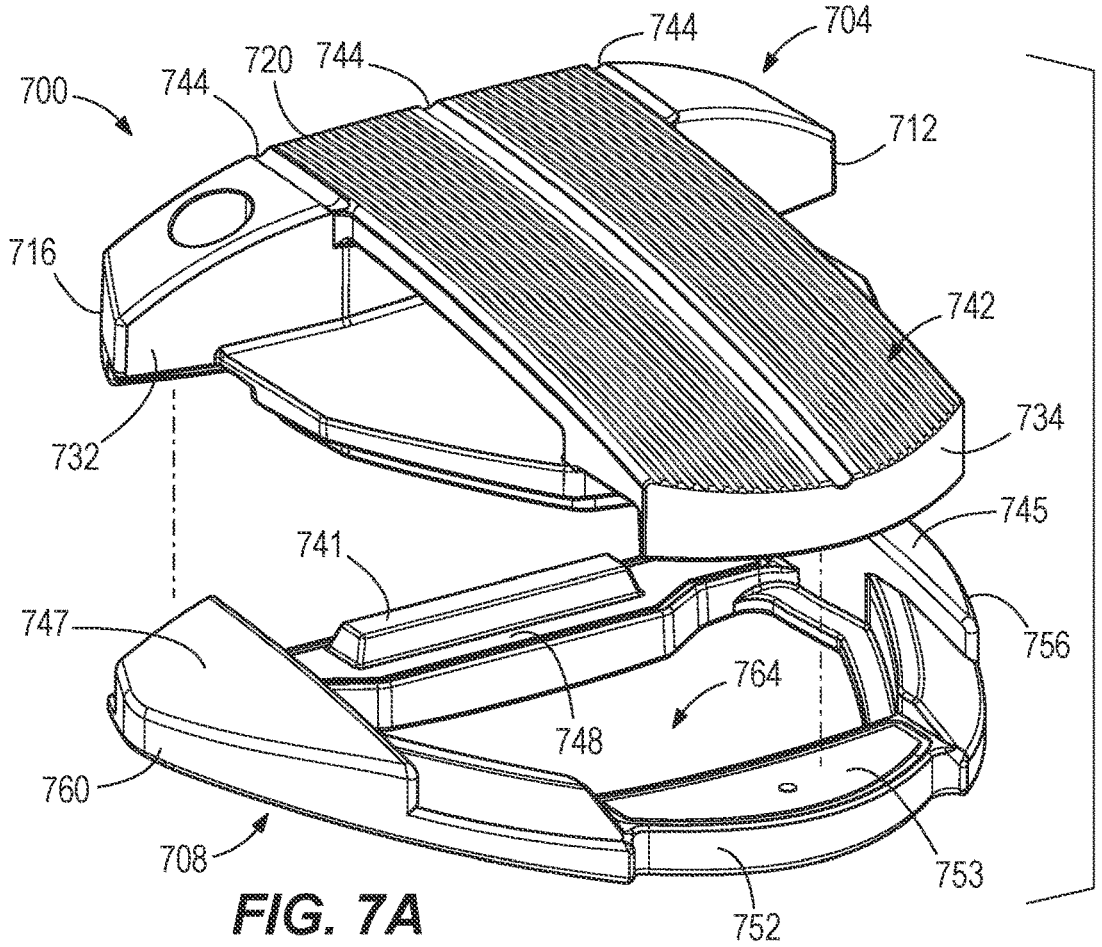
FIG. 7A illustrates an exploded view of a spade putter type golf club head.
Figure 7B:
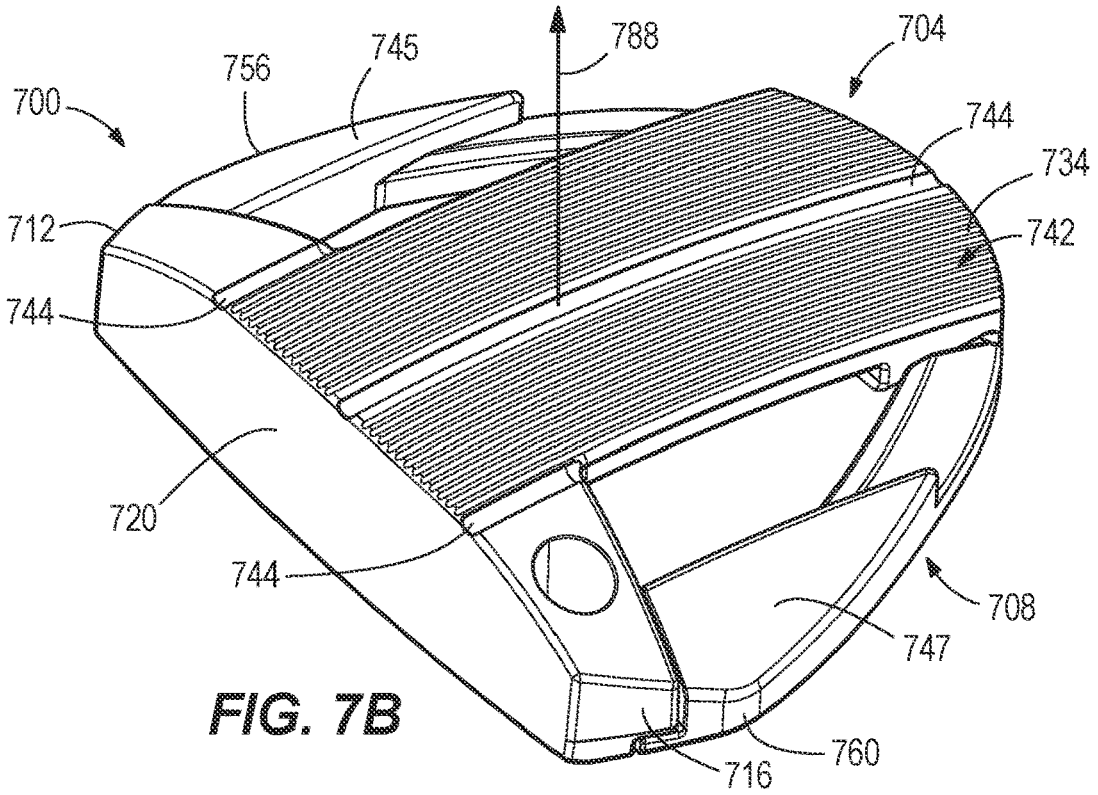
FIG. 7B illustrates an isometric view of the spade putter type golf club head of FIG. 7A.

In one embodiment, the putter-type golf club head can be a spade shaped putter head with periphery spans 700. Referring to FIGS. 7A and 7B, the spade shaped putter head 700 has a upper portion 704 and a lower portion 708. The upper portion 704 is made from a first material have a first density and the lower portion 708 is made from a second material having a second density. The first density is less than the second density. The upper portion 704 and lower portion 708 combine to create a high-MOI putter head 700 (5000 $g \cdot cm^2$-6500 $g \cdot cm^2$), while maintaining a desirable volume and mass.

As discussed above, the lower portion 708 is comprised of a high-density material (i.e., the first material), thereby lowering the mass below a midline 784. The lower portion 708 comprises a front periphery 748, a rear periphery 752, a toe side periphery 756, and a heel side periphery 760. The front periphery 748 is adjacent to the toe side periphery 756 and the heel side periphery 760, and opposite to the rear periphery 752. The toe side periphery 756 is adjacent to the front periphery 748 and the rear periphery 752, and opposite and to the heel side periphery 760. The heel side periphery 760 is also adjacent to the front periphery 748 and the rear periphery 752, but opposite to the toe side periphery 756. In some embodiments, the heel side periphery 760 and toe side periphery 756 can be parallel, while in some embodiments the heel side periphery 760 and toe side periphery 756 are not parallel. In some embodiments, the rear periphery 752 and front periphery 748 can be parallel, while in some embodiments the rear periphery 752 and front periphery 748 are not parallel.

The front periphery 748, of the lower portion 708, comprises a front width. The front width is measured from the junction of the toe side periphery 756 and the front periphery 748, to the junction of the heel side periphery 760 and the front periphery 748. Further, the rear periphery 752, of the lower portion 708, comprises a rear width. The rear width is measured from the junction of the toe side periphery 756 and the rear periphery 752, to the junction of the heel side periphery 760 and the rear periphery 752. In most embodiments, the front width is greater than the rear width, however in some embodiments, the front width can be equal to or less than the rear width.

The front periphery 748, rear periphery 752, toe side periphery 756, and heel side periphery 760, join to from an aperture 764, wherein the aperture 764 is bounded by the four peripheries (front 756, rear 752, toe side 756, and heel side 760). The four peripheries 756, 752, 756, 760, form a perimeter around the aperture 764. The central aperture 764, formed by the peripheries 756, 752, 756, 760 of the lower portion 708, shifts a majority of the volume and mass of the putter to the extremities of the lower portion 708.

The upper portion 704 of the putter head 700 comprises a toe end 712, a heel end 716, a strike face 720, a rear wall 732, a back edge 734, a crown 742, and an under surface (not pictured). The toe end 712 is opposite the heel end 716. The strike face 720 spans from the toe end 712 to the heel end 716 and is opposite the rear wall 732. The rear wall 732 is opposite, and approximately parallel to the strike face 720. The crown 742 extends away from the strike face 720, over at least a portion of the rear wall 732, and to the back edge 734 of the upper portion 704. Furthermore, the under surface is opposite the crown 742, spanning from the strike face 720 to the back edge 734.

The crown 742 further descends from the strike face 720 to the back edge 734. Additionally, the crown 742 extends away from the strike face 720, over at least a portion of the rear wall 732, the aperture 764 of the lower portion 708, and to the back edge 734 of the upper portion 704. The crown 742, in most embodiments, is inward 25% of the total club head 700 width from the toe side periphery 756 and the heel side periphery 760. In this embodiment, the crown 742 spans approximately 50% of the width of the club head 700. In other embodiments, the crown 742, can span the entire width of the total club head 700, in a heel to toe direction. In some embodiments, the crown 742, can span less than 90% of the total width of the club head 700, less than 90% of the total width of the club head 700, less than 80% of the total width of the club head 700, less than 70% of the total width of the club head 700, less than 60% of the total width of the club head 700, less than 50% of the total width of the club head 700, less than 40% of the total width of the club head 700, or less than 30% of the total width of the club head 700. Further, in some embodiments, the crown 742 can be substantially flat from the strike face 720 to the back edge 734 or ascend from the strike face 720 to the back edge 734. In most embodiments, the ascent or descent of the crown 742 can be linear, curvilinear, parabolic, sinusoidal, or a function of polynomial.

Furthermore, the upper portion 704 of the putter head 700 can comprise one or more alignment features 744 on the crown 742. The alignment feature 744 can be any one or combination of the following: a line, a series of lines, milling troughs, a circle, a dashed line, a triangle, a channel, or any other desired alignment feature 744. The alignment features 744 are equally spaced on the entire crown 742, wherein the crown is configured to be the width of a golf ball (approximately 4.27 cm). The alignment features 744, extending along the crown 742, function to provide the viewer a visual alignment field that extends the width of the golf ball, from the strike face 720 to the back edge 734 of the putter 700. The goal is to align the entire putter 700 with the golf ball using these alignment features 744 along the crown 742.

Figure 7C:
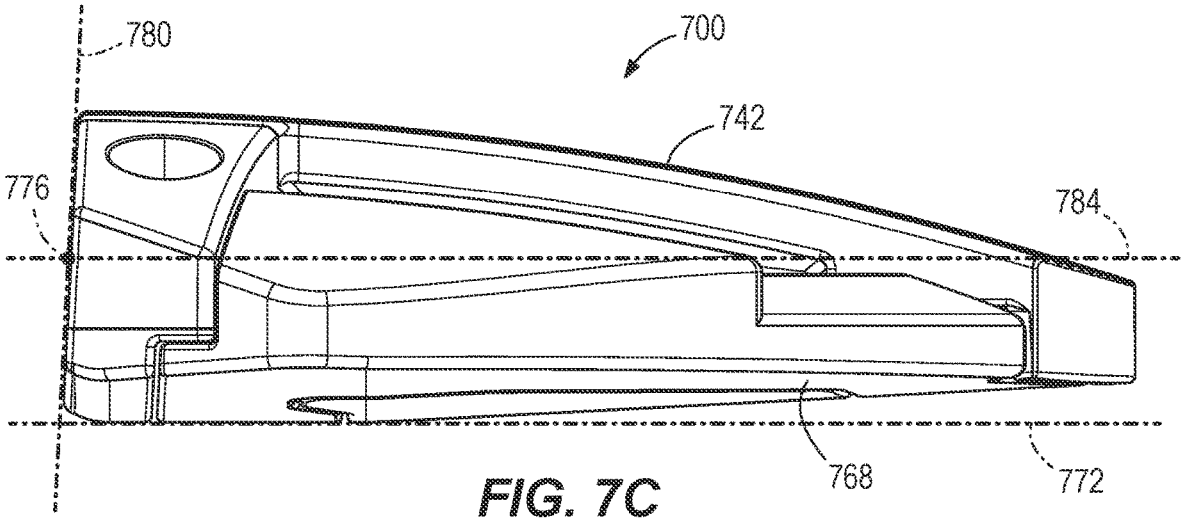
FIG. 7C illustrates a side view of the spade putter type golf club head of FIG. 7A.

Referring to FIG. 7C, the upper portion 704 is affixed to the lower portion 708 such that the upper portion 704 is further from a ground plane 772 than the lower portion 708, wherein the ground plane 772 is tangent to the lower portion 704, when the putter head 700 is at an address position to strike a golf ball.

Further, the strike face 720 of the putter head 700 comprises a strike face center point 776 and a loft plane 780. The strike face center point 776 is equidistant from the crown 742 and the undersurface of the upper portion 704, as well as equidistant from the heel end 716 and toe end 712 of the putter head 700. The loft plane 780 is tangent to the strike face 720 of the putter head 700. Further, a midplane 748 intersects the strike face center point 776 and is perpendicular to the loft plane 780. Furthermore, a y-axis 788 intersects the midplane 784, and is perpendicular to the ground plane 772.

When the upper portion 704 and lower portion 708 are joined such that the heel end 716 overlays at least a portion of the heel side periphery 760. Further, when the upper portion 704 and lower portion 708 are joined such that the toe end 712 overlays at least a portion of the toe side periphery 756. Further still, when the upper portion 704 and lower portion 708 are joined such that the strike face 720 overlays at least a portion of the front periphery 748. Finally, the upper portion 704 and lower portion 708 are joined such that the back edge 734 overlays at least a portion of the rear periphery 752.

Figure 7D:
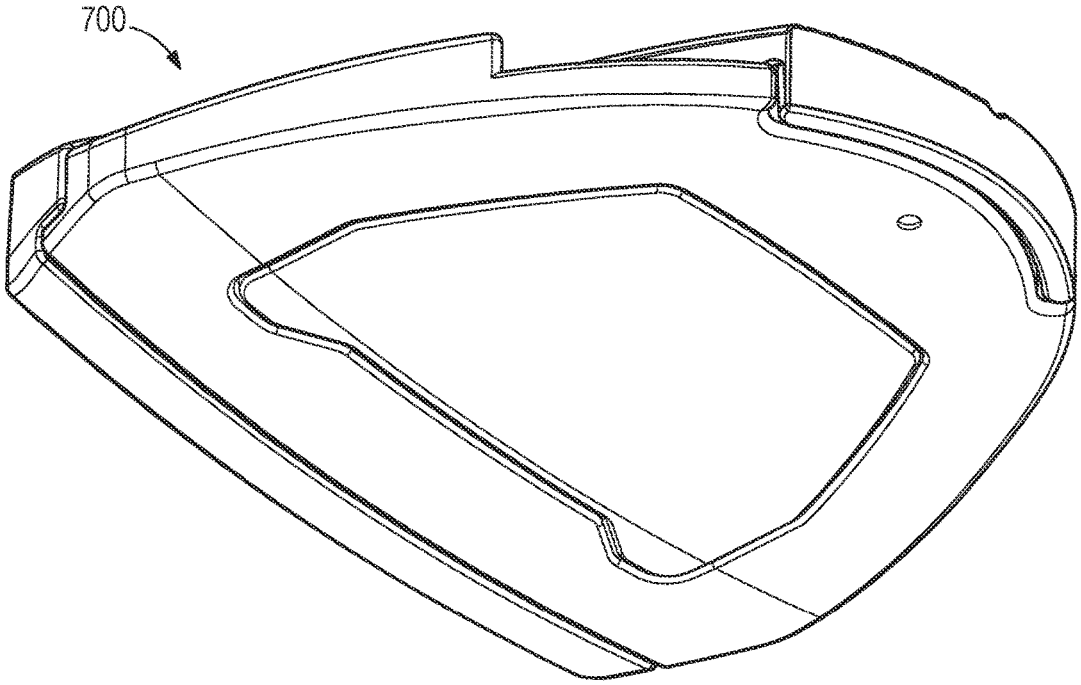
FIG. 7D illustrates a bottom perspective view of the spade putter type golf club head of FIG. 7A.

Referring to FIG. 7D, the four peripheries (front 748, rear 752, toe side 756, and heel side 760) of the lower portion 708, combined with the upper portion 704, create a sole 768. The sole 768 is perpendicular to the ground plane 772, wherein the ground plane 772 is tangent to the sole 768, when the putter head 700 is at an address position to strike a golf ball. The sole 768 of the putter head 700 extends from the toe end 712 of the putter head 700 to the heel end 716 of the putter head 700.

In most embodiments, the sole 768 of the putter head 700 can be perfectly flat. In some embodiments, the sole 768 of the putter head 700 can have a slight arch in a heel 716 to toe 712 direction, wherein the slight arch can be linear, or a function of a polynomial. In some embodiments, the sole 768 of the putter head 700 can have a strong arch in the heel 716 to toe 712 direction, wherein the strong arch can be linear, or a function of a polynomial. The sole 768 functions to provide a surface to rest the putter head 700 on the ground plane 772.

Referring to FIG. 7A, in one embodiment, the lower portion 708 can further comprise a front mass 741, a rear mass 743, a toe mass 745, and a heel mass 747. The front mass 741, rear mass 743, toe mass 745, and heel mass 747 are integral to the lower portion 708. The front mass 741, rear mass 743, toe mass 745, and heel mass 747 extend from the lower portion 708, in a direction away from the ground plane 772, and toward the upper portion 704. These mass portions provide a means to position to upper portion 704 and align with the lower portion 708 of the putter head 700. Furthermore, these mass portions (i.e., the front mass 741, rear mass 743, toe mass 745, and heel mass 747) provide an additional means of adding weight to the perimeters for increasing the MOI of the putter 700 over putters without these mass features. These mass features can have weight that range from 2-5 grams, 3-7 grams or 1-6 grams. The mass features can have all the same weight or be different weight within the ranges provided above. The mass features can be 1 gram, 2 grams, 3 grams, 4 grams, 5 grams, 6 grams, or 7 grams. The front mass 741, a rear mass 743, a toe mass 745, and a heel mass 747 can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape.

In one embodiment, the front mass 741 is positioned on the front periphery 748, is equidistance from the toe side periphery 756 and the heel side periphery 760, however in other embodiments the front mass 741 can be positioned anywhere along the front periphery 748. In one embodiment, the rear mass 743, is positioned on the rear periphery 752, equidistance from the toe side periphery 756 and the heel side periphery 760, however in other embodiments the rear mass 743 can be positioned anywhere along the rear periphery 752. In one embodiment, the toe mass 745 can be positioned at the junction of the toe side periphery 756 and the rear periphery 752, however in other embodiments the toe mass 745 can be positioned anywhere along the toe side periphery 756. In one embodiment, the heel mass 747 can be positioned at the junction of the heel side periphery 760 and the rear periphery 752, however in other embodiments the heel mass 747 can be positioned anywhere along the heel side periphery 760.

The front mass 741, a rear mass 743, a toe mass 745, and a heel mass 747, provide areas of concentrated mass, such that each mass 741, 743, 745, and 747 function to increase the moment of inertia of the putter head 700. The placement of each mass 741, 743, 745, and 747 on the peripheries 748, 752, 756, 760, increases the MOI since each mass 741, 743, 745, and 747 since each mass is farther from a center of gravity of the putter 700. Each mass 741, 743, 745, 747 on the peripheries 748, 752, 756, 760 is integrally formed from the second material, wherein the second material is denser than the first material.

The front mass 741 and the rear mass 743 offer dual functionalities, such that the front mass 741 and rear mass 743 function not only to increase the MOI of the putter 700 but provide additional surfaces for the upper portion 704 to join to the lower portion 708. Therefore, the front mass 741 can also be referred to as a front adhesion portion 741 and the rear mass 743.

In some embodiments, the under surface, strike face 720, and rear wall 732 of the upper portion 708, can form a first cavity (not shown). The first cavity extends inwards from the under surface towards the crown 742 but does not reach the crown 742. The first cavity is bounded by the rear wall 732 and the strike face 720. The first cavity functions to receive the front mass 741 of the lower portion 708.

In some embodiments, the under surface, the back edge 734, and the crown 742 forms a second cavity (not shown). The second cavity extends inwards from the under surface, towards the crown 742, but does not reach the crown 742. The second cavity is bounded by the back edge 734, and the crown 732. In most embodiments, the second cavity is positioned equidistance between the toe side periphery 756 and the heel side periphery 760, when the lower portion 708 is joined to the upper portion 704. The second cavity functions to receive the rear mass 743 of the lower portion 708.

The first and second cavity can comprise any desired geometry, however in most embodiments, the first and second cavity comprise a geometry similar or identical to that of the front mass 741 and the rear mass 743. Further, when the upper portion 704 is affixed to the lower portion 708, the first cavity is positioned such that the first cavity encompasses the front mass 741, and the second cavity is positioned such that the second cavity encompasses the rear mass 743.

The combination of the low density first material upper portion 704 with the high density second material lower portion 708, creates a high MOI putter 700, without creating an extremely heavy putter. The large aperture 764 formed by the peripheries 748, 752, 756, 760 of the lower portion 708 forms a dense, yet low volume portion that increases the MOI of the putter, in comparison to a putter milled from a single material. A single material putter fails to allocate high density material to the periphery, while maintaining a desirable volume (75 cc-100 cc) and mass (340 grams-385 grams).

The lower portion 708, in most embodiments, comprises less than 35% of a total volume of the putter 700. In some embodiments, the lower portion 708 comprises less than 34% of the total volume of the putter 700, less than 33% of the total volume of the putter 700, less than 32% of the total volume of the putter 700, less than 31% of the total volume of the putter 700, less than 30% of the total volume of the putter 700, less than 29% of the total volume of the putter 700, less than 28% of the total volume of the putter 700, or less than 27% of the total volume of the putter 700.

Although the lower portion 708 comprises less than half of the volume of the putter 700, the lower portion 708 comprises at least 45% of an overall mass of the putter 700. In some embodiments, the lower portion 708 comprises at least 46% of the mass of the putter 700, at least 47% of the mass of the putter 700, at least 48% of the mass of the putter 700, at least 49% of the mass of the putter 700, at least 50% of the mass of the putter 700, at least 51% of the mass of the putter 700, at least 52% of the mass of the putter 700, at least 53% of the mass of the putter 700, at least 54% of the mass of the putter 700, or at least 55% of the mass of the putter 700.

The beneficial shift of mass to the periphery of the putter head 700, through the use of a high density, low volume lower portion 708, increases the MOI of the putter 700, over a putter with the same volume, mass, and single material construction (i.e., a putter milled of a single stainless steel block, or a putter investment cast of a single material).

g. T-Shaped Embodiment with Periphery Spans

Figure 8A:
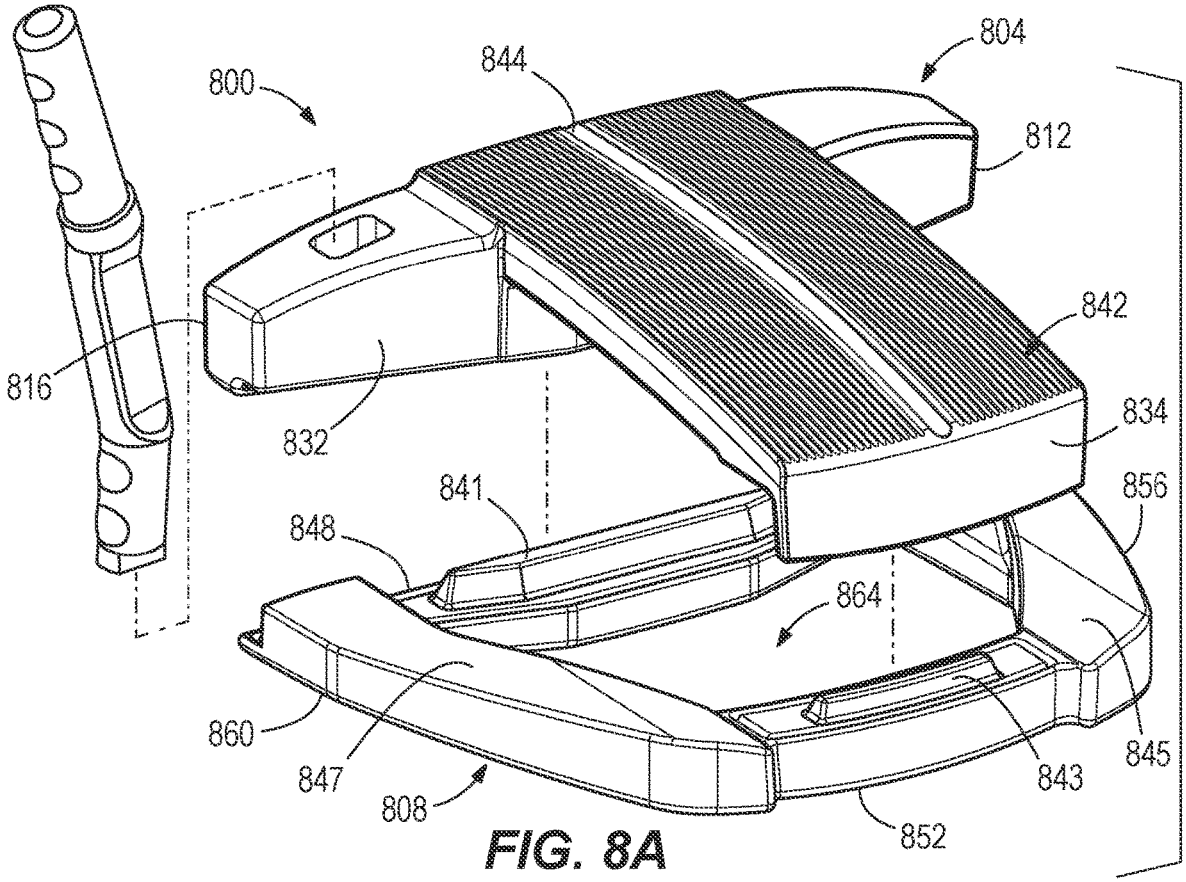
FIG. 8A illustrates an exploded view of a T-shaped putter type golf club head with periphery spans.
Figure 8B:
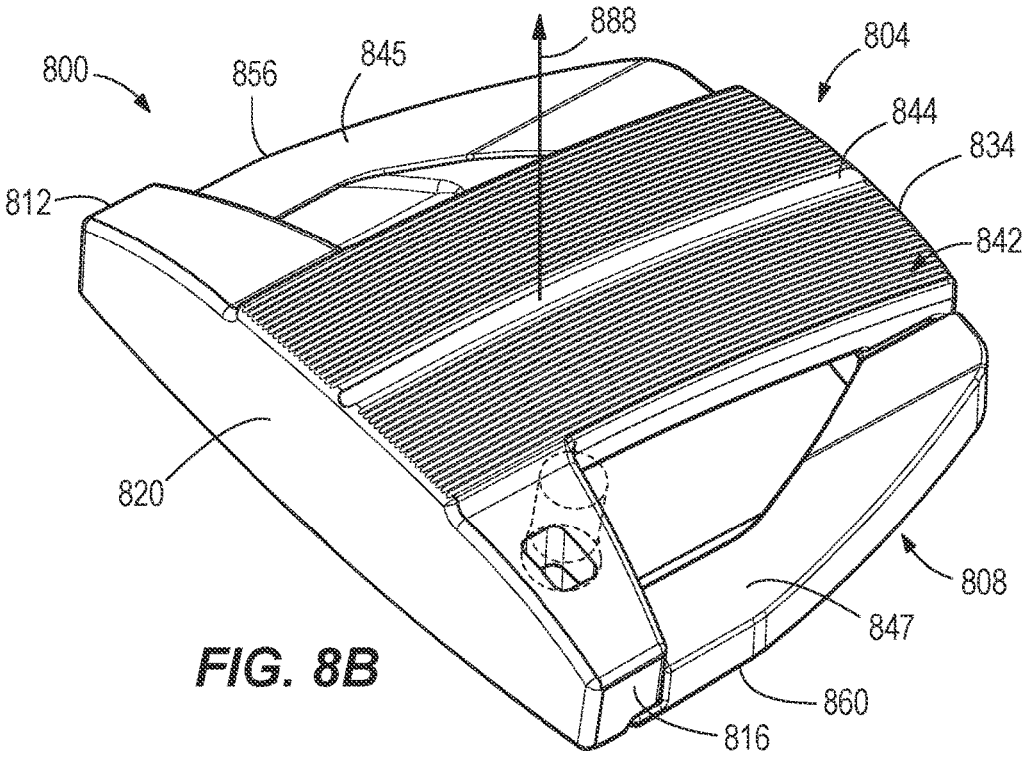
FIG. 8B illustrates an isometric view of the T-shaped putter type golf club head with periphery spans of FIG. 8A.

In one embodiment, the putter-type golf club head can be a T-shaped putter head with periphery spans 800. Referring to FIGS. 8A and 8B, the T-shaped putter head with periphery spans 800 has a upper portion 804 and a lower portion 808. The upper portion 804 is made from a first material have a first density and the lower portion 808 is made from a second material having a second density. The first density is less than the second density. The upper portion 804 and lower portion 808 combine to create a high-MOI putter head 800 (5000 $g \cdot cm^2$-6500 $g \cdot cm^2$), while maintaining a desirable volume and mass.

As discussed above, the lower portion 808 is comprised of a high-density material (i.e., the second material), thereby lowering the mass below a midline 884. The lower portion 808 comprises a front periphery 848, a rear periphery 852, a toe side periphery 856, and a heel side periphery 860. The front periphery 848 is adjacent to the toe side periphery 856 and the heel side periphery 860, and opposite to the rear periphery 852. The toe side periphery 856 is adjacent to the front periphery 848 and the rear periphery 852, and opposite and to the heel side periphery 860. The heel side periphery 860 is also adjacent to the front periphery 848 and the rear periphery 852, but opposite to the toe side periphery 856. In some embodiments, the heel side periphery 860 and toe side periphery 856 can be parallel, while in some embodiments the heel side periphery 860 and toe side periphery 856 are not parallel. In some embodiments, the rear periphery 852 and front periphery 848 can be parallel, while in some embodiments the rear periphery 852 and front periphery 848 are not parallel.

The front periphery 848, of the lower portion 808, comprises a front width. The front width is measured from the junction of the toe side periphery 856 and the front periphery 848, to the junction of the heel side periphery 860 and the front periphery 848. Further, the rear periphery 852, of the lower portion 808, comprises a rear width. The rear width is measured from the junction of the toe side periphery 856 and the rear periphery 852, to the junction of the heel side periphery 860 and the rear periphery 852. In most embodiments, the front width is greater than the rear width, however in some embodiments, the front width can be equal to or less than the rear width.

The front periphery 848, rear periphery 852, toe side periphery 856, and heel side periphery 860, join to from an aperture 864, wherein the aperture 864 is bounded by the four peripheries (front 856, rear 852, toe side 856, and heel side 860). The four peripheries 856, 852, 856, 860, form a perimeter around the aperture 864. The central aperture 864, formed by the peripheries 856, 852, 856, 860 of the lower portion 808, shifts a majority of the volume and mass of the putter to the extremities of the lower portion 808.

In some embodiments, the aperture 864, formed by the front periphery 848, rear periphery 852, toe side periphery 856, and heel side periphery 860 can be any one of the following shapes: rectangular, triangular, semi-circular, circular (golf ball sized), circular (larger than a golf ball), circular (smaller than a golf ball), square, ovular, elliptical, trapezoidal, pentagonal, hexagonal, octagonal, or any other desired geometric or non-geometric shape.

The upper portion 804 of the putter head 800 comprises a toe end 812, a heel end 816, a strike face 820, a rear wall 832, a back edge 834, a crown 842, and an under surface (not pictured). The toe end 812 is opposite the heel end 816. The strike face 820 spans from the toe end 812 to the heel end 816 and is opposite the rear wall 832. The rear wall 832 is opposite, and approximately parallel to the strike face 820. The crown 842 extends away from the strike face 820, over at least a portion of the rear wall 832, and to the back edge 834 of the upper portion 804. Furthermore, the under surface is opposite the crown 842, spanning from the strike face 820 to the back edge 834.

The crown 842 further descends from the strike face 820 to the back edge 834. Additionally, the crown 842 extends away from the strike face 820, over at least a portion of the rear wall 832, the aperture 864 of the lower portion 808, and to the back edge 834 of the upper portion 804. The crown 842, in most embodiments, is inward 25% of the total club head 800 width from the toe side periphery 856 and the heel side periphery 860. In this embodiment, the crown 842 spans approximately 50% of the width of the club head 800, thus forming a "T-Shape" with the strike face. In other embodiments, the crown 842, can span the entire width of the total club head 800, in a heel to toe direction. In some embodiments, the crown 842, can span less than 90% of the total width of the club head 800, less than 90% of the total width of the club head 800, less than 80% of the total width of the club head 800, less than 70% of the total width of the club head 800, less than 60% of the total width of the club head 800, less than 50% of the total width of the club head 800, less than 40% of the total width of the club head 800, or less than 30% of the total width of the club head 800. Further, in some embodiments, the crown 842 can be substantially flat from the strike face 820 to the back edge 834 or ascend from the strike face 820 to the back edge 834. In most embodiments, the ascent or descent of the crown 842 can be linear, curvilinear, parabolic, sinusoidal, or a function of polynomial.

Furthermore, the upper portion 804 of the putter head 800 can comprise one or more alignment features 844 on the crown 842. The alignment feature 844 can be any one or combination of the following: a line, a series of lines, milling troughs, a circle, a dashed line, a triangle, a channel, or any other desired alignment feature 844. The alignment features 844 are equally spaced on the entire crown 842, wherein the crown is configured to be the width of a golf ball (approximately 4.27 cm). The alignment features 844, extending along the crown 842, function to provide the viewer a visual alignment field that extends the width of the golf ball, from the strike face 820 to the back edge 834 of the putter 800. The goal is to align the entire putter 800 with the golf ball using these alignment features 844 along the crown 842.

Figure 8C:
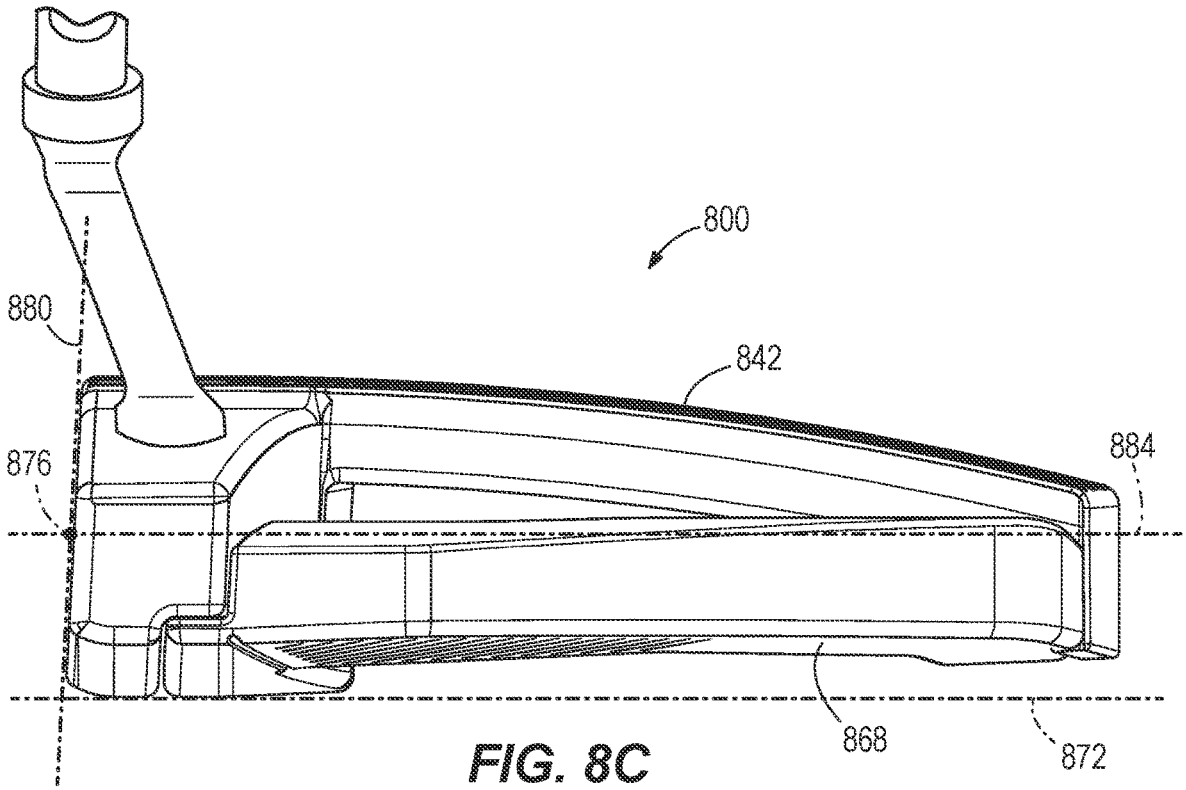
FIG. 8C illustrates a side view of the T-shaped putter type golf club head with periphery spans of FIG. 8A.

Referring to FIG. 8C, the upper portion 804 is affixed to the lower portion 808 such that the upper portion 804 is further from a ground plane 872 than the lower portion 808, wherein the ground plane 872 is tangent to the lower portion 804, when the putter head 800 is at an address position to strike a golf ball.

Further, the strike face 820 of the putter head 800 comprises a strike face center point 876 and a loft plane 880. The strike face center point 876 is equidistant from the crown 842 and the undersurface of the upper portion 804, as well as equidistant from the heel end 816 and toe end 812 of the putter head 800. The loft plane 880 is tangent to the strike face 820 of the putter head 800. Further, a midplane 884 intersects the strike face center point 876 and is perpendicular to the loft plane 880. Furthermore, a y-axis 888 intersects the midplane 884, and is perpendicular to the ground plane 872.

When the upper portion 804 and lower portion 808 are joined such that the heel end 816 overlays at least a portion of the toe side periphery 856. Further, when the upper portion 804 and lower portion 808 are joined such that the toe end 812 overlays at least a portion of the heel side periphery 860. Further still, when the upper portion 804 and lower portion 808 are joined such that the strike face 820 overlays at least a portion of the front periphery 848. Finally, the upper portion 804 and lower portion 808 are joined such that the back edge 834 overlays at least a portion of the rear periphery 852.

Figure 8D:
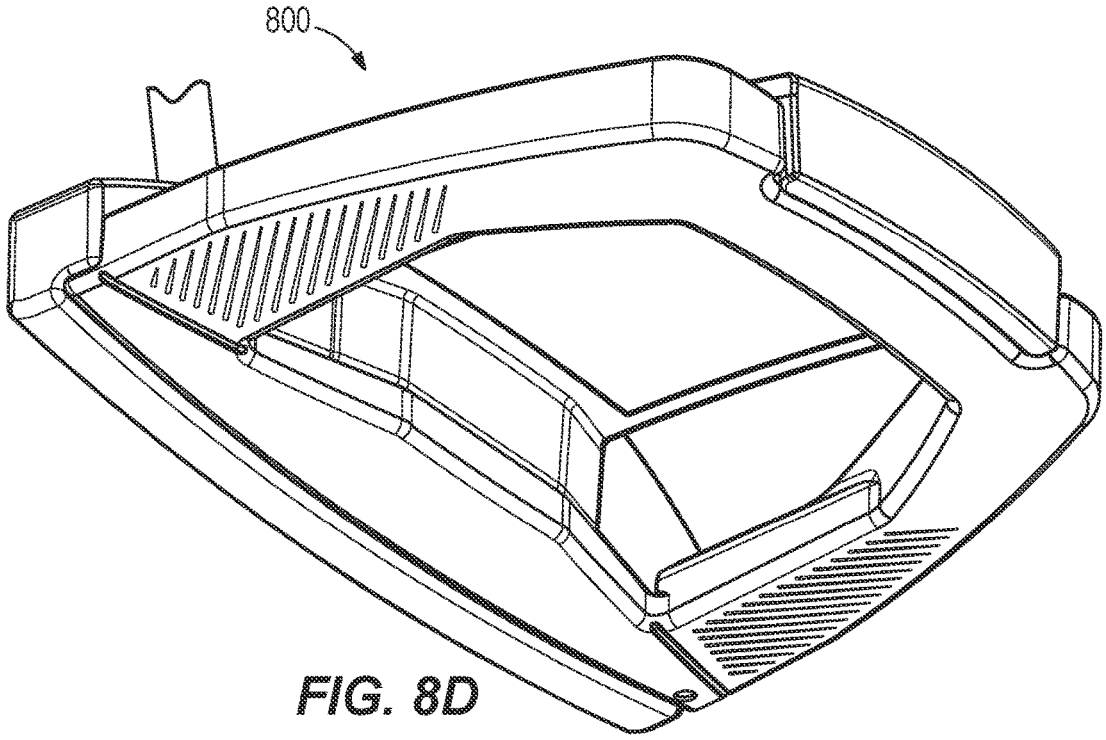
FIG. 8D illustrates a bottom perspective view of the T-shaped putter type golf club head with periphery spans of FIG. 8A.

Referring to FIG. 8D, the four peripheries (front 848, rear 852, toe side 856, and heel side 860) of the lower portion 808, combined with the upper portion 804, create a sole 868. The sole 868 is perpendicular to the ground plane 872, wherein the ground plane 872 is tangent to the sole 868, when the putter head 800 is at an address position to strike a golf ball. The sole 868 of the putter head 800 extends from the toe end 812 of the putter head 800 to the heel end 816 of the putter head 800.

In most embodiments, the sole 868 of the putter head 800 can be perfectly flat. In some embodiments, the sole 868 of the putter head 800 can have a slight arch in a heel 816 to toe 812 direction, wherein the slight arch can be linear, or a function of a polynomial. In some embodiments, the sole 868 of the putter head 800 can have a strong arch in the heel 816 to toe 812 direction, wherein the strong arch can be linear, or a function of a polynomial. The sole 868 functions to provide a surface to rest the putter head 800 on the ground plane 872.

Referring to FIG. 8A, in one embodiment, the lower portion 808 can further comprise a front mass 841, a rear mass 843, a toe mass 845, and a heel mass 847. The front mass 841, rear mass 843, toe mass 845, and heel mass 847 are integral to the lower portion 808. The front mass 841, rear mass 843, toe mass 845, and heel mass 847 extend from the lower portion 808, in a direction away from the ground plane 872, and toward the upper portion 804. These mass portions provide a means to position to upper portion 804 and align with the lower portion 808 of the putter head 800. Furthermore, these mass portions (i.e., the front mass 841, rear mass 843, toe mass 845, and heel mass 847) provide an additional means of adding weight to the perimeters for increasing the MOI of the putter 800 over putters without these mass features. These mass features can have weight that range from 2-5 grams, 3-7 grams or 1-6 grams. The mass features can have all the same weight or be different weight within the ranges provided above. The mass features can be 1 gram, 2 grams, 3 grams, 4 grams, 5 grams, 6 grams, or 7 grams. The front mass 841, a rear mass 843, a toe mass 845, and a heel mass 847 can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape.

In one embodiment, the front mass 841 is positioned on the front periphery 848, is equidistance from the toe side periphery 856 and the heel side periphery 860, however in other embodiments the front mass 841 can be positioned anywhere along the front periphery 848. In one embodiment, the rear mass 843, is positioned on the rear periphery 852, equidistance from the toe side periphery 856 and the heel side periphery 860, however in other embodiments the rear mass 843 can be positioned anywhere along the rear periphery 852. In one embodiment, the toe mass 845 can be positioned at the junction of the toe side periphery 856 and the rear periphery 852, however in other embodiments the toe mass 845 can be positioned anywhere along the toe side periphery 856. In one embodiment, the heel mass 847 can be positioned at the junction of the heel side periphery 860 and the rear periphery 852, however in other embodiments the heel mass 847 can be positioned anywhere along the heel side periphery 860.

The front mass 841, a rear mass 843, a toe mass 845, and a heel mass 847, provide areas of concentrated mass, such that each mass 841, 843, 845, and 847 function to increase the moment of inertia of the putter head 800. The placement of each mass 841, 843, 845, and 847 on the peripheries 848, 852, 856, 860, increases the MOI since each mass 841, 843, 845, and 847 since each mass is farther from a center of gravity of the putter 800. Each mass 841, 843, 845, 847 on the peripheries 848, 852, 856, 860 is integrally formed from the second material, wherein the second material is denser than the first material.

The front mass 841 and the rear mass 843 offer dual functionalities, such that the front mass 841 and rear mass 843 function not only to increase the MOI of the putter 800 but provide additional surfaces for the upper portion 804 to join to the lower portion 808. Therefore, the front mass 841 can also be referred to as a front adhesion portion 841 and the rear mass 843.

In some embodiments, the under surface, strike face 820, and rear wall 832 of the upper portion 808, can form a first cavity (not shown). The first cavity extends inwards from the under surface towards the crown 842 but does not reach the crown 842. The first cavity is bounded by the rear wall 832 and the strike face 820. The first cavity functions to receive the front mass 841 of the lower portion 808.

In some embodiments, the under surface, the back edge 834, and the crown 842 forms a second cavity (not shown). The second cavity extends inwards from the under surface, towards the crown 842, but does not reach the crown 842. The second cavity is bounded by the back edge 834, and the crown 832. In most embodiments, the second cavity is positioned equidistance between the toe side periphery 856 and the heel side periphery 860, when the lower portion 808 is joined to the upper portion 804. The second cavity functions to receive the rear mass 843 of the lower portion 808.

The first and second cavity can comprise any desired geometry, however in most embodiments, the first and second cavity comprise a geometry similar or identical to that of the front mass 841 and the rear mass 843. Further, when the upper portion 804 is affixed to the lower portion 808, the first cavity is positioned such that the first cavity encompasses the front mass 841, and the second cavity is positioned such that the second cavity encompasses the rear mass 843.

The combination of the low density first material upper portion 804 with the high density second material lower portion 808, creates a high MOI putter 800, without creating an extremely heavy putter. The large aperture 864 formed by the peripheries 848, 852, 856, 860 of the lower portion 808 forms a dense, yet low volume portion that increases the MOI of the putter, in comparison to a putter milled from a single material. A single material putter fails to allocate high density material to the periphery, while maintaining a desirable volume (75 cc-100 cc) and mass (340 grams-385 grams).

The lower portion 808, in most embodiments, comprises less than 35% of a total volume of the putter 800. In some embodiments, the lower portion 908 comprises less than 34% of the total volume of the putter 800, less than 33% of the total volume of the putter 800, less than 32% of the total volume of the putter 800, less than 31% of the total volume of the putter 800, less than 30% of the total volume of the putter 800, less than 29% of the total volume of the putter 800, less than 28% of the total volume of the putter 800, or less than 27% of the total volume of the putter 800.

Although the lower portion 808 comprises less than half of the volume of the putter 800, the lower portion 808 comprises at least 45% of an overall mass of the putter 800. In some embodiments, the lower portion 808 comprises at least 46% of the mass of the putter 800, at least 46% of the mass of the putter 800, at least 46% of the mass of the putter 800, at least 47% of the mass of the putter 800, at least 48% of the mass of the putter 800, at least 49% of the mass of the putter 800, at least 50% of the mass of the putter 800, at least 51% of the mass of the putter 800, at least 52% of the mass of the putter 800, at least 53% of the mass of the putter 800, at least 54% of the mass of the putter 800, or at least 55% of the mass of the putter 800.

The beneficial shift of mass to the periphery of the putter head 800, through the use of a high density, low volume lower portion 808, increases the MOI of the putter 800, over a putter with the same volume, mass, and single material construction (i.e., a putter milled of a single stainless steel block, or a putter investment cast of a single material).

h. Dual-Rail Embodiment

Figure 9A:
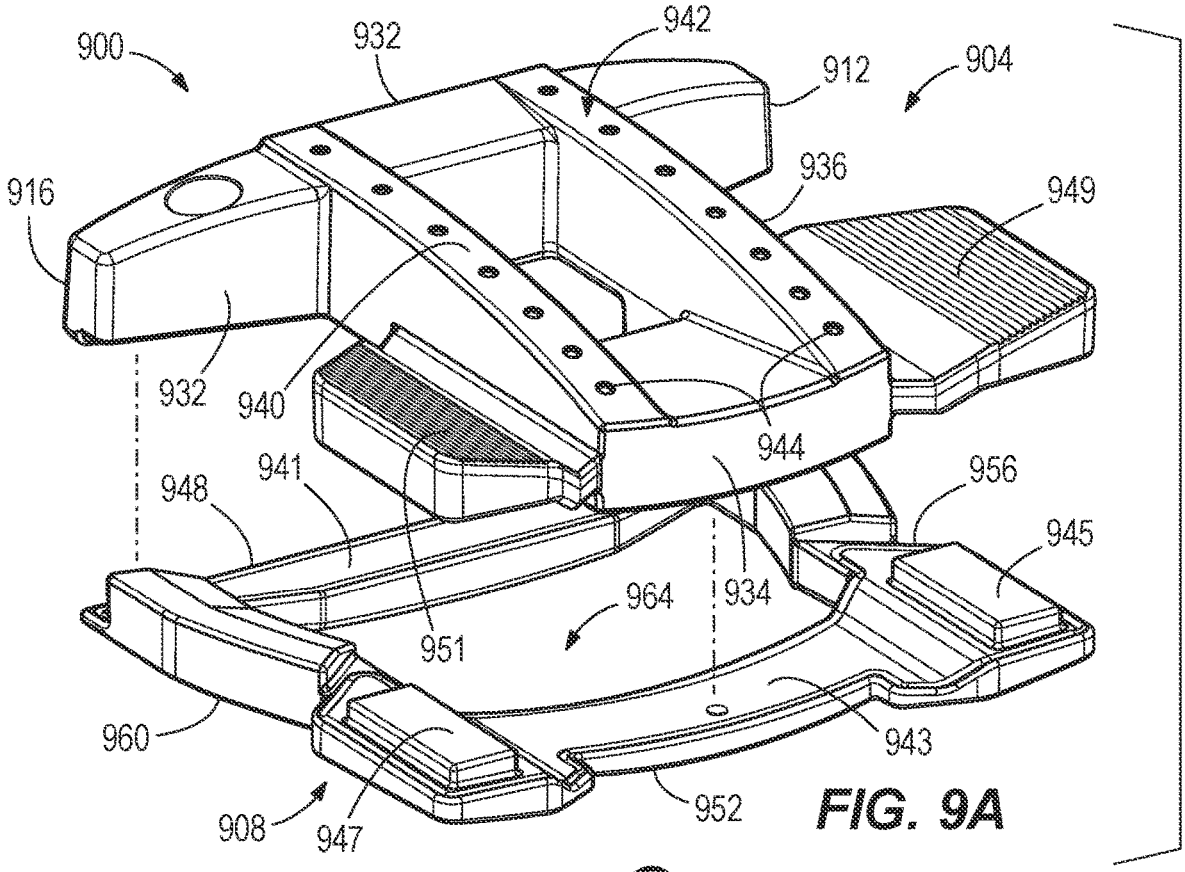
FIG. 9A illustrates an exploded view of a dual rail putter type golf club head.
Figure 9B:
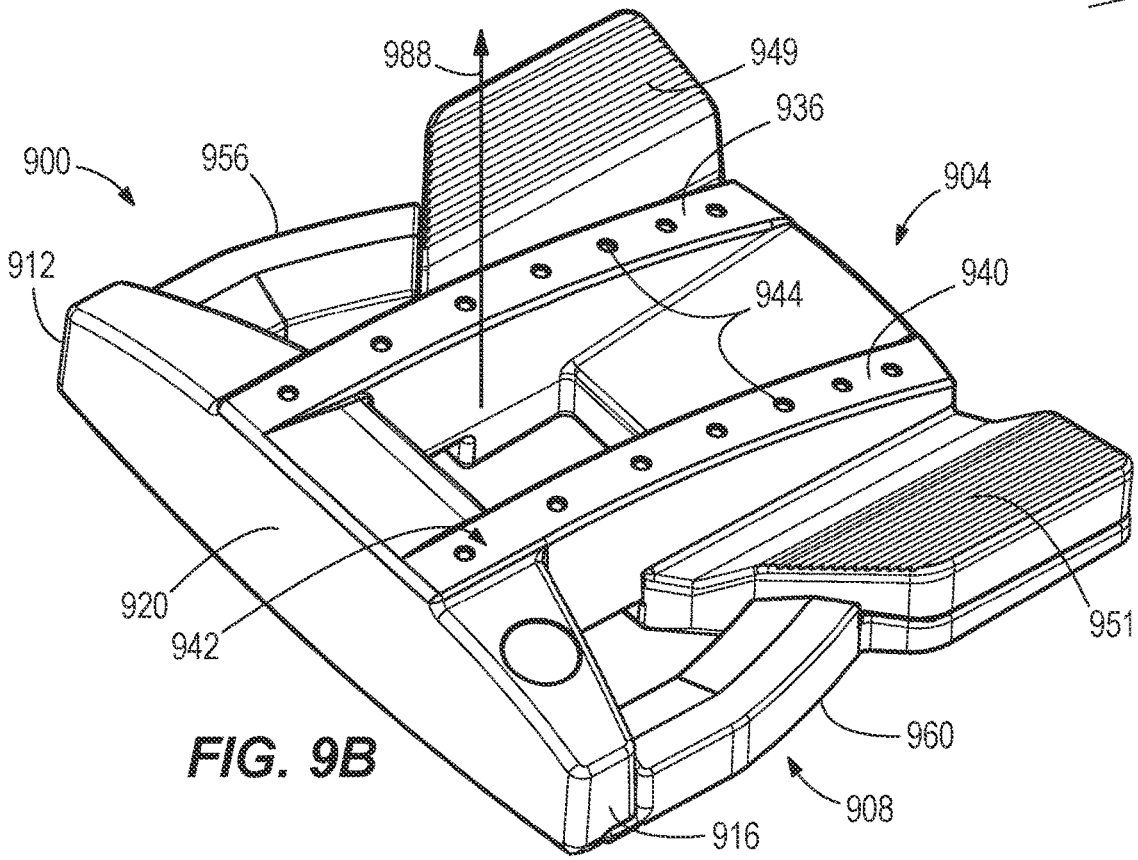
FIG. 9B illustrates an isometric view of the dual rail putter type golf club head of FIG. 9A.

In another embodiment, the putter-type golf club head can be a dual-rail putter head 900. Referring to FIGS. 9A and 9B, the dual-rail putter head 900 has a upper portion 904 and a lower portion 908. The upper portion 904 is made from a first material have a first density and the lower portion 908 is made from a second material having a second density. The first density is less than the second density. The upper portion 904 and lower portion 908 combine to create a high-MOI putter head 900 (5000 $g \cdot cm^2$-6500 $g \cdot cm^2$), while maintaining a desirable volume and mass.

As discussed above, the lower portion 908 is comprised of a high-density material (i.e., the second material), thereby lowering the mass below a midline 984. The lower portion 908 comprises a front periphery 948, a rear periphery 952, a toe side periphery 956, and a heel side periphery 960. The front periphery 948 is adjacent to the toe side periphery 956 and the heel side periphery 960, and opposite to the rear periphery 952. The toe side periphery 956 is adjacent to the front periphery 948 and the rear periphery 952, and opposite and to the heel side periphery 960. The heel side periphery 956 is also adjacent to the front periphery 948 and the rear periphery 952, but opposite to the toe side periphery 956. In some embodiments, the heel side periphery 960 and toe side periphery 956 can be parallel, while in some embodiments the heel side periphery 960 and toe side periphery 956 are not parallel. In some embodiments, the rear periphery 952 and front periphery 948 can be parallel, while in some embodiments the rear periphery 952 and front periphery 948 are not parallel.

The front periphery 948, of the lower portion 908, comprises a front width. The front width is measured from the junction of the toe side periphery 956 and the front periphery 948, to the junction of the heel side periphery 960 and the front periphery 948. Further, the rear periphery 952, of the lower portion 908, comprises a rear width. The rear width is measured from the junction of the toe side periphery 956 and the rear periphery 952, to the junction of the heel side periphery 960 and the rear periphery 952. In most embodiments, the front width is greater than the rear width, however in some embodiments, the front width can be equal to or less than the rear width.

The front periphery 948, rear periphery 952, toe side periphery 956, and heel side periphery 960, join to from an aperture 964, wherein the aperture 964 is bounded by the four peripheries (front 948, rear 952, toe side 956, and heel side 960). The four peripheries 948, 952, 956, 960, form a perimeter around the aperture 964. The central aperture 964, formed by the peripheries 948, 952, 956, 960 of the lower portion 908, shifts a majority of the volume and mass of the putter to the extremities of the lower portion 908.

In some embodiments, the aperture 964, formed by the front periphery 948, rear periphery 952, toe side periphery 956, and heel side periphery 960 can be any one of the following shapes: rectangular, triangular, semi-circular, circular (golf ball sized), circular (larger than a golf ball), circular (smaller than a golf ball), square, ovular, elliptical, trapezoidal, pentagonal, hexagonal, octagonal, or any other desired geometric or non-geometric shape.

The upper portion 904 of the dual-rail putter head 900 comprises a toe end 912, a heel end 916, a strike face 920, a rear wall 932, a back edge 934, a crown 942, and an under surface (not pictured). The toe end 912 is opposite the heel end 916. The strike face 920 spans from the toe end 912 to the heel end 916 and is opposite the rear wall 932. The rear wall 932 is opposite, and approximately parallel to the strike face 920. The crown 942 extends away from the strike face 920, over at least a portion of the rear wall 932, and to the back edge 934 of the upper portion 904. Furthermore, the under surface is opposite the crown 942, spanning from the strike face 920 to the back edge 934.

The crown 942 of the upper portion 904 further comprises a toe end mid-rail 936 and a heel end mid-rail 940. In most embodiments, the toe end mid-rail 936 and heel end mid-rail 940 are approximately parallel, while perpendicular to the strike face 920. Further, the toe end mid-rail 936 and heel end mid-rail 940 do not contact the toe side periphery 956 or the heel side periphery 960. The toe end mid-rail 936 and the heel end mid-rail 940 are approximately ⅓ inward of the total club head width from the outer periphery of the toe side periphery 956 and heel side periphery 960 respectively. However, in other embodiments, the toe end mid-rail 936 and the heel end mid-rail 940 can be more or less than ⅓ inward of the total club head width from the outer periphery of the toe-side periphery and heel-side periphery respectively. The toe end mid-rail 936 and heel end mid-rail 940 descend from the strike face 920 to the back edge 934. In some embodiments, the toe end mid-rail 936 and heel end mid-rail 940 are not parallel and not perpendicular to the strike face 920. In some embodiments, the toe end mid-rail 936 and heel end mid-rail 940 can be substantially flat from the strike face 920 to the back edge 934 or ascend from the strike face 920 to the back edge 934. In most embodiments, the ascent or descent of the mid-rails 936, 940 can be linear, curvilinear, parabolic, sinusoidal, or a function of polynomial.

Furthermore, the upper portion 904 of the dual-rail putter head 900 can comprise one or more alignment features 944 on toe end mid-rail 936 and heel end mid-rail 940. The alignment feature 944 can be any one or combination of the following: a line, a circle, a dashed line, a triangle, a channel, or any other desired alignment feature 944. The alignment features 944 are spaced such on the rails 936, 940 to be the width of a golf ball (approximately 4.27 cm). The alignment features 944 extend along the rails to provide the viewer a visual alignment field that extends from the golf ball, strike face 920 to the entire putter 900. The goal is to align the entire putter 900 with the golf ball using these alignment features 944 along the toe end mid-rail 936 and heel end mid-rail 940.

The upper portion 904 is affixed to the lower portion 908 such that the upper portion 904 is further from a ground plane 972 than the lower portion 908, wherein the ground plane 972 is tangent to the lower portion 904, when the dual-rail putter head 900 is at an address position to strike a golf ball.

Further, the strike face 920 of the dual-rail putter head 900 comprises a strike face center point 976 and a loft plane 980. The strike face center point 976 is equidistant from the crown 942 and the undersurface of the upper portion 904, as well as equidistant from the heel end 916 and toe end 912 of the dual-rail putter head 900. The loft plane 980 is tangent to the strike face 920 of the dual-rail putter head 900. Further, a midplane 984 intersects the strike face center point 976 and is perpendicular to the loft plane 980. Furthermore, a y-axis 988 intersects the midplane 984, and is perpendicular to the ground plane 972.

When the upper portion 904 and lower portion 908 are joined such that the heel end 916 overlays at least a portion of the toe side periphery 956. Further, when the upper portion 904 and lower portion 908 are joined such that the toe end 912 overlays at least a portion of the heel side periphery 960. Further still, when the upper portion 904 and lower portion 908 are joined such that the strike face 920 overlays at least a portion of the front periphery 948. Finally, when the upper portion 904 and lower portion 908 are joined such that the back edge 934 overlays at least a portion of the rear periphery 952.

Figure 9C:
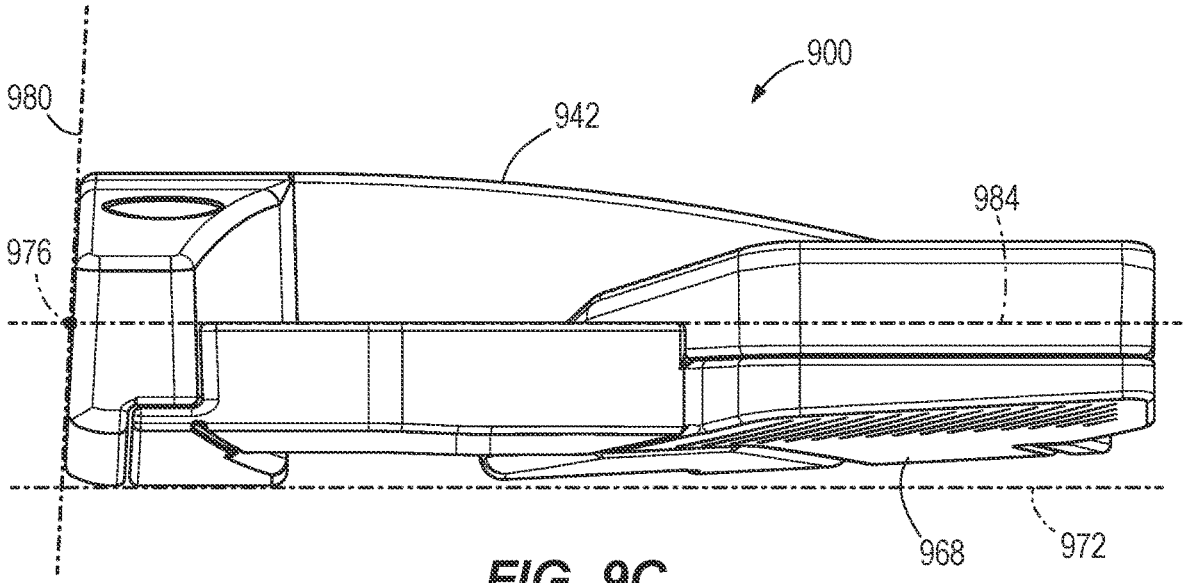
FIG. 9C illustrates a side view of the dual rail putter type golf club head of FIG. 9A.
Figure 9D:
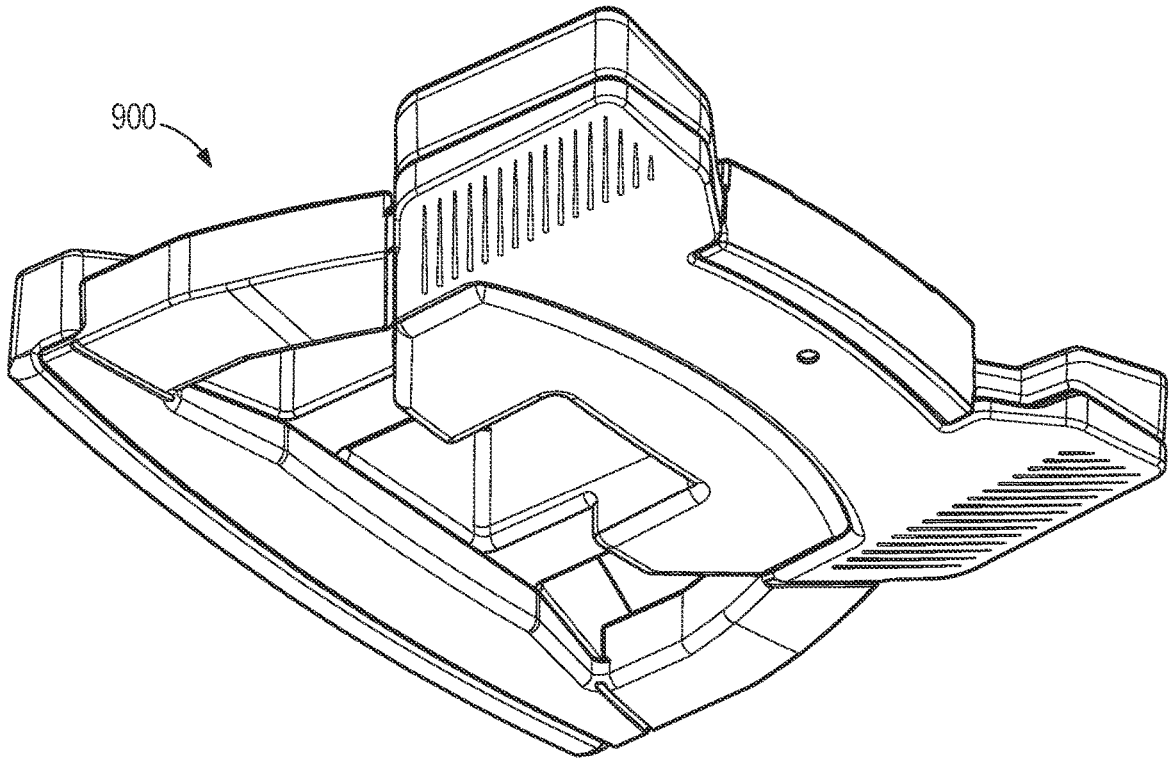
FIG. 9D illustrates a bottom perspective view of the dual rail putter type golf club head of FIG. 9A.

Referring to FIGS. 9C and 9D, the four peripheries (front 948, rear 952, toe side 956, and heel side 960) of the lower portion 908, combined with the upper portion 904, create a sole 968. The sole 968 is perpendicular to the ground plane 972, wherein the ground plane 972 is tangent to the sole 968, when the dual-rail putter head 900 is at an address position to strike a golf ball. The sole 968 of the dual-rail putter head 900 extends from the toe end 912 of the dual-rail putter head 900 to the heel end 916 of the dual-rail putter head 900.

In most embodiments, the sole 968 of the dual-rail putter head 900 can be perfectly flat. In some embodiments, the sole 968 of the putter head 900 can have a slight arch in a heel to toe direction, wherein the slight arch can be linear, or a function of a polynomial. In some embodiments, the sole 968 of the putter head 900 can have a strong arch in the heel to toe direction, wherein the strong arch can be linear, or a function of a polynomial. The sole 968 functions to provide a surface to rest the dual-rail putter head 900 on the ground plane 972.

Referring to FIG. 9A, in one embodiment, the lower portion 908 can further comprise a front mass 941, a rear mass 943, a toe mass 945, and a heel mass 947. The front mass 941, rear mass 943, toe mass 945, and heel mass 947 are integral to the lower portion 908. The front mass 941, rear mass 943, toe mass 945, and heel mass 947 extend from the lower portion 908, in a direction away from the ground plane 972, and toward the upper portion 904. These mass portions provide a means to position to upper portion and align with the lower portion of the dual-rail putter head 900. Furthermore, these mass portions (i.e., the front mass 941, rear mass 943, toe mass 945, and heel mass 947) provide an additional means of adding weight to the perimeters for increasing the MOI of the putter over putters without these mass features. These mass features can have weight that range from 2-5 grams, 3-7 grams or 1-6 grams. The mass features can have all the same weight or be different weight within the ranges provided above. The mass features can be 1 gram, 2 grams, 3 grams, 4 grams, 5 grams, 6 grams, or 7 grams. The front mass 941, a rear mass 943, a toe mass 945, and a heel mass 947 can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape.

In one embodiment, the front mass 941 is positioned on the front periphery 948, is equidistance from the toe side periphery 956 and the heel side periphery 960, however in other embodiments the front mass 941 can be positioned anywhere along the front periphery 948. In one embodiment, the rear mass 943, is positioned on the rear periphery 952, equidistance from the toe side periphery 956 and the heel side periphery 960, however in other embodiments the rear mass 943 can be positioned anywhere along the rear periphery 952. In one embodiment, the toe mass 945 can be positioned at the junction of the toe side periphery 956 and the rear periphery 952, however in other embodiments the toe mass 945 can be positioned anywhere along the toe side periphery 956. In one embodiment, the heel mass 947 can be positioned at the junction of the heel side periphery 960 and the rear periphery 952, however in other embodiments the heel mass 947 can be positioned anywhere along the heel side periphery 960.

The front mass 941, a rear mass 943, a toe mass 945, and a heel mass 947, provide areas of concentrated mass, such that each mass 941, 943, 945, and 947 function to increase the moment of inertia of the putter head 900. The placement of each mass 941, 943, 945, and 947 on the peripheries 948, 952, 956, 960, increases the MOI since each mass 941, 943, 945, and 947 since each mass is farther from a center of gravity of the putter 900. Each mass 941, 943, 945, 947 on the peripheries 948, 952, 956, 960 is integrally formed from the second material, wherein the second material is denser than the first material.

The front mass 941, a rear mass 943, a toe mass 945, and a heel mass 947 offer dual functionalities, such that each mass 941, 943, 945, and 947 functions not only to increase the MOI of the putter 900, but provide additional surface for the upper portion 904 to join to the lower portion 908. Therefore, the front mass 941 can also be referred to as a front adhesion portion 941, the rear mass 943 can also be referred to as rear adhesion portion 943, the toe mass 945 can also be referred to as a toe adhesion portion 945, and the heel mass 947 can also be referred to as a heel adhesion portion 947.

Further, the crown 942 of the upper portion 942 comprises a toe end cap 949, and a heel end cap 951, such that the toe end cap 949 and heel end cap 951 function to mate to the toe mass 945 and the heel mass 947, respectively. The toe end cap 949 is adjacent the toe end mid-rail 936 and the back edge 934. The heel end cap 951 is adjacent the heel end mid-rail 940 and the back edge 934. In most embodiments, the toe end cap 949 and heel end cap 951 comprise identical geometries, however in some embodiments, the toe end cap 949 and heel end cap 951 can comprise different geometries.

In most embodiments, the toe end cap 949 and heel end cap 951, of the crown 942, are larger than the toe mass 945 and heel mass 947, respectively, so that the toe end cap 949 and heel end cap 951 encompass the toe mass 945 and heel mass 947, when the upper portion 904 is affixed to the lower portion 908. Further, when the upper portion 904 is affixed to the lower portion 908, the toe end cap 949 is positioned such that the toe end cap 949 overlays at least a portion of the toe side periphery 956 and the toe mass 945. Further still, when the upper portion 904 is affixed to the lower portion 908, the heel end cap 951 is positioned such that the heel end cap 951 overlays at least a portion of the heel side periphery 960 and the heel mass 960.

In some embodiments, the under surface, strike face 920, and rear wall 932 of the upper portion 908, can form a first cavity (not shown). The first cavity extends inwards from the under surface towards the crown 942 but does not reach the crown 942. The first cavity is bounded by the rear wall 932 and the strike face 920. The first cavity functions to receive the front mass 941 of the lower portion 908.

In some embodiments, the under surface, the back edge 934, and the crown 942 forms a second cavity (not shown). The second cavity extends inwards from the under surface, towards the crown 942, but does not reach the crown 942. The second cavity is bounded by the back edge 934, the toe cap 949, and the heel end cap 951. In most embodiments, the second cavity is positioned equidistance between the toe end cap 949 and the heel end cap 951. The second cavity functions to receive the rear mass 943 of the lower portion 908.

The first and second cavity can comprise any desired geometry, however in most embodiments, the first and second cavity comprise a geometry similar or identical to that of the front mass 941 and the rear mass 943. Further, when the upper portion 904 is affixed to the lower portion 908, the first cavity is positioned such that the first cavity encompasses the front mass 941, and the second cavity is positioned such that the second cavity encompasses the rear mass 943.

The combination of the low density first material upper portion 904 with the high density second material lower portion 908, creates a high MOI putter 900, without creating an extremely heavy putter. The large aperture 964 formed by the peripheries 948, 952, 956, 960 of the lower portion 908 forms a dense, yet low volume portion that increases the MOI of the putter, in comparison to a putter milled from a single material. A single material putter fails to allocate high density material to the periphery, while maintaining a desirable volume (75 cc-100 cc) and mass (340 grams-385 grams).

The lower portion 908, in most embodiments, comprises less than 35% of a total volume of the putter 900. In some embodiments, the lower portion 908 comprises less than 34% of the total volume of the putter 900, less than 33% of the total volume of the putter 900, less than 32% of the total volume of the putter 900, less than 31% of the total volume of the putter 900, less than 30% of the total volume of the putter 900, less than 29% of the total volume of the putter 900, less than 28% of the total volume of the putter 900, or less than 27% of the total volume of the putter 900.

Although the lower portion 908 comprises less than half of the volume of the putter 900, the lower portion 908 comprises at least 45% of an overall mass of the putter 900. In some embodiments, the lower portion 908 comprises at least 46% of the mass of the putter 900, at least 46% of the mass of the putter 900, at least 46% of the mass of the putter 900, at least 47% of the mass of the putter 900, at least 48% of the mass of the putter 900, at least 49% of the mass of the putter 900, at least 50% of the mass of the putter 900, at least 51% of the mass of the putter 900, at least 52% of the mass of the putter 900, at least 53% of the mass of the putter 900, at least 54% of the mass of the putter 900, or at least 55% of the mass of the putter 900.

The beneficial shift of mass to the periphery of the putter head 900, through the use of a high density, low volume lower portion 908, increases the MOI of the putter 900, over a putter with the same volume, mass, and single material construction (i.e., a putter milled of a single stainless steel block, or a putter investment cast of a single material).

i. Circular Embodiment

Figure 10A:
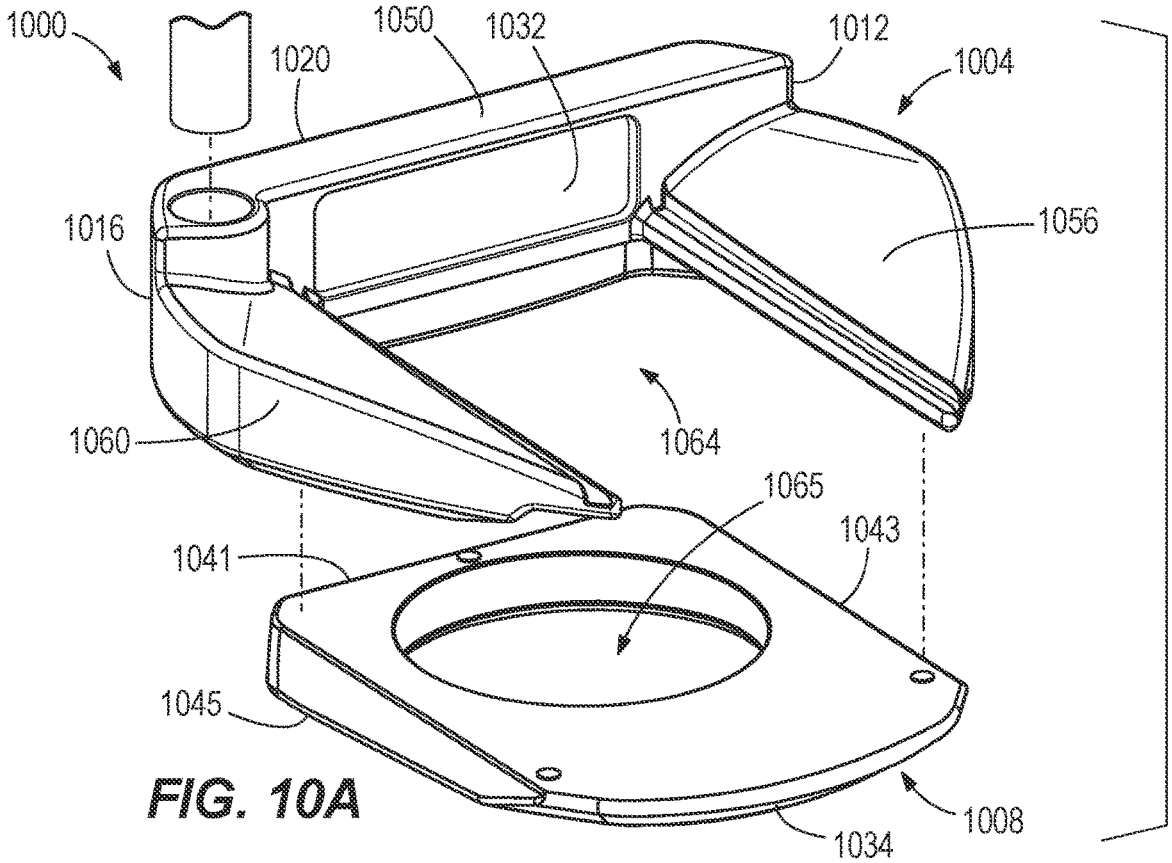
FIG. 10A illustrates an exploded view of a circular putter type golf club head.
Figure 10B:
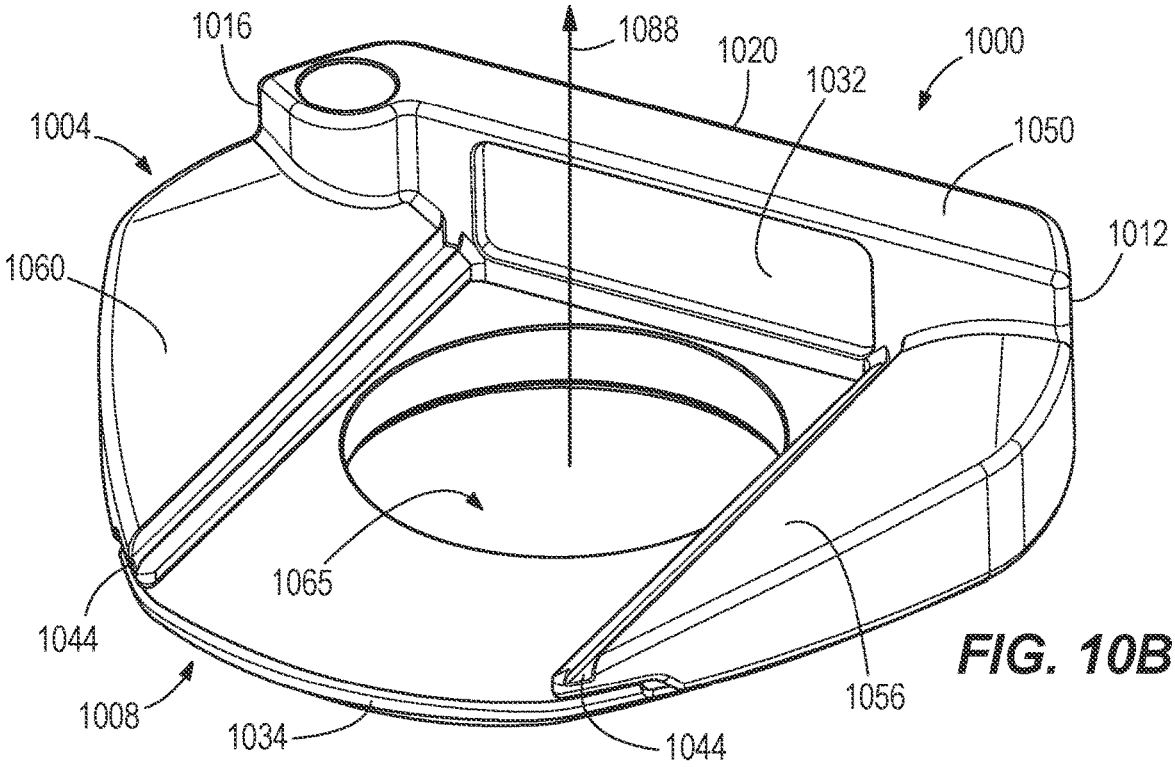
FIG. 10B illustrates an isometric view of the circular putter type golf club head of FIG. 10A.
Figure 10C:
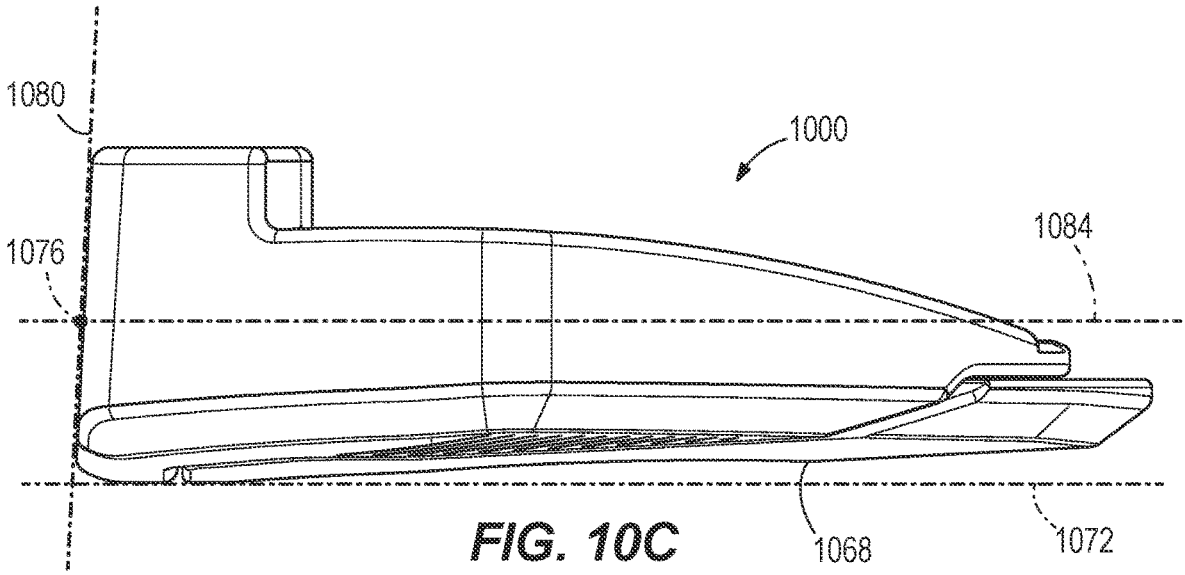
FIG. 10C illustrates a side view of the circular putter type golf club head of FIG. 10A.

In another embodiment, the putter-type golf club head 1000 can be a circular shaped putter head 1000. Referring to FIG. 10A-10C, the circular putter head 1000 has an upper portion 1004 and a lower portion 1008. The lower portion 1008 is made from a first material have a first density and the upper portion 1004 is made from a second material having a second density. The first density is less than the second density. The upper portion 1004 and lower portion 1008 combine to create a high-MOI putter head 1000 (5000 $g \cdot cm^2$-6500 $g \cdot cm^2$), while maintaining a desirable volume and mass.

As discussed above, the upper portion 1004 is comprised of a high-density material (i.e., the second material). The upper portion 1004 comprises a toe end 1012, a heel end 1016, a strike face 1020, a rear wall 1032, and an under surface (not pictured). The toe end 1012 is opposite the heel end 1016. The strike face 1020 spans from the toe end 1012 to the heel end 1016 and is opposite the rear wall 1032. The rear wall 1032 is opposite, and approximately parallel to the strike face 1020.

The upper portion 1004 further comprises a toe side span 1056, and a heel side span 1060. The toe side span 1056 is adjacent to the toe end 1012 and opposite and to the heel side span 1060. The heel side span 1060 is also adjacent to the heel end 1016 and opposite to the toe side span 1056. In some embodiments, the heel side span 1060 and toe side span 1056 can be parallel, while in some embodiments, the heel side span 1060 and toe side span 1056 are not parallel. The toe side span 1056 and heel side span 1060, extend perpendicularly away from the rear wall 1032, in a direction away from the rear wall 1032, and strike face 1020.

In most embodiments, the toe side span 1056 extends perpendicularly from rear wall 1032 such that a right angle (90° angle) is formed at the junction of the toe side span 1056 and the rear wall 1032. However, in other embodiments, the toe side span 1056 can extend from the rear wall 1032 in any direction, such that any angle (0°-180°) can be formed at the junction of the toe side span 1056 and the rear wall 1032. Further, in most embodiments, the heel side span 1060 extends perpendicularly from the rear wall 1032, such that a right angle (90° angle) is formed at the junction of the heel side span 1060 and the rear wall 1032. However, in other embodiments, the heel side span 1060 can extend from the rear wall 1032 in any direction, such that any angle (0°-180°) can be formed at the junction of the heel side span 1060 and the rear wall 1032.

The rear wall 1032, toe side span 1056, and heel side span 1060 form a gap 1064. The gap 1064 is bounded by the rear wall 1032, the toe side span 1056, and the heel side span 1060. The gap 1064 formed by the rear wall 1032, the toe side span 1056, and the heel side span 1060 shifts a majority of the volume and mass of the putter to the extremities of the upper portion 1008. The gap 1064 can comprise any shape, however in one embodiment the gap is approximately rectangular. In other embodiments, the gap 1064 can be circular, curvilinear, triangular, trapezoidal, parabolic, golf ball shaped, square, or any other desired geometric shape.

The lower portion 1008 of the putter head 1000 comprises a front edge 1041, a rear edge 1034, a toe edge 1043, and a heel edge 1045. The front edge 1041 is adjacent to the toe edge 1043 and the heel edge 1045, and opposite to the rear edge 1034. The toe edge 1034 is adjacent to the front edge 1041 and rear edge 1034, and opposite to the heel edge 1045. The heel edge 1045 is also adjacent to the front edge 1041 and the rear edge 1034, and opposite to the toe edge 1043. In some embodiments, the toe edge 1043 and heel edge 1045 can be parallel, while in some embodiments, the toe edge 1043 and heel edge 1045 are not parallel. In some embodiments, the front edge 1041 and rear edge 1034 can be parallel, while in some embodiments, the front edge 1041 and rear edge 1034 are not parallel.

The front edge 1041, rear edge 1034, toe edge 1043, and heel edge 1045 join to form an aperture 1065, wherein the aperture 1065 is bounded by the four edges (front 1041, rear 1034, toe 1043, heel 1045). The four edges 1041, 1034, 1043, 1045, form a perimeter around the aperture 1065.

In some embodiments, the aperture 1065, formed by the front edge 1041, rear edge 1034, toe edge 1043, and heel edge 1045 can be any one of the following shapes: rectangular, triangular, semi-circular, circular (golf ball sized), circular (larger than a golf ball), circular (smaller than a golf ball), square, ovular, elliptical, trapezoidal, pentagonal, hexagonal, octagonal, or any other desired geometric or non-geometric shape.

Referring to FIG. 10C, the lower portion 1008 is affixed to the upper portion 1004 such that a portion of the upper portion 1004 and the lower portion 1008 intersect a ground plane 1072. The ground plane 1072 is tangent to the lower portion 1004, when the putter head 1000 is at an address position to strike a golf ball.

Further, the strike face 1020 of the putter head 1000 comprises a strike face center point 1076 and a loft plane 1080. The strike face center point 1076 is equidistant from a top rail 1050 and the ground plane 1072 of the upper portion 1004, wherein the top rail 1050 is adjacent the strike face 1020 and the rear wall 1032, while opposite the ground plane 1072. The strike face center point 1076 is also equidistant from the heel end 1016 and toe end 1012 of the putter head 1000. The loft plane 1080 is tangent to the strike face 1020 of the putter head 1000. Further, a midplane 1084 intersects the strike face center point 1076 and is perpendicular to the loft plane 1080. Furthermore, a y-axis 1088 intersects the midplane 1084, and is perpendicular to the ground plane 1072.

When the upper portion 1004 and lower portion 1008 are joined such that the toe side span 1056 overlays at least a portion of the toe edge 1043. Further, when the upper portion 1004 and lower portion 1008 are joined such that the heel side span 1060 overlays at least a portion of the heel edge 1045. Further still, when the upper portion 1004 and lower portion 1008 are joined such that the strike face 1020 overlays at least a portion of the front edge 1048. Finally, when the upper portion 1004 and lower portion 1008 are joined such that the lower portion 1008 is affixed to a portion of the strike face 1020, toe side span 1056, and heel side span 1060, thereby filling at least a portion of the gap 1064 formed by the rear wall 1032, toe side span 1056, and heel side span 1060

Figure 10D:
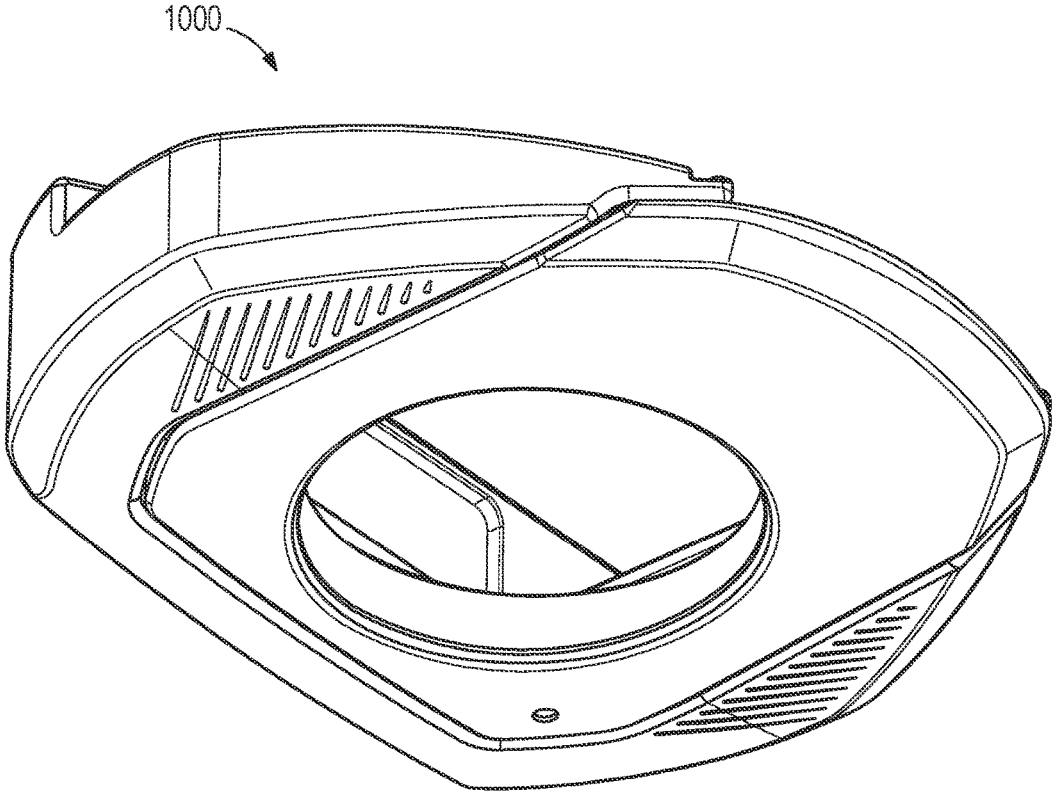
FIG. 10D illustrates a bottom perspective view of the circular putter type golf club head of FIG. 10A.

Referring to FIG. 10D the lower portion 1008, and the toe side span 1056 and heel side span 1060 of the upper portion 1004, when combined create a sole 1068. The sole 1068 is perpendicular to the ground plane 1072, wherein the ground plane 1072 is tangent to the sole 1068, when the putter head 1000 is at an address position to strike a golf ball. The sole 1068 of the putter head 1000 extends from the toe end 1012 of the putter head 1000 to the heel end 1016 of the putter head 1000.

In most embodiments, the sole 1068 of the putter head 1000 can be perfectly flat. In some embodiments, the sole 1068 of the putter head 1000 can have a slight arch in a heel 1016 to toe 1012 direction, wherein the slight arch can be linear, or a function of a polynomial. In some embodiments, the sole 1068 of the putter head 1000 can have a strong arch in the heel 1016 to toe 1012 direction, wherein the strong arch can be linear, or a function of a polynomial. The sole 1068 functions to provide a surface to rest the putter head 1000 on the ground plane 1072.

In some embodiments, the upper portion 1004 can further comprise a crown (not shown). The crown extends away from the strike face 1020 to the back edge 1034 of the lower portion 1008. Furthermore, the crown, spans from the strike face 1020 to the back edge 1034, at least over a portion of the aperture 1065 of the lower portion and at least over a portion of the rear wall 1032.

The crown can further descend from the strike face 1020 to the back edge 1034. The crown, in most embodiments, spans approximately inward 25% of the total club head 1000 width from the toe side span 1056 and spans approximately inward 25% of the total club head 1000 width from the heel side span 1060. In other embodiments, the crown can, continuously or discontinuously, span the entire width of the total club head 1000, in a heel to toe direction. In some embodiments, the crown, can span less than 90% of the total width of the club head 1000, less than 90% of the total width of the club head 1000, less than 80% of the total width of the club head 1000, less than 70% of the total width of the club head 1000, less than 60% of the total width of the club head 1000, less than 50% of the total width of the club head 1000, less than 40% of the total width of the club head 1000, or less than 30% of the total width of the club head 1000. Further, in some embodiments, the crown can be substantially flat from the strike face 1020 to the back edge 1034 or ascend from the strike face 1020 to the back edge 1034. In most embodiments, the ascent or descent of the crown can be linear, curvilinear, parabolic, sinusoidal, or a function of polynomial.

Furthermore, the upper portion 1004 of the putter head 1000 can comprise one or more alignment features 1044 on the toe side span 1065 and the heel side span 1060. The alignment feature 1044 can be any one or combination of the following: a line, a series of lines, milling troughs, a circle, a dashed line, a triangle, a channel, or any other desired alignment feature 1044. The alignment features 1044 can be equally spaced on the entire toe side span 1065 and the heel side span 1060, a portion of the crown, or the entire crown. The alignment features 1044, extending along the toe side span 1056 and the heel side span 1060, function to provide the viewer a visual alignment field that extends the width of the golf ball, from the rear wall 1032 to the back edge 1034 of the putter 1000. The goal is to align the entire putter 1000 with the golf ball using these alignment features 1044 along the toe side span 1056 and the heel side span 1060 and/or the crown.

The combination of the high density first material upper portion 1004 with the low density second material lower portion 1008, creates a high MOI putter 1000, without creating an extremely heavy putter. The large gap 1064 formed by the rear wall 1032 and the spans 1056, 1060 of the upper portion 1004 forms a dense, yet low wide periphery that increases the MOI of the putter, in comparison to a putter milled from a single material. A single material putter fails to allocate high density material to the periphery, while maintaining a desirable volume (75 cc-100 cc) and mass (340 grams-385 grams).

The beneficial shift of mass to the periphery of the putter head 1000, through the use of a high density, upper portion 1008, and low volume low mass lower portion 100, increases the MOI of the putter 1000, over a putter with the same volume, mass, and single material construction (i.e., a putter milled of a single stainless steel block, or a putter investment cast of a single material).

III. Sole Plate Embodiments

Described below are additional multi-component putter head embodiments comprising an upper portion and a lower portion. The lower portion further comprises a sole plate formed from a high-density material, and the upper portion is formed from a low-density material. The material density of the upper portion is less than the material density of the lower portion including the sole plate. The sole plate embodiments described below comprise mass structures, ball retrieval features, and/or ball outlining alignment aids to provide more consistent and more forgiving putts. As described below, the putter heads including the upper portion and the lower portion comprising the sole plate provides increased perimeter weighting, MOI, and forgiveness while being pleasing to the eye to create a consistent putting stroke. Further, the putter heads including the upper portion and the lower portion comprising the sole plate provides consistent ball speed and ball travel distance for repeated putts.

a. Putter Head with Sole Plate Having Heel and Toe Mass

In another embodiment, the putter-type golf club head can be a semi-circular shaped putter head 1200 comprising a sole plate. Referring to FIGS. 12A-12E, the semi-circular putter head 1200 has an upper portion 1204 and a lower portion 1208. The upper portion 1204 is formed from a first material have a first density and the lower portion 1208 is made from a second material having a second density. The first density is less than the second density. The sole plate of the putter head 1200 increases perimeter weighting and MOI. The upper portion 1204 and lower portion 1208 combine to create a high-MOI putter head 1200 (3000 $g \cdot cm^2$-4000 $g \cdot cm^2$), while maintaining a desirable volume and mass. For example, the putter head 1200 can have a MOI ranging from 3000 $g \cdot cm^2$-3500 $g \cdot cm^2$ or 3500 $g \cdot cm^2$-4000 $g \cdot cm^2$. The putter head 1200 comprises a 2%-15% increase of MOI about the y-axis over a putter head devoid of a multi-material construction (i.e. a single material). For example, the putter head 1200 comprises a 2%-5%, 5%-10%, or 10%-15% increase over a single material putter.

The putter head 1200 can comprise the strike face features 1100 as described above and as illustrated in FIGS. 11A-11C. The putter head 1200 can comprise a strike face insert formed from a single component system 1120, or a two-component system 1130. The putter head 1200 can comprise a strike face insert disposed between one or more metal portions 1142. The strike face features 1100 can improve the sound and feel during impacts with the strike face of putter head 1200.

The lower portion 1208 comprises a high-density material (i.e., the second material), thereby lowering the mass below a midline 1284. The lower portion 1208 further comprises a sole plate formed from the high-density material. As illustrated in FIG. 12C, the lower portion 1208 comprises a front periphery 1248, a rear periphery 1252, a toe side periphery 1256, and a heel side periphery 1260. The front periphery 1248 is adjacent to the toe side periphery 1256 and the heel side periphery 1260, and opposite to the rear periphery 1252. The toe side periphery 1256 is adjacent to the front periphery 1248 and the rear periphery 1252, and opposite and to the heel side periphery 1260. The heel side periphery 1260 is also adjacent to the front periphery 1248 and the rear periphery 1252, but opposite to the toe side periphery 1256. In many embodiments, as illustrated in FIG. 12B, the heel side periphery 1260 and the toe side periphery 1256 can be symmetric about a horizontal centerline extending through the strike face center point 1276 in a direction extending from a strike face 1220 to a back edge 1234. The horizontal centerline extends parallel with a ground plane 1272. In many embodiments, the heel side periphery 1260 and the toe side periphery 1256 can comprise similar curved edges or follow a similar curvilinear path around the periphery of the putter head 1200.

The front periphery 1248 of the lower portion 1208 comprises a front width. The front width is measured from the junction of the toe side periphery 1256 and the front periphery 1248, to the junction of the heel side periphery 1260 and the front periphery 1248. Further, the rear periphery 1252 of the lower portion 1208 comprises a rear width. The rear width is measured from the junction of the toe side periphery 1256 and the rear periphery 1252, to the junction of the heel side periphery 1260 and the rear periphery 1252. In many embodiments, the front width is greater than the rear width, however in some embodiments, the front width can be equal to or less than the rear width.

Figure 12A:
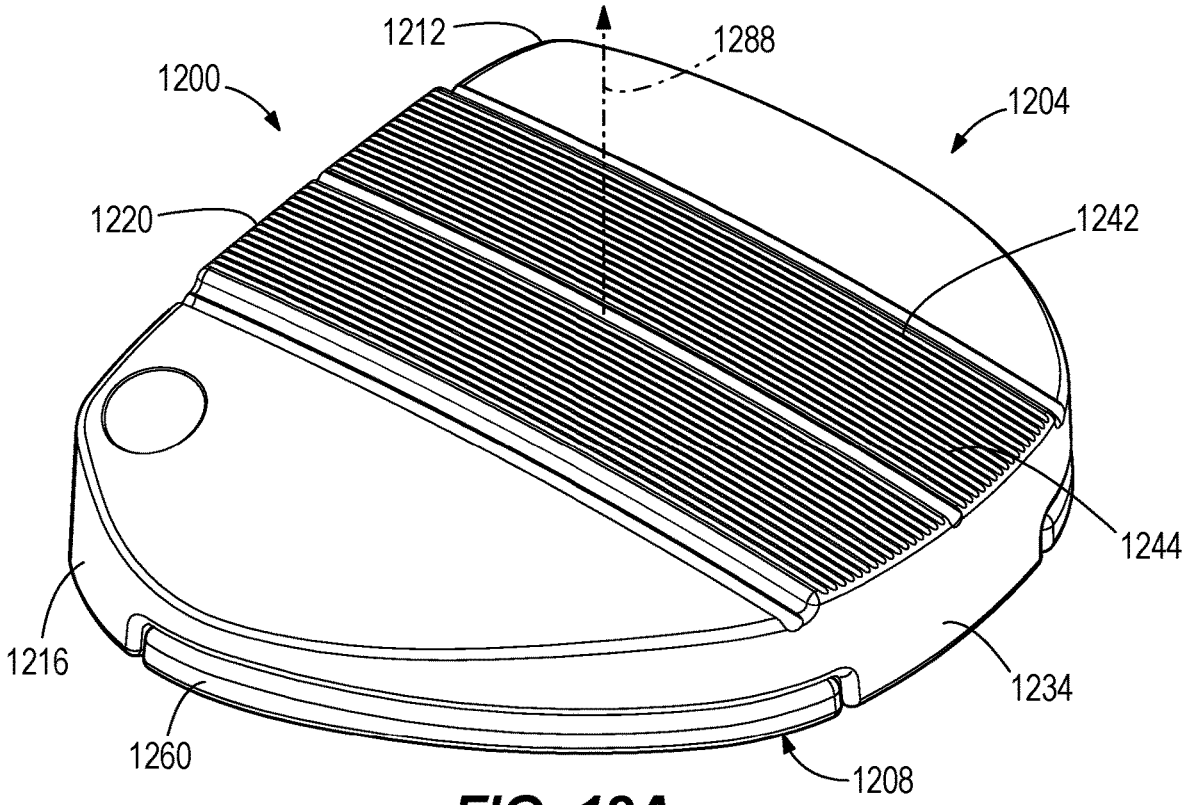
FIG. 12A illustrates a top perspective view of a two-part putter type club head comprising a sole plate.
Figure 12B:
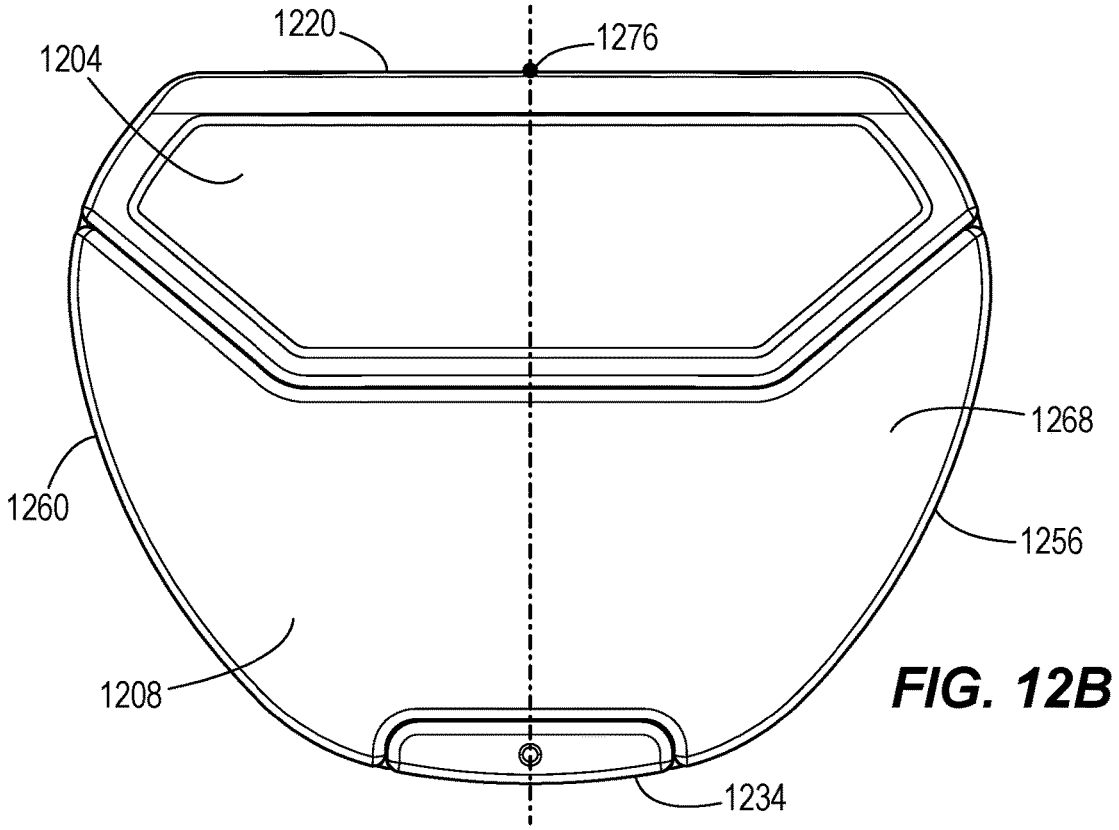
FIG. 12B illustrates a sole view of the two-part putter of FIG. 12A.
Figure 12C:
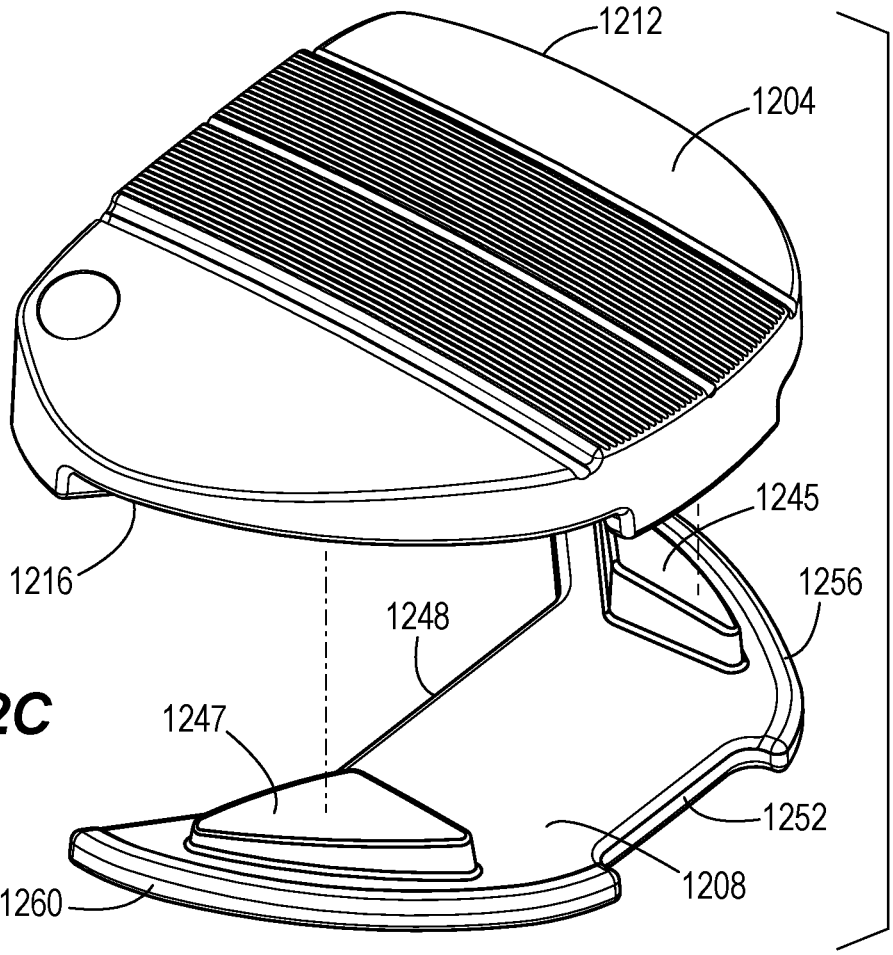
FIG. 12C illustrates an exploded view of the two-part putter of FIG. 12A.
Figure 12D:
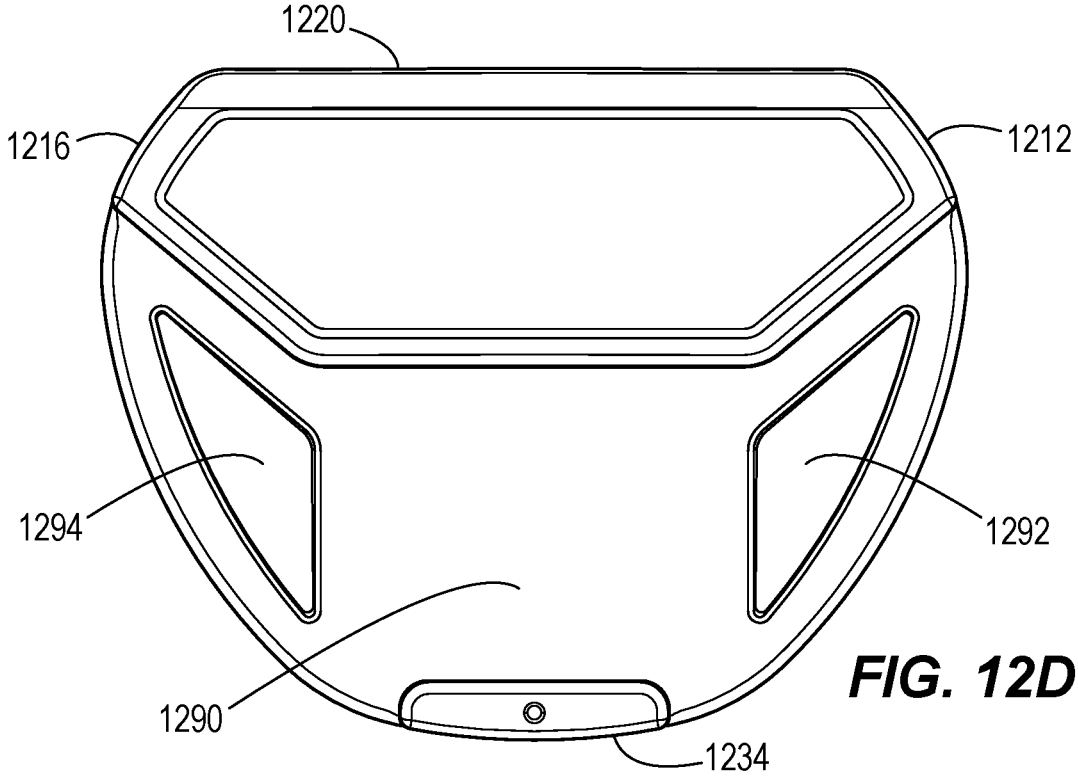
FIG. 12D illustrates a bottom view of the two-part putter of FIG. 12A with the lower portion removed.
Figure 12E:
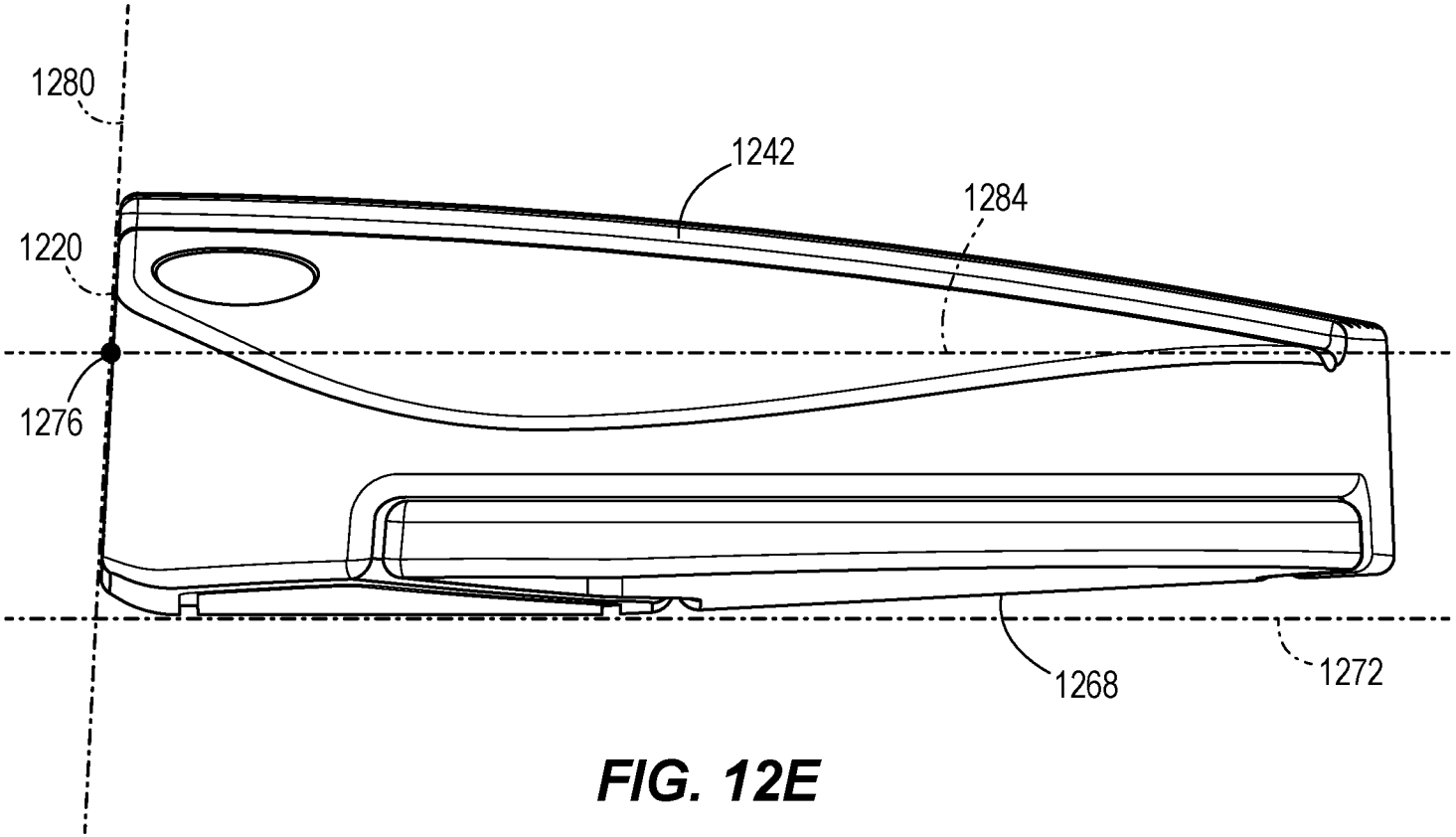
FIG. 12E illustrates a heel view of the two-part putter of FIG. 12A.

The upper portion 1204 of the putter head 1200 comprises a toe end 1212, a heel end 1216, a strike face 1220, a back edge 1234, a crown 1242, and an under surface 1290 (shown in FIG. 12D). The toe end 1212 is opposite the heel end 1216. The strike face 1220 spans from the toe end 1212 to the heel end 1216. The crown 1242 extends an entire width of the strike face 1220 in a toe end 1212 to heel end 1216 direction. The crown 1242 extends between the strike face 1220 and the back edge 1234 of the upper portion 1204. Furthermore, the under surface 1290 is opposite the crown 1242, spanning from the strike face 1220 to the back edge 1234.

The crown 1242 further descends from the strike face 1220 to the back edge 1234. Additionally, the crown 1242 extends away from the strike face 1220, over a majority of the lower portion 1208, to the back edge 1234 of the upper portion 1204. The crown 1242, in most embodiments, spans the entire width of the putter head 1200 in a heel to toe direction from the toe side periphery 1256 and the heel side periphery 1260. Further, in some embodiments, the crown 1242 can be substantially flat from the strike face 1220 to the back edge 1234 or ascend from the strike face 1220 to the back edge 1234. In many embodiments, the descent of the crown 1242 toward the back edge 1234 can be linear, curvilinear, parabolic, sinusoidal, or a function of a polynomial.

Furthermore, the upper portion 1204 of the putter head 1200 can comprise one or more alignment features 1244 on the crown 1242. The alignment feature 1244 can be any one or combination of the following: a line, a series of lines, milling troughs, a circle, a dashed line, a triangle, a channel, or any other desired alignment feature 1244. The alignment features 1244 are equally spaced on the entire crown 1242, wherein the crown is configured to be the width of a golf ball (approximately 4.27 cm). The alignment features 1244, extending along the crown 1242, function to provide the viewer a visual alignment field that extends the width of the golf ball, from the strike face 1220 to the back edge 1234 of the putter head 1200. The goal is to align the putter head 1200 with the golf ball using these alignment features 1244 along the crown 1242.

Referring to FIG. 12D, the upper portion 1204 is affixed to the lower portion 1208 such that the upper portion 1204 is further from a ground plane 1272 than the lower portion 1208, wherein the ground plane 1272 is tangent to the lower portion 1204, when the putter head 1200 is at an address position to strike a golf ball.

Further, the strike face 1220 of the putter head 1200 comprises a strike face center point 1276 and a loft plane 1280. The strike face center point 1276 is equidistant from the crown 1242 and the undersurface of the upper portion 1204, as well as equidistant from the heel end 1216 and toe end 1212 of the putter head 1200. The loft plane 1280 is tangent to the strike face 1220 of the putter head 1200. Further, a midplane 1284 intersects the strike face center point 1276 and is perpendicular to the loft plane 1280. Furthermore, a y-axis 1288 intersects the midplane 1284, and is perpendicular to the ground plane 1272.

When the upper portion 1204 and lower portion 1208 are joined such that the heel end 1216 overlays at least a portion of the heel side periphery 1260. Further, when the upper portion 1204 and lower portion 1208 are joined such that the toe end 1212 overlays at least a portion of the toe side periphery 1256. Further still, when the upper portion 1204 and lower portion 1208 are joined such that the strike face 1220 overlays at least a portion of the front periphery 1248. Finally, the upper portion 1204 and lower portion 1208 are joined such that the back edge 1234 overlays at least a portion of the rear periphery 1252.

The four peripheries (front 1248, rear 1252, toe side 1256, and heel side 1260) of the lower portion 1208, combined with the upper portion 1204 to form a sole 1268. The sole 1268 can extend approximately parallel to the ground plane 1272, wherein the ground plane 1272 is tangent to the sole 1268 when the putter head 1200 is at an address position to strike a golf ball. The sole 1268 of the putter head 1200 extends from the toe end 1212 of the putter head 1200 to the heel end 1216 of the putter head 1200.

In most embodiments, the sole 1268 of the putter head 1200 can be flat. In some embodiments, the sole 1268 of the putter head 1200 can have a slight arch in a heel 1216 to toe 1212 direction, wherein the slight arch can be linear, or a function of a polynomial. In some embodiments, the sole 1268 of the putter head 1200 can have a strong arch in the heel 1216 to toe 1212 direction, wherein the strong arch can be linear, or a function of a polynomial. The sole 1268 functions to provide a surface to rest the putter head 1200 on the ground plane 1272.

Referring to FIG. 12C, the lower portion 1208 can further comprise a toe mass 1245, and a heel mass 1247. The toe mass 1245 and heel mass 1247 are integral to the lower portion 1208. The toe mass 1245 and heel mass 1247 extend from the lower portion 1208, in a direction away from the ground plane 1272, and toward the upper portion 1204. These mass portions provide a means to position and align the upper portion 1204 with the lower portion 1208 of the putter head 1200. Furthermore, these mass features (i.e. toe mass 1245, and heel mass 1247) provide an additional means of adding weight to the perimeter of the putter head 1200. Increasing perimeter weighting can increase the moment of inertia (i.e. MOI) of the putter head 1200 compared to putters without or devoid of these mass features. Furthermore, the weight of the heel mass 1247 and toe mass 1245 can be tailored to achieve a desired swing weight or overall putter head mass. These mass features can have weight that range from 2-5 grams, 3-7 grams or 1-6 grams. The toe mass 1245 and the heel mass 1247 can have similar weight or can comprise different weights within the ranges provided above. The mass features can be 1 gram, 2 grams, 3 grams, 4 grams, 5 grams, 6 grams, or 7 grams. The toe mass 1245 and the heel mass 1247 can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape.

In one embodiment, the toe mass 1245 can be positioned at the junction of the toe side periphery 1256 and the rear periphery 1252, however in other embodiments the toe mass 1245 can be positioned anywhere along the toe side periphery 1256. In many embodiments, the toe mass 1245 can be positioned closer to the front periphery 1248 than the rear periphery 1252. In one embodiment, the heel mass 1247 can be positioned at the junction of the heel side periphery 1260 and the rear periphery 1252, however in other embodiments the heel mass 1247 can be positioned anywhere along the heel side periphery 1260. In many embodiments, the heel mass 1247 can be positioned closer to the front periphery 1248 than the rear periphery 1252.

The toe mass 1245 and the heel mass 1247, provide areas of concentrated mass, such that each mass 1245 and 1247 function to increase the moment of inertia of the putter head 1200. The placement of each mass 1245 and 1247 on the peripheries 1256 and 1260 respectively increases the MOI since each mass 1245 and 1247 is positioned away from a center of gravity of the putter head 1200. Each mass 1245 and 1247 on the peripheries 1256 and 1260 is integrally formed from the second material, wherein the second material is denser than the first material.

In many embodiments, the upper portion 1204 can form at least one cavity. The at least one cavity is formed in the under surface 1290 of the upper portion 1204. As illustrated in FIG. 12D, the upper portion 1204 can form a first cavity 1292 and a second cavity 1294. The first cavity 1292 and second cavity 1294 extend inward from the under surface 1290 of the upper portion 1204 towards the crown 1242 but does extend through the crown 1242. The first cavity 1292 is positioned near the toe side periphery 1256, and the second cavity 1294 is positioned near the heel side periphery 1260, when the lower portion 1208 is joined to the upper portion 1204. The first cavity 1292 functions to receive the toe mass 1245 of the lower portion 1208. The second cavity 1294 functions to receive the heel mas 1247 of the lower portion 1208.

The first cavity 1292 and second cavity 1294 can comprise any desired geometry, however in most embodiments, the first cavity 1292 and the second cavity 1294 comprise a geometry similar or identical to that of the toe mass 1245 and the heel mass 1247. In one embodiment, the first cavity 1292 and the second cavity 1294, and the respective toe mass 1245 and the heel mass 1247 can comprise a general triangle shape. Further, when the upper portion 1204 is affixed to the lower portion 1208, the first cavity 1292 is positioned such that the first cavity 1292 encompasses the toe mass 1245, and the second cavity 1294 is positioned such that the second cavity 1294 encompasses the heel mass 1260.

The combination of the upper portion 1204 comprising the low density first material and the lower portion 1208 comprising the high density second material provides a high MOI putter head 1200. The putter head 1200 comprises a high MOI while maintaining an acceptable weight (i.e. does not create an extremely heavy putter). A single material putter fails to allocate high density material to the periphery, while maintaining a desirable volume. The putter head 1200 comprises a high MOI, a desirable volume (75 cc-110 cc), and a desirable mass (340 grams-385 grams). In one example, the putter head comprises a high MOI (3134 $g \cdot cm^2$), a desirable volume (103 cc), and a desirable mass (357 grams).

The lower portion 1208, in most embodiments, comprises less than 25% of a total volume of the putter head 1200. In some embodiments, the lower portion 1208 comprises less than 24% of the total volume of the putter head 1200, less than 23% of the total volume of the putter head 1200, less than 22% of the total volume of the putter head 1200, less than 21% of the total volume of the putter head 1200, less than 20% of the total volume of the putter head 1200, less than 19% of the total volume of the putter head 1200, less than 18% of the total volume of the putter head 1200, or less than 17% of the total volume of the putter head 1200. In one example, the lower portion 1208 can comprise 16% of the total volume of the putter head 1200.

Although the lower portion 1208 comprises less than half of the volume of the putter head 1200, the lower portion 1208 comprises at least 45% of an overall mass of the putter head 1200. In some embodiments, the lower portion 1208 comprises at least 46% of the mass of the putter head 1200, at least 46% of the mass of the putter head 1200, at least 46% of the mass of the putter head 1200, at least 47% of the mass of the putter head 1200, at least 48% of the mass of the putter head 1200, at least 49% of the mass of the putter head 1200, at least 50% of the mass of the putter head 1200, at least 51% of the mass of the putter head 1200, at least 52% of the mass of the putter head 1200, at least 53% of the mass of the putter head 1200, at least 54% of the mass of the putter head 1200, or at least 55% of the mass of the putter head 1200. In one example, the lower portion 1208 comprises 60% of the mass of the putter head 1200.

The putter head 1200 comprising the high-density lower portion shifts the mass to the periphery of the putter head 1200. Perimeter weighting increases the MOI of the putter head 1200. The putter head 1200 comprises a larger MOI compared to a putter formed from a single material construction with a similar volume and mass (i.e., a putter milled of a single stainless-steel block, or a putter investment cast of a single material).

b. Putter Head with Pocket and Sole Plate

In another embodiment, as illustrated in FIGS. 13A-13E, the putter-type golf club head can comprise a putter head 1300 having a pocket and a sole plate. As described in more detail below, the pocket of putter head 1300 allows weight to be removed from the putter head 1300 and the sole plate allows for increased perimeter weighting. The putter head 1300 comprises an upper portion 1304 and a lower portion 1308. The upper portion 1304 is formed from a first material having a first density and the lower portion 1308 is formed from a second material having a second density. The first density is less than the second density. The upper portion 1304 and the lower portion 1308 combine to create a high-MOI putter head (4000 $g \cdot cm^2$-5500 $g \cdot cm^2$), while maintain a desirable volume and mass. For example, the putter head 1300 can have an MOI ranging from 4000 $g \cdot cm^2$-4500 $g \cdot cm^2$, 4500 $g \cdot cm^2$-5000 $g \cdot cm^2$, or 5000 $g \cdot cm^2$-5500 $g \cdot cm^2$. The putter head 1300 comprises a 2%-15% increase of MOI about the y-axis over a putter head devoid of a multi-material construction (i.e. a single material). For example, the putter head 1300 comprises a 2%-5%, 5%-10%, or 10%-15% increase over a single material putter.

The putter head 1300 comprises a toe end 1312, a heel end 1316, a strike face 1320, a rear end 1334, a crown 1336, and a sole 1368. The toe end 1312 is opposite the heel end 1316. The strike face 1320 extends in a heel to toe direction from the toe end 1312 to the heel end 1314. The rear end 1334 is opposite the strike face 1320 and located at a rearmost portion of the putter head 1300. The crown 1336 extends away from the strike face 1320 toward the rear end 1334.

The upper portion 1304 comprises a low-density material (i.e., the second material). The second material of the upper portion 1304 is less than the first density of the lower portion 1308. The upper portion 1304 comprises the strike face 1320, the rear end 1334, the crown 1336, and an under surface 1342. The under surface 1342 can be a bottommost surface of the upper portion 1304 (i.e., surface that is located closest to the ground when the putter head 1300 is assembled and at an address position). The under surface 1342 of the upper portion 1304 is configured to be affixed to the lower portion 1308 via an adhesive.

The upper portion 1304 further comprises a crown bridge 1338 extending between the strike face 1320 and the rear end 1334. The crown bridge 1338 comprises the crown 1336. The upper portion 1304 further comprises an upright member 1340 extending generally perpendicular from the crown bridge 1338. The upright member 1340 can structurally support the crown bridge 1338 and provide additional structural support to the upper portion 1304.

To further remove mass from the upper portion 1304, the upper portion 1304 defines a pocket 1372. Specifically, as illustrated in FIGS. 13B, 13D, and 13E, the upper portion 1304 comprises a front pocket wall 1376 opposite the strike face 1320, a rear pocket wall 1380 opposite the rear end 1334, a pocket ceiling 1384 opposite the crown 1384, and a pocket floor 1388 opposite the under surface 1342 of the upper portion 1304. The front pocket wall 1376, the rear pocket wall 1380, the pocket ceiling 1384, and the pocket floor 1388 together define the pocket 1372. The pocket 1372 of the upper portion 1304 allows weight to be removed from a center portion of the putter head 1300 thereby allowing weight to be reallocated to the perimeter of the putter head 1300. Increasing perimeter weighting increases the MOI of the putter head 1300 thereby providing greater forgiveness.

The crown bridge 1338 extends from the strike face 1320 to the rear end 1334, over the front pocket wall 1376. The upright member 1340, extending from the crown bridge 1338, divides the pocket 1372 into a toe side pocket 1392 and a heel side pocket 1396. The toe side pocket 1392 and the heel side pocket 1396 allows weight to be removed from the upper portion 1304 and reallocated into the lower portion 1308, the toe mass 1345, and/or the heel mass 1347.

Figure 13A:
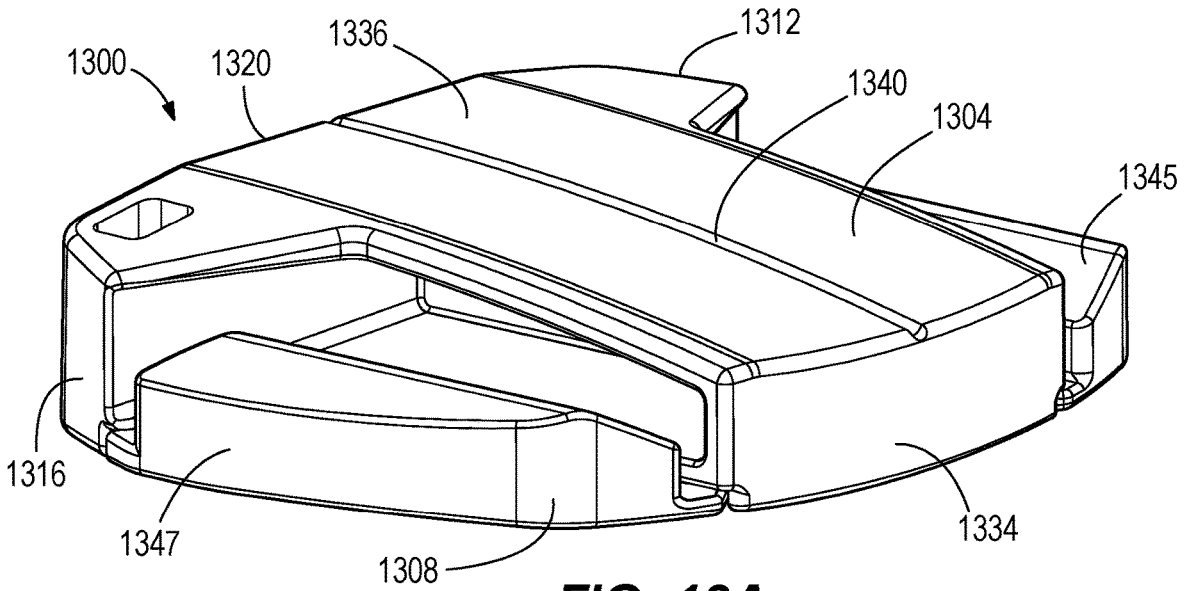
FIG. 13A illustrates a rear perspective view of a two-part putter type club head comprising a pocket.
Figure 13B:
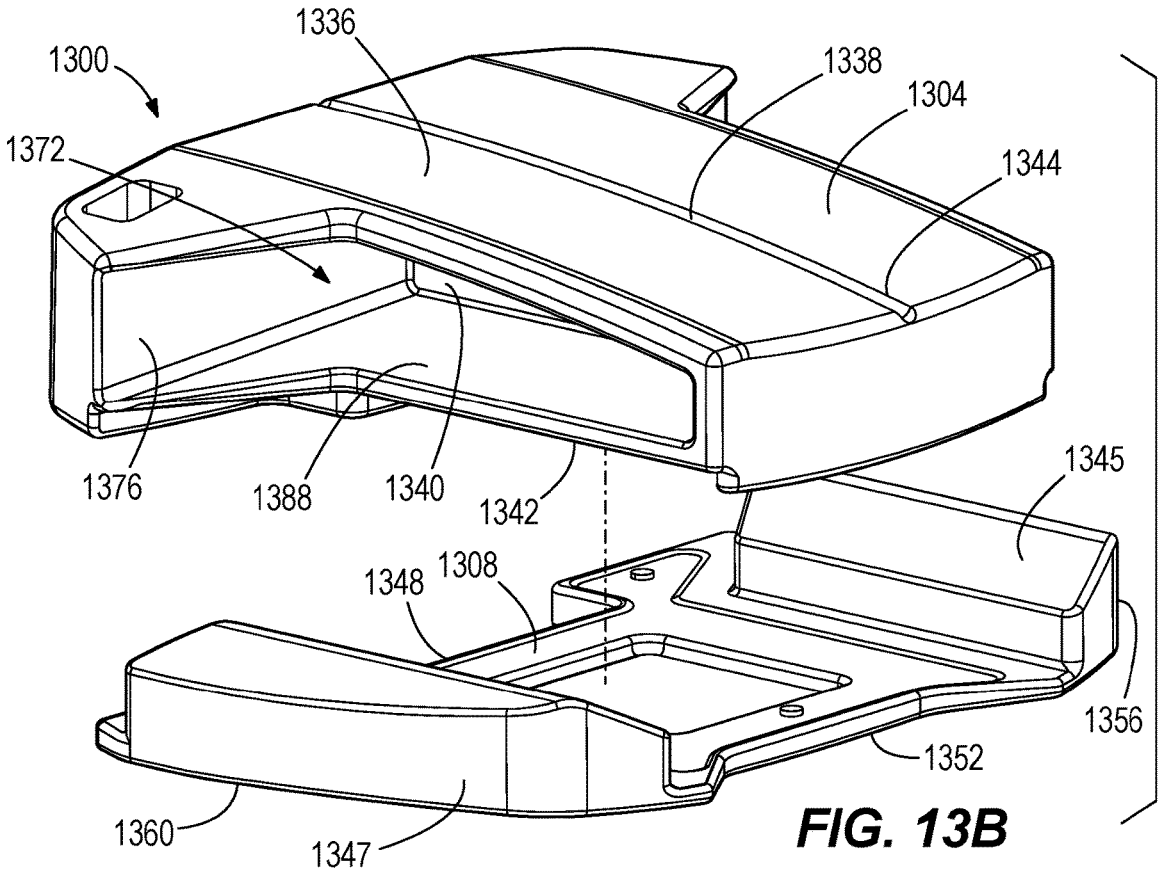
FIG. 13B illustrates an exploded view of the two-part putter of FIG. 13A.

As illustrated in FIGS. 13A and 13B, the upper portion 1304 of the putter head 1300 can comprise one or more alignment features 1344 located on the crown 1336. The alignment feature 1344 can be any one or combination of the following: a line, a series of lines, milling troughs, a circle, a dashed line, a triangle, a channel, or any other desired alignment feature 1344. The alignment features 1344 are equally spaced on the crown 1336, wherein the crown 1336 is configured to be the width of a golf ball (approximately 4.27 cm or 1.68 inch). The alignment features 1344, extending along the crown 1336, function to provide the viewer a visual alignment field that extends the width of the golf ball, from the strike face 1320 to the rear end 1334 of the putter 1300. The goal is to align the putter 1300 with the golf ball using these alignment features 1344 along the crown 1342 in the address position on a putting surface.

The upper portion 1304 is affixed to the lower portion 1308 such that the upper portion 1304 is farther from the ground than the lower portion 1308. The upper portion 1304 can be affixed to the lower portion 1308 via an adhesive. In other embodiments, the upper portion 1304 can be affixed to the lower portion 1308 through a combination of adhesives and interlocking geometry (e.g., cavities receiving protrusions). The upper portion 1304 is affixed to the lower portion 1308 such the crown bridge 1340 is positioned between the toe mass 1345 and the heel mass 1347.

Further, the pocket 1372 can be positioned between the toe mass 1345 and the heel mass 1347. Specifically, as illustrated in FIG. 13A, the toe side pocket 1392 can be positioned between the toe mass 1345 and the upright member 1340, and the heel side pocket 1396 can be positioned between the heel mass 1347 and the upright member 1340. The pocket 1372 removes weight from the upper portion 1304 (i.e., central portion of the upper portion 1304) to allow the weight to be reallocated to the lower portion 1304, the toe mass 1345, and/or the heel mass 1347. The combination of the weight removing features and perimeter mass features increases the MOI of the putter head 1300. The assembled putter head 1300 allows the toe mass 1345 and the heel mass 1347 to be positioned at the perimeter of the putter head 1300. The toe mass 1345 and heel mass 1347 increase the perimeter weighting of the putter head 1300 thereby increasing MOI and forgiveness. Furthermore, the weight of the heel mass 1347 and toe mass 1345 can be tailored to achieve a desired swing weight or overall putter head mass.

When the upper portion 1304 and the lower portion 1308 are joined together, the upper portion 1304 can overlay the front periphery 1348 of the lower portion 1308. When the upper portion 1304 and the lower portion 1308 are joined together, the upper portion 1304 can overlay the rear periphery 1352 of the lower portion 1308. Further, the upper portion 1304 and the lower portion 1308 are joined such that the rear end 1334 overlays a portion of the rear periphery 1352 of the lower portion 1308. Further still, the upper portion 1304 and the lower portion 1308, when joined, together form the sole 1368. The sole 1368 of the putter head 1300 sits on the ground or ground plane when the putter head 1300 is at the address position.

Figure 13C:
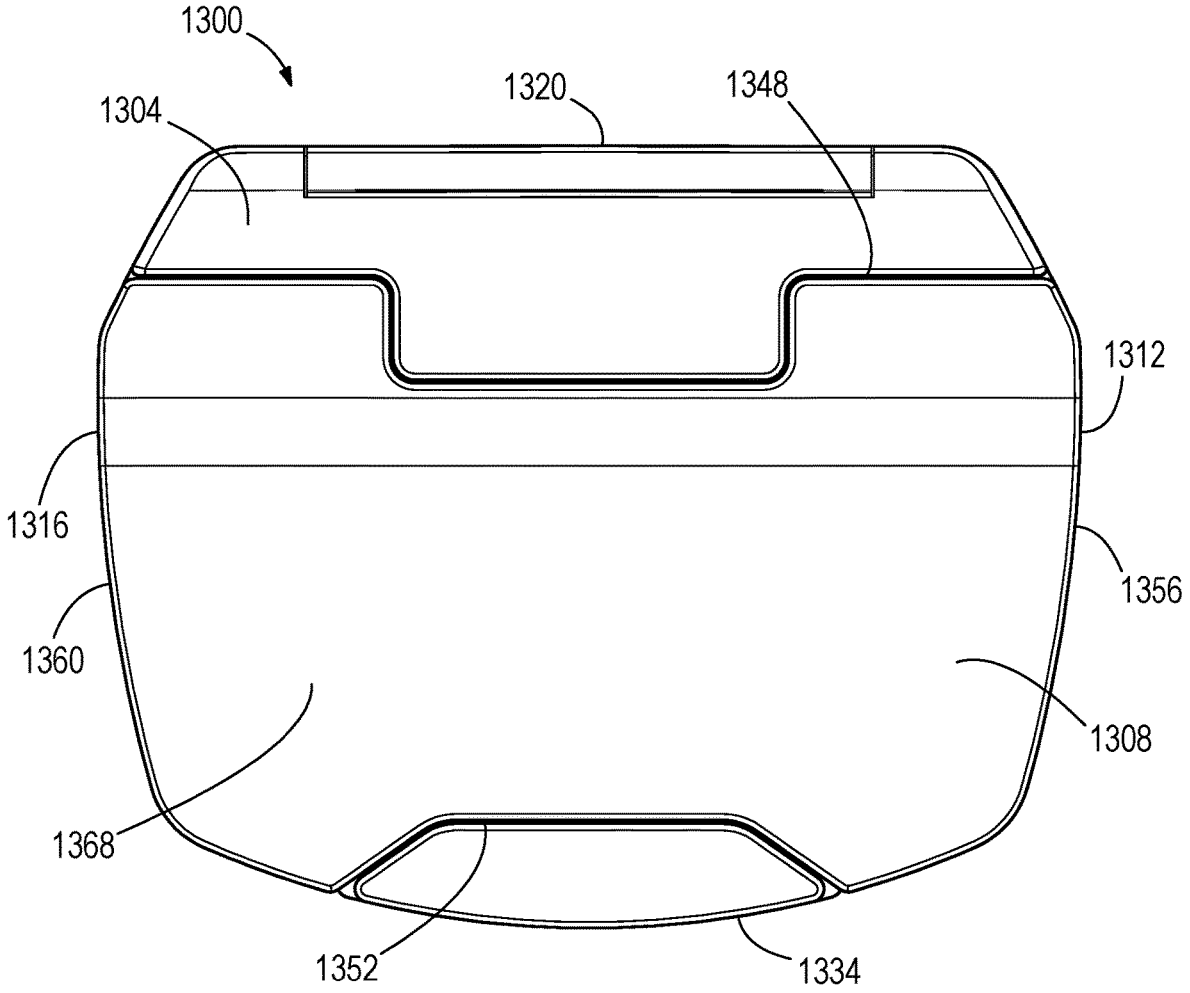
FIG. 13C illustrates a sole view of the two-part putter of FIG. 13A.
Figure 13D:
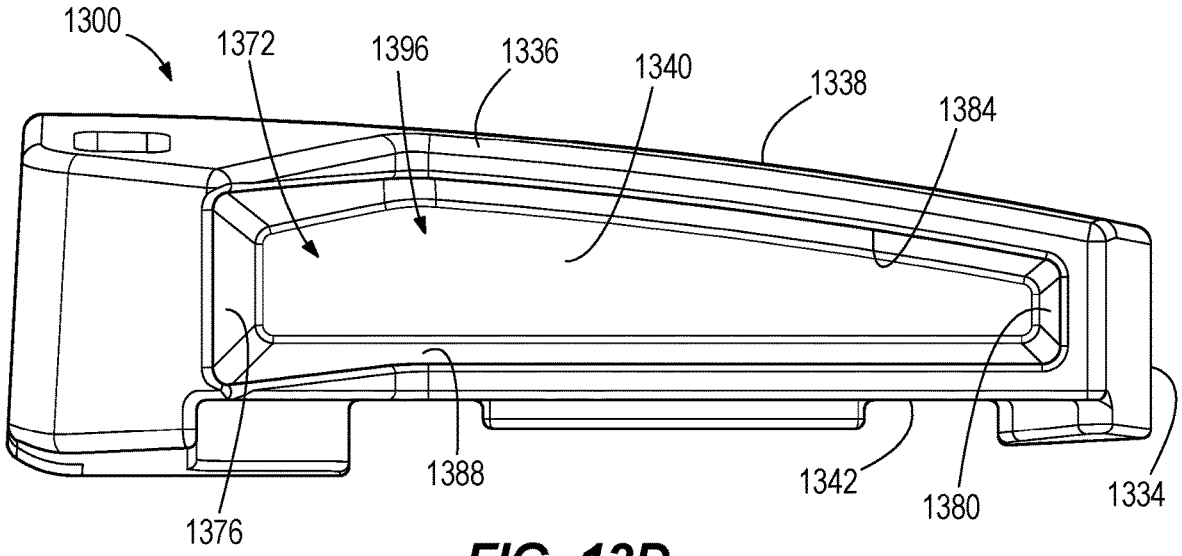
FIG. 13D illustrates a heel view of the two-part putter of FIG. 13A with the lower portion removed.
Figure 13E:
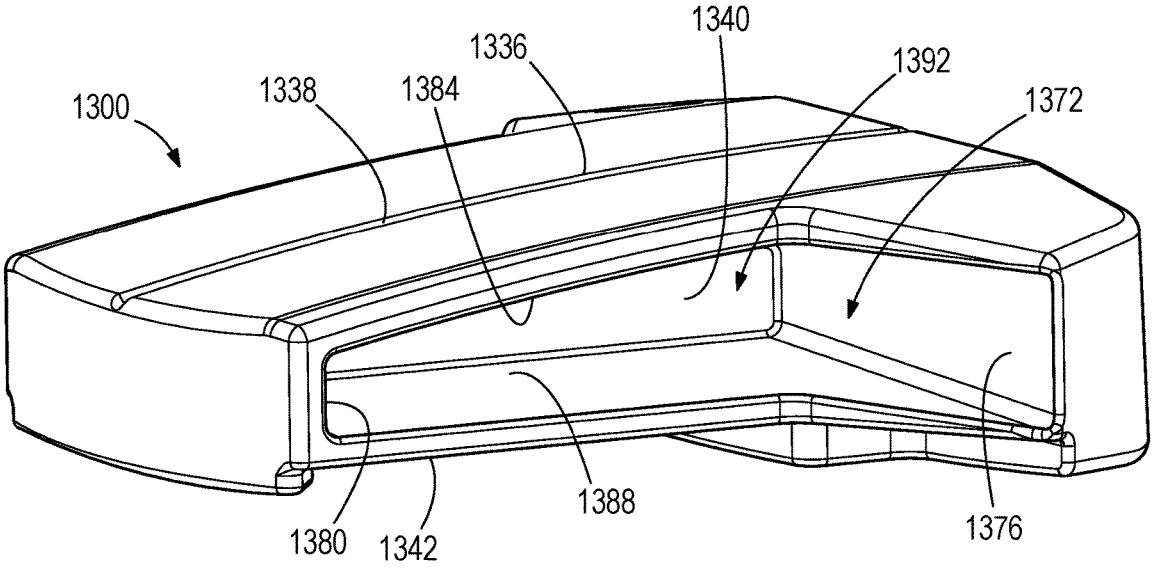
FIG. 13E illustrates a toe view of the two-part putter of FIG. 13A with the lower portion removed.

The lower portion 1308 further comprises a sole plate comprising a high-density material (i.e., the first material), thereby lowering the mass closer to the ground. As illustrated in FIGS. 13B and 13C, the lower portion 1308 comprises an outer periphery having a front periphery 1348, a rear periphery 1352, a toe side periphery 1356, and a heel side periphery 1360. The front periphery 1348 is located closer to the strike face 1320 or is adjacent the strike face 1320. The rear periphery 1352 is located closer to the rear end 1334 or is adjacent the rear end 1334. The toe side periphery 1356 forms a portion of the toe end 1312 and the heel side periphery 1360 forms a portion of the heel end 1314.

Referring to FIGS. 13A and 13B, the lower portion 1308 can further comprise a toe mass 1345 and a heel mass 1347. The toe mass 1345 and the heel mass 1347 are integral to the lower portion 1308. The toe mass 1345 is located at the toe side periphery 1356 of the lower portion 1308, and the heel mass 1347 is located at the heel side periphery 1360 of the lower portion 1308. Both the toe mass 1345 and the heel mass 1347 extend from the lower portion 1308, in a direction away from the ground or upward from the lower portion 1308. Further, the toe mass 1345 and the heel mass 1347 provide an additional means of adding weight to the perimeter of the putter head 1300. Increased weight at the perimeter of the putter head 1300 increases the MOI of the putter 1300. The toe mass 1345 and the heel mass 1347 can have weight that range from 2-5 grams, 3-7 grams or 1-6 grams. The mass features can have all the same weight or be different weight within the ranges provided above. The mass features can be 1 gram, 2 grams, 3 grams, 4 grams, 5 grams, 6 grams, or 7 grams. The toe mass 1345 and the heel mass 1347 can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape.

The toe mass 1345 and the heel mass 1347 provide areas of concentrated mass, such that each mass 1345 and 1347 functions to increase the moment of inertia of the putter head 1300. The placement of the toe mass 1345 on the toe periphery 1356 and the heel mass on the heel periphery 1360, increases the MOI of the putter head 1300 because the masses 1345, 1347 are located on the putter head 1300 perimeter at a maximum distance away from a center of gravity of the putter head 1300. Each mass 1345 and 1347 are integrally formed with the second material, wherein the second material is denser than the first material.

The combination of the upper portion 1304 comprising the low density first material, and the lower portion 1308 comprising the high density second material forms a high MOI putter 1300. The putter head 1300 comprises a high MOI while maintaining an acceptable weight (i.e. does not create an extremely heavy putter). The pocket 1372 formed by the pocket walls of the upper portion 1304 increases the MOI of the putter 1300 by removing weight from a center portion of the putter 1300. The lower portion 1308 comprising the high density second material, the toe mass 1345, and the heel mass 1347 increases the MOI of the putter 1300 by increasing the perimeter weighting of the putter 1300. The multi component design of the putter 1300 provides increased MOI compared to a putter milled from a single material. A putter formed from a single material putter fails to allocate high density material to the periphery, while maintaining a desirable volume (75 cc-100 cc) and mass (340 grams-385 grams).

The lower portion 1308 comprises less than 35% of a total volume of the putter 1300. In other embodiments, the lower portion 1308 comprises less than 34% of the total volume of the putter 1300, less than 33% of the total volume of the putter 700, less than 32% of the total volume of the putter 1300, less than 31% of the total volume of the putter 1300, less than 30% of the total volume of the putter 1300, less than 29% of the total volume of the putter 1300, less than 28% of the total volume of the putter 1300, or less than 27% of the total volume of the putter 1300.

Although the lower portion 1308 comprises less than half of the volume of the putter 1300, the lower portion 1308 comprises at least 45% of an overall mass of the putter 1300. In some embodiments, the lower portion 1308 comprises at least 46% of the mass of the putter 700, at least 47% of the mass of the putter 700, at least 48% of the mass of the putter 1300, at least 49% of the mass of the putter 1300, at least 50% of the mass of the putter 1300, at least 51% of the mass of the putter 1300, at least 52% of the mass of the putter 1300, at least 53% of the mass of the putter 1300, at least 54% of the mass of the putter 1300, or at least 55% of the mass of the putter 1300.

The putter head 1300 comprising the high-density lower portion 1308 shifts the mass to the periphery of the putter head 1300. Perimeter weighting increases the MOI of the putter head 1300. The putter head 1300 comprises a larger MOI compared to a putter formed from a single material construction with a similar volume and mass (i.e., a putter milled of a single stainless-steel block, or a putter investment cast of a single material). The advantages of putter head 1300 over a putter head formed from a single material construction are described in the examples below.

c. Putter Head with Sole Plate and Ball Retrieval Feature

In another embodiment, the putter head 1400 can be a mallet type putter head. Referring to FIGS. 14A-14D, the putter head 1400 comprises an upper portion 1404 and a lower portion 1408. The lower portion 1408 is a sole plate comprising a toe mass 1446, a heel mass 1448, and a rear mass 1450. The putter head 1400 further comprises a ball retrieval feature 1422. The ball retrieval feature 1422 is configured to pick up and retain a golf ball. The ball retrieval feature and sole plate increase the perimeter weighting thereby increasing the MOI and forgiveness of the putter head 1400. The putter head 1400 can have an MOI ranging from 4000 $g \cdot cm^2$-5000 $g \cdot cm^2$. For example, the putter head 1400 can have an MOI ranging from 400 $g \cdot cm^2$ 4500 $g \cdot cm^2$ or 4500 $g \cdot cm^2$-5000 $g \cdot cm^2$. The putter head 1400 comprises a 2%-15% increase of MOI about the y-axis over a putter head devoid of a multi-material construction (i.e. a single material). For example, the putter head 1400 comprises a 2%-5%, 5%-10%, or 10%-15% increase over a single material putter.

The upper portion 1404 comprises of a low-density material (i.e., the first material). The upper portion 1404 comprises a toe end 1412, a heel end 1416, and a strike face 1420. The putter head 1400 can further comprise the strike face feature from putter head 1100 as described above. In this embodiment, the strike face 1420 is an insert that is formed separately and then attached to the putter head 1400. In other embodiments, the strike face 1420 can be formed by the upper portion 1404.

The upper portion 1404 further comprises alignment features 1446. The alignment features are located on the crown 1444 of the putter head. In this embodiment, the alignment feature is defined by three lines extending rearwardly and perpendicular to the strike face. In other embodiments, the alignment feature can take various shapes and sizes according to aspects of the present invention.

The lower portion 1408 comprises a high-density material (i.e., the second material). The lower portion 1408 is a sole plate and thereby forms the sole 1442 of the putter head 1400. The lower portion 1408 comprises a toe side periphery 1438, a heel side periphery 1440, a front periphery 1434, a rear periphery 1436, a toe mass 1446, a heel mass 1448, and a rear mass 1450. The toe mass 1446 and heel mass 1448 improve the overall MOI of the putter head. Furthermore, the weight of the heel mass 1448 and toe mass 1446 can be tailored to achieve a desired swing weight or overall putter head mass. In this embodiment, the lower portion 1408 comprises less than 37% of the total volume of the putter head 1400. In other embodiments, the lower portion 1408 can comprise less than 35%, 34%, 33%, 32%, 31%, 30%, 29%, or 28% of the total volume of the putter head 1400. Although the lower portion 1408 can comprise less than 37% of the total volume of the putter head 1400, the lower portion 1408 comprises at least 63% of the overall mass of the putter head 1400. In other embodiments, the lower portion 1408 comprises at least 50%, 55%, 58%, 60%, 62%, 65%, 68%, or 70% of the overall mass of the putter head 1400.

The upper portion 1404 and lower portion 1408 are combined and secured together via an adhesive layer located on the interlocking geometries of the respective pieces. The upper portion 1404 and lower portion 1408 can also be combined via other fastening means well known in the art. For example, the upper portion 1404 and lower portion 1408 can be combined via screws and threads, tape, or welding.

The putter head 1400 further comprises a ball retrieval feature 1422. The ball retrieval feature 1422 is located on the sole 1442 of the putter head 1400. In this embodiment, the ball retrieval feature 1422 is defined by a recessed formed in the sole 1442. In other embodiments, the ball retrieval feature 1422 can be defined by a cavity or an aperture. The ball retrieval feature 1422 increases the MOI of the putter head by removing material and mass from a central area of the putter head, so a majority of the mass is distributed around the periphery of the putter head 1400. The ball retrieval feature 1422 improves MOI with a perimeter weighted mallet type putter head, while incorporating a ball pick up feature to provide a forgiving putter head that makes it easier to pick up the golf ball from the putting surface during a round of golf. The advantages of putter head 1400 over a putter head formed from a single material construction are described in the examples below.

In this embodiment, the ball retrieval feature 1422 is formed by the upper portion 1404 and the lower portion 1408 such that the upper portion 1404 comprises a recess which forms a portion of the ball retrieval feature 1422 and the lower portion 1408 comprises an aperture which forms the remainder of the ball retrieval feature 1422. In other embodiments, the ball retrieval feature 1422 can be formed by only the upper portion 1404, or by only the lower portion 1408. In this embodiment, the upper portion 1404 and lower portion 1408 comprise complimentary geometry such that when put together, the upper portion 1404 and lower portion 1408 form the ball retrieval feature 1422.

The ball retrieval feature 1422 comprises a ball retention portion 1424. The ball retention portion 1424 is configured to receive and retain a golf ball. The ball retention portion 1424 is defined by a circular shape with a diameter less than the diameter of a golf ball (i.e. golf ball diameter is approximately 1.6 inches). The diameter of the ball retention portion 1424 can range between 1.45 inches to 1.75 inches to accommodate different sized golf balls. To properly retain the golf ball, the ball retention portion 1424 comprises a ball retention edge 1428. The ball retention edge 1428 is configured to grip the surface of the golf ball. Accordingly, the ball retention edge 1428 engages with approximately 75%-90% of the circumference of the golf ball. In other embodiments, the ball removal edge 1430 engages 5-90% of the circumference of the golf ball.

The ball retrieval feature 1422 further comprises a ball removal portion 1426. The ball removal portion 1426 is defined by a semicircular slot shape and is configured to receive a user's finger to reach underneath the golf ball and remove it from the ball retention portion 1424. The semicircular slot shape can have a width that can range from 0.25 in to 1 inch. The ball removal portion 1426 comprises a ball removal edge 1430 which does not engage or contact the ball while the ball is received in the ball retention portion 1424. The ball removal edge 1430 is offset from the ball retention edge 1428 to allow the user to reach around the golf ball. The ball removal portion 1426 allows the user to grab around and underneath the golf ball (i.e. pull and rotate the golf ball out of ball retention portion) to remove it from the putter head 1400. Pulling and rotating (i.e. two degrees of movement) the golf ball out of the putter head 1400 is advantageous over a pulling force (i.e. one degree of movement).

Figure 14A:
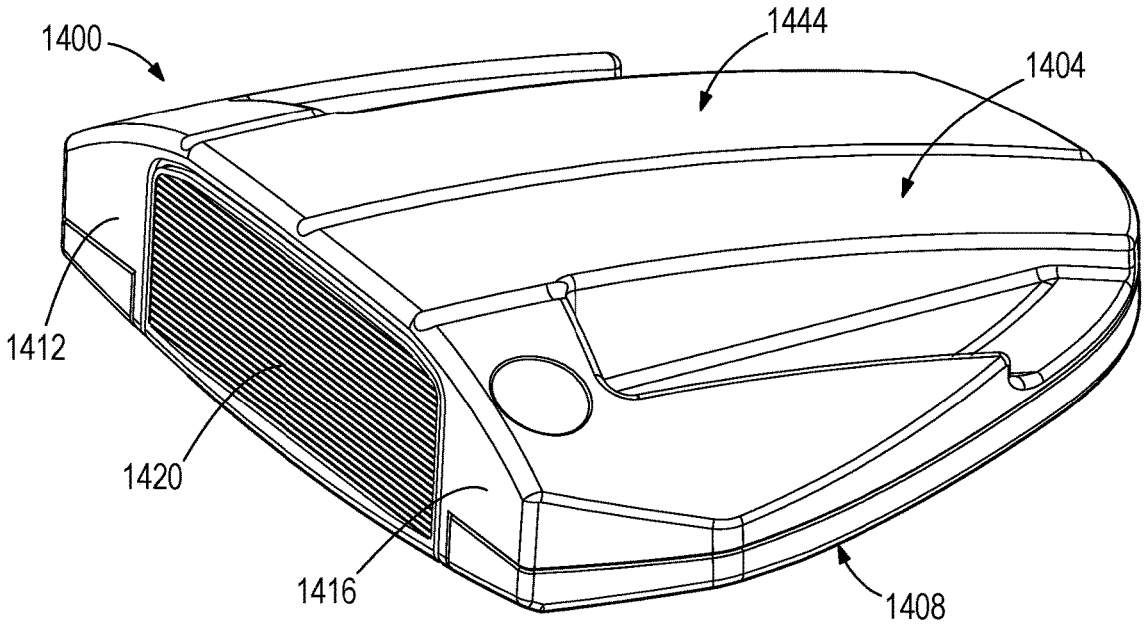
FIG. 14A illustrates a top perspective view of a two-part putter head comprising a ball retrieval feature according to a first embodiment.
Figure 14B:
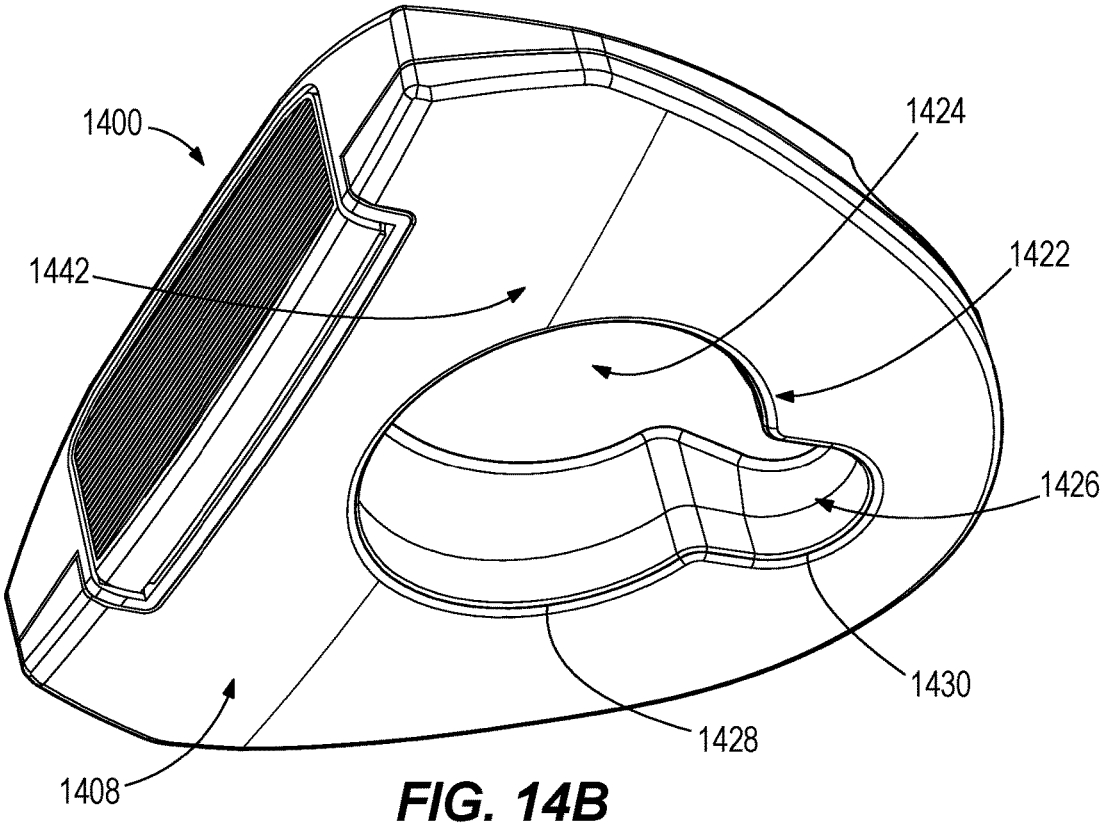
FIG. 14B illustrates a bottom perspective view of the putter head of FIG. 14A.
Figure 14C:
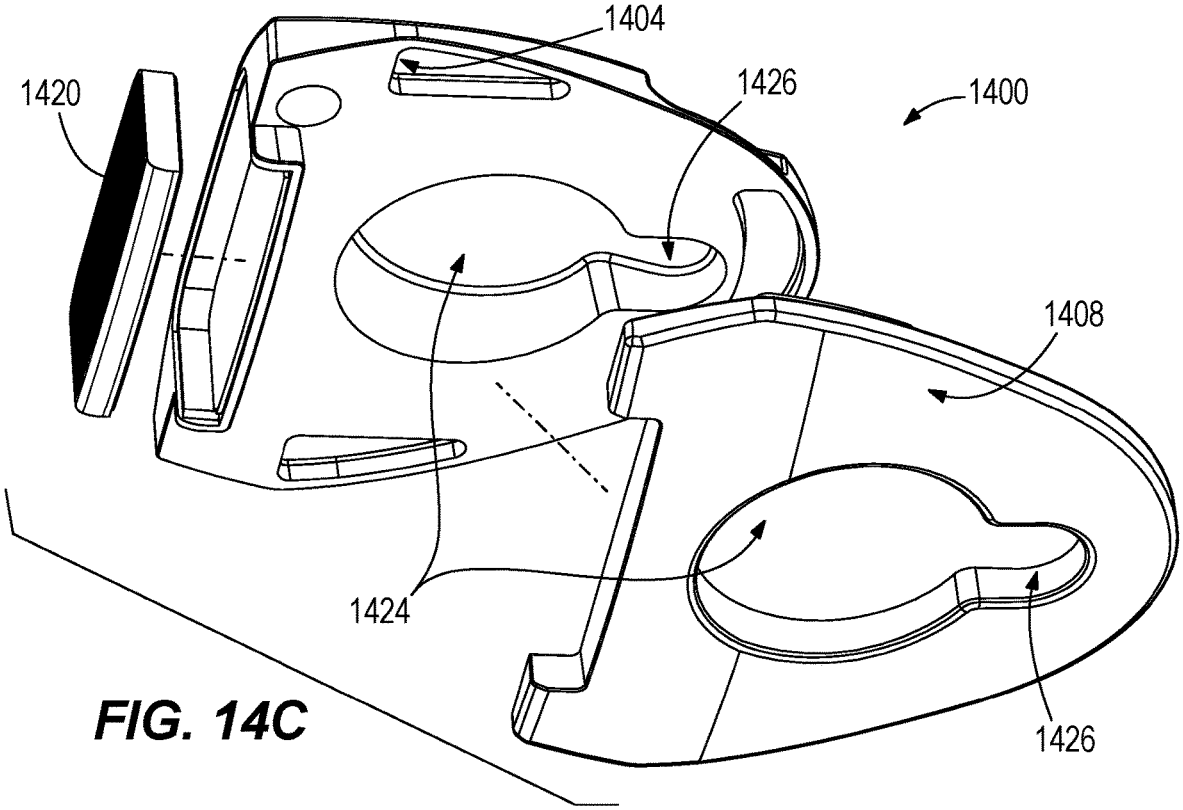
FIG. 14C illustrates an exploded view of the putter head of FIG. 14A.
Figure 14D:
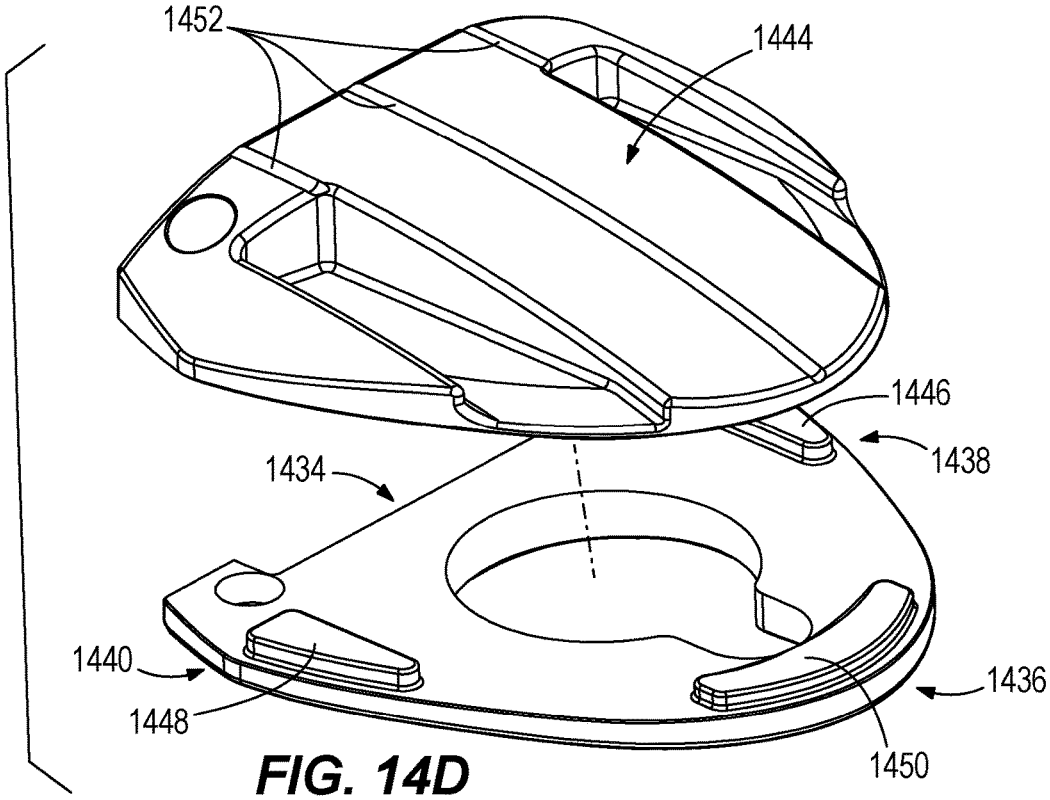
FIG. 14D illustrates an exploded view of the putter head of FIG. 14A.
Figure 14E:
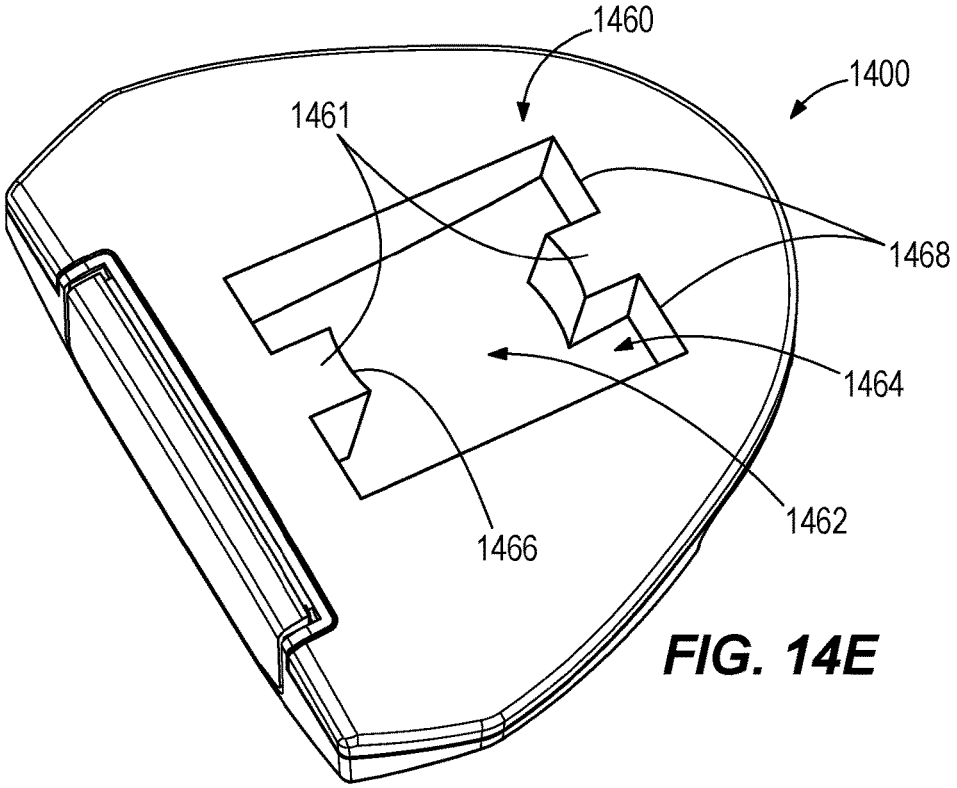
FIG. 14E illustrates a bottom perspective view of a two-part putter head comprising a ball retrieval feature according to a second embodiment.

FIGS. 14E-14H illustrates additional embodiments of a ball retrieval feature to be used on putter head 1400. FIG. 14E illustrates a ball retrieval feature 1460 comprising a ball retention portion 1462, a ball removal portion 1464, and a plurality of prongs 1461. In this embodiment, the ball retrieval feature 1460 has two prongs 1461. Each prong 1461 is located on opposite sides of the ball retrieval feature 1460. In this embodiment, one prong 1461 is located proximate the strike face, and the other prong 1461 is located near the rear. The prongs 1461 define the ball retention portion 1462 and ball retention edges 1466 which engage the ball. The ball removal portion 1464 has ball removal edges 1468 that are located adjacent to the prongs 1461. As mentioned above, the ball removal edges 1468 do not engage the ball.

Figure 14F:
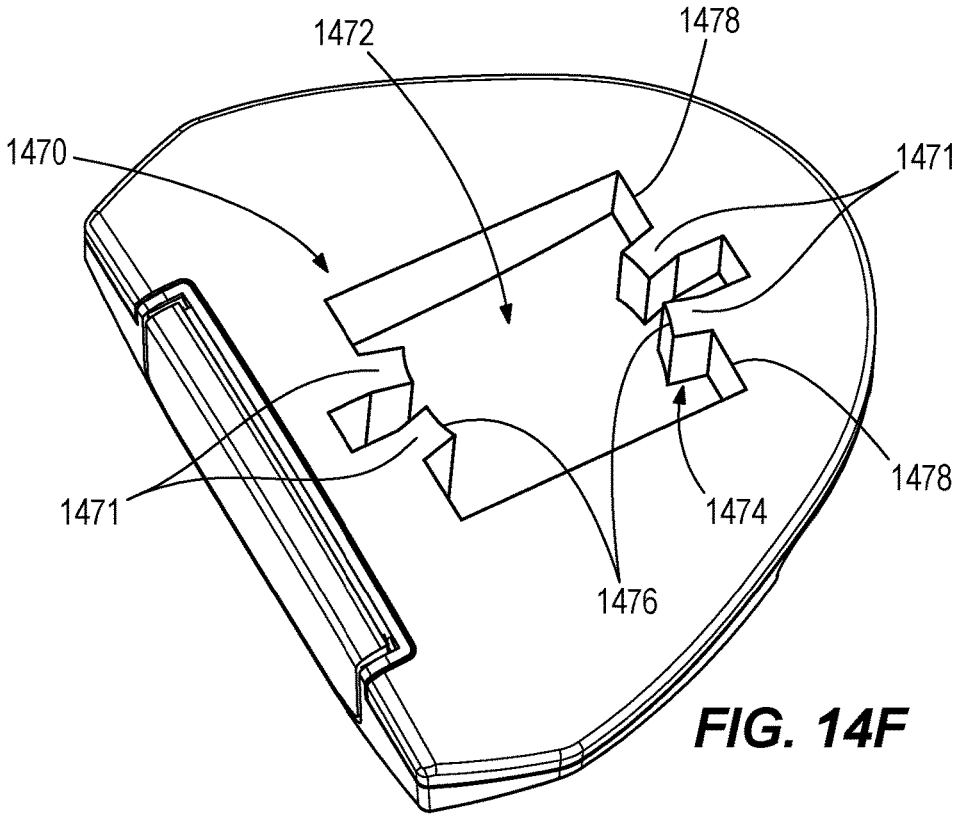
FIG. 14F illustrates a bottom perspective view of a two-part putter head comprising a ball retrieval feature according to a third embodiment.

FIG. 14F illustrates a ball retrieval feature 1470 comprising a ball retention portion 1472, a ball removal portion 1474, and a plurality of prongs 1471. In this embodiment, the ball retrieval feature 1470 has four prongs 1471. The prongs 1471 are grouped into a first set and a second set. The first set of two prongs 1471 are located proximate the strike face and the second set of prongs 1471 are located near the rear. The prongs 1471 comprise the ball retention edges 1432. The ball retention edges 1432 are defined by a circle having a diameter of a golf ball. The ball removal portion 1474 has ball removal edges 1478 that are located adjacent to the prongs 1471. As mentioned above, the ball removal edges 1478 do not engage the ball.

Figure 14G:
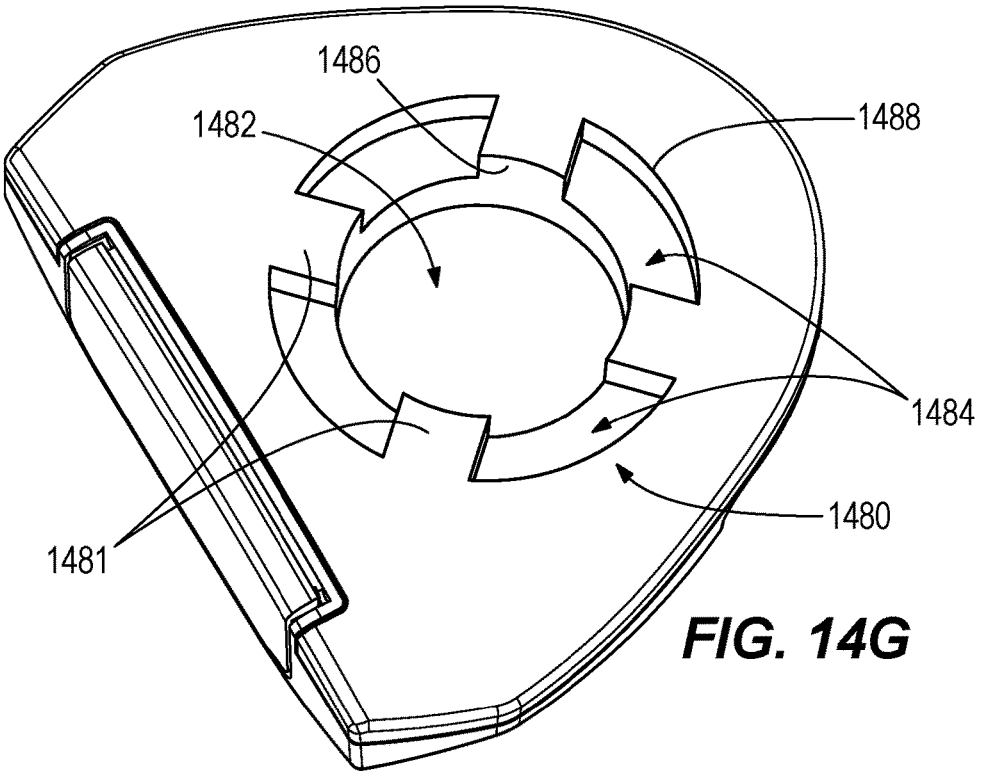
FIG. 14G illustrates a bottom perspective view of a two-part putter head comprising a ball retrieval feature according to a fourth embodiment.

FIG. 14G illustrates a ball retrieval feature 1480 comprising a ball retention portion 1482, a ball removal portion 1484, and a plurality of prongs 1481. The ball retention portion 1482 is defined by a circular shape with a diameter that is slightly less than a golf ball, as mentioned above. In this embodiment, the ball retention portion 1482 has four prongs 1481 located around the perimeter of the circular shape. The prongs 1481 are arranged in 90-degree intervals around the circular shape. The prongs 1481 further define the ball retention edges 1486. The ball retention edges 1486 are curved due to the circular shape which defines the ball retention portion. The ball removal portion 1484 is defined by a larger circular shape than that of the ball retention portion 1482. The ball removal portion 1484 is further defined by a first recess with a first depth and the ball retention portion 1482 is further defined by a second recess with a second depth such that the first depth is less than the second depth. The ball removal portion 1484 has ball removal edges 1488 that are located adjacent to prongs 1481. As mentioned above, the ball removal edges 1488 do not engage the ball.

Figure 14H:
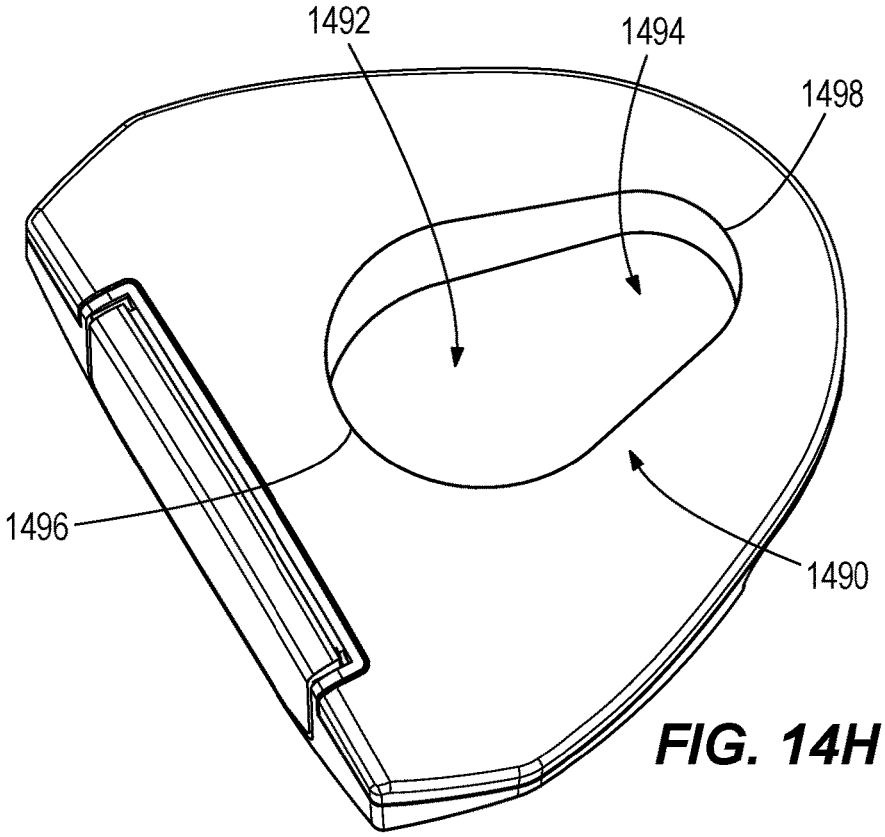
FIG. 14H illustrates a bottom perspective view of a two-part putter head comprising a ball retrieval feature according to a fifth embodiment.

FIG. 14H illustrates a ball retrieval feature 1490 comprising a ball retention portion 1492 and a ball removal portion 1494. The ball retrieval feature 1490 takes a pear shape such that the ball retention portion 1492 is located at the larger end of the pear shape and the ball removal portion 1494 is located at the smaller end of the pear shape. The ball retention portion 1492 is defined by a circular shape with a diameter than is slightly less than a golf ball. The ball removal portion 1494 is defined by a circular that has a diameter less than that of the ball retention portion 1492. The positioning and size of the ball retention portion 1492 and the ball removal portion 1494 form the pear shape. The pear shape can also be described as an oblong ellipse As mentioned above, the ball retention portion 1492 comprises a ball retention edge 1496 and the ball removal portion 1494 comprises a ball removal edge 1498. As mentioned above, the ball removal edge 1498 does not engage the ball.

d. Putter Head with Ball-Outlining Alignment Aid and Sole Plate

Figure 15A:
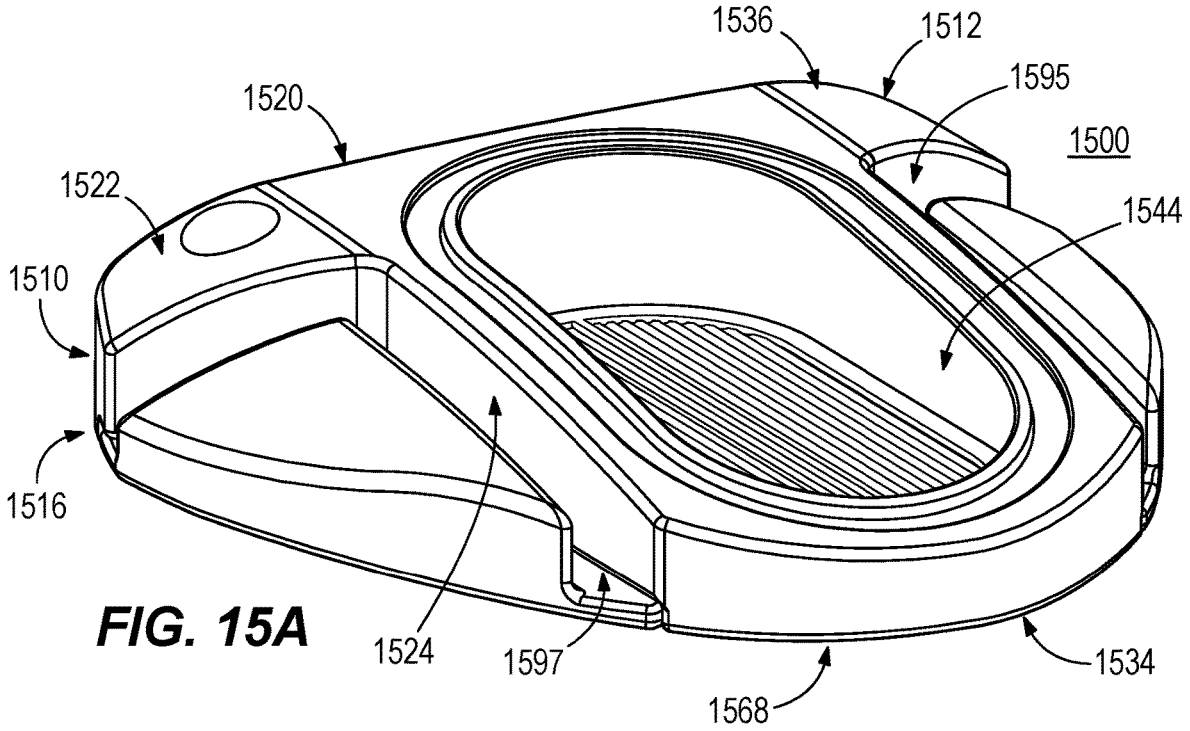
FIG. 15A illustrates a rear perspective view of a two-part putter head comprising a ball-outlining alignment aid.
Figure 15B:
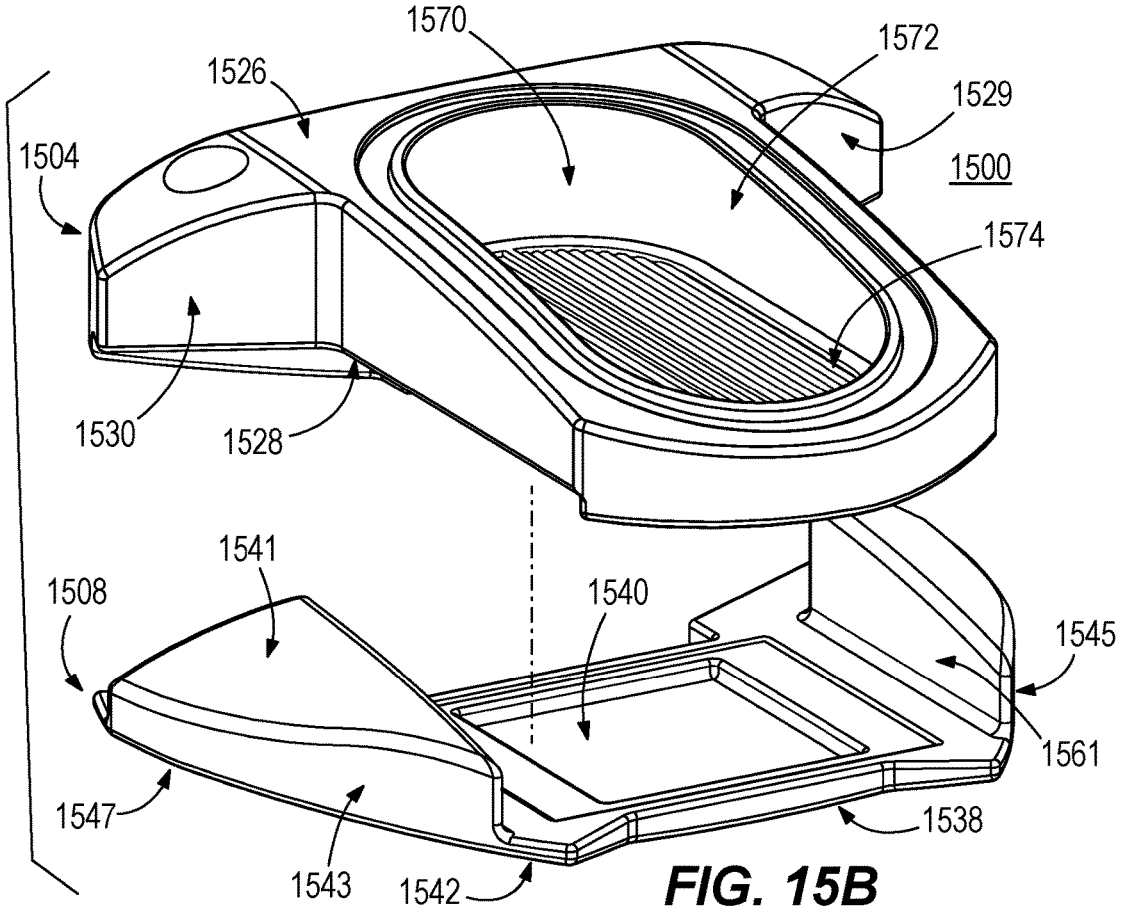
FIG. 15B illustrates a rear perspective exploded view of the two-part putter head of FIG. 15A.
Figure 15C:
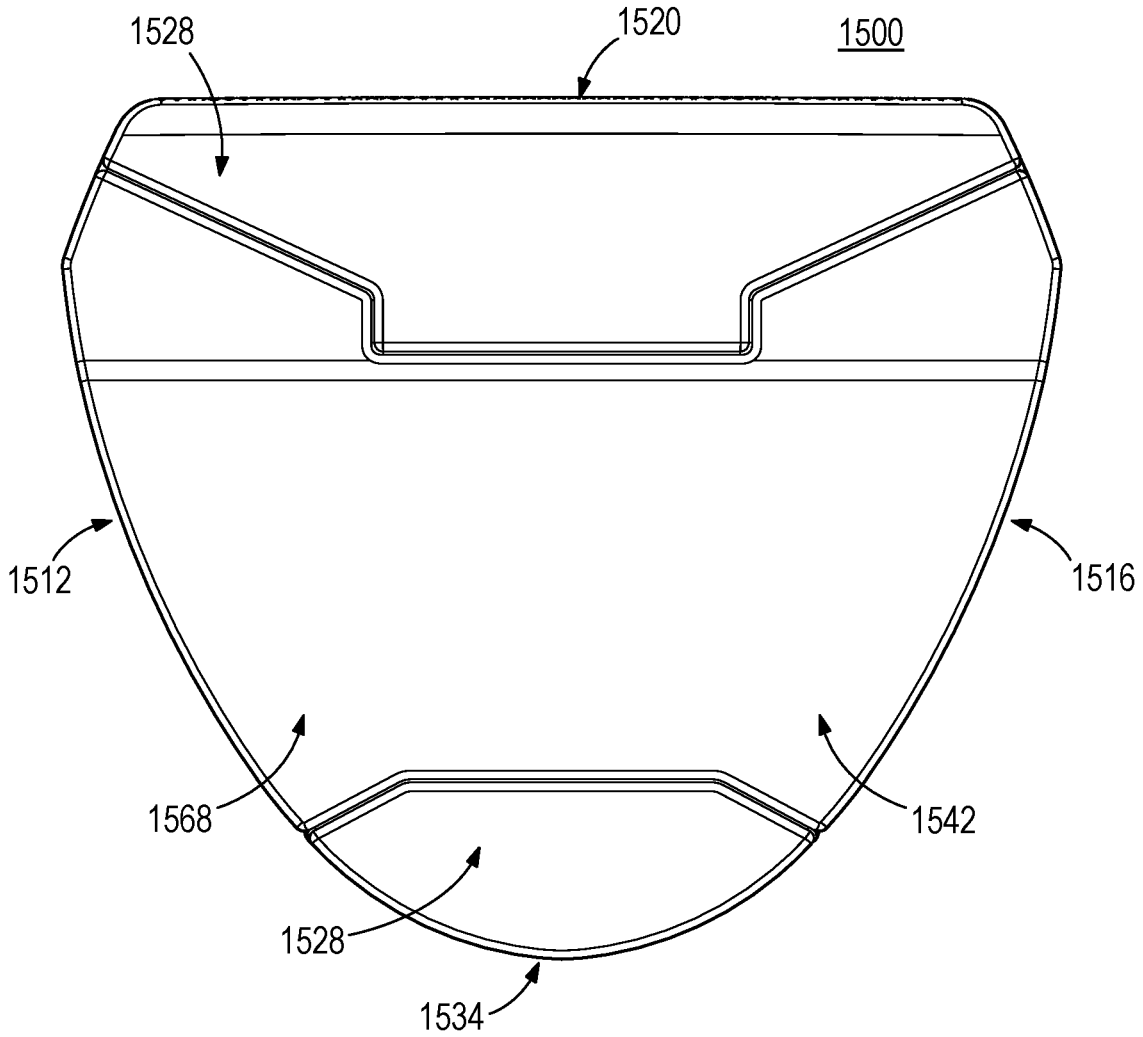
FIG. 15C illustrates a bottom view of the two-part putter head of FIG. 15A.

In one embodiment, the putter-type golf club head comprises a two-part construction and includes an alignment aid having a ball-outlining feature. The two-part construction allows the putter-type club head to be formed from multiple materials. Referring to FIGS. 15A and 15B, the putter-type golf club head 1500 comprises an upper portion 1504 and a lower portion 1508. The upper portion 1504 is affixed to the lower portion 1508. The upper portion 1504 is formed from a first material having a first density, and the lower portion 1508 is formed from a second material having a second density. In some embodiments, the first density is less than the second density. As discussed in more detail below, the upper portion 1504 and the lower portion 1508 combine to create a high-MOI putter-type club head 1500 (5000 g·cm$^2$-6500 g·cm$^2$), while maintaining a desirable volume and mass. For example, the putter head 1500 can have an MOI ranging from 5000 g·cm$^2$-5500 g·cm$^2$, 5500 g·cm$^2$-6000 g·cm$^2$, 6000 g·cm$^2$-6500 g·cm$^2$. The putter head 1500 comprises a 2%-15% increase of MOI about the y-axis over a putter head devoid of a multi-material construction (i.e. a single material). For example, the putter head 1500 comprises a 2%-5%, 5%-10%, or 10%-15% increase over a single material putter.

The putter-type club head 1500 further comprises a crown 1536, a sole 1568, a strike face 1520, a rear end 1534, a toe end 1512, and a heel end 1516. The outermost points of the strike face 1520, the rear end 1534, the toe end 1512, and the heel end 1516 define a perimeter 1510 of the putter-type club head 1500. The upper portion 1504 and the lower portion 1508 are affixed together and each form a portion of the crown 1536, a portion of the sole 1568, a portion of the toe end 1512, a portion of the heel end 1516, and a portion of the perimeter 1510. The crown 1536 gradually slopes from the strike face 1520 to the rear end 1534 such that the putter-type club head 1500 is thicker near the strike face 1520 and gradually thins towards the rear end 1534. The slope of the crown 1536 can be linear, curvilinear, parabolic, sinusoidal, or a function of polynomial. Further, the strike face 1520 comprises a strike face center point equidistant from the heel end 1516 and toe end 1512, as well as equidistant from the crown 1536 and the sole 1568.

In many embodiments, the sole 1568 can be planar. In some embodiments, the sole 1568 can have a slight arch in a heel end 1516 to toe end 1512 direction, wherein the slight arch can be linear, or a function of a polynomial. In some embodiments, the sole 1568 can have a strong arch in the heel end 1516 to toe end 1512 direction, wherein the strong arch can be linear, or a function of a polynomial. The sole 1568 functions to provide a surface to rest the putter-type club head 1500 on the ground plane 1590. As discussed above, the putter-type club head 1500 comprises an upper portion 1504 and a lower portion 1508, where the lower portion 1508 forms a majority of the sole 1568 and rests on the ground plane. The upper portion 1504 sits above the lower portion 1508 when the putter-type club head 1500 is assembled.

As discussed above, the upper portion 1504 comprises a low-density material (i.e., the first material). In many embodiments, the upper portion 1504 is formed from aluminum. The upper portion 1504 is affixed to the lower portion 1508 to define the crown 1536, the sole 1568, the toe end 1512, the heel end 1516, and the perimeter 1510. The upper portion 1504 comprises an upper portion top surface 1526 and an upper portion bottom surface 1528, where the upper portion top surface 1526 forms a portion of the crown 1536, and the upper portion bottom surface 1528 forms a portion of the sole 1568. The upper portion 1504 further comprises a forward portion 1522 and a rearward extension 1524. The forward portion 1522 comprises the strike face 1520. The rearward extension 1524 extends rearward from the forward portion 1522 towards the rear end 1534. The rearward extension 1524 is generally perpendicular to the strike face 1520 such that the forward portion 1522 and the rearward extension 1524 form a T-shape.

The forward portion 1522 comprises rear walls opposite the strike face 1520 near the heel end 1516 and the toe end 1512. The rearward extension 1524 comprises side walls near the heel end 1516 and the toe end 1512. The rear wall and side wall near the toe end 1512 define a toe wall 1529, and the rear wall and side wall near the heel end 1516 define a heel wall 1530. The toe wall 1529 and the heel wall 1530 that frame the T-shape of the upper portion 1504. Further, the toe and heel walls 1529, 1530 define cutout regions that allow the upper portion 1504 to receive the lower portion 1508. The cutout regions extend inward from the toe end 1512 or the heel end 1516 toward the center of the upper portion 1504. The cutout regions are bounded by the crown 1536, the perimeter 1510, and either the toe wall 1529, or the heel wall 1530. The toe and heel walls 1529, 1530 define a boundary between the cutout regions and the forward portion 1522, as well as a boundary between the cutout regions and the rearward extension 1524. The cutout portions remove mass from the low-density upper portion 1504, which is replaced with the high-density lower portion 1508 to increase the perimeter weighing of the putter-type club head 1500.

To further reduce the mass of the upper portion 1504, the upper portion 1504 defines a central recess 1570 that extends from the forward portion 1522 to the rear end 1536. The central recess 1570 removes mass from a central portion of the upper portion 1504, thereby allowing mass to be moved toward the perimeter 1510. The central recess 1570 is defined by a recess wall 1572 and a recess floor 1574. The recess floor 1574 is recessed into the upper portion 1504 away from the upper portion top surface 1526, and the recess wall 1572 circumscribes the recess floor 1574. The recess wall 1572 defines a transition between the upper portion top surface 1526 and the recess floor 1574.

The recess wall 1572 comprises a height. In some embodiments, the recess wall height slopes with the slope of the crown 1536 such that the recess wall height is larger near the strike face 1520 and smaller near the rear end 1534. In such an embodiment, the recess wall 1572 comprises a height near the rear end 1534 such that the recess floor 1574 is not flush with the upper portion top surface 1526. In other embodiments, the recess wall height remains constant throughout the central recess 1570. The recess floor 1574 is parallel to the ground plane to provide a parallel surface to the ground plane for portions of the alignment aid 1544. The central recess 1570 is located near a middle of the putter-type club head 1500 within the forward portion 1522 and the rear extension 1524 to provide a centered feature for the alignment aid 1544. The central recess 1570 further contributes to the alignment aid 1544, as discussed in more detail below.

Figure 15D:
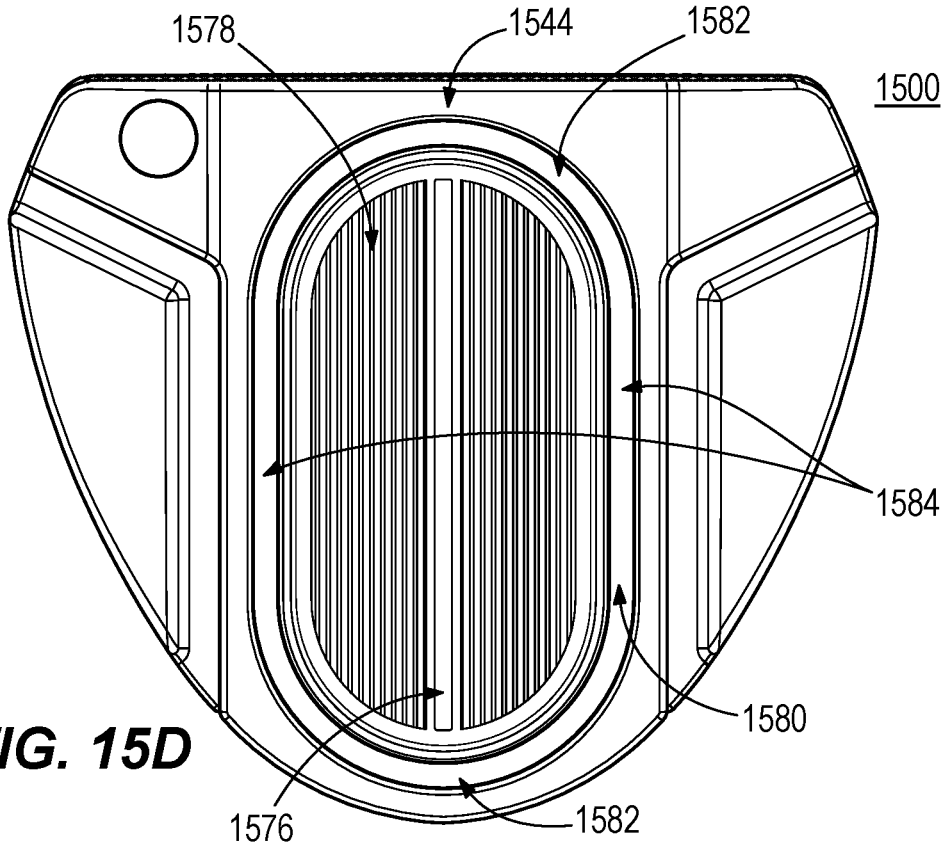
FIG. 15D illustrates a top view of the two-part putter head comprising the ball-outlining alignment aid of FIG. 15A.
Figure 15E:
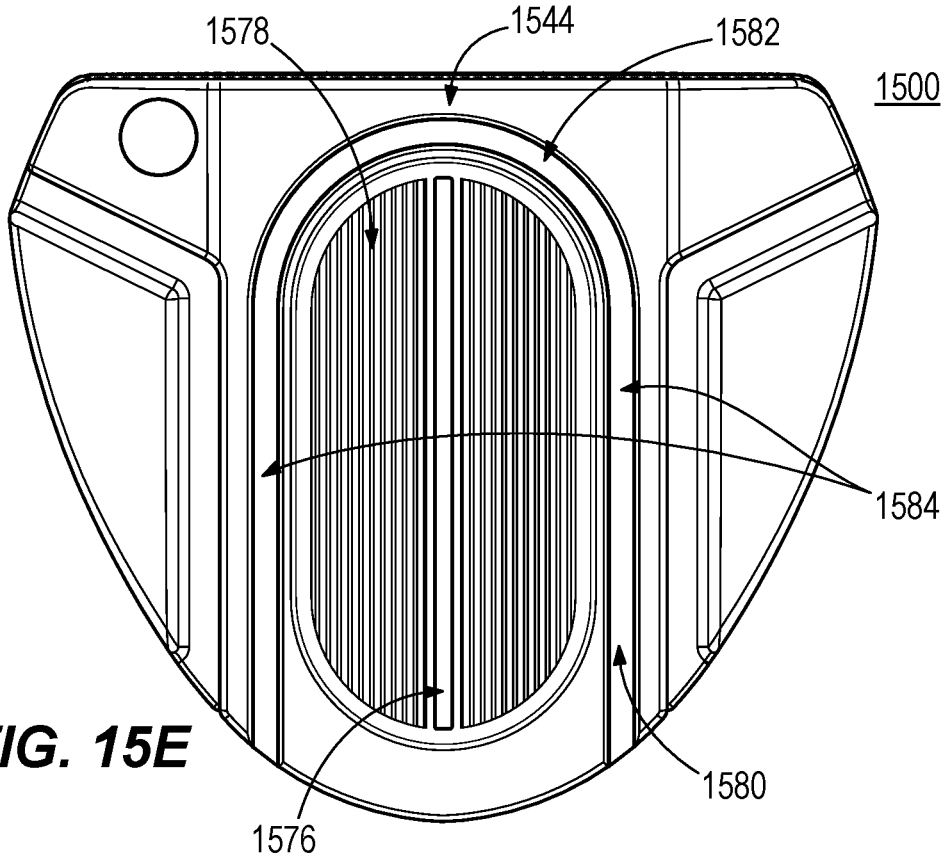
FIG. 15E illustrates a top view of the two-part putter head comprising a ball-outlining alignment aid according to a second embodiment.
Figure 15F:
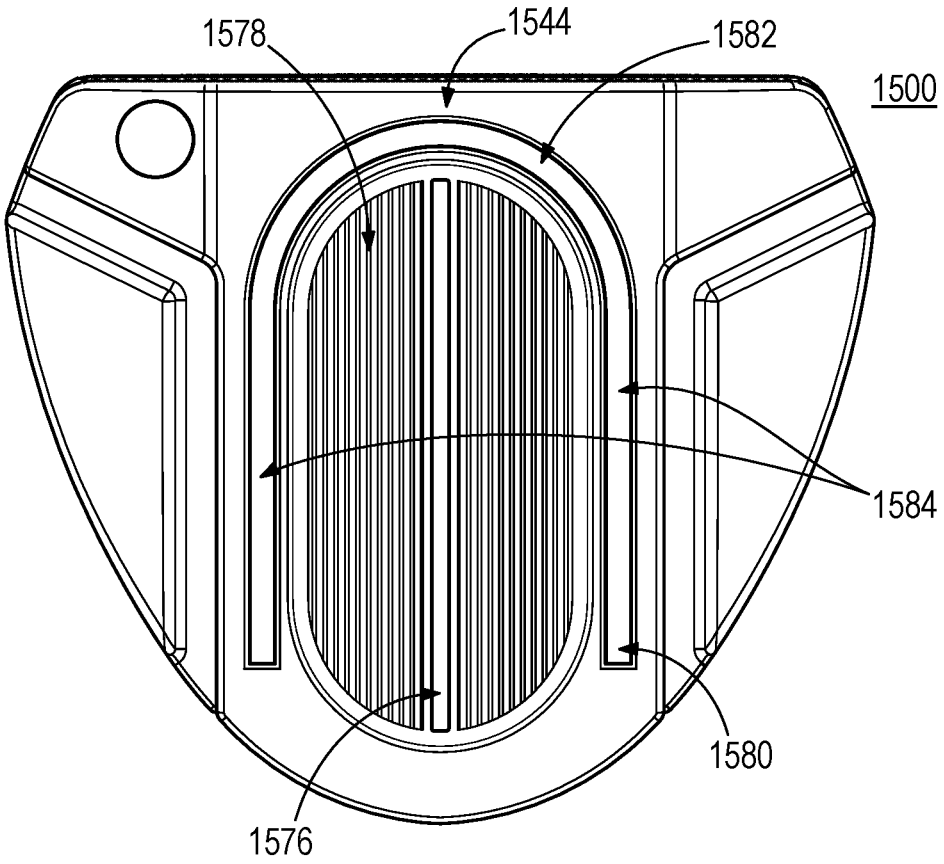
FIG. 15F illustrates a top view of the two-part putter head comprising a ball-outlining alignment aid according to a third embodiment.

Referring to FIG. 15D-15F, the upper portion 1504 further comprises an alignment aid 1544. The alignment aid 1544 extends along the upper portion 1504 from the forward portion 1522 to the rear end 1534. The alignment aid 1544 comprises several features that work, in conjunction with the central recess 1570, to provide the viewer a visual alignment field that extends from the strike face 1520 to the rear end 1534. The goal is to align the entire putter-type club head 1500 with the golf ball using the alignment aid 1544.

The alignment aid 1544 comprises several corresponding features that are carefully positioned relative to the central recess 1570. Referring to FIGS. 15D-15F, the alignment aid 1544 comprises a ball-outlining feature 1580, a central line 1576, and a plurality of grooves 1578. The ball-outlining feature 1580 is formed integrally with the upper portion 1504. The ball-outlining feature 1580 is centered on the strike face center point and positioned at an offset from the strike face 1520. The ball-outlining feature 1580 is approximately the width of a golf ball (1.68 inches) to help frame the golf ball during a swing. In some embodiments, the ball-outlining feature 1580 is slightly wider than the width of a golf ball to allow forgiveness when framing the ball. The ball-outlining feature 1580 is generally golf ball shaped near the strike face 1520.

The ball-outlining feature 1580 is located on the upper portion top surface 1526 above the central recess 1570. However, the ball-outlining feature 1580 generally follows a perimeter of the central recess 1570. The ball-outlining feature 1580 comprises one or more arcuate portions 1582 and a set of parallel lines 1584 connected to the one or more arcuate portions 1582. At least one arcuate portion 1582 arcs near the strike face 1520 and is offset from the strike face 1520. Referring to FIG. 15D, in some embodiments, the ball-outlining feature 1580 comprises two arcuate portions 1582, where one arcuate portion arcs near the strike face 1520, and the other arcs near the rear end 1534. The one or more arcuate portions 1582 generally resemble one half of a golf ball. The parallel lines 1584 extend rearward from the arcuate portion 1582 toward the rear end 1534. The parallel lines 1584 are generally parallel to the rear extension 1524. The parallel lines 1584 are approximately the width of a golf ball (1.68 inches). The ball-outlining feature 1580 is generally the width of a golf ball and generally resembles an elongated golf ball to help the viewer visualize the trajectory of the golf ball. The ball-outlining feature is located on the upper portion top surface 1526 and outlines the central recess 1570.

The ball-outlining feature 1580 partially or fully circumscribes the central recess 1570. In some embodiments, the parallel lines 1584 connect multiple arcuate portions 1582 to form a circular or oblong ball-outlining feature 1580 that fully circumscribes the central recess 1570, as shown in FIG. 15D. In other embodiments having only one arcuate portion 1582, the parallel lines 1584 extend rearward, thereby defining a U-shaped ball-outlining feature 1580 that partially circumscribes the central recess 1570. In some embodiments, the parallel lines 1584 extend fully to the rear end 1534, as shown in FIG. 15E. In other embodiments, the parallel lines 1584 extend partially to the rear end 1534, as shown in FIG. 15F. The ball-outlining feature 1580 generally follows the perimeter of the central recess 1570 and is located on the upper portion top surface 1526.

In some embodiments, the ball-outlining feature 1580 is recessed into the upper portion 1504 away from the upper portion top surface 1526, thereby defining a channel. However, in other embodiments, the ball-outlining feature 1580 is flush with the upper portion top surface 1526. Further, in other embodiments, the ball-outlining feature 1580 protrudes from the upper portion top surface 1526. The ball-outlining feature 1580 is positioned on the upper portion top surface 1526 outside of the central recess 1570. The alignment aid 1544 further comprises a central line 1576 and a plurality of grooves 1578 located within the central recess 1570. These features can work in conjunction with the ball-outlining feature 1580 to provide the viewer an elongated alignment aid 1544 that extends from the strike face 1520 to the rear end 1534.

The central line 1576 is located within the central recess 1570 on the recess floor 1574. The central line 1576 is positioned behind the strike face center point and extends through the entire length of the central recess 1570. The central line 1576 extends perpendicularly from the strike face 1520 towards the rear end 1534. The central line 1576 also extends parallel to the parallel lines 1584 of the ball-outlining feature 1580. In some embodiments, the central line 1576 is further recessed into the recess floor 1574. In other embodiments, the central line 1576 is flush with the recess floor 1574. In some further embodiments, the central line 1576 protrudes from the recess floor 1574. The central line 1576 assists the viewer in finding a center of the alignment aid 1544. The central line 1576 is positioned in a middle of the recess floor 1574.

The alignment aid further comprises a plurality of grooves 1578 that are positioned on the recess floor 1574 on either side of the central line 1576. The plurality of grooves 1578 are further recessed into the recess floor 1574. In some embodiments, the plurality of grooves 1578 are equally spaced apart from each other. In other embodiments, the plurality of grooves 1578 are concentrated near the central line 1576, or near the toe end 1512 and the heel end 1516. The plurality of grooves 1578 are and are parallel to the central line 1576 and the parallel lines 1584 of the ball-outlining feature 1580. The plurality of grooves 1578 provide a series of alignment lines perpendicular to the strike face 1520 that further assist the viewer in correctly aligning the golf ball.

As discussed above, each feature of the alignment aid 1544 assists the viewer in aligning the putter-type club head 1500 with the golf ball. The ball-outlining feature 1580 is approximately the width of a golf ball and generally resembles an oblong golf ball. The ball-outlining feature 1580 allows the user to outline the edges of the golf ball with the parallel lines to frame the ball. The central line 1576 is located in a middle of the ball-outlining feature 1580 and behind the strike face center point to help the viewer align the center of the golf ball with the center of the putter-type club head 1500. The plurality of grooves 1578 are parallel to the parallel lines 1584 and the central line 1576 and further assist the user in squaring the golf ball with the putter-type club head 1500.

The alignment aid 1544 further utilizes the central recess 1570. The central recess 1570 provides a structure for the ball-outlining feature 1580 to outline. Further, the central recess 1570 houses the central line 1576 and the plurality of grooves 1578. The ball-outlining feature 1580 is located near the upper portion top surface 1526, and the central line 1576 and the plurality of grooves 1578 are located on the recess floor 1574 at a vertical offset from the ball-outlining feature 1580. In a top-down view of the putter-type club head 1500, the central line 1576 appears slightly offset from the ball-outlining feature. The offset is contributed to the positioning of the ball-outlining feature 1580 on the upper portion top surface 1526 and the central line 1576 on the recess floor 1574. Further, in a top down view, the recess wall 1572 disappears when the putter-type club head 1500 is in alignment, as shown in FIG. 15D. The different portions of the alignment aid 1544 work in conjunction with the central recess 1570 to help the user align the golf ball. The alignment aid 1544 can comprise a plurality of colors to help the viewer identify the different features of the alignment aid 1544.

Each portion of the alignment aid 1544 comprises a color. The ball-outlining feature 1580 comprises a first color, and the central line 1576 comprises a second color. Further, the upper portion 1504 comprises a third color. The colors can white, black, grey, silver, red, blue, yellow, green, orange, purple, or any other suitable color. In some embodiments, the first, second, and third colors are similar. In other embodiments, the first, second, and third colors are different from one another. The different colors provide a visual contrast between the different features of the alignment aid 1544, which helps the viewer identify the various features.

In some embodiments, the contrast is defined by colors that are opposite from one another. For example, the first, second, or third colors can be primary colors selected from the group consisting of red, yellow, and blue, while the other of the first, second, or third colors can be secondary colors selected from the group consisting of green, orange, and purple. Alternatively, the first, second, or third colors can be white or black, while the other of the first, second, or third colors can be the other of white or black. The different or contrasting colors of each feature further assist the viewer in alignment by improving the viewer's ability of the brain to detect a malalignment among parallel lines, a phenomenon known as Vernier Acuity.

The arrangement of the parallel lines 1584 of the ball-outlining feature 1580 and the central line 1576 take advantage the viewer's Vernier Acuity. In some embodiments, the positioning and the contrasting colors of the parallel lines 1584 of the ball-outlining feature 1580 and the central line 1576 keep the viewer's eyes still and allow the viewer's eyes to naturally stay focused on the central line 1576 to better align the golf ball with the target. In some embodiments, the ball-outlining feature 1580 and the central line 1576 are paint-filled. The shading and sizing of the features are selected to provide an alignment aid 1544 that generally resembles a golf ball.

The ball-outlining feature 1580 defines width measured between the furthest extent of the parallel lines 1584. The width can be slightly larger than the width of a golf ball to allow forgiveness when framing the golf ball. The width is between 1.65 inches to 1.80 inches. In some embodiments, the width is approximately 1.65 inches, 1.66 inches, 1.67 inches, 1.68 inches, 1.69 inches, 1.70 inches, 1.71 inches, 1.72 inches, 1.73 inches, 1.74 inches, 1.75 inches, 1.76 inches, 1.77 inches, 1.78 inches, 1.79 inches, or 1.80 inches. In one embodiment, the width is approximately 1.78 inches.

The ball-outlining feature 1580 further defines a thickness. The thickness can be large enough to provide a substantial ball-outlining feature 1580. The thickness is between 0.03 inch and 0.15 inch. In some embodiments, the thickness is approximately 0.03 inch, 0.04 inch, 0.05 inch, 0.06 inch, 0.07 inch, 0.08 inch, 0.09 inch, 0.10 inch, 0.11 inch, 0.12 inch, 0.13 inch, 0.14 inch, or 0.15 inch.

The ball-outlining feature 1580 further defines a length. The length is measured in a front to rear direction between the end points of the ball-outlining feature 1580. The length is between 2.9 inches to 3.1 inches. In some embodiments, the length is approximately 2.90 inches, 2.91 inches, 2.92 inches, 2.93 inches, 2.94 inches, 2.95 inches, 2.96 inches, 2.97 inches, 2.98 inches, 2.99 inches, 3.00 inches, 3.01 inches, 3.02 inches, 3.03 inches, 3.04 inches, 3.05 inches, 3.06 inches, 3.07 inches, 3.08 inches, 3.09 inches, or 3.10 inches. In one embodiment, the length is 3.08 inches.

The alignment aid 1544 is designed to provide a golf ball-like feature that is approximately the width of a golf ball. As discussed above, the alignment aid 1544 comprises different features positioned near or within the central recess 1570. Each feature provides a function to the alignment aid 1544, thereby allowing the user to better align the golf ball with the desired spot on the putter-type golf club head to achieve more accurate shots. Further, the alignment aid 1544 utilizes the central recess 1570 to further assist the viewer in alignment. The alignment aid 1544 and the central recess 1570 are located near a middle of the putter-type club head 1500 within the forward portion 1522 and the rear extension 1524. The rear extension 1524 is configured to allow the upper portion 1504 to receive the lower portion 1508.

The lower portion 1508 comprises a high-density material (i.e., the second material) than the upper portion 1504. In many embodiments, the lower portion 1508 is formed from stainless steel. Referring to FIG. 15B, the lower portion 1508 comprises a central portion 1538, a toe mass 1545, and a heel mass 1547. The central portion 1538 is a thinned region relative to the toe and heel masses 1545, 1547 and allows the upper portion 1504 to be received by the lower portion 1508. The thinned central portion 1538 also removes mass from a center of the lower portion 1508 that can be reallocated to the toe and heel masses 1545, 1547 to improve the moment of inertia of the putter-type club head 1500. The central portion 1538 comprises a central portion top surface 1540 proximate the upper portion bottom surface 1528. The central portion top surface 1540 comprises a corresponding geometry to the upper portion bottom surface 1528. In some embodiments, the central portion top surface 1528 comprises one or more recesses, as shown in FIG. 15B. The one or more recesses can further reduce the mass from a center of the lower portion 1508. The mass can be redistributed to the toe and heel masses 1545, 1547, which are configured to distribute mass to the peripheries of the putter-type club head 1500.

The toe and heel masses 1545, 1547 are raised portions relative to the central portion 1538. The toe and heel masses 1545, 1547 are located near the perimeter 1510 to provide perimeter weighting to increase the moment of inertia of the putter-type club head 1500. Furthermore, the weight of the toe and heel masses 1545, 1547 can be tailored to achieve a desired swing weight or overall putter head mass. The toe and heel masses 1545, 1547 comprise a mass top surface 1541 that forms a portion of the crown 1536. The upper portion 1504 and the lower portion 1508 each form a portion of the crown 1536 and the sole 1568. The lower portion 1508 further comprises a lower portion bottom surface 1542 that forms a portion of the sole. The toe and heel masses 1545, 1547 further comprise an inner surface 1561 located near the toe and heel walls 1529, 1530, and an outer surface 1543 that forms a portion of the perimeter 1510. In some embodiments, the outer surface 1543 forms a portion of the toe end 1512, the heel end 1516, or the rear end 1534. The inner surface 1561 defines a transition between the toe mass 1545 and the central portion 1538, as well as a transition between the heel mass 1547 and the central portion 1538. The inner surface 1561 comprises a corresponding geometry to the toe and heel walls 1529, 1530. The lower portion 1508 is configured to receive the upper portion 1504 such that the rearward extension 1524 is situated above the central portion 1538 and between the toe and heel masses 1545, 1547.

In some embodiments, the toe and heel masses 1545, 1547 form a tight fit with the upper portion 1504. In other embodiments, the inner surface 1561 and toe and heel walls 1529, 1530 define a gap 1595, 1597 therebetween. The gap 1595, 1597 allows toe and heel masses 1545, 1547 of varying sizes to be held within the cutout regions to tailor the weighting of the putter-type club head 1500. The gap 1595, 1597 defines a width measured between the respective inner surface 1561 and toe and heel walls 1529, 1530. The gap width can remain constant throughout the entire gap 1595, 1597, or the gap width can vary throughout the gap 1595, 1597. The gap width can be between 0.05 inch to 0.21 inch. In some embodiments, the gap width is between 0.05 inch to 0.09 inch, 0.07 inch to 0.13 inch, 0.10 inch to 0.18 inch, and 0.15 inch to 0.21 inch. In some embodiments, the gap width is 0.05 inch, 0.06 inch, 0.07 inch, 0.08 inch, 0.09 inch, 0.10 inch, 0.11 inch, 0.12 inch, 0.13 inch, 0.14 inch, 0.15 inch, 0.16 inch, 0.17 inch, 0.18 inch, 0.19 inch, 0.20 inch, or 0.21 inch. In one embodiment, the gap width is 0.16 inch. The gap width depends on the size and shaping of the toe and heel masses 1545, 1547 and the corresponding cutout regions.

The toe and heel masses 1545, 1547 can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape. The geometry of the toe and heel masses 1545, 1547 corresponds to the geometry of the respective cutout region of the upper portion 1504.

The toe and heel masses 1545, 1547 provide an additional means of adding mass to the perimeter 1510 for increasing the MOI of the putter-type club head 1500 over a putter without these mass features. The lower portion 1508 comprises a mass between 200 grams to 215 grams. In some embodiments, the mass is between 200 grams to 210 grams, 205 grams to 210 grams, and 210 grams to 215 grams. The mass can be 200 grams, 201 grams, 202 grams, 203 grams, 204 grams, 205 grams, 206 grams, 207 grams, 208 grams, 209 grams, 210 grams, 211 grams, 212 grams, 213 grams, 214 grams, or 215 grams. In one embodiment, the mass is 205.7 grams.

The lower portion, and the toe and heel masses 1545, 1547 specifically, provide areas of concentrated mass near the perimeter 1510, such that toe and heel masses 1545, 1547 function to increase the moment of inertia of the putter-type club head 1500. The placement of the toe and heel masses 1545, 1547 on the perimeter 1510 increases the MOI since each mass is farther from a center of gravity of the putter-type club head 1500. The upper portion 1504 is affixed to the lower portion 1508, which is formed using the second material, wherein the second material is denser than the first material. The upper portion 1504 can be affixed to the lower portion 1508 with the use of an adhesive.

The lower portion 1508, in many embodiments, comprise less than 35% of a total volume of the putter-type club head 1500. In some embodiments, the lower portion 1508 comprises less than 34%, less than 33%, less than 32%, less than 31%, less than 30%, less than 29%, less than 28%, less than 27%, less than 26%, less than 25%, less than 24%, or less than 23% of the total volume. In one embodiment, the lower portion 1508 comprises 30.1% of the total volume.

Although the lower portion 1508 comprises less than half of the volume of the putter-type club head 1500, the lower portion 1508 comprises at least 50% of a total mass of the putter-type club head 1500. In some embodiments, the lower portion 1508 comprises at least 51%, at least 52%, at least 53%, at least 54%, at least 55%, at least 56%, at least 57%, at least 58%, at least 59%, or at least 60% of the total mass. In one embodiment, the lower portion 1508 comprises 56.1% of the total mass. As discussed in more detail below, the lower portion 1508 comprises a low proportion (less than 50%) of the volume of the putter-type club head 1500 and a high proportion (greater than 50%) of the mass of the putter-type club head 1500.

The combination of the low-density upper portion 1504 with the high-density lower portion 1508, creates a high MOI putter-type club head 1500, without creating an extremely heavy putter. The central recess 1570 shifts a majority of the volume and mass of the putter-type club head 1500 to the perimeter 1510. This shift forms a low volume portion that increases MOI in comparison to a putter milled from a single material. A single material putter-type club head fails to allocate high-density material to the periphery, while maintaining a desirable volume (75 cc-100 cc) and mass (340 grams-385 grams). The advantages of putter head 1500 over a putter head formed from a single material construction are described in the examples below.

IV. Putter Head with Ball-Outlining Alignment Aid and Separate Weights

Figure 16A:
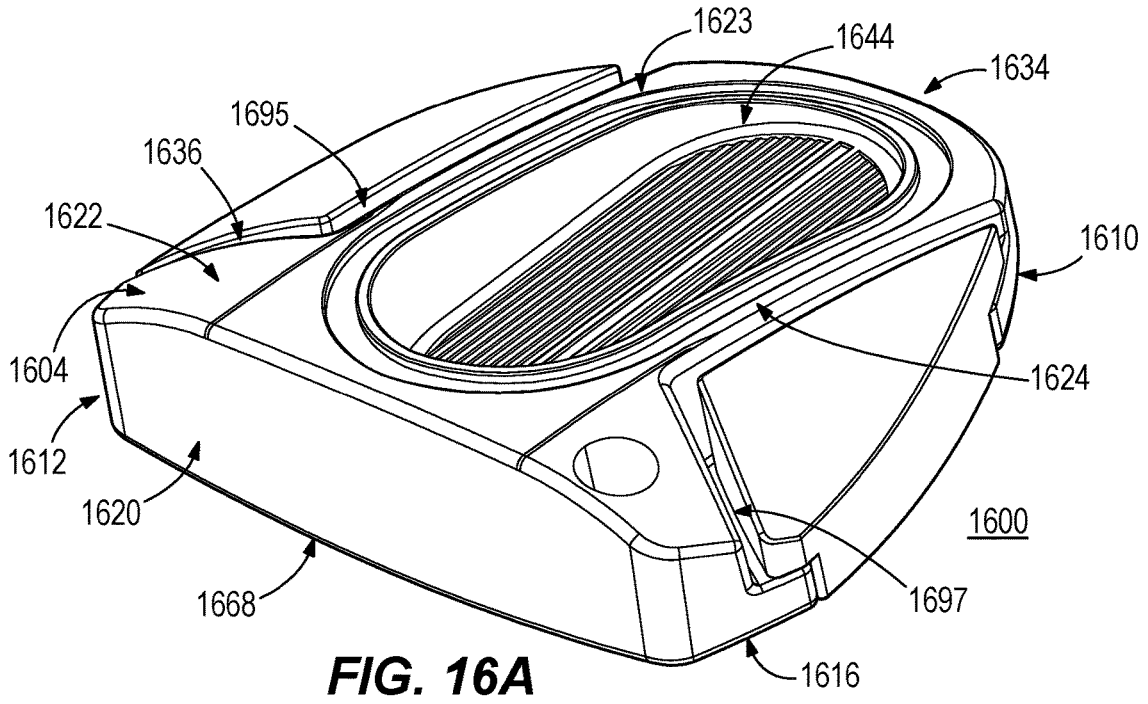
FIG. 16A illustrates a front perspective view of a putter head comprising a separate toe mass and heel mass.
Figure 16B:
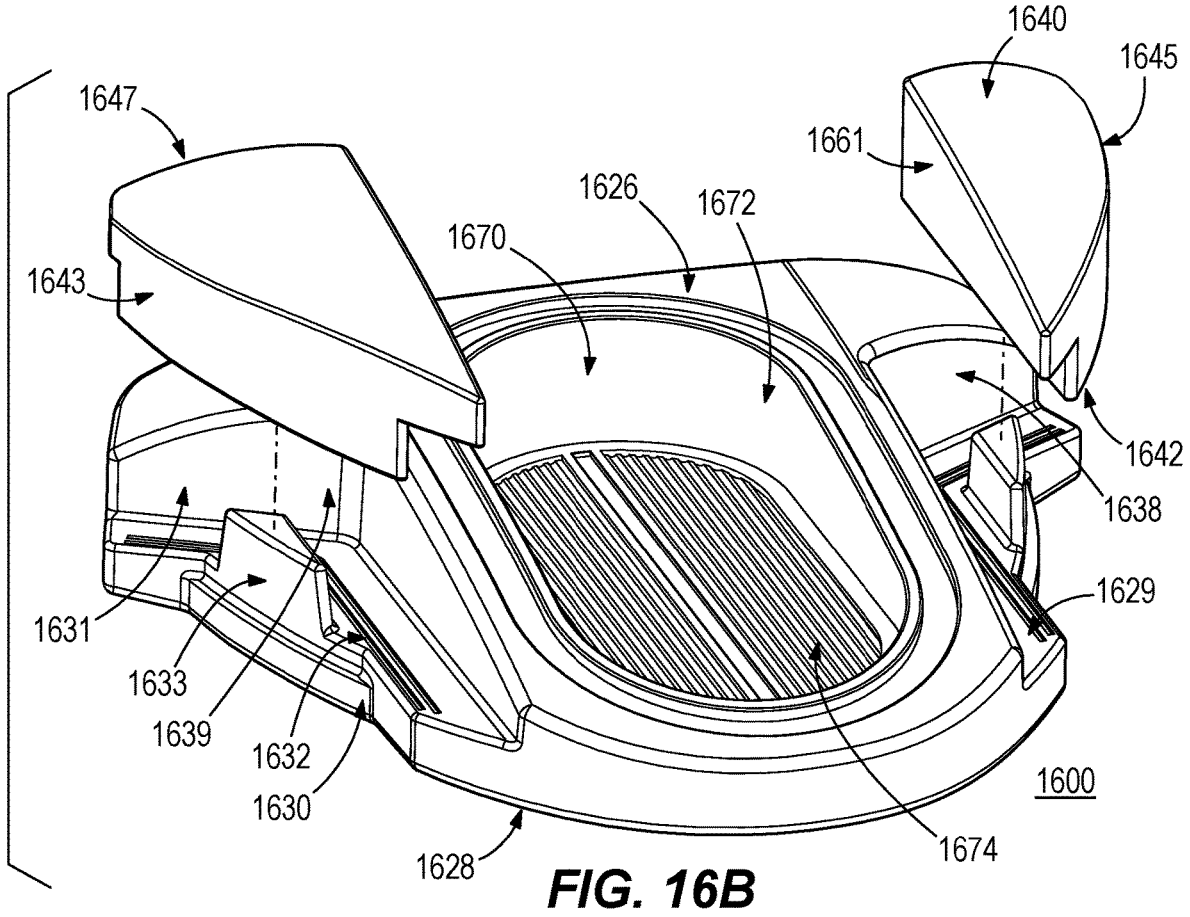
FIG. 16B illustrates a rear perspective exploded view of the putter head of FIG. 16A.
Figure 16C:
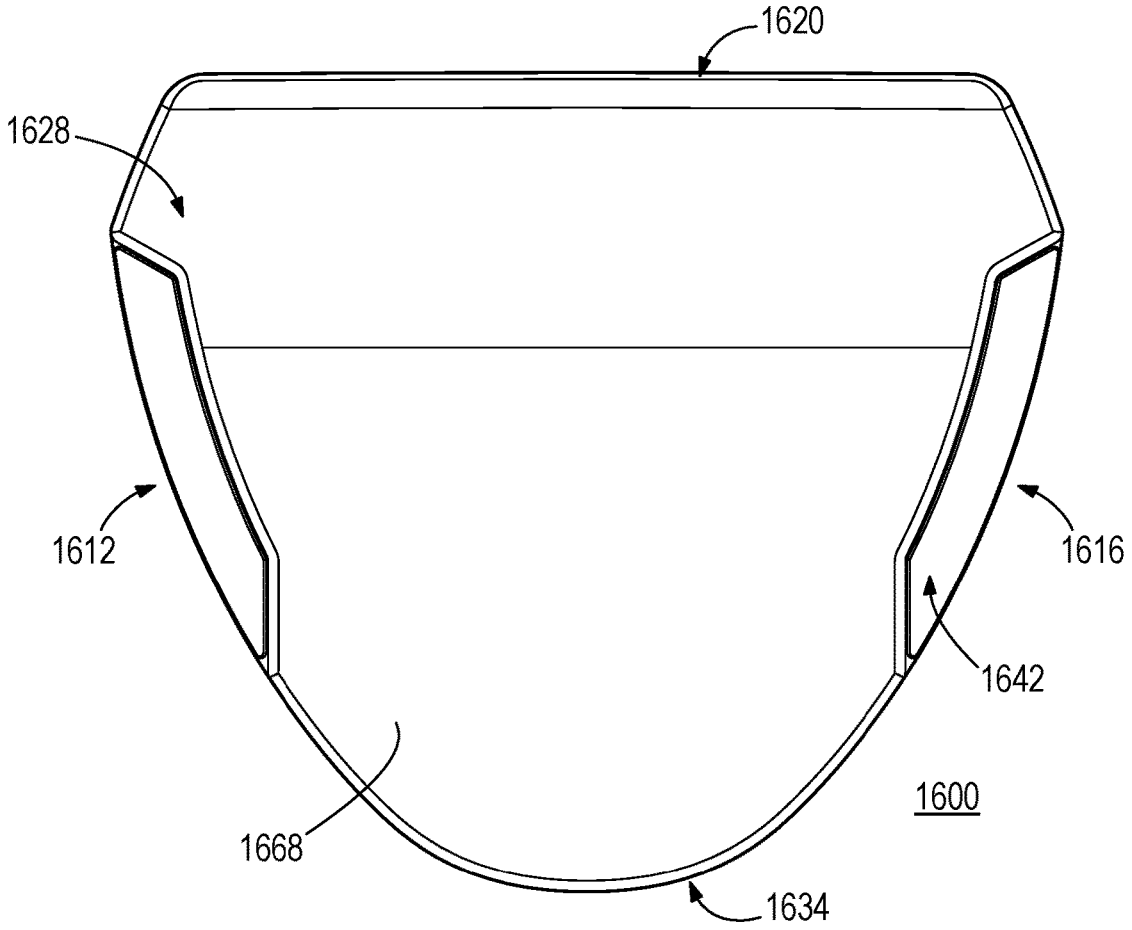
FIG. 16C illustrates a sole view of the putter head of FIG. 16A.

In one embodiment, the putter-type club head can comprise a two-part construction and can include an alignment aid having a ball-outlining feature. The two-part construction allows the putter-type club head to be formed from multiple materials. Referring to FIGS. 16A and 16B, the putter-type club head 1600 comprises a body 1604, a toe weight 1645, and a heel weight 1647. In some embodiments, the body 1604 is formed from a first material having a first density, and the toe and heel weights 1645, 1647 are formed from a second material having a second density. In some embodiments, the first density is less than the second density. As discussed in more detail below, the body 1604 and the toe and heel weights 1645, 1647 combine to create a high-MOI putter-type club head 1600 (5000 $g \cdot cm^2$-6500 $g \cdot cm^2$), while maintaining a desirable volume and mass. For example, the putter head 1600 can have an MOI ranging from 5000 $g \cdot cm^2$-5500 $g \cdot cm^2$, 5500 $g \cdot cm^2$-6000 $g \cdot cm^2$, 6000 $g \cdot cm^2$-6500 $g \cdot cm^2$. The putter head 1600 comprises a 2%-15% increase of MOI about the y-axis over a putter head devoid of a multi-material construction (i.e. a single material). For example, the putter head 1600 comprises a 2%-5%, 5%-10%, or 10%-15% increase over a single material putter.

The putter-type club head 1600 further comprises a crown 1636, a sole 1668, a strike face 1620, a rear end 1634, a toe end 1612, and a heel end 1616. The outermost points of the strike face 1620, the rear end 1634, the toe end 1612, and the heel end 1616 define a perimeter 1610 of the putter-type club head 1600. The body 1604 and the toe and heel weights 1645, 1647 each form a portion of the crown 1636, a portion of the sole 1668, a portion of the toe end 1612, a portion of the heel end 1616, and a portion of the perimeter 1610. The crown 1636 gradually slopes from the strike face 1620 to the rear end 1634 such that the putter-type club head 1600 is thicker near the strike face 1620 and gradually thins towards the rear end 1634. The slope of the crown 1636 can be linear, curvilinear, parabolic, sinusoidal, or a function of polynomial. Further, the strike face 1620 comprises a strike face center point equidistant from the heel end 1616 and toe end 1612, as well as equidistant from the crown 1636 and the sole 1668.

In many embodiments, the sole 1668 can be planar. In some embodiments, the sole 1668 can have a slight arch in a heel 1616 to toe 1612 direction, wherein the slight arch can be linear, or a function of a polynomial. In some embodiments, the sole 1668 can have a strong arch in the heel 1616 to toe 1612 direction, wherein the strong arch can be linear, or a function of a polynomial. The sole 1568 functions to provide a surface to rest the putter-type club head 1600 on the ground plane. As discussed above, the putter-type club head 1600 comprises a body 1604, a toe weight 1645, and a heel weight 1647, where the body 1604 forms a majority of the sole 1668 and rests on the ground plane. The toe weight 1645 and heel weight 1647 sit above the body 1604 when the putter-type club head 1600 is assembled.

As discussed above, the body 1604 comprises a low-density material (i.e., the first material). In many embodiments, the body 1604 is formed from aluminum. The toe weight 1645 and the heel weight 1647 are affixed to the body 1604 to define the crown 1636, the sole 1668, the toe end 1612, the heel end 1616, and the perimeter 1610. The body 1604 comprises an upper surface 1626 and a lower surface 1628, where the upper surface 1626 forms a portion of the crown 1636, and the lower surface 1628 forms a portion of the sole 1668. The body 1604 further comprises a forward portion 1622 and a rear portion 1623, where the forward portion 1622 comprises the strike face 1620. The rear portion 1623 comprises a rearward extension 1624 that extends rearward from the forward portion 1622 towards the rear end 1634. The rearward extension 1624 is generally perpendicular to the strike face 1620. The forward portion 1622 and the rearward extension 1624 form a T-shape.

The body 1604 defines a central recess 1670 that extends from the forward portion 1622 to the rear end 1634. The central recess 1670 removes mass from a central portion of the body 1604, thereby allowing mass to be moved toward the perimeter 1610. The central recess 1670 is defined by a recess wall 1672 and a recess floor 1674. The recess floor 1674 is recessed into the body 1604 away from the body upper surface 1626, and the recess wall 1672 circumscribes the recess floor 1674.

The recess wall 1672 comprises a height. In some embodiments, the recess wall height slopes with the slope of the crown 1636 such that the recess wall height is larger near the strike face 1620 and smaller near the rear end 1634. In such an embodiment, the recess wall 1672 comprises a height near the rear end 1634 such that the recess floor 1674 is not flush with the body upper surface 1626. In other embodiments, the recess wall height remains constant throughout the central recess 1670. The recess floor 1674 is parallel to the ground plane to provide a parallel surface to the ground plane for portions of the alignment aid 1644. The central recess 6570 is located near a middle of the putter-type club head 1600 within the forward portion 1622 and the rear extension 1624 to provide a centered feature for the alignment aid 1644. The central recess 1670 further contributes to the alignment aid 1644, as discussed in more detail below.

The body 1604 further comprises an alignment aid 1644. The alignment aid 1644 is similar to the alignment aid 1544 and is described using similar reference numbers to the alignment aid 1544. For example, the alignment aid comprises one or more arcuate portions 1682 and a set of parallel lines 1684, which are similar to the one or more arcuate portions 1582 and the set of parallel lines 1584 of the alignment aid 1544. However, the alignment aid 1544 is located on the body upper surface 1626, instead of the upper portion top surface 1526, like the alignment aid 1544.

The alignment aid 1644 comprises a ball-outlining feature 1680, a central line 1676, and a plurality of grooves 1678. The ball-outlining feature 1680 can be similar to the ball-outlining feature 1580 shown in FIGS. 15D-15E. For example, the ball-outlining feature 1680 can partially or fully circumscribe the central recess 1670. In some embodiments, the parallel lines 1684 connect multiple arcuate portions 1682 to form a circular or oblong ball-outlining feature 1680 that fully circumscribes the central recess 1670, as shown in FIG. 15D. In other embodiments having only one arcuate portion 1682, the parallel lines 1684 extend rearward, thereby defining a U-shaped ball-outlining feature 1680 that partially circumscribes the central recess 1670. In some embodiments, the parallel lines 1684 extend fully to the rear end 1634, as shown in FIG. 15E. In other embodiments, the parallel lines 1684 extend partially to the rear end 1634, as shown in FIG. 15F. The ball-outlining feature 1680 generally follows the perimeter of the central recess 1670 and is located on the body upper surface 1626.

Further, the central line 1676 and the plurality of grooves 1678 can be similar to the central line 1576 and the plurality of grooves 1578 of the alignment aid 1544. The central line 1676 and the plurality of grooves 1678 are located on the recess floor 1674. The central line 1676 is positioned behind the strike face center point and extends through the entire length of the central recess 1670. The plurality of grooves 1678 that are recessed into the recess floor 1674 on either side of the central line 1676. Each feature of the alignment aid 1644 assists the viewer in aligning the putter-type club head 1600 with the golf ball. The alignment aid 1644 also utilizes the central recess 1670. The central recess 1670 provides a structure for the ball-outlining feature 1670 to outline. Further, the central recess 1670 houses the central line 1676 and the plurality of grooves 1678. As discussed above, the alignment aid 1644 is located near the body upper surface 1526 and extends from the forward portion 1622 through the rear extension 1623 to the rear end 1634. The rear portion 1623 is further configured to receive one or more weights.

The rear portion 1623 further comprises a toe wing 1629 and a heel wing 1630 that receive the toe weight 1645 and the heel weight 1647. The wings 1629, 1630 are located near the perimeter 1610 towards the rear end 1634 such that the rear extension 1624 extends between the wings 1629, 1630. The wings 1629, 1630 are defined between a wing floor 1632 and the sole 1668. The wing floor 1632 is recessed into the body 1604 away from the body upper surface 1626. The wing floor 1632 form a base for the wings 1629, 1630 to receive the weights 1645, 1647.

The rear portion defines a toe weight recess 1638 and a heel weight recess 1639. The weight recesses 1638, 1369 are located above the wings 1629, 1630 and function to receive the weights 1645, 1647. The weight recesses 1638, 1639 are defined a wing wall 1631 and the wing floor 1632, where the wing wall 1631 is adjacent to a respective recess floor 1632. The toe weight recess 1638 extends inwards from the toe end 1612 toward the center of the body 1604. The heel weight recess 1639 extends from the heel end 1616 toward the center of the body 1604. The weight recesses 1638, 1639 are bounded by the crown 1636, the perimeter 1610, the recess floor 1632, and the wing wall 1631.

The wing wall 1631 defines a boundary between the wings 1629, 1630 and the forward portion 1622, as well as a boundary between the wings 1629, 1630 and the rearward extension 1624. In some embodiments, the wing walls 1631 can fully encompass the weights 1645, 1647. In other embodiments, the wing walls 1631 can partially encompass the weights 1645, 1647. For example, in some embodiments, the wing wall 1631 can encompass between 30% to 45%, 40% to 65%, 50% to 90%, or 60% to 95% of the weight 1645, 1647.

The wings recesses 1638, 1369 are configured to receive the weights 1645, 1647 such that the weights 1645, 1647 sit above the wings 1629, 1630. Referring to FIG. 16B, the wings 1629, 1630 comprise an attachment point 1633 that receives a respective weight 1645, 1647. Each attachment point 1633 protrudes from the wing floor 1632 into the respective weight recess 1638, 1639. The attachment point 1633 can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape.

The weight recesses 1638, 1369 and the wings 1629, 1630 can comprise any desired geometry. However, in many embodiments, the weight recesses 1638, 1369 and the wings 1629, 1630 comprise a geometry similar or identical to that of the weight 1645, 1647. Each weight recess 1638, 1369 corresponds to a respective wing 1629, 1630 and attachment point 1633 for a respective weight 1645, 1647.

Referring to FIG. 16A, the putter-type club head 1600 comprises a heel weight 1647 and a toe weight 1645 that correspond to a respective wing 1629, 1630, weight recess 1638, 1639, and attachment point 1633. However, the putter-type club head 1600 is not limited to a heel weight 1647 and a toe weight 1645. In some embodiments, the putter-type club head 1600 can comprise one, two, three, four, five, six, seven, or eight weights. In these embodiments, the putter-type club head 1600 can comprise one, two, three, four, five, six, seven, or eight corresponding wings and attachment points.

Figure 16D:
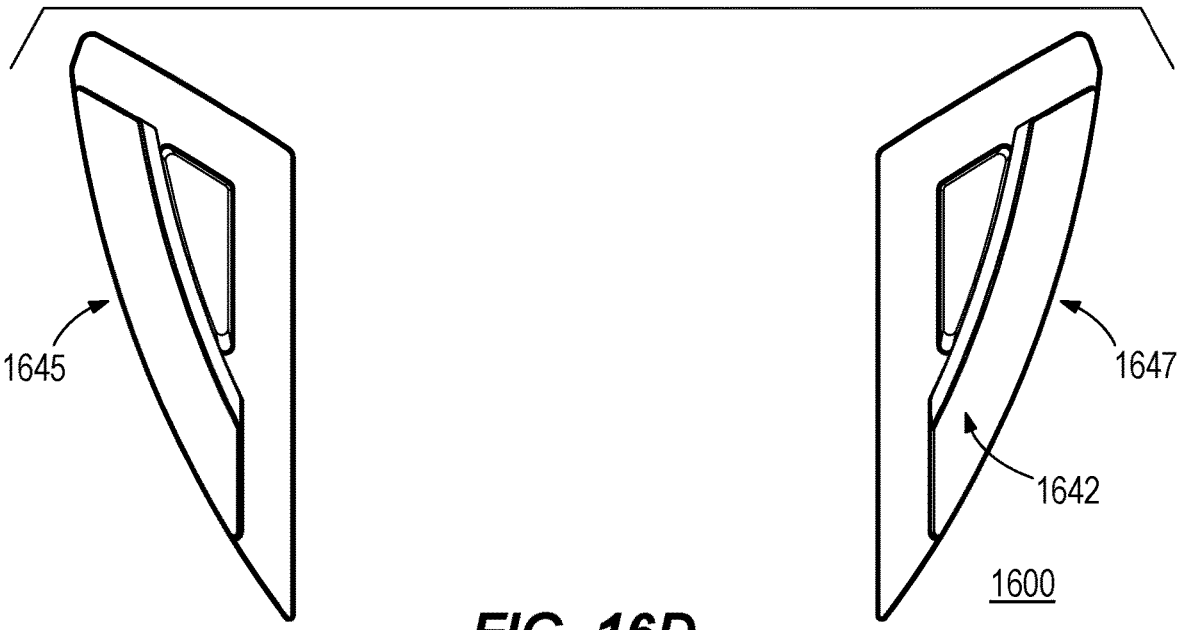
FIG. 16D illustrates a bottom view of the toe mass and heel mass of the putter head of FIG. 16A.

The weights 1645, 1647 comprise a high-density material (i.e., the second material) than the body 1604. In many embodiments, the weights 1645, 1647 are formed from stainless steel. The weights 1645, 1647 are located near the perimeter 1610 and are affixed to the body 1604. Referring to FIGS. 16B and 16D, the weights 1645, 1647 comprise an inner surface 1661 located near the wing wall 1631, and an outer surface 1643 that forms a portion of the perimeter 1610. In some embodiments, the outer surface 1643 forms a portion of the toe end 1612, the heel end 1616, or the rear end 1634. The inner surface 1661 comprises a corresponding geometry to the wing wall 1631.

In some embodiments, the weights 1645, 1647 form a tight fit with the body 1604. In other embodiments, the inner surface 1661 and the wing wall 1631 define a gap 1695, 1697 therebetween. The gap 1695, 1697 allows weights 1629, 1630 of varying sizes to be held within the weight recesses 1638, 1639 to tailor the weighting of the putter-type club head 1600. The gap 1695, 1697 defines a width measured between the respective inner surface 1661 and wing wall 1631. The gap width can remain constant throughout the entire gap 1695,1697, or the gap width can vary throughout the gap 1695, 1697. The gap width can be between 0.05 inch to 0.21 inch. In some embodiments, the gap width is between 0.05 inch to 0.09 inch, 0.07 inch to 0.13 inch, 0.10 inch to 0.18 inch, and 0.15 inch to 0.21 inch. In some embodiments, the gap width is 0.05 inch, 0.06 inch, 0.07 inch, 0.08 inch, 0.09 inch, 0.10 inch, 0.11 inch, 0.12 inch, 0.13 inch, 0.14 inch, 0.15 inch, 0.16 inch, 0.17 inch, 0.18 inch, 0.19 inch, 0.20 inch, or 0.21 inch. In one embodiment, the gap width is 0.16 inch.

The weights 1645, 1647 further comprise a weight upper surface 1640 and a weight lower surface 1642. The weight upper surfaces 1640 form a portion of the crown 1636, and the weight lower surfaces 1642 form a portion of the sole 1668. The weight lower surfaces 1642 are proximate the wing floors 1632 and comprise a corresponding geometry to the respective wings 1629, 1630 and attachment points 1633. Referring to FIG. 16D, the weight lower surface 1642 comprises a stepped-down geometry that corresponds to the respective wing 1629, 1630 and attachment point 1633 geometry. The weights 1645, 1647 slide over the attachment point 1633 and are further secured with an epoxy material. In some embodiments, the wing floors 1632 comprise a plurality of grooves that increase the surface area of the wing floor 1632. The plurality of grooves increase the surface area available for bonding, thereby strengthening the bond between the weights 1645, 1647 and the floor 1632. The geometry of the weight lower surface 1642 facilitates a tight connection between the weights 1645, 1647 and the wings 1629, 1630.

The weights 1645, 1647 can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape. The geometry of the weights 1645, 1647 corresponds to the geometry of the respective weight recess 1638,1639.

The weights 1645, 1647 provide an additional means of adding mass to the perimeter 1610 for increasing the MOI of the putter-type club head 1600 over a putter without these mass features. Furthermore, the weights 1645, 1647 can be tailored to achieve a desired swing weight or overall putter head mass. The weights 1645, 1647 comprise a combined mass between 45 grams to 70 grams. In some embodiments, the mass is between 45 grams to 60 grams, 55 grams to 70 grams, and 55 grams to 65 grams. The combined mass can be 45 grams, 46 grams, 47 grams, 48 grams, 49 grams, 50 grams, 51 grams, 52 grams, 53 grams, 54 grams, 55 grams, 56 grams, 57 grams, 58 grams, 59 grams, 60 grams, 61 grams, 62 grams, 63 grams, 64 grams, 65 grams, 66 grams, 67 grams, 68 grams, 69 grams, or 70 grams. The weights 1645, 1647 provide areas of concentrated mass near the perimeter 1610, such that each weight 1645, 1647 functions to increase the moment of inertia of the putter-type club head 1600. The placement of each weight 1645, 1647 on the perimeter 1610 increases the MOI since each mass is farther from a center of gravity of the putter-type club head 1600. Each weight 1645, 1647 is affixed to the body 1604 using the second material, wherein the second material is denser than the first material.

The weights 1645, 1647, in many embodiments, comprise less than 25% of a total volume of the putter-type club head 1600. In some embodiments, the weights 1645, 1647 comprise less than 24%, less than 23%, less than 22%, less than 21%, less than 20%, less than 19%, less than 18%, less than 17%, less than 16%, less than 15%, less than 14%, or less than 13% of the total volume.

Although the weights 1645, 1647 comprise less than half of the volume of the putter-type club head 1600, the weights 1645, 1647 comprise at least 30% of a total mass of the putter-type club head 1600. In some embodiments, the weights 1645, 1647 comprise at least 31%, at least 32%, at least 33%, at least 34%, at least 35%, at least 36%, at least 37%, at least 38%, at least 39%, or at least 40% of the total mass.

The combination of the low-density body 1604 with the high-density weights 1645, 1647, creates a high MOI putter-type club head 1600, without creating an extremely heavy putter. The central recess 1670 shifts a majority of the volume and mass of the putter-type club head 1600 to the extremities of the body 1604. This shift forms a low volume portion that increases MOI in comparison to a putter milled from a single material. A single material putter-type club head fails to allocate high-density material to the periphery, while maintaining a desirable volume (75 cc-100 cc) and mass (340 grams-385 grams).

V. Three-Part Putter Head

In some embodiments, rather than a two part putter, the putter type golf club head can comprise a three part construction including a crown portion 1802 in addition to the upper portion and the lower portion. Providing a three-part putter head comprising a crown portion 1802 in addition to the upper portion and the lower portion allows the mass distribution throughout the putter head to be more precisely controlled and optimized to increase the MOI of the putter head.

The upper portion of the three-part putter-type golf club head can be similar to one or more of the upper portions described in reference to previous embodiments and can be made of the first material described above. Similarly, the lower portion of the three-part putter-type golf club head can be similar to one or more of the lower portions described in reference to previous embodiments and can be made of the second material described above.

The three-part putter head further comprises a crown portion made of a third material different than both the first material of the upper portion and the second material of the lower portion. The third material can be lightweight and can comprise a density less than both the first density and the second density. In many embodiments, the crown portion 1802 can be joined to the top of the upper portion and can form the uppermost surface of the putter head.

In many embodiments, the crown portion of the putter head having the third material comprises a third density ranging between 0.5 g/cc and 3.5 g/cc. The third density can range between 1.5 g/cc to 2.5 g/cc. In some embodiments, the third density can range between 0.5-0.75 g/cc, 0.75-1.0 g/cc, 1.0-1.25 g/cc, 1.25-1.5 g/cc, 1.5-1.75 g/cc, 1.75-2.0 g/cc, 2.0-2.25 g/cc, 2.25-2.5 g/cc, 2.5-2.75 g/cc, 2.75-3.0 g/cc, or 3.25-3.5 g/cc. In one embodiment, the third density of the crown portion 1802 can range between 1.0-2.0 g/cc. In some embodiments, the third density can be less 3.5 g/cc, less than 3.0 g/cc, less than 2.5 g/cc, less than 2.0 g/cc, less than 1.5 g/cc, or less than 1.0 g/cc. In some embodiments, the third density can be 0.5 g/cc, 0.75 g/cc, 1.0 g/cc, 1.25 g/cc, 1.50 g/cc, 1.75 g/cc, 2.0 g/cc, 2.25 g/cc, 2.50 g/cc, 2.75 g/cc, 3.0 g/cc, 3.25 g/cc, or 3.50 g/c.

The crown portion of the putter head having the third material can be made from any one or combination of the following: aluminum, aluminum alloy, ADC-12, a polymeric material, a composite material, a filled thermoplastic, a fiber-reinforced composite, or any other suitable low-density material.

Inclusion of the low-density crown portion allows for an increase in the MOI of the putter head. Replacing portions of the club head that would otherwise be made of either the first material or the second material creates discretionary mass that can be reallocated throughout the putter head.

a. Three-Part Spade Shaped Embodiment

FIGS. 18A-18D illustrate a first embodiment of the three-part putter-type golf club head 1800. In the present embodiment, putter head 1800 is a spade shaped putter head 1800, similar to the two-part spade shaped putter head 700 of FIGS. 7A-7C. The three-part spade shaped putter head 1800 comprises an upper portion 1804, a lower portion 1808, and a crown portion 1802, and a hollow interior cavity 1850 formed between the upper portion 1804, lower portion 1808, and crown portion 1802. The upper portion 1804 is made from a first material having a first density, the lower portion 1808 is made from a second material having a second density, and the crown portion 1802 is made from a third material having a third density. The first density is less than the second density. The third density is less than both the first density and the second density. The upper portion 1804, lower portion 1808, and crown portion 1802 combine to create a high-MOI putter head (3500 g·cm$^2$-5000 g·cm$^2$) 1800 while maintaining a desirable volume and mass. For example, in some embodiments, the putter head 1800 can comprise an MOI approximately between 3500 g·cm$^2$ and 4000 g·cm$^2$, between 4000 g·cm$^2$ and 4500 g·cm$^2$, or between 4500 g·cm$^2$ and 5000 g·cm$^2$. In some embodiments, the putter head 1800 can comprise an MOI approximately between 3500 g·cm$^2$ and 3750 g·cm$^2$, between 3750 g·cm$^2$ and 4000 g·cm$^2$, between 4000 g·cm$^2$ and 4250 g·cm$^2$, between 4250 g·cm$^2$ and 4500 g·cm$^2$, between 4500 g·cm$^2$ and 4750 g·cm$^2$, or between 4750 g·cm$^2$ and 5000 g·cm$^2$.

Figure 18A:
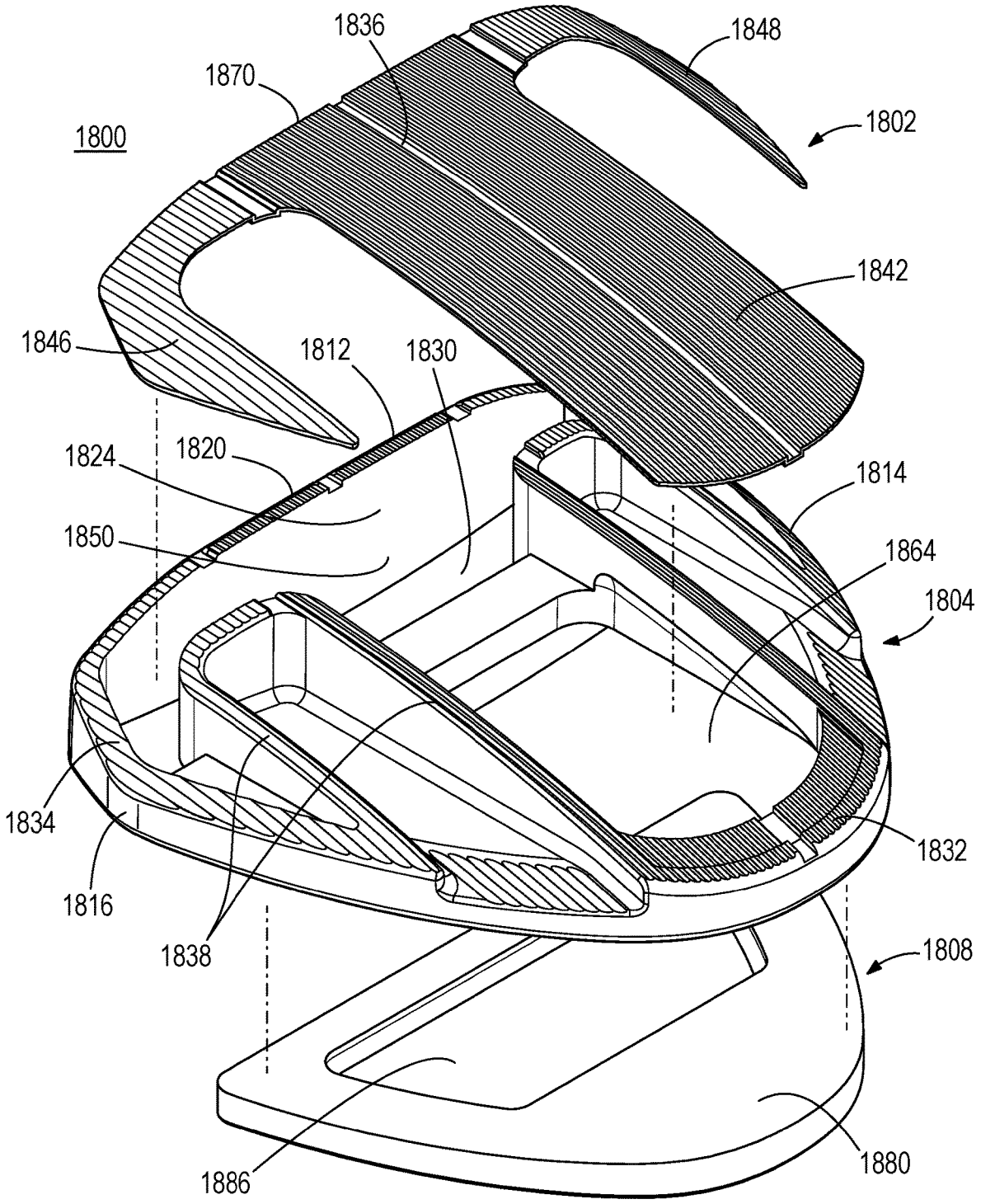
FIG. 18A illustrates a rear perspective exploded view of a three-part putter head according to one embodiment.

As illustrated in FIG. 18A, the upper portion 1804 forms a majority of the main body of the putter head 1800. The upper portion 1804 comprises a base 1830 and a plurality of walls extending vertically from the base 1830. The upper portion 1804 can comprise a plurality of perimeter walls including a front wall 1812 defining a strike face 1820, a toe wall 1814, a heel wall 1816, and a rear wall 1832. The front wall 1812 is adjacent to the toe wall 1814 and the heel wall 1816, and opposite to the rear wall 1832. An exterior surface of the front wall 1812 forms the strike face 1820 while an interior surface of the front wall 1812 forms a back face 1824. The toe wall 1814 is adjacent to the front wall 1812 and the rear wall 1832, and opposite to the heel wall 1816. The heel wall 1816 is also adjacent to the front wall 1812 and the rear wall 1832, but opposite to the toe wall 1814.

The plurality of perimeter walls can form the majority of a perimeter of the putter head 1800. The base 1830 can extend from the front wall 1812 to the rear wall 1832 and from the toe wall 1814 to the heel wall 1816. The base 1830 further comprises an upper surface 1831 and a lower surface 1833 opposite the upper surface 1831. The lower surface 1833 of the base 1830 forms at least a portion of the sole 1868. In many embodiments, referring to FIG. 18C, the lower surface 1833 can comprise a recessed area 1840 configured to receive the lower portion 1808 such that the lower surface 1833 of the base 1830 forms part of the sole 1868 and a bottom surface 1882 of the lower portion 1808 forms the remainder of the sole 1868.

The upper portion 1804 further comprises a plurality of internal walls 1838 extending vertically from the base 1830. Each of the plurality of internal walls 1838 are inset with respect to the perimeter of the putter head 1800. The plurality of internal walls 1838 therefore do not form any portion of the club head perimeter. As illustrated in FIG. 18A, the plurality of perimeter walls and the plurality of internal walls 1838 can be interconnected. The interconnection between the plurality of perimeter walls and the plurality of internal walls 1838 can collectively form a cavity profile, when viewed from above, wherein the cavity profile defines the shape of the hollow interior cavity 1850. The shape of the cavity profile is defined by the orientation and shaping of the plurality of perimeter walls and the plurality of internal walls 1838. In some embodiments, such as the embodiment illustrated in FIG. 18A, the upper portion 1804 can comprise one or more internal walls 1838 extending substantially perpendicular to the strike face 1820 and one or more internal walls 1838 extending substantially parallel to the strike face 1820. In other embodiments, one or more internal walls 1838 can extend at an angle with respect to the strike face 1820. FIG. 18A illustrates the plurality of internal walls 1838 being formed as substantially straight walls, but in other embodiments, the putter head 1800 can comprise one or more internal walls 1838 that are curved. The top of the upper portion 1804 can be open such that the upper portion 1804 by itself does not enclose any hollow portions or interior cavities.

The upper portion 1804 can further define one or more external portions 1835 situated outside of the cavity profile. The one or more external portions 1835 form areas of the putter head 1800 wherein the upper surface 1831 of the base 1830 is exposed to the exterior of the putter head 1800. The one or more external portions 1835 can be partially bounded by the exterior surface of one or more internal walls 1838, but the external portions 1835 are not bounded on any sides by any of the plurality of perimeter walls.

The upper portion 1804 further comprises a central aperture 1864 extending through a portion of the base 1830. The central aperture 1864 extends through both the upper surface 1831 and the lower surface 1833 of the base 1830. The central aperture 1864 shifts a large portion of the volume and mass of the putter head 1800 to the extremities of the upper portion 1804. The central aperture 1864 can be configured to be covered by the lower portion 1808 to enclose the hollow interior cavity 1850.

Figure 18B:
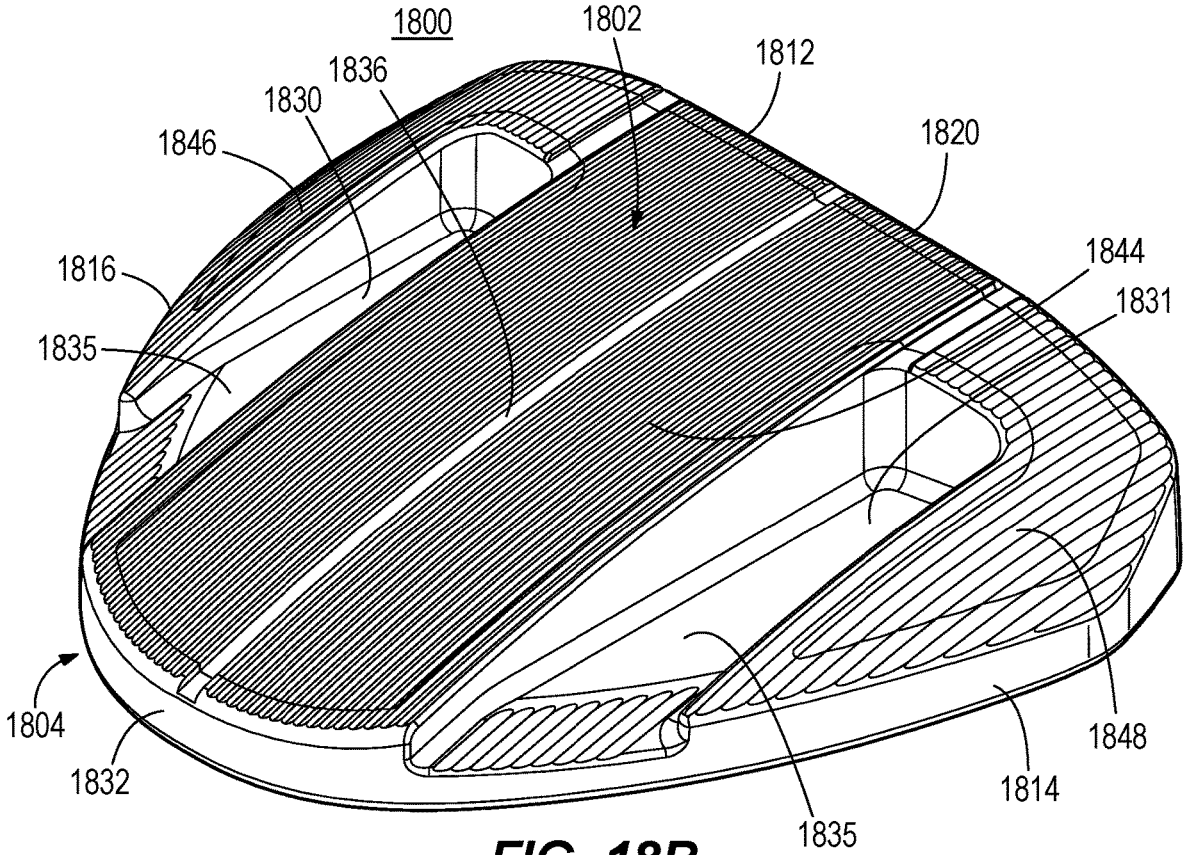
FIG. 18B illustrates a rear perspective view of the three-part putter head of FIG. 18A.
Figure 18C:
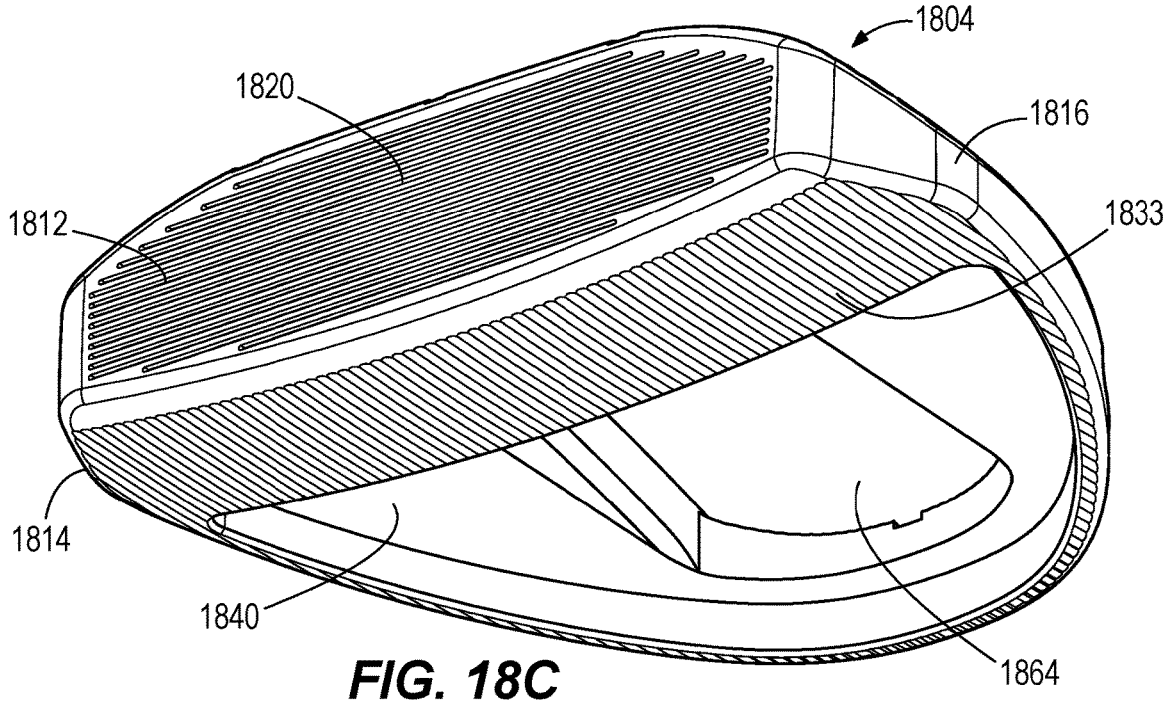
FIG. 18C illustrates a bottom perspective view of the three-part putter head of FIG. 18A with the lower portion removed.

As illustrated by FIGS. 18A and 18B, the crown portion 1802 forms the majority of the top surface of the putter head 1800. The crown portion 1802 can comprise a thin, cover-like structure configured to overlay the upper portion 1804. The plurality of walls can provide surfaces 1834 to which the crown portion 1802 is attached. As illustrated in FIG. 18A, the shape of the crown portion 1802 is complementary to the geometry of the upper portion 1804. In particular, the shape of the crown corresponds to the cavity profile formed by the plurality of upper portion walls. The perimeter edges of the crown portion 1802 can be configured to attach to the top surfaces 1834 of the upper portion perimeter walls and the upper portion internal walls 1838. As illustrated in FIG. 18B, by overlaying the top of the lower portion 1808, the crown portion 1802 entirely encloses the top of the hollow interior cavity 1850.

The crown portion 1802 comprises a front edge 1870 extending along the front wall 1812 in a heel-to-toe direction. The front edge 1870 can extend all the way from the toe wall 1814 to the heel wall 1816. The crown portion 1802 further comprises a central extension 1842, a heel extension 1846, and a toe extension 1848. The central extension 1842 extends rearward from the front edge 1870, near the center of the front wall 1812. The central extension 1842 extends all the way from the front wall 1812 to the rear wall 1832 and covers a central area of the cavity profile. The heel extension 1846 extends rearward from a heel side of the front edge 1870. The heel extension 1846 extends along the heel wall 1816 and extends a portion of the way from the front wall 1812 to the rear wall 1832. The toe extension 1848 extends rearward from a toe side of the front edge 1870. The toe extension 1848 extends along the toe wall 1814 and extends a portion of the way from the front wall 1812 to the rear wall 1832.

Furthermore, the crown portion 1802 of the putter head 1800 can comprise one or more alignment features 1836. The alignment feature 1836 can be any one or combination of the following: a line, a series of lines, milling troughs, a circle, a dashed line, a triangle, a channel, or any other desired alignment feature 1836. In the embodiment of FIGS. 18A-18D, the central extension 1842 is configured to be the width of a golf ball (approximately 4.27 cm). The alignment features 1836, extending along the crown portion 1802, function to provide the viewer a visual alignment field that extends the width of the golf ball, from the strike face 1820 to the rear of the putter head 1800. The goal is to align the entire putter head 1800 with the golf ball using these alignment features 1836 along the crown portion 1802.

Figure 18D:
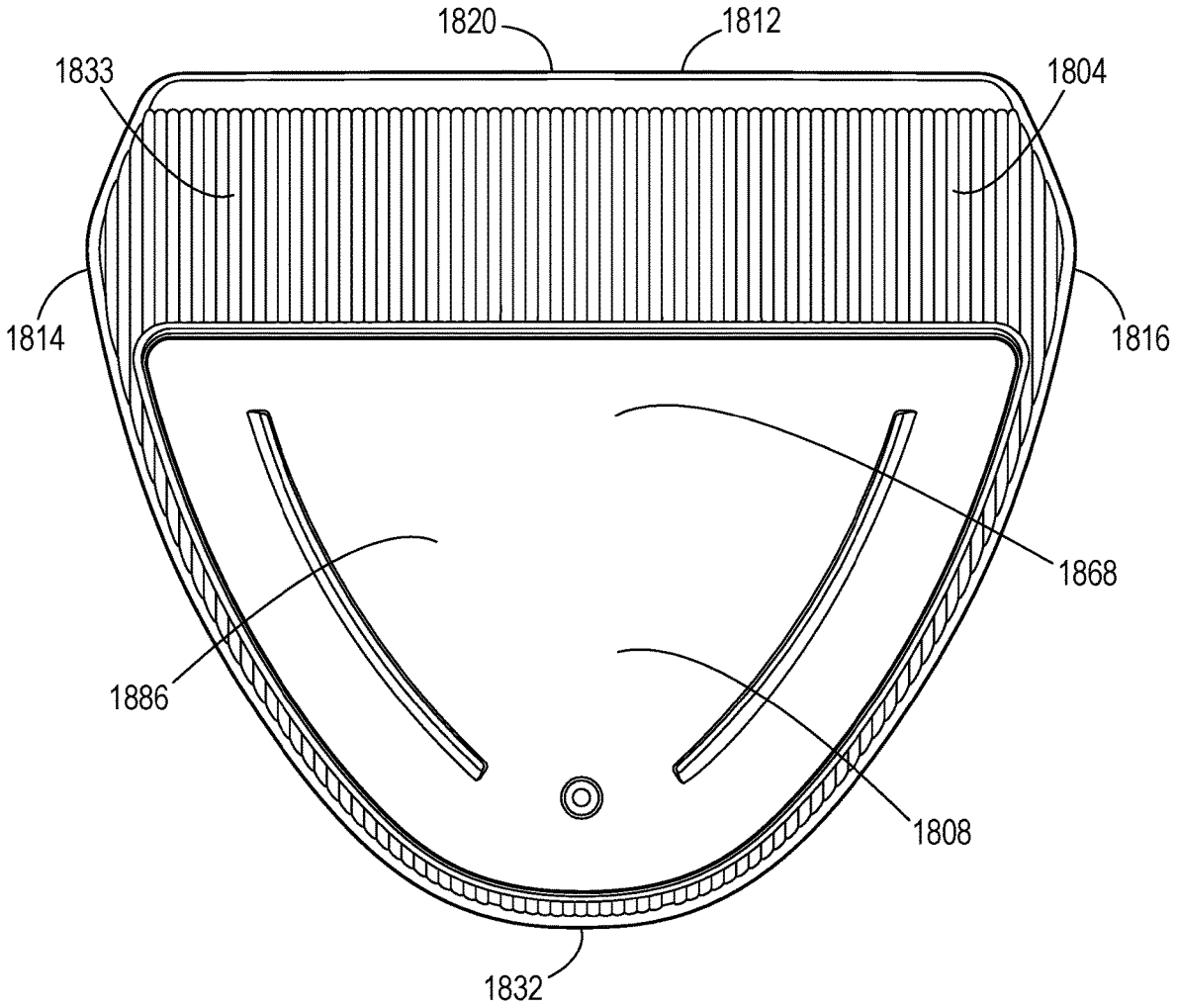
FIG. 18D illustrates a sole view of the three-part putter head of FIG. 18A.

As illustrated by FIG. 18D, the lower portion 1808 can form a majority of the sole 1868. The lower portion 1808 can be formed as a substantially flat, high-density sole plate. In many embodiments, the lower portion 1808 is received within the recessed area 1840 of the upper portion lower surface 1833. The lower portion 1808 can be received within the upper portion 1804 such that a bottom surface 1882 of the lower portion 1808 sits flush with the lower surface 1833 of the upper portion 1804. In this way, the bottom surfaces 1833, 1882 of the upper portion 1804 and lower portion 1808 combine to define a generally continuous sole surface at the bottom of the putter head 1800. In some embodiments, referring to FIG. 18A, the top surface 1880 of the lower portion 1808 can comprise one or more recesses 1886. The one or more recesses 1886 can be located near the center of the lower portion 1808. The one or more recesses 1886 can serve to shift mass toward the perimeter of the lower portion 1808.

Referring to FIG. 18D, the lower portion 1808 is located toward the rear wall 1832 of the putter head 1800 and can extend substantially between the heel wall 1816 and the toe wall 1814. As such, the majority of the sole 1868 proximate the rear wall 1832 is formed by the lower portion bottom surface 1882. In many embodiments, the lower portion 1808 can be spaced rearwardly from the front wall 1812. As such, the majority of the sole 1868 proximate the strike face 1820 can be formed by the lower surface 1833 of the upper portion 1804.

The lower portion 1808 is configured to be received such that it covers the upper portion aperture 1864 from the bottom of the putter head 1800. The lower portion 1808 can seal off the hollow interior cavity 1850 from the sole 1868, enclosing the bottom of the hollow interior cavity 1850.

When joined together, the upper portion 1804, the lower portion 1808, and the crown portion 1802 form a hollow interior cavity 1850 within the putter head 1800. The hollow interior cavity 1850 is bounded between interior surfaces of the perimeter walls and internal walls 1838 of the upper portion 1804, an underneath surface (not shown) of the crown portion 1802, and the top surface 1880 of the lower portion 1808. The hollow interior cavity 1850 removes a large amount of mass from near the center of gravity. The hollow interior cavity 1850 thereby increases the MOI of the putter head 1800 by allowing mass to be shifted toward perimeter of the putter head 1800.

In the embodiment of FIGS. 18A-18D, the hollow interior cavity 1850 is completely enclosed by the upper portion 1804, lower portion 1808, and crown portion 1802 such that there are no openings from the exterior of the putter head 1800 into the hollow interior cavity 1850. Completely enclosing the interior cavity 1850 by the upper portion 1804, lower portion 1808, and crown portion 1802 provides the putter head 1800 with the high MOI of a hollow putter head while retaining the appearance of a solidly constructed putter head.

In some embodiments, the hollow interior cavity 1850 can comprise a filler material (not shown). In some embodiments, the filler material can completely fill the volume of the hollow interior cavity 1850. In other embodiments, the filler material can fill only a portion of the volume of the hollow interior cavity 1850. In some embodiments the filler material can fill greater than 5%, greater than 10%, greater than 20%, greater than 30%, greater than 40%, greater than 50%, greater than 60%, greater than 70%, greater than 80%, or greater than 90% of the volume of the hollow interior cavity 1850. In other embodiments, the filler material can fill less than 90%, less than 80%, less than 70%, less than 60%, less than 50%, less than 40%, less than 30%, less than 20%, less than 10%, or less than 5% of the volume of the hollow interior cavity 1850.

In many embodiments, the filler material can be a polymer. The polymer can comprise a thermoplastic, a thermoplastic elastomer, polyurethane, ethylene, vinyl acetate, ethylene vinyl acetate (EVA), polyolefin copolymer, styrene, styrene-butadiene, a polymer foam material, any other suitable polymer material, or any combination thereof. In other embodiments, the filler material can comprise an elastomer, a polyurethane elastomer, a silicone, a silicone elastomer, a rubber, or a vulcanized natural rubber latex. In other embodiments still, the filler material can be an epoxy, a resin, an adhesive, a polyurethane adhesive, a glue, or any other suitable adhesive. For example, the carrier can be a polyurethane adhesive such as Gorilla Glue (Gorilla Glue Company, Cincinnati Ohio). In another example, the filler material can be a polyurethane elastomer such as Freeman 1040 (Freeman Manufacturing & Supply Company, Avon Ohio), or a polyurethane based thermoplastic elastomer such as Freeman 3040 (Freeman Manufacturing & Supply Company, Avon Ohio). In some embodiments, the filler material can be a lattice material. The lattice filler material can be formed from a metal using processes such as casting, die casting, co die casting, additive manufacturing, or metallic 3D printing.

The combination of the low density first material upper portion 1804 and low density third material crown portion 1802 with the high density second material lower portion 1808, creates a high MOI putter head 1800, without creating an extremely heavy putter head 1800. Providing the hollow interior cavity 1850 allows for the inclusion of a dense, yet low volume lower portion 1808 that increases the MOI of the putter head 1800, in comparison to a putter head milled from a single material. A single material putter head fails to allocate high density material to the perimeter, while maintaining a desirable volume (75 cc-100 cc) and mass (340 grams-385 grams). In one example, the putter head 1800 comprises a high MOI, a desirable volume (91 cc), and a desirable mass (361 grams).

The lower portion 1808, in most embodiments, comprises less than 40% of a total volume of the putter head 1800. In some embodiments, the lower portion 1808 comprises less than 39% of the total volume of the putter head 1800, less than 38% of the total volume of the putter head 1800, less than 37% of the total volume of the putter head 1800, less than 36% of the total volume of the putter head 1800, less than 35% of the total volume of the putter head 1800, less than 34% of the total volume of the putter head 1800, less than 33% of the total volume of the putter head 1800, less than 32% of the total volume of the putter head 1800, less than 31% of the total volume of the putter head 1800, or less than 30% of the total volume of the putter head 1800.

The inclusion of the hollow interior cavity 1850 allows a large proportion of the mass of the putter head 1800 to be concentrated in the lower portion 1808 without creating an extremely heavy putter head 1800. Although the lower portion 1808 comprises less than 40% of the volume of the putter head 1800, the lower portion 1808 comprises at least 60% of an overall mass of the putter head 1800. In some embodiments, the lower portion 1808 comprises at least 61% of the mass of the putter head 1800, at least 62% of the mass of the putter head 1800, at least 63% of the mass of the putter head 1800, at least 64% of the mass of the putter head 1800, at least 65% of the mass of the putter head 1800, at least 66% of the mass of the putter head 1800, at least 67% of the mass of the putter head 1800, at least 68% of the mass of the putter head 1800, at least 69% of the mass of the putter head 1800, or at least 70% of the mass of the putter head 1800.

The beneficial shift of mass to the perimeter of the putter head 1800, through the use of a high density, low volume lower portion 1808 and the inclusion of a hollow interior cavity 1850 increases the MOI of the putter head 1800. The putter head 1800 comprises an increased MOI over a putter head with the same volume, mass, and single material construction (i.e., a putter head milled of a single stainless steel block, or a putter head investment cast of a single material).

VI. Benefits

The putter-type golf club head provides MOI, CG, feel, and weighting benefits, in a putter-type golf club head with an upper and lower portion having different densities and/or without using mechanically fastened weights or weight ports. By creating an upper portion and lower portion of a putter-type golf club head from two different material, the weighting of the club head shifts towards the peripheries of the putter-type golf club head, without any weight ports or attachments to the heel end and toe end of the putter-type golf club head. This shift in weight, towards the peripheries of the putter-type golf club head, raises the MOI of the club head about the y-axis (Iyy), therefore preventing the rotation about the y-axis and assuring the strike face is square to a golf ball during impact. The increase in MOI about the y-axis helps achieve a straighter ball path and improve the outcome of off-centered hits (impact at the heel end or toe end).

By creating the putter-type golf club head from two portions of two different materials, the putter-type golf club head can be optimized to improve the MOI, while keeping the golf club head at a desirable overall weight. In some embodiments, the moment of inertia of the golf club head about the y-axis center of gravity is between 3500 $g \cdot cm^2$-6500 $g \cdot in^2$. In other embodiments the moment of inertia of the golf club head about the y-axis center of gravity can be between 3500 $g \cdot cm^2$-4000 $g \cdot cm^2$, 4000 $g \cdot cm^2$-4500 $g \cdot cm^2$, 4500 $g \cdot cm^2$-5000 $g \cdot cm^2$, 5000 $g \cdot cm^2$-5500 $g \cdot cm^2$, 5500 $g \cdot cm^2$-6000 $g \cdot cm^2$, or 6000 $g \cdot cm^2$-6500 $g \cdot cm^2$. The golf club head comprises a 2%-15% increase in MOI about the y-axis over a club head devoid of a multi-material construction (i.e. a single material). In other embodiments, the golf club head has a 2%-5%, 5%-10%, or 10%-15% increase over a club head with a single material.

The putter-type golf club head with upper and lower portions of two different materials, increases the MOI about the y-axis center of gravity by at least 30% over a putter with the same volume, mass, and single material construction (i.e., a putter milled of a single material such as a steel putter or a putter investment cast of a single material). In some embodiments, the putter-type golf club head with upper and lower portions of two different materials, increases the MOI about the y-axis center of gravity by at least 35%, by at least 40%, by at least 45%, by at least 50%, by at least 55%, by at least 60%, by at least 65%, by at least 70%, by at least 75%, by at least 80%, by at least 85%, by at least 90%, by at least 95%, by at least 95%, by at least 100%, or by at least 105%, over a putter with the same volume, mass, and single material construction.

The putter-type golf club head with the alignment aid 1544 of FIGS. 15A-15D provides visual advantages that are pleasing to the eye and created repeatability in putting. The alignment aid 1544 assists the user in properly aligning the putter head with the golf ball on a consistent basis. The alignment aid 1544 comprises a ball outlining feature 1580 which helps the viewer align the putter head with the outsides of the golf ball and a central line 1576 that aligns the center of the golf ball with the putter head. The proper alignment of the putter head with the golf ball enables the user to start the ball on the intended line. The putter head including the alignment aid 1544 provides increased perimeter weighting, MOI, and forgiveness while being pleasing to the eye to create a consistent putting stroke.

VII. EXAMPLES a. Example 1—Exemplary High MOI Putter Head

An exemplary putter head 1300 comprising a multi-material construction was compared to a similar control putter head, but devoid of a multi-material construction. The exemplary putter head 1300 comprised an upper portion 1304 formed from a low-density material and a lower portion 1308 formed from a high-density material as illustrated in FIGS. 13A-13E. The lower portion 1308 further comprised a sole plate including a toe mass 1345 and a heel mass 1347 to increase perimeter weighting. The upper portion 1300 further comprised a pocket 1372 to allow for mass removal from a center portion of the putter head 1300. The control putter head comprised a similar mass, volume, and weight to the exemplary putter head 1300, but comprised a single material construction.

A test was conducted to compare the moment of inertia about the y-axis (Iyy) between the exemplary putter head 1300 and the control putter head. The moment of inertia about the y-axis is the property that determines the forgiveness of the putter head (i.e., resists twisting motion after a golf ball impact). The test resulted in the exemplary putter 1300 having a total mass of 363.2 grams and a total volume 85.2 cc. The lower portion 1308 comprised a sole plate mass of 207.4 grams and a sole plate volume of 26.55 cc. The lower portion 1308 comprised 57.1% of the total mass of putter 1300 while comprising 31.16% of the total volume of the putter 1300.

The exemplary putter 1300 comprised a MOI of 4368 $g \cdot cm^2$ about the y-axis (Iyy). The control putter head comprised a MOI of 3702 $g \cdot cm^2$ about the y-axis (Iyy). The results show the exemplary putter head 1300 comprised a 10.78% increase in MOI over the control putter head. The exemplary putter head 1300 achieves desirable perimeter weighting to increase MOI and forgiveness while maintaining a desirable mass and volume. The exemplary putter 1300 achieves a high MOI with a multi-material construction over a putter head formed from a single material.

b. Example 2—Exemplary High MOI Putter Head

An exemplary putter head 1400 comprising a multi-material construction was compared to a similar control putter head, but devoid of a multi-material construction. The exemplary putter 1400 comprised an upper portion 1404 formed from a low-density material and a lower portion 1408 formed from a high-density material as illustrated in FIGS. 14A-14D. The lower portion 1408 further comprised a sole plate including a toe mass 1446, a heel mass 1448, and a rear mass 1450 to increase perimeter weighting. The exemplary putter head 1400 further comprised a ball retrieval feature 1422 located on the sole 1442. The ball retrieval feature 1422 further increases perimeter weighting by removing material and mass from a central area of the putter head 1400. The control putter head comprised a similar mass, volume, and weight to the exemplary putter head 1300, but comprised a single material construction.

A test was conducted to compare the moment of inertia about the y-axis (Iyy) between the exemplary putter head 1300 and the control putter head. The moment of inertia about the y-axis is the property that determines the forgiveness of the putter head (i.e., resists twisting motion after a golf ball impact). The test resulted in the exemplary putter 1400 having a total mass of 360 grams and a total volume 80.79 cc. The lower portion 1408 comprised a sole plate mass of 228 grams and a sole plate volume of 29.74 cc. The lower portion 1408 comprised 63% of the total mass of putter 1400 while comprising 37% of the total volume of the putter 1400.

The exemplary putter 1400 comprised an MOI of 4710 $g \cdot cm^2$ about the y-axis (Iyy). The control putter head comprised a MOI of 4474 $g \cdot cm^2$ about the y-axis (Iyy). The test results show the exemplary putter head 1400 comprised a 5.26% increase in MOI over the control putter head. The exemplary putter head 1400 achieves desirable perimeter weighting to increase MOI and forgiveness while maintaining a desirable mass and volume. The exemplary putter 1400 achieves a high MOI with a multi-material construction over a putter head formed from a single material.

c. Example 3—Exemplary High MOI Putter Head

An exemplary putter head 1500 comprising a multi-material construction was compared to a similar control putter head, but devoid of a multi-material construction. The exemplary putter head 1500 comprised an upper portion 1504 formed from a low-density material and a lower portion 1508 formed from a high-density material as illustrated in FIGS. 15A-15D. The lower portion 1508 comprised a sole plate including a toe mass 1545 and a heel mass 1547 to increase perimeter weighting. The upper portion 1504 further defines a central recess 1570 to allow for mass removal from a center portion of the putter-type club head 1500. The control putter head comprised a similar mass, volume, and weight to the exemplary putter head 1500, but comprised a single material construction.

A test was conducted to compare the moment of inertia about the y-axis (Iyy) between the exemplary putter head 1300 and the control putter head. The moment of inertia about the y-axis is the property that determines the forgiveness of the putter head (i.e., resists twisting motion after a golf ball impact). The test resulted in the exemplary putter-type club head 1500 having a total mass of 366.5 grams and a total volume of 87 cc. The lower portion 1508 comprised a sole plate mass of 205.7 grams and a sole plate volume of 26.2 cc. The lower portion 1508 comprised 56.1% of the total mass of putter-type club head 1500 while comprising 30.1% of the total volume of the putter-type club head 1500.

The exemplary putter-type club head 1500 comprised a MOI of 4416 $g \cdot cm^2$ about the y-axis (Iyy). The control putter head comprised a MOI of 4324 $g \cdot cm^2$ about the y-axis (Iyy). The test results show the exemplary putter head comprised a 2.12% increase in MOI over the control putter head. The exemplary putter head 1500 achieves desirable perimeter weighting to increase MOI and forgiveness while maintaining a desirable mass and volume. The exemplary putter head 1500 achieves a high MOI with a multi-material construction over a putter head formed from a single material. The exemplary putter head 1500 further comprised a ball outlining alignment aid to improve putt consistency while being pleasing to the eye during repeated ball impacts.

d. Example 4—Putter Alignment Aid Test

Further described herein is a player test comparing two putter-type club heads having different alignment aids. The club heads were mallet-style club heads having a similar shape but comprised different alignment aid styles. The results compared the effect of the different alignment aid types on player satisfaction and performance.

The first putter-type club head (hereafter referred to as the "control club head") comprised an alignment aid (hereafter referred to as the "control aid"), similar to club head 1200, as shown in FIG. 12A. The control aid was positioned on the crown and included three parallel lines that extended from the strike face to the rear end. The central line was positioned behind the strike face center point, and the remaining lines were positioned on the heel and toe sides of the central line. The three parallel lines were approximately the width of a golf ball (i.e. 1.68 inches). The parallel lines comprised a color different from the color of the control club head. The control aid further comprised a plurality of grooves positioned between the parallel lines.

The second putter-type club head (hereafter referred to as the "exemplary club head") comprised an alignment aid (hereafter referred to as the "exemplary aid"), similar to the alignment aid 1544 associated with club head 1500, as shown in FIG. 15D. The exemplary club head defined a central recess that extended from the strike face to the rear end. The exemplary aid comprised a ball-outlining feature that outlined a perimeter of the central recess. The ball-outlining feature included two arcuate portions, where one arcuate portion arced near the strike face and the other arced near the rear end. The arcuate portions were connected by a set of parallel lines to form a continuous perimeter around the central recess. The ball-outlining feature was approximately the width of a golf ball and resembled an oblong golf ball shape due to the arcuate portions. The ball-outlining feature comprised a color different from the color of the exemplary club head. The exemplary aid further comprised a central line positioned within the central recess and extending along the length of the central recess. The central line was further positioned behind the strike face center point.

A player test was conducted to compare the alignment aid performance between the exemplary aid and the control aid. The player test involved thirty players who participated in a survey that compared their experiences with the exemplary aid having a ball-outlining feature, and the control aid devoid of a ball-outlining feature. The players tested each club head under similar conditions, where the putter club heads included similar shaft lengths and similar loft angles. Further, the player test was conducted on a typical putting surface. The test involved hitting a golf ball across the putting surface with the control putter head and the exemplary putter head.

After testing, the participants rated the club head performance and satisfaction based on five parameters. The parameters included the alignment aid look, the alignment aid performance, the overall club head feel, accuracy, and the comfort at address position. Based on these parameters, the club heads were given a rating of between 1 to 5. A rating of 1 represented the lowest level of satisfaction, where the club head only met 1 of the parameters. A rating of 5 represented the highest level of satisfaction, where the club head met all 5 of the parameters. A rating of 4 represented a high level of satisfaction, where the club head met 3 or more of the parameters.

TABLE 1

| | Control | Exemplary | Increase |
|---|---|---|---|
| Number of Participants who Rated 4 or 5 (out of 30) | 13 | 20 | 53.8% |
| Percentage of Participants who Rated 4 or 5 | 46.4% | 68.9% | 48.5% |

Table 1 above illustrates the number of participants who gave each sample club head a "good" rating, where a "good" rating was a score of 4 or 5. The exemplary club head was rated higher than the control club head. The control club head received a "good" rating from 46.4% of the players while the exemplary club head received a "good" rating from 68.9% of the players.

The test resulted in the exemplary aid meeting more of the parameters than the control aid (e.g., alignment aid look, alignment aid performance, the overall club head feel, accuracy, and comfort at the address position). The participants in the player test felt the exemplary putter head performed better than the control putter head. The exemplary aid provides advantages over the control aid. The exemplary aid included multiple components that each provided a function to the alignment aid. The ball-outlining feature defined an oblong shape that generally resembled a golf ball and helped the viewer outline the sides of the golf ball. The central line helped the viewer find the center of the club head. Further, the exemplary aid utilized the central recess, where the recess walls disappeared when the club head was in alignment. The exemplary putter head comprising the exemplary aid provided improved player performance and satisfaction while comprising a high MOI.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

The above examples may be described in connection with a putter-type golf club, the apparatus, methods, and articles of manufacture described herein. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Clause 1. A putter type golf club head comprising: an upper portion and a lower portion; wherein the upper portion is made from a first material having a first density and the lower portion is made from a second material having a second density; wherein the first density is less than the second density; the lower portion comprises a front periphery, a toe side periphery, a heel side periphery, and a rear periphery; wherein the lower portion further comprises an aperture bounded by the front periphery, toe side periphery, heel side periphery, and rear periphery; the upper portion comprises a heel end, a toe end, a strike face, a rear wall, a back edge, a crown, and an under surface; wherein the toe end is opposite the heel end, the back edge is opposite the strike face; the crown extends away from the strike face, over at least a portion of the rear wall, and to the back edge; the under surface is opposite the crown spanning from the strike face to the back edge; the upper portion is affixed to the lower portion, and is farther from a ground plane than the lower portion, wherein the heel end overlays at least a portion of the heel side periphery, the toe end overlays at least a portion of the toe side periphery, the strike face overlays at least a portion of the front periphery, and the crown spans from the strike face to the rear periphery; the lower portion and upper portion combine to create a sole; wherein the sole is tangent to the ground plane, when the golf club head is at an address position; the strike face is tangent to a loft plane, wherein a loft angle formed between the loft plane and the ground plane; a volume and a mass; wherein the lower portion comprises less than 30% of the volume of the golf club head; and wherein the lower portion comprises greater than 50% of the mass of the golf club head.

Clause 2. The putter type golf club head of clause 1, wherein the lower portion further comprises: a toe mass at the junction of the toe side periphery and the rear periphery; a heel mass at the junction of the heel side periphery and the rear periphery; a rear mass positioned on the rear periphery, equidistance from the toe side periphery and the heel side periphery; and a front mass positioned on the front periphery, equidistance from the toe side periphery and the heel side periphery.

Clause 3. The putter type golf club head of clause 2, wherein the toe mass, heel mass, rear mass, and front mass are integral and extend away from the lower portion, in a direction away from the ground plane and toward the upper portion.

Clause 4. The putter type golf club head of clause 1, wherein the crown, of the upper portion, further comprises a toe end mid-rail, a heel end mid-rail, a toe end cap, and a heel end cap.

Clause 5. The putter type golf club head of clause 4, wherein the toe end cap is configured to mate with the toe mass and the heel end cap is configured to mate with the heel mass.

Clause 6. The putter type golf club head of clause 5, wherein the upper portion further comprises a first cavity, wherein the first cavity is formed in the under surface, between the strike face and the rear wall, and extends in a direction towards the crown; and a second cavity, wherein the rear aperture is formed in the under surface, adjacent the back edge, and equidistant between the toe end cap and the heel end cap.

Clause 7. The putter type golf club head of clause 6, wherein the first cavity is configured to mate with the front mass, and the second cavity is configured to mate with the rear mass.

Clause 8. The putter type golf club head of clause 4, wherein the toe end mid-rail and heel end mid-rail descend from the strike face to the rear periphery.

Clause 9. The putter type golf club head of clause 4, wherein the heel end mid-rail and the toe end mid-rail comprise one or more alignment features on the heel end mid-rail and the toe end mid-rail.

Clause 10. The putter type golf club head of clause 9, wherein the one or more alignment features can be unequally or equally spaced apart from the strike face to the rear periphery.

Clause 11. The putter type golf club head of clause 1, wherein the front periphery, of the lower portion, comprises a front width measured from the junction of the toe side periphery and the front periphery, to the junction of the heel side periphery and the front periphery;

Clause 12. The putter type golf club head of clause 11, wherein the rear periphery, of the lower portion, comprises a rear width measured from the junction of the toe side periphery and the rear periphery, to the junction of the heel side periphery and the rear periphery.

Clause 13. The putter type golf club head of clause 12, wherein the front width is greater than the rear width.

Clause 14. The putter type golf club head of clause 1, wherein one or more alignment feature is positioned on the crown.

Clause 15. The putter type golf club head of clause 1, wherein the first density of the first material is less than 6.0 g/cc.

Clause 16. The putter type golf club head of clause 1, wherein the second density of the second material is greater than 7.0 g/cc.

Clause 17. The putter type golf club head of clause 1, wherein the second density of the second material is at least 2 times greater than the first density of the first material.

Clause 18. The putter type golf club head of clause 1, wherein the first material can comprise any one or combination of the following: 8620 alloy steel, S25C steel, carbon steel, maraging steel, 17-4 stainless steel, 303 stainless steel, 304 stainless steel, stainless steel alloy, tungsten, aluminum, aluminum alloy, ADC-12, or any metal suitable for creating a golf club head.

Clause 19. The putter golf club head of clause 1, wherein the second material can comprise any one or combination of the following: 8620 alloy steel, S25C steel, carbon steel, maraging steel, 17-4 stainless steel, 303 stainless steel, 304 stainless steel, stainless steel alloy, tungsten, aluminum, aluminum alloy, ADC-12, or any metal suitable for creating a golf club head.

Clause 20. The putter golf club head of clause 1, wherein the first material is ADC-12 and the second material is 304 stainless steel.

Clause 21. A putter type golf club head comprising: a strike face, a rear end, a toe end, a heel end, a crown, a sole; an upper portion comprising the strike face, and a lower portion; wherein: the upper portion is formed from a first material having a first density and the lower portion is formed from a second material having a second density; the first density is less than the second density; the lower portion comprises a sole plate having a toe mass and a heel mass; the upper portion comprises a crown bridge including the crown, and extending from the strike face to the rear end; the upper portion comprises a front pocket wall opposite the strike face, a rear pocket wall opposite the rear end, a pocket ceiling opposite the crown, and a pocket floor opposite an under surface of the upper portion; the front pocket wall, the rear pocket wall, the pocket ceiling, and the pocket floor together define a pocket; the upper portion comprises an upright member extending between the crown bridge and the pocket ceiling, dividing the pocket into a toe side pocket and a heel side pocket; the upper portion is affixed to the lower portion via an adhesive; and the upper portion is affixed to the lower portion such that the crown bridge is positioned between the toe mass and the heel mass.

Clause 22. The putter type golf club head of clause 21, wherein the putter type golf club head comprises a loft angle less than 7 degrees.

Clause 23. The putter type golf club head of clause 21, wherein the putter type golf club head further comprises a volume and a mass; wherein the lower portion comprises less than 35% of the volume of the putter type golf club head; and wherein the lower portion comprises greater than 50% of the mass of the putter type golf club head.

Clause 24. The putter type golf club head of clause 21, wherein the heel side pocket is between the heel mass and the upright member.

Clause 25. The putter type golf club head of clause 21, wherein the toe side pocket is between the toe mass and the upright member.

Clause 26. The putter type golf club head of clause 21, wherein the crown comprises one or more alignment aids extending along the crown in a strike face to rear end direction.

Clause 27. The putter type golf club head of clause 21, wherein the first density of the first material is less than 6.0 g/cc.

Clause 28. The putter type golf club head of clause 21, wherein the second density of the second material is greater than 7.0 g/cc.

Clause 29. The putter type golf club head of clause 21, wherein the golf club head comprises a center of gravity defining an origin for a coordinate system including a vertical CG y-axis perpendicular to a ground plane when the putter type golf club head is at an address position, the putter type golf club head comprises a moment of inertia Iyy about the CG y-axis greater than 3000 g-cm$^2$.

Clause 30. The putter type golf club head of clause 21, wherein the first material and the second material comprise a material selected from the group consisting of 8620 alloy steel, S25C steel, carbon steel, maraging steel, 17-4 stainless steel, 303 stainless steel, stainless steel alloy, tungsten, aluminum, aluminum alloy, and ADC-12.

Clause 31. A putter type golf club head comprising: a strike face, a rear end, a toe end, a heel end, a crown, a sole; an upper portion comprising the strike face, and a lower portion; wherein: the upper portion is formed from a first material having a first density and the lower portion is formed from a second material having a second density; the first density is less than the second density; the lower portion comprises a sole plate having a toe mass and a heel mass; the upper portion comprises a crown bridge including the crown and extending from the strike face to the rear end; the upper portion comprises a front pocket wall opposite the strike face, a rear pocket wall opposite the rear end, a pocket ceiling opposite the crown, and a pocket floor opposite an under surface of the upper portion; the front pocket wall, the rear pocket wall, the pocket ceiling, and the pocket floor together define a pocket; the upper portion comprises an upright member extending between the crown bridge and the pocket ceiling, dividing the pocket into a toe side pocket and a heel side pocket; the upper portion is affixed to the lower portion via an adhesive; and the upper portion is affixed to the lower portion such that the crown bridge is positioned between the toe mass and the heel mass; the putter type golf club head further comprises a volume and a mass; the lower portion comprises less than 35% of the volume of the putter type golf club head; and the lower portion comprises greater than 50% of the mass of the putter type golf club head.

Clause 32. The putter type golf club head of clause 31, wherein the putter type golf club head comprises a loft angle less than 7 degrees.

Clause 33. The putter type golf club head of clause 31, wherein the putter type golf club head further comprises a volume and a mass; wherein the lower portion comprises less than 35% of the volume of the putter type golf club head; and wherein the lower portion comprises greater than 50% of the mass of the putter type golf club head.

Clause 34. The putter type golf club head of clause 31, wherein the heel side pocket is between the heel mass and the upright member.

Clause 35. The putter type golf club head of clause 31, wherein the toe side pocket is between the toe mass and the upright member.

Clause 36. The putter type golf club head of clause 31, wherein the crown comprises one or more alignment aids extending along the crown in a strike face to rear end direction.

Clause 37. The putter type golf club head of clause 31, wherein the first density of the first material is less than 6.0 g/cc.

Clause 38. The putter type golf club head of clause 31, wherein the second density of the second material is greater than 7.0 g/cc.

Clause 39. The putter type golf club head of clause 31, wherein the golf club head comprises a center of gravity defining an origin for a coordinate system including a vertical CG y-axis perpendicular to a ground plane when the putter type golf club head is at an address position, the putter type golf club head comprises a moment of inertia Iyy about the CG y-axis greater than 3000 g-cm$^2$.

Clause 40. The putter type golf club head of clause 31, wherein the first material and the second material comprise a material selected from the group consisting of 8620 alloy steel, S25C steel, carbon steel, maraging steel, 17-4 stainless steel, 303 stainless steel, stainless steel alloy, tungsten, aluminum, aluminum alloy, and ADC-12.

Clause 41. The putter type golf club head of clause 31, wherein the golf club head comprises a center of gravity defining an origin for a coordinate system including a vertical CG y-axis perpendicular to a ground plane when the putter type golf club head is at an address position, the putter type golf club head comprises a moment of inertia Iyy about the CG y-axis greater than 3000 g-cm$^2$.

Clause 42. A putter type golf club head comprising: a putter head coupled to the elongated shaft, the putter head defining a heel end, a toe end opposite the heel end, a strike face, a sole, and a crown; the putter head further comprises an upper portion and a lower portion such that the upper portion forms the crown and the lower portion forms the sole; wherein the lower portion further comprises a ball retrieval feature; the ball retrieval feature comprises a ball retention portion and a ball removal portion; the ball retention portion is configured to receive a golf ball and the ball removal portion is configured to receive a user's finger; the ball removal portion and the ball retention portion are connected together; the ball retention portion is defined by a circle with diameter of 1.650 inches.

Clause 43. The putter type golf club head of clause 42, wherein the ball retention portion is defined by a semicircular slot with a width between 0.25 inch and 1 inch.

Clause 44. The putter type golf club head of clause 42, wherein the ball retrieval is defined by a recess in the upper portion and an aperture in the lower portion.

Clause 45. The putter type golf club head of clause 42, wherein the ball retention portion comprises a plurality of prongs.

Clause 46. The putter type golf club head of clause 45, wherein the ball retention portion comprises 2 prongs located on opposite sides of the ball retention portion.

Clause 47. The putter type golf club head of clause 45, wherein the ball retention portion comprises a first set of two prongs and a second set of two prongs wherein the first set of two prongs are located near the strike face and the second set of two prongs are located near the rear.

Clause 48. The putter type golf club head of clause 45, wherein the ball retention portion comprises four prongs that are spaced at 90-degree intervals.

Clause 49. The putter type golf club head of clause 42, wherein the ball retrieval feature is defined by a pear shape.

Clause 50. The putter type golf club head of clause 42, wherein the head body is a mallet type style putter.

Clause 51. The putter type golf club head of clause 42, wherein the upper portion comprises alignment features extending the entire length of the crown.

Clause 52. The putter type golf club head of clause 42, wherein the golf club head comprises a center of gravity defining an origin for a coordinate system including a vertical CG y-axis perpendicular to a ground plane when the putter type golf club head is at an address position, the putter type golf club head comprises a moment of inertia Iyy about the CG y-axis greater than 4000 g-cm$^2$.

Clause 53. A putter-type golf club head comprising: a crown, a sole, a toe end, a heel end, a strike face, and a rear end; a body comprising a forward portion, and a rear portion, wherein: the forward portion comprises the strike face; the rear portion extends rearward from the forward portion towards the rear end; the rear portion comprises a rear extension, a toe wing, and a heel wing, wherein: the toe wing and the heel wing are recessed into the body via a respective wing floor; a toe weight recess and heel weight recess are defined by the respective wing floor and a respective wing wall; the toe wing and the heel wing comprise an attachment point that extends from the respective wing floor into the respective weight recess; the body defines a central recess that is recessed into the body via a recess floor and a circumferential recess wall; the body further comprises an alignment aid, wherein the alignment aid comprises: a ball-outlining feature that circumscribes the central recess, and comprises one or more arcuate portions and a set of parallel lines, wherein the one or more arcuate portions are located near the strike face, or the rear end, the set of parallel lines extend from the strike face to the rear end, and the ball-outlining feature comprises a first color; a central line situated on the recess floor, wherein the central line is located within the ball-outlining feature, and the central line comprises a second color; a plurality of grooves recessed into the recess floor on either side of the central line; one or more weights that are received by the respective attachment points; the body comprises a first low-density material and the weights comprise a second high-density material.

Clause 54. The putter-type golf club head of clause 53, wherein the second color is different from the first color.

Clause 55. The putter-type golf club head of clause 53, wherein the second color is similar to the first color.

Clause 56. The putter-type golf club head of clause 53, wherein the body further comprises a third color, wherein: the third color is different from the first color and the second color, the first color, the second color, and the third color assist the viewer in alignment by improving the viewer's Vernier Acuity.

Clause 57. The putter-type golf club head of clause 53, wherein: the one or more arcuate portions comprise a first arcuate portion near the strike face and a second arcuate portion near the rear end; and the set of parallel lines connect the first arcuate portion and the second arcuate portion to define a continuous perimeter around the central recess; and the ball-outlining feature comprises an oblong shape.

Clause 58. The putter-type golf club head of clause 53, wherein: the one or more arcuate portions comprise a single arcuate portion near the strike face; and the set of parallel lines extend from the single arcuate portion toward the rear end to define a discontinuous perimeter around the central recess; and the ball-outlining feature is U-shaped.

Clause 59. The putter-type golf club head of clause 53, wherein: the ball-outlining feature defines a width similar to the width of a golf ball; and the width is approximately 1.78 inches.

Clause 60. The putter-type golf club head of clause 53, wherein the body further comprises a body upper surface and a body lower surface, and the one or more weights each comprise a weight upper surface and a weight lower surface, wherein: the body upper surface and the weight upper surfaces form the crown; and the body lower surface and the weight lower surfaces form the sole.

Clause 61. The putter-type golf club head of clause 53, wherein the ball-outlining feature is recessed into the body away from the crown to define a channel.

Clause 62. The putter-type golf club head of clause 60, wherein the ball-outlining feature protrudes outwardly from the body upper surface.

Clause 63. The putter-type golf club head of clause 53, wherein the central recess extends from the forward portion to the rear end.

Clause 64. The putter-type golf club head of clause 53, wherein the one or more weights comprise any one or combination of shapes selected from the group consisting of rectangular, triangular, pyramidal, spherical, semi-circular, square, cylindrical, ovular, elliptical, trapezoidal, pentagonal, hexagonal, octagonal, or any other desired geometric or non-geometric shape.

Clause 65. The putter type golf club head of clause 53, wherein the golf club head comprises a center of gravity defining an origin for a coordinate system including a vertical CG y-axis perpendicular to a ground plane when the putter type golf club head is at an address position, the putter type golf club head comprises a moment of inertia Iyy about the CG y-axis greater than 4000 g-cm$^2$.

Clause 66. A putter type golf club head comprising an upper portion and a lower portion; wherein the upper portion is made from a first material having a first density and the lower portion is made from a second material having a second density; wherein the first density is less than the second density; the lower portion comprises a front surface, a rear wall opposite the front surface, a toe end, a heel end, a rear portion, and a sole; an aperture extending through the front surface and the rear wall; the sole comprises a heel portion, a toe portion, and a central portion in between the heel portion and the toe portion, wherein the heel portion and the toe portion comprise a thickness greater than a thickness of the central portion; a first transition region between the heel portion and the central portion; a second transition region between the toe portion and the central portion; the upper portion comprises a main body, a toe extension, and a heel extension; wherein the main body overlays the central portion, the toe extension overlays the toe portion, and the heel extension overlays the heel portion; wherein a portion of the main body extends through and fills the aperture of the lower portion; and wherein the front surface of the lower portion and the main body of the upper portion combine to form a strike face with a continuous surface.

Clause 67. The putter type golf club head of clause 66, wherein the lower portion further comprises a toe mass integrally formed with the toe portion of the sole and a heel mass integrally formed with the heel portion of the sole.

Clause 68. The putter type golf club head of clause 67, wherein the upper portion defines a first cavity recessed from an under surface of the upper portion at the toe extension and a second cavity recessed from the under surface at the heel extension Clause 69. The putter type golf club head of clause 68, wherein the toe extension is configured to receive the toe mass within the first cavity such that the toe extension overlays the toe mass, and wherein the heel extension is configured to receive the heel mass within the second cavity such that the heel extension overlays the heel mass.

Clause 70. The putter type golf club head of clause 66, wherein the lower portion comprises less than 75% of a volume of the putter type golf club head.

Clause 71. The putter type golf club head of clause 66, wherein the lower portion comprises greater than 85% of a mass of the putter type golf club head.

Clause 72. The putter type golf club head of clause 67, wherein the heel mass and the toe mass each comprise a mass between 10 grams to 40 grams.

Clause 73. The putter type golf club head of clause 67, wherein the heel mass and the toe mass are spaced rearwardly from the rear wall.

Clause 74. The putter type golf club head of clause 66, wherein the golf club head comprises a center of gravity defining an origin for a coordinate system including a vertical CG y-axis perpendicular to a ground plane when the putter type golf club head is at an address position, the putter type golf club head comprises a moment of inertia Iyy about the CG y-axis greater than 4000 g-cm$^2$.

The invention claimed is:

1. A putter-type golf club head comprising:

a toe end, a heel end, a strike face, a rear end, a crown, a sole, an upper portion, and a lower portion, wherein:

the upper portion comprises a forward portion and a rearward extension, wherein the forward portion comprises the strike face, and the rearward extension extends rearward from the forward portion towards the rear end;

the upper portion defines a central recess that is recessed into the upper portion via a recess floor and a circumferential recess wall;

the upper portion further comprises an alignment aid, wherein the alignment aid comprises:

a ball-outlining feature that circumscribes the central recess, and comprises one or more arcuate portions and a set of parallel lines, wherein the one or more arcuate portions are located near the strike face, or the rear end, the set of parallel lines extend from the strike face to the rear end, and the ball-outlining feature comprises a first color;

a central line situated on the recess floor, wherein the central line is located within the ball-outlining feature, and the central line comprises a second color;

a plurality of grooves recessed into the recess floor on either side of the central line;

the lower portion comprises a central portion, a toe mass, and a heel mass;

the lower portion is configured to receive the upper portion such that the rearward extension is situated above the central portion and between the toe mass and the heel mass; and the upper portion comprises a first material having a first density and the lower portion comprises a second material having a second density, the first density is less than the second density.

2. The putter-type golf club head of claim 1, wherein the second color is different from the first color.

3. The putter-type golf club head of claim 1, wherein the putter type golf club head comprises a loft angle less than 7 degrees.

4. The putter-type golf club head of claim 1, wherein:

the one or more arcuate portions comprise a first arcuate portion near the strike face and a second arcuate portion near the rear end;

the set of parallel lines connect the first arcuate portion and the second arcuate portion to define a continuous perimeter around the central recess; and the ball-outlining feature comprises an oblong shape.

5. The putter-type golf club head of claim 1, wherein:

the one or more arcuate portions comprise a single arcuate portion near the strike face;

the set of parallel lines extend from the single arcuate portion toward the rear end to define a discontinuous perimeter around the central recess; and the ball-outlining feature comprises a U-shaped.

6. The putter-type golf club head of claim 1, wherein the ball-outlining feature is recessed into the upper portion to define a channel.

7. The putter-type golf club head of claim 1, wherein the ball-outlining feature protrudes outwardly from the upper portion.

8. The putter-type golf club head of claim 1, wherein:

the ball-outlining feature defines a width measured in a heel end to toe end direction; and the width of the ball-outlining feature is approximately 1.78 inches.

9. The putter-type golf club head of claim 1, wherein the upper portion is affixed to the lower portion via an adhesive.

10. The putter-type golf club head of claim 1, wherein the first material and the second material comprise a material selected from the group consisting of 8620 alloy steel, S25C steel, carbon steel, maraging steel, 17-4 stainless steel, 303 stainless steel, stainless steel alloy, tungsten, aluminum, aluminum alloy, and ADC-12.

11. A putter-type golf club head comprising:

a toe end, a heel end, a strike face, a rear end, a crown, a sole, an upper portion, and a lower portion, wherein:

the upper portion comprises a forward portion and a rearward extension, wherein the forward portion comprises the strike face, and the rearward extension extends rearward from the forward portion towards the rear end;

the upper portion defines a central recess that is recessed into the upper portion via a recess floor and a circumferential recess wall;

the upper portion further comprises an alignment aid, wherein the alignment aid comprises:

a ball-outlining feature that circumscribes the central recess, and comprises one or more arcuate portions and a set of parallel lines, wherein the one or more arcuate portions are located near the strike face, or the rear end, the set of parallel lines extend from the strike face to the rear end, and the ball-outlining feature comprises a first color;

a central line situated on the recess floor, wherein the central line is located within the ball-outlining feature, and the central line comprises a second color;

a plurality of grooves recessed into the recess floor on either side of the central line;

the lower portion comprises a central portion, a toe mass, and a heel mass;

the lower portion is configured to receive the upper portion such that the rearward extension is situated above the central portion and between the toe mass and the heel mass;

the upper portion comprises a first material having a first density and the lower portion comprises a second material having a second density, the first density is less than the second density;

the putter type golf club head further comprises a volume and a mass;

the lower portion comprises less than 35% of the volume of the putter type golf club head; and the lower portion comprises greater than 50% of the mass of the putter type golf club head.

12. The putter-type golf club head of claim 11, wherein the second color is different from the first color.

13. The putter-type golf club head of claim 11, wherein the putter type golf club head comprises a loft angle less than 7 degrees.

14. The putter-type golf club head of claim 11, wherein:

the one or more arcuate portions comprise a first arcuate portion near the strike face and a second arcuate portion near the rear end;

the set of parallel lines connect the first arcuate portion and the second arcuate portion to define a continuous perimeter around the central recess; and the ball-outlining feature comprises an oblong shape.

15. The putter-type golf club head of claim 11, wherein:

the one or more arcuate portions comprise a single arcuate portion near the strike face;

the set of parallel lines extend from the single arcuate portion toward the rear end to define a discontinuous perimeter around the central recess; and the ball-outlining feature comprises a U-shaped.

16. The putter-type golf club head of claim 11, wherein the ball-outlining feature is recessed into the upper portion to define a channel.

17. The putter-type golf club head of claim 11, wherein the ball-outlining feature protrudes outwardly from the upper portion.

18. The putter-type golf club head of claim 11, wherein:

the ball-outlining feature defines a width measured in a heel end to toe end direction; and the width of the ball-outlining feature is approximately 1.78 inches.

19. The putter-type golf club head of claim 11, wherein the upper portion is affixed to the lower portion via an adhesive.

20. The putter-type golf club head of claim 11, wherein the first material and the second material comprise a material selected from the group consisting of 8620 alloy steel, S25C steel, carbon steel, maraging steel, 17-4 stainless steel, 303 stainless steel, stainless steel alloy, tungsten, aluminum, aluminum alloy, and ADC-12.

* * * * *